US007358929B2

(12) United States Patent
Mueller et al.

(10) Patent No.: US 7,358,929 B2
(45) Date of Patent: Apr. 15, 2008

(54) TILE LIGHTING METHODS AND SYSTEMS

(75) Inventors: George G. Mueller, Boston, MA (US); Ihor A. Lys, Milton, MA (US); Frederick M. Morgan, Quincy, MA (US); Colin Piepgras, Swampscott, MA (US); Brian Roberge, Franklin, MA (US); Hern Kim, Allston, MA (US); Kevin J. Dowling, Westford, MA (US); Derek Logan, Sanford, ME (US); Charles H. Cella, Pembroke, MA (US)

(73) Assignee: Philips Solid-State Lighting Solutions, Inc., Burlington, MA (US)

( * ) Notice: Subject to any disclaimer, the term of this patent is extended or adjusted under 35 U.S.C. 154(b) by 561 days.

(21) Appl. No.: 10/828,933

(22) Filed: Apr. 21, 2004

(65) Prior Publication Data

US 2005/0116667 A1 Jun. 2, 2005

Related U.S. Application Data

(63) Continuation-in-part of application No. 10/803,540, filed on Mar. 18, 2004, now Pat. No. 7,180,252, and a continuation-in-part of application No. 10/245,786, filed on Sep. 17, 2002, now Pat. No. 6,965,205.

(60) Provisional application No. 60/464,185, filed on Apr. 21, 2003, provisional application No. 60/467,913, filed on May 5, 2003, provisional application No. 60/500,754, filed on Sep. 5, 2003, provisional application No. 60/523,903, filed on Nov. 20, 2003, provisional application No. 60/558,400, filed on Mar. 31, 2004, provisional application No. 60/322,765, filed on Sep. 17, 2001, provisional application No. 60/329,202, filed on Oct. 12, 2001.

(51) Int. Cl.
*G09G 5/00* (2006.01)

(52) U.S. Cl. ..... 345/1.3; 345/1.1; 345/3.3; 345/903

(58) Field of Classification Search ..... 345/1.3, 345/1.1, 3.3, 903
See application file for complete search history.

(56) References Cited

U.S. PATENT DOCUMENTS 3,595,991 A 7/1971 Diller (Continued)

FOREIGN PATENT DOCUMENTS

EP 390479 3/1990

(Continued)

OTHER PUBLICATIONS

Schlig, Eugene S., "Electrothermal Considerations in Display Applications of Light-Emitting Diodes," *IEEE Transactions on Electron Devices*, vol. ED-19, No. 7, Jul. 1982, pp. 847-851.

(Continued)

*Primary Examiner*—Richard Hjerpe
*Assistant Examiner*—Leonid Shapiro
(74) *Attorney, Agent, or Firm*—Wolf, Greenfield & Sacks, P.C.

(57) ABSTRACT

A tile lighting system is provided in which an interior space of a tile is lit by LEDs, such as in a grid or edge-lit formation, and a light diffusing panel is disposed over the interior space. The tile lighting system can be combined with others to tile any surface, such as a floor, ceiling, wall, or building exterior. Lighting control signals can be supplied to generate a wide range of effects on the tile lighting units, including effects coordinated among different tile lighting units. Two- and three-dimensional embodiments are contemplated.

81 Claims, 67 Drawing Sheets

U.S. PATENT DOCUMENTS

| | | | | |
|---|---|---|---|---|
| 3,696,393 | A | 10/1972 | McDonald | |
| 3,740,570 | A | 6/1973 | Kaelin et al. | |
| 3,787,752 | A | 1/1974 | Delay | |
| 3,942,065 | A | 3/1976 | Russ | |
| 4,151,547 | A | 4/1979 | Rhoades et al. | |
| 4,267,559 | A | 5/1981 | Johnson et al. | |
| 4,360,804 | A | 11/1982 | Ohura | |
| 4,394,600 | A | 7/1983 | Flannagan | |
| 4,470,044 | A | 9/1984 | Bell | |
| 4,559,480 | A | 12/1985 | Nobs | |
| 4,581,612 | A | 4/1986 | Jones | |
| 4,581,655 | A | 4/1986 | Ide et al. | |
| 4,612,720 | A | 9/1986 | Manners-Smith et al. | |
| 4,644,342 | A | 2/1987 | Abbas | |
| 4,654,754 | A | 3/1987 | Daszkowski | |
| 4,720,709 | A | 1/1988 | Imamura et al. | |
| 4,729,076 | A | 3/1988 | Masami et al. | |
| 4,782,336 | A | 11/1988 | Bailey | |
| 4,833,542 | A | 5/1989 | Hara et al. | |
| 4,857,801 | A | 8/1989 | Farrell | |
| 4,929,866 | A | 5/1990 | Murata et al. | |
| 4,935,665 | A | 6/1990 | Murata | |
| 4,974,119 | A | 11/1990 | Martin | |
| 5,061,874 | A | 10/1991 | Hecq et al. | |
| 5,136,483 | A | 8/1992 | Schoniger et al. | |
| 5,173,839 | A | 12/1992 | Metz, Jr. | |
| 5,209,560 | A | 5/1993 | Taylor et al. | |
| 5,230,175 | A | 7/1993 | Follis | |
| 5,235,347 | A | 8/1993 | Lee | |
| 5,262,658 | A | 11/1993 | Jankowski | |
| 5,289,351 | A * | 2/1994 | Kashima et al. | 362/627 |
| 5,375,043 | A | 12/1994 | Tokunaga | |
| 5,410,328 | A | 4/1995 | Yoksza et al. | |
| 5,414,328 | A | 5/1995 | Hunt et al. | |
| 5,528,474 | A | 6/1996 | Roney et al. | |
| 5,583,349 | A | 12/1996 | Norman et al. | |
| 5,583,350 | A | 12/1996 | Norman et al. | |
| 5,633,629 | A | 5/1997 | Hochstein | |
| 5,634,711 | A | 6/1997 | Kennedy et al. | |
| 5,684,309 | A | 11/1997 | McIntosh et al. | |
| 5,782,555 | A | 7/1998 | Hochstein | |
| 5,796,376 | A | 8/1998 | Banks | |
| 5,808,592 | A | 9/1998 | Mizutani et al. | |
| 5,857,767 | A | 1/1999 | Hochstein | |
| 5,896,403 | A | 4/1999 | Nagasaki et al. | |
| 5,900,850 | A | 5/1999 | Bailey et al. | |
| 5,949,581 | A | 9/1999 | Kurtenbach et al. | |
| 5,961,201 | A | 10/1999 | Gismondi | |
| 6,023,255 | A | 2/2000 | Bell | |
| 6,028,582 | A | 2/2000 | Drew et al. | |
| 6,069,595 | A | 5/2000 | Tokimoto | |
| 6,069,597 | A | 5/2000 | Hansen | |
| 6,104,414 | A | 8/2000 | Odryna et al. | |
| 6,175,342 | B1 | 1/2001 | Nicholson et al. | |
| 6,208,073 | B1 | 3/2001 | Wang et al. | |
| 6,237,290 | B1 * | 5/2001 | Tokimoto et al. | 52/236.3 |
| 6,314,669 | B1 | 11/2001 | Tucker | |
| 6,329,764 | B1 | 12/2001 | van de Ven | |
| 6,330,111 | B1 | 12/2001 | Myers | |
| 6,331,915 | B1 | 12/2001 | Myers | |
| 6,361,198 | B1 | 3/2002 | Reed | |
| 6,379,209 | B1 | 4/2002 | Tucker | |
| 6,386,720 | B1 | 5/2002 | Mochizuki | |
| 6,476,779 | B1 | 11/2002 | Yano et al. | |
| 6,498,355 | B1 | 12/2002 | Harrah et al. | |
| 6,498,592 | B1 * | 12/2002 | Matthies | 345/1.1 |
| 6,509,906 | B1 | 1/2003 | Awe et al. | |
| 6,540,373 | B2 | 4/2003 | Bailey | |
| 6,543,164 | B1 | 4/2003 | Sperl et al. | |
| 6,558,021 | B2 | 5/2003 | Wu et al. | |
| 6,603,243 | B2 | 8/2003 | Parkyn et al. | |
| 6,618,031 | B1 | 9/2003 | Bohn, Jr. et al. | |
| 6,639,574 | B2 | 10/2003 | Scheibe | |
| 6,642,666 | B1 | 11/2003 | St-Germain | |
| 6,676,284 | B1 | 1/2004 | Wynne Willson | |
| 6,680,579 | B2 | 1/2004 | Allen et al. | |
| 6,690,341 | B2 | 2/2004 | Tokimoto et al. | |
| 6,693,385 | B2 | 2/2004 | Koyama | |
| 6,704,989 | B1 | 3/2004 | Lutz et al. | |
| 6,707,389 | B2 | 3/2004 | Pederson | |
| 6,928,775 | B2 | 8/2005 | Banister | |
| 6,999,045 | B2 * | 2/2006 | Cok | 345/1.3 |
| 7,015,825 | B2 | 3/2006 | Callahan | |
| 2002/0126064 | A1 | 9/2002 | Yen | |
| 2003/0107887 | A1 | 6/2003 | Eberl | |
| 2004/0066652 | A1 | 4/2004 | Hong | |
| 2005/0122064 | A1 | 6/2005 | Chevalier et al. | |
| 2005/0128743 | A1 | 6/2005 | Chuey et al. | |

FOREIGN PATENT DOCUMENTS

| | | |
|---|---|---|
| EP | 507366 | 3/1992 |
| EP | 629508 | 6/1994 |
| EP | 876085 | 4/1998 |
| JP | 04-015685 | 1/1992 |
| JP | 6334223 | 12/1994 |
| JP | 7275200 | 10/1995 |
| JP | 9152840 | 6/1997 |
| JP | 9269746 | 10/1997 |
| JP | 10302514 | 11/1998 |
| JP | 2000-155544 A * | 6/2000 |
| WO | 96/11499 | 4/1996 |
| WO | WO 99/30537 A1 | 6/1999 |
| WO | WO 01/73818 A1 | 10/2001 |

OTHER PUBLICATIONS

Asai, S. et al., "Heat Conductive Wire Matrix Board for Light Emitting Diode (LED) Dot Matrix Display," *Circuit World*, vol. 21, No. 4, 1995, pp. 27-31.

"Cree Research, Inc. Announces Fiscal 1994 Results," *PR Newswire*, Jul. 28, 1994, pp. 1-2.

"Cree Research, Inc. Announces Acquisition of Full-Color LED Display Company," *PR Newswire*, Aug. 9, 1994, pp. 1-2.

Mishiko, Yashuhiro, et al., "Large-Scale Color LED Display System," *National Technical Report*, vol. 33, No. 1, Feb. 1987, pp. 94-101.

Miyoshi, Morimasa et al., "Large-Scale Color LED Stock-Information Display Board," *National Technical Report*, vol. 33, No. 1, Feb. 1987, pp. 102-107.

Motozono, Takefumi et al., "LED Display Devices," *National Technical Report*, vol. 28, No. 1, Feb. 1982, pp. 74-82.

Tsujikado, Kazumi et al., "Large-Scale LED Display System," *National Technical Report*, vol. 42, No. 3, Jun. 1996, pp. 18-25.

Shibata, Kazuhisa, "Improvements in Multicolored LEDs May be Practical Display Alternative," *JEE*, Aug. 1985, pp. 60-62.

Murata, Kazuhisa, "Developers Continue to Refine Blue LED Technologies for Display Use," *Display Devices*, 1992, serial No. 6, pp. 46-50.

Koga, Kazuyuki et al., "RGB Multi-Color LED DOT-Matrix Units and Their Application to Large-Size Flat Displays," *Optoelectronics-Devices and Technologies*, vol. 7, No. 2, pp. 221-229, Dec. 1992.

Murata, Kazuhisa, "SiC Brightens Blues for Full-Color LED Display Units," *JEE*, Nov. 1993, pp. 59-65.

Lerner, Eric, J., "Laser Diodes and LEDs Light Optoelectronic Devices," *Laser Focus World*, Feb. 1997, pp. 109-117.

Martin, David, et al., "Material Advances Light Full-Color LED Displays," *Laser Focus World*, Mar. 1997, pp. 119-124.

* cited by examiner

2600

| 2602 LIGHT SYSTEM | 2604 TIME | 2608 POSITION | 2610 LIT POSITION | 2612 COLOR RANGE | 2614 INTENSITY | 2618 OTHER SYS. | 2620 POSITION |
|---|---|---|---|---|---|---|---|
| LS001 | T1 | (1, 3, 7) | POLY001 | 0–16000 | 0–100 | | |
| LS001 | T2 | (1, 3, 7) | PLOY001 | 0–16000 | | | |
| LS001 | T3 | (1, 3, 7) | POLY002 | 0–16000 | | | |
| LS002 | T1 | (0, 0, 0) | POLY003 | 0–16000 | | | |
| LS002 | T2 | (0, 0, 0) | POLY004 | 0–16000 | | | |
| LS002 | T3 | (0, 0, 0) | POLY005 | 0–16000 | | | |
| | | | | | | | |
| | | | | | | | |
| | | | | | | | |
| | | | | | | | |
| | | | | | | | |
| LS00N | TN | | | | | | |

FIG. 26

TILE LIGHTING METHODS AND SYSTEMS

CROSS-REFERENCES TO RELATED APPLICATIONS

This application claims the benefit, under 35 U.S.C. §119(e), of the following U.S. Provisional Applications:

Ser. No. 60/464,185, filed Apr. 21, 2003, entitled "Tile Lighting Methods and Systems;

Ser. No. 60/467,913, filed May 5, 2003, entitled "Tile Lighting Methods and Systems;

Ser. No. 60/500,754, filed Sep. 5, 2003, entitled "Tile Lighting Methods and Systems;

Ser. No. 60/523,903, filed Nov. 20, 2003, entitled "Light System Manager;" and

Ser. No. 60/558,400, filed Mar. 31, 2004, entitled "Methods and Systems for Providing Lighting Components."

This application also claims the benefit, under 35 U.S.C. §120, as a continuation-in-part (CIP) of U.S. Non-provisional application Ser. No. 10/803,540, filed Mar. 18, 2004, now U.S. Pat. No. 7,180,252 entitled "Geometric Panel Lighting Apparatus and Methods;".

Each of the aforementioned applications is incorporated herein by reference.

This application also claims the benefit, under 35 U.S.C. §120, as a continuation-in-part (CIP) of U.S. Non-provisional application Ser. No. 10/245,786, filed Sep. 17, 2002 now U.S. Pat. No. 6,965,205, entitled "Light Emitting Diode Based Products," which in turn claims the benefit of the following U.S. Provisional applications:

Ser. No. 60/322,765, filed Sep. 17, 2001, entitled "Light Emitting Diode Illumination Systems and Methods:" and Ser. No. 60/329,202, filed Oct. 12, 2001, entitled "Light Emitting Diode Illumination Systems and Methods."

Each of the aforementioned applications is incorporated herein by reference.

BACKGROUND

LED-based lighting methods and systems are known, including those developed and marketed by Color Kinetics Incorporated and those disclosed in the patents, patent applications and other documents incorporated by reference herein. A need exists for improved lighting fixtures that take full advantage of the inventive aspects of LED-based illumination methods and systems, including lighting fixtures with particular forms, including lighting fixtures that take the form of tiles.

SUMMARY

The methods and systems disclosed herein include those for providing a tile lighting system that may comprise a lighting system configured in a two-dimensional shape, such as a square, rectangle, circle, polygon, or other shape. Methods and systems are disclosed herein for controlling light output from such a tile light, for mechanically constructing a tile light to provide optimal light output, for connecting tile lights to each other to facilitate addressing and controlling such tile lights, for authoring effects to be presented with such a tile light, for supplying power and data to such a tile light, and other aspects.

Methods and systems disclosed herein also encompass three-dimensional lights that comprise combinations of flat circuit boards of simple geometries. For example, a substantially spherical lighting unit can be formed from circuit boards of simple polygons, such as triangles, hexagons or pentagons. Similarly, a pyramidal lighting unit can be formed of triangular lighting units. Such three-dimensional lighting units can be addressed, powered, and controlled in the manner described for other lighting units herein, and effects for such lighting units can be authored using methods and systems described herein.

The methods and systems disclosed herein may further comprise control protocols, which may include disposing a plurality of lighting units in a serial configuration and controlling all of them by a stream of data to respective ASICs (Application Specific Integrated Circuits) of each of them, wherein each lighting system responds to the first unmodified bit of data in the stream, modifies that bit of data, and transmits the stream to the next ASIC. This protocol is described herein in some cases as a "string light" protocol or as a Chromasic protocol, such as that offered by Color Kinetics Incorporated and described in the patent applications incorporated herein by reference.

The methods and systems may further include providing a communication facility of the lighting system, wherein the lighting system responds to data from a source exterior to the lighting system. The data may come from a signal source exterior to the lighting system. The signal source may be a wireless signal source. In embodiments the signal source includes a sensor for sensing an environmental condition, and the control of the lighting system is in response to the environmental condition. In embodiments the signal source generates a signal based on a scripted lighting program for the lighting system.

In embodiments the control of the lighting system is based on assignment of lighting system units as objects in an object-oriented computer program. In embodiments the computer program is an authoring system. In embodiments the authoring system relates attributes in a virtual system to real world attributes of lighting systems. In embodiments the real world attributes include positions of lighting units of the lighting system. In embodiments the computer program is a computer game. In other embodiments the computer program is a music program.

In embodiments of the methods and systems provided herein, the lighting system includes a power supply. In embodiments the power supply is a power-factor-controlled power supply. In embodiments the power supply is a two-stage power supply. In embodiments the power factor correction includes an energy storage capacitor and a DC-DC converter. In embodiments the PFC and energy storage capacitor are separated from the DC-DC converter by a bus.

In embodiments of the methods and systems provided herein, the lighting systems further include disposing at least one such lighting unit in or on a building. In embodiments the lighting units are disposed in an array on a building. In embodiments the array is configured to facilitate displaying at least one of a number, a word, a letter, a logo, a brand, and a symbol. In embodiments the array is configured to display a light show with time-based effects.

Methods and systems disclosed herein include methods and systems for providing a tile lighting system. The tile lighting system may include a plurality of addressable lighting units disposed in a grid, a controller for controlling the illumination from the addressable lighting units and a light diffusing cover for covering the grid. In embodiments the light diffusing cover may include a phosphorescent material. In embodiments the light diffusing cover is substantially translucent. In embodiments the light diffusing cover is provided with a geometric shape. In embodiments the light diffusing cover is provided with an irregular pattern.

In embodiments the lighting system is configured to be disposed in proximity to similar lighting systems in a tile arrangement. In embodiments the lighting units are controlled using a string light protocol. In embodiments the light system may further include an authoring system for authoring effects on the tile lighting system. In embodiments lighting system is capable of coordinating effects with another similar lighting system.

In embodiments the lighting system is disposed in an architectural environment. In embodiments the lighting system is disposed on a building exterior.

Methods and systems described herein include providing a tile light that includes a plurality of LED lighting units disposed on a circuit board in an array, wherein the LED lighting units respond to control signals to produce mixed light of varying colors and a diffuser for receiving light from the lighting units. In embodiments the light diffusing cover may include a phosphorescent material. In embodiments the light diffusing cover is substantially translucent. In embodiments the light diffusing cover is provided with a geometric shape. In embodiments the light diffusing cover is provided with an irregular pattern.

In embodiments the methods and systems may include an authoring system for authoring effects for the lighting system. In embodiments the authoring system is an object-oriented authoring facility. In embodiments an effect displayed on the array corresponds to a graphical representation of the authoring facility. In embodiments an effect displayed on the array corresponds to an incoming video signal. In embodiments the array is disposed in an architectural environment. In embodiments the array is disposed on a building exterior.

Methods and systems described herein include providing a tile light that includes a plurality of linear LED lighting units disposed about the perimeter of a substantially rectangular housing and a diffuser for diffusing light from the lighting units. In embodiments the diffuser may include a phosphorescent material, may be substantially translucent, may be provided with a geometric shape or may be provided with an irregular pattern. In embodiments the methods and systems include a reflector in the housing for providing a consistent level of light output to different portions of the diffuser. In embodiments to divided into a plurality of cells. In embodiments the cells are rectangular. In embodiments the cells are triangular. In embodiments the methods and systems include an authoring system for authoring effects for the lighting system. In embodiments the authoring system is an object-oriented authoring facility. In embodiments an effect displayed on the array corresponds to a graphical representation of the authoring facility. In embodiments the array is disposed in an architectural environment. In embodiments the array is disposed on a building exterior.

Methods and systems described herein include lighting systems that include a series of LED-based lighting units, wherein each lighting unit is configured respond to data addressed to it in a serial addressing protocol, wherein the series of lighting units is configured in a flexible string and a fastening facility for holding the flexible string in a predetermined configuration. In embodiments the fastening facility is a substantially linear channel for holding the flexible string. In embodiments the fastening facility holds the flexible string in an array. In embodiments the methods and systems include an authoring system for authoring effects for the lighting system. In embodiments the authoring system is an object-oriented authoring facility. In embodiments an effect displayed on the array corresponds to a graphical representation of the authoring facility. In embodiments an effect displayed on the array corresponds to an incoming video signal. In embodiments the array is disposed in an architectural environment. In embodiments the array is disposed on a building exterior.

Methods and systems disclosed herein include a modular component for a lighting system that includes a series of LED-based lighting units disposed in an array on a circuit board, wherein each lighting unit is configured respond to data addressed to it in a serial addressing protocol. The methods and systems may further include an authoring system for authoring effects for the lighting system. In embodiments the authoring system is an object-oriented authoring facility. In embodiments an effect displayed on the array corresponds to a graphical representation of the authoring facility. In embodiments an effect displayed on the array corresponds to an incoming video signal. In embodiments the circuit board is a flexible circuit board. In embodiments the circuit board is a printed circuit board. In embodiments the array is disposed in an architectural environment. In embodiments the array is disposed on a building exterior.

Methods and systems disclosed herein include methods and systems for providing a lighting system that includes a plurality of modular components, wherein each modular component includes a series of LED-based lighting units disposed in an array on a circuit board, wherein each lighting unit is configured respond to data addressed to it in a serial addressing protocol. In embodiments the modular components are disposed adjacent to each other to form a large array of modular components. The methods and systems may further include an authoring system for authoring effects for the lighting system. In embodiments the authoring system is an object-oriented authoring facility. In embodiments an effect displayed on the large array corresponds to a graphical representation of the authoring facility. In embodiments an effect displayed on the array corresponds to an incoming video signal. In embodiments the array is disposed in an architectural environment. In embodiments the array is disposed on a building exterior.

Method and systems disclosed herein include controlled, networked or non-networked illumination devices. The fundamental building blocks include semiconductor-based illumination devices such as light-emitting diodes (LEDs) that are used to illuminate surfaces. Included are system and methods for creating surfaces that can provide patterns of color and color changing capability at a variety of scales. The devices, in many embodiments, can be incorporated into any 2D or 3D surface. In embodiments, the illuminated surfaces include geometries to maximize light output, homogenize and diffuse light output, and to shape light output. The viewed surfaces incorporate textures and 2D or 3D forms to guide and direct light towards the viewer.

A variety of fastening methods are also described to mount and connect devices onto or into surfaces.

As used herein for purposes of the present disclosure, the term "LED" should be understood to include any light emitting diode or other type of carrier injection/junction-based system that is capable of generating radiation in response to an electric signal. Thus, the term LED includes, but is not limited to, various semiconductor-based structures that emit light in response to current, light emitting polymers, light-emitting strips, electro-luminescent strips, and the like.

In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured to generate radiation having various bandwidths for a given spectrum (e.g., narrow bandwidth, broad bandwidth).

It should be noted that LED(S) in systems according to the present invention might be any color including white, ultraviolet, infrared or other colors within the electromagnetic spectrum. As used herein, the term "LED" should be further understood to include, without limitation, light emitting diodes of all types, light emitting polymers, semiconductor dies that produce light in response to current, organic LEDs, electro-luminescent strips, and other such systems. In an embodiment, an "LED" may refer to a single light emitting diode having multiple semiconductor dies that are individually controlled. It should also be understood that the term "LED" does not restrict the package type of the LED. The term "LED" includes packaged LEDs, non-packaged LEDs, surface mount LEDs, chip on board LEDs and LEDs of all other configurations. The term "LED" also includes LEDs packaged or associated with material (e.g. a phosphor) wherein the material may convert energy from the LED to a different wavelength.

For example, one implementation of an LED configured to generate essentially white light (e.g., a white LED) may include a number of dies which respectively emit different spectrums of luminescence that, in combination, mix to form essentially white light. In another implementation, a white light LED may be associated with a phosphor material that converts luminescence having a first spectrum to a different second spectrum. In one example of this implementation, luminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectrums of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources as defined above, incandescent sources (e.g., filament lamps, halogen lamps), fluorescent sources, phosphorescent sources, high-intensity discharge sources (e.g., sodium vapor, mercury vapor, and metal halide lamps), lasers, other types of luminescent sources, electro-lumiscent sources, pyro-luminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication and/or illumination. An "illumination source" is a light source that is particularly configured to generate radiation having a sufficient intensity to effectively illuminate an interior or exterior space.

An LED system is one type of illumination source. As used herein "illumination source" should be understood to include all illumination sources, including LED systems, as well as incandescent sources, including filament lamps, pyro-luminescent sources, such as flames, candle-luminescent sources, such as gas mantles and carbon arch radiation sources, as well as photo-luminescent sources, including gaseous discharges, fluorescent sources, phosphorescence sources, lasers, electro-luminescent sources, such as electro-luminescent lamps, light emitting diodes, and cathode luminescent sources using electronic satiation, as well as miscellaneous luminescent sources including galvano-luminescent sources, crystallo-luminescent sources, kine-luminescent sources, thermo-luminescent sources, triboluminescent sources, sonoluminescent sources, and radioluminescent sources. Illumination sources may also include luminescent polymers capable of producing primary colors.

The term "illuminate" should be understood to refer to the production of a frequency of radiation by an illumination source. The term "color" should be understood to refer to any frequency of radiation within a spectrum; that is, a "color," as used herein, should be understood to encompass frequencies not only of the visible spectrum, but also frequencies in the infrared and ultraviolet areas of the spectrum, and in other areas of the electromagnetic spectrum.

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (essentially few frequency or wavelength components) or a relatively wide bandwidth (several frequency or wavelength components having various relative strengths). It should also be appreciated that a given spectrum may be the result of a mixing of two or more other spectrums (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to different spectrums having different wavelength components and/or bandwidths. It also should be appreciated that the term "color" may be used in connection with both white and non-white light.

The term "color temperature" generally is used herein in connection with white light, although this usage is not intended to limit the scope of this term. Color temperature essentially refers to a particular color content or shade (e.g., reddish, bluish) of white light. The color temperature of a given radiation sample conventionally is characterized according to the temperature in degrees Kelvin (K) of a black body radiator that radiates essentially the same spectrum as the radiation sample in question. The color temperature of white light generally falls within a range of from approximately 700 degrees K (generally considered the first visible to the human eye) to over 10,000 degrees K.

Lower color temperatures generally indicate white light having a more significant red component or a "warmer feel," while higher color temperatures generally indicate white light having a more significant blue component or a "cooler feel." By way of example, a wood burning fire has a color temperature of approximately 1,800 degrees K, a conventional incandescent bulb has a color temperature of approximately 2848 degrees K, early morning daylight has a color temperature of approximately 3,000 degrees K, and overcast midday skies have a color temperature of approximately 10,000 degrees K. A color image viewed under white light having a color temperature of approximately 3,000 degree K has a relatively reddish tone, whereas the same color image viewed under white light having a color temperature of approximately 10,000 degrees K has a relatively bluish tone.

The terms "lighting unit" and "lighting fixture" are used interchangeably herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources.

The terms "processor" or "controller" are used herein interchangeably to describe various apparatus relating to the operation of one or more light sources. A processor or controller can be implemented in numerous ways, such as with dedicated hardware, using one or more microprocessors that are programmed using software (e.g., microcode or firmware) to perform the various functions discussed herein, or as a combination of dedicated hardware to perform some functions and programmed microprocessors and associated circuitry to perform other functions. Among other things, processor can include an integrated circuit, such as an application specific integrated circuit.

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers, including by retrieval of stored sequences of instructions.

The term "addressable" is used herein to refer to a device (e.g., a light source in general, a lighting unit or fixture, a controller or processor associated with one or more light sources or lighting units, other non-lighting related devices, etc.) that is configured to receive information (e.g., data) intended for multiple devices, including itself, and to selectively respond to particular information intended for it. The term "addressable" often is used in connection with a networked environment (or a "network," discussed further below), in which multiple devices are coupled together via some communications medium or media.

In one implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices coupled to the network each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it. In another implementation, devices may be configured to receive data in a certain order or along a certain path, such as by being placed along a line or string. In such an implementation, data may be addressed to a particular lighting unit according to its ordinal position in the string. Thus, the first unit responds to the first packet of data, the second unit responds to the second packet of data, and so on. This may be accomplished, for example, by having each lighting unit modify the packet of data that is addressed to it (such as by placing a "1" in the first position of a byte of data) and by having each lighting unit respond to the first unmodified packet of data. This and other implementations that rely on the ordinal position of the lighting units along a string of lighting units are referred to herein as "string light" protocols.

The term "network" as used herein refers to any interconnection of two or more devices (including controllers or processors) that facilitates the transport of information (e.g. for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present invention, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

The lighting systems described herein may also include a user interface used to change and or select the lighting effects displayed by the lighting system. The communication between the user interface and the processor may be accomplished through wired or wireless transmission. The term "user interface" as used herein refers to an interface between a human user or operator and one or more devices that enables communication between the user and the device(s). Examples of user interfaces that may be employed in various implementations of the present invention include, but are not limited to, switches, human-machine interfaces, operator interfaces, potentiometers, buttons, dials, sliders, a mouse, keyboard, keypad, various types of game controllers (e.g., joysticks), track balls, display screens, various types of graphical user interfaces (GUIs), touch screens, microphones and other types of sensors that may receive some form of human-generated stimulus and generate a signal in response thereto.

The following patents and patent applications are hereby incorporated herein by reference:

U.S. Pat. No. 6,016,038, issued Jan. 18, 2000, entitled "Multicolored LED Lighting Method and Apparatus;"

U.S. Pat. No. 6,608,453, issued Aug. 19, 2003, entitled "Methods and Apparatus for Controlling Devices in a Networked Lighting System;"

U.S. Pat. No. 6,548,967, issued Apr. 15, 2003, entitled "Universal Lighting Network Methods and Systems;"

U.S. patent application Ser. No. 09/886,958, filed Jun. 21, 2001, entitled Method and Apparatus for Controlling a Lighting System in Response to an Audio Input;"

U.S. patent application Ser. No. 10/078,221, filed Feb. 19, 2002, entitled "Systems and Methods for Programming Illumination Devices;"

U.S. patent application Ser. No. 09/344,699, filed Jun. 25, 1999, entitled "Method for Software Driven Generation of Multiple Simultaneous High Speed Pulse Width Modulated Signals;"

U.S. patent application Ser. No. 09/805,368, filed Mar. 13, 2001, entitled "Light-Emitting Diode Based Products;"

U.S. patent application Ser. No. 09/716,819, filed Nov. 20, 2000, entitled "Systems and Methods for Generating and Modulating Illumination Conditions;"

U.S. patent application Ser. No. 09/675,419, filed Sep. 29, 2000, entitled "Systems and Methods for Calibrating Light Output by Light-Emitting Diodes;"

U.S. patent application Ser. No. 09/870,418, filed May 30, 2001, entitled "A Method and Apparatus for Authoring and Playing Back Lighting Sequences;"

U.S. patent application Ser. No. 09/923,223, filed Aug. 8, 2001, entitled "Ultraviolet Light Emitting Diode Systems and Methods";

U.S. patent application Ser. No. 10/045,604, filed Oct. 23, 2001, entitled "Systems and Methods for Digital Entertainment;"

U.S. patent application Ser. No. 09/989,677, filed Nov. 20, 2001, entitled "Information Systems;

U.S. patent application Ser. No. 10/045,629, filed Oct. 25, 2001, entitled "Methods and Apparatus for Controlling Illumination;"

U.S. patent application Ser. No. 10/158,579, filed May 30, 2002, entitled "Methods and Apparatus for Controlling Devices in a Networked Lighting System;"

U.S. patent application Ser. No. 10/163,085, filed Jun. 5, 2002, entitled "Systems and Methods for Controlling Programmable Lighting Systems;"

U.S. patent application Ser. No. 10/325,635, filed Dec. 19, 2002, entitled "Controlled Lighting Methods and Apparatus;" and U.S. patent application Ser. No. 10/360,594, filed Feb. 6, 2003, entitled "Controlled Lighting Methods and Apparatus."

It should be appreciated that all combinations of the foregoing concepts and additional concepts discussed in greater detail below are contemplated as being part of the inventive subject matter disclosed herein. In particular, all combinations of claimed subject matter appearing at the end of this disclosure are contemplated as being part of the inventive subject matter disclosed herein.

BRIEF DESCRIPTION OF THE DRAWINGS

FIG. 26 illustrates a configuration file for data relating to light systems in an environment.

DETAILED DESCRIPTION

The description below pertains to several illustrative embodiments of the invention. Although many variations of the invention may be envisioned by one skilled in the art, such variations and improvements are intended to fall within the compass of this disclosure. Thus, the scope of the invention is not to be limited in any way by the disclosure below.

Various embodiments of the present invention are described below, including certain embodiments relating particularly to LED-based light sources. It should be appreciated, however, that the present invention is not limited to any particular manner of implementation, and that the various embodiments discussed explicitly herein are primarily for purposes of illustration. For example, the various concepts discussed herein may be suitably implemented in a variety of environments involving LED-based light sources, other types of light sources not including LEDs, environments that involve both LEDs and other types of light sources in combination, and environments that involve non-lighting-related devices alone or in combination with various types of light sources.

Figure 1:
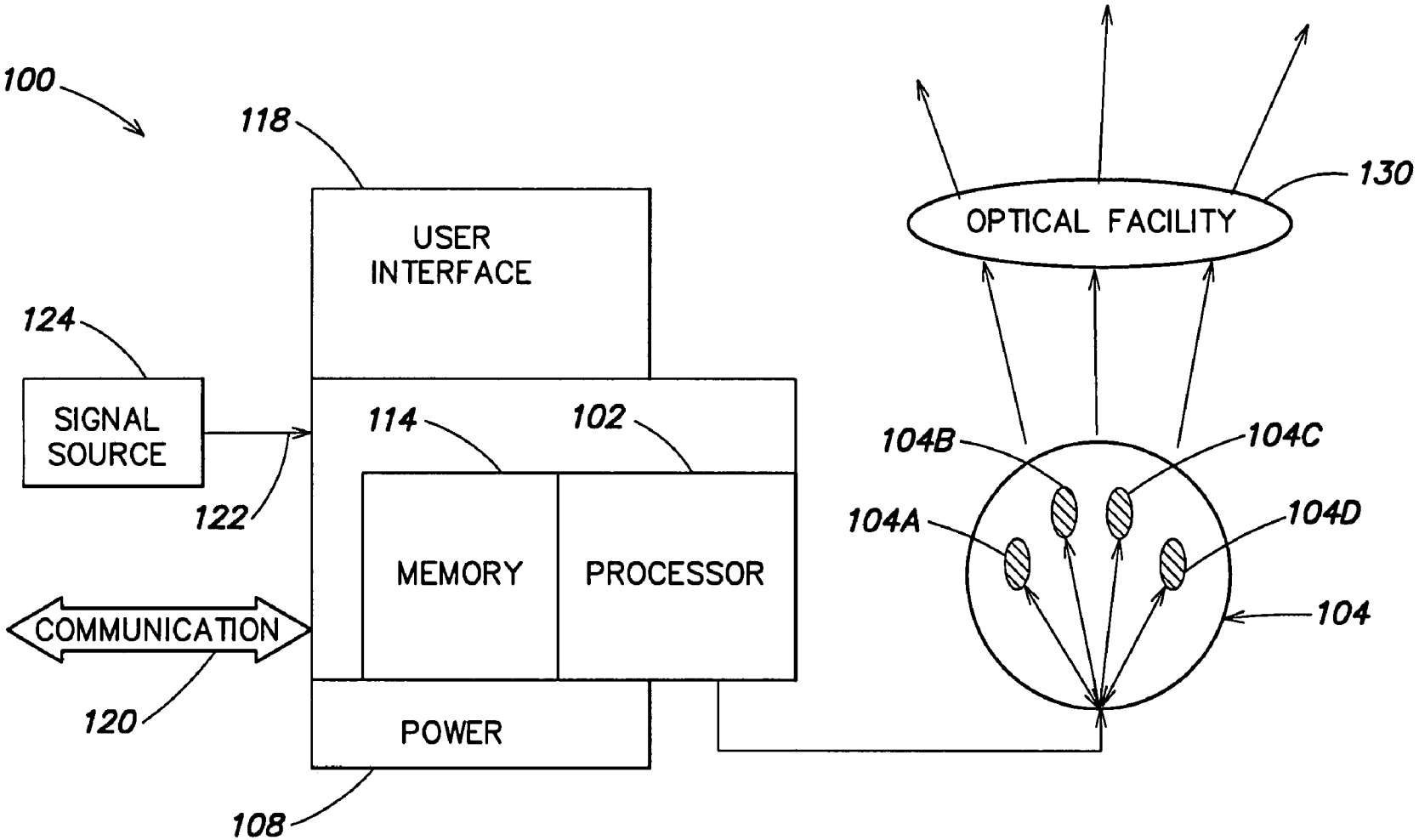
FIG. 1 illustrates one example of a lighting unit that may serve as a device in a lighting environment according to one embodiment of the present invention.

FIG. 1 illustrates one example of a lighting unit 100 that may serve as a device in a lighting environment according to one embodiment of the present invention. Some examples of LED-based lighting units similar to those that are described below in connection with FIG. 1 may be found, for example, in U.S. Pat. No. 6,016,038, issued Jan. 18, 2000 to Mueller et al., entitled "Multicolored LED Lighting Method and Apparatus," and U.S. Pat. No. 6,211,626, issued Apr. 3, 2001 to Lys et al, entitled "Illumination Components," which patents are both hereby incorporated herein by reference.

In various embodiments of the present invention, the lighting unit 100 shown in FIG. 1 may be used alone or together with other similar lighting units in a system of lighting units (e.g., as discussed further below in connection with FIG. 2). Used alone or in combination with other lighting units, the lighting unit 100 may be employed in a variety of applications including, but not limited to, interior or exterior space illumination in general, direct or indirect illumination of objects or spaces, theatrical or other entertainment-based/special effects illumination, decorative illumination, safety-oriented illumination, vehicular illumination, illumination of displays and/or merchandise (e.g. for advertising and/or in retail/consumer environments), combined illumination and communication systems, etc., as well as for various indication and informational purposes.

Additionally, one or more lighting units similar to that described in connection with FIG. 1 may be implemented in a variety of products including, but not limited to, various forms of lighting fixtures, various forms of light modules or bulbs having various shapes and electrical/mechanical coupling arrangements (including replacement or "retrofit" modules or bulbs adapted for use in conventional sockets or fixtures), as well as a variety of consumer and/or household products (e.g., night lights, toys, games or game components, entertainment components or systems, utensils, appliances, kitchen aids, cleaning products, etc.).

In one embodiment, the lighting unit 100 shown in FIG. 1 may include one or more light sources 104, such as the light sources 104A, 104B, 104C, and 104D of FIG. 1, wherein one or more of the light sources may be an LED-based light source that includes one or more light emitting diodes (LEDs). In one aspect of this embodiment, any two or more of the light sources 104A, 104B, 104C and 104D may be adapted to generate radiation of different colors (e.g. red, green, and blue, respectively). Although FIG. 1 shows four light sources 104A, 104B, 104C, and 104D, it should be appreciated that the lighting unit is not limited in this respect, as different numbers and various types of light sources (all LED-based light sources, LED-based and non-LED-based light sources in combination, etc.) adapted to generate radiation of a variety of different colors, including essentially white light, may be employed in the lighting unit 100, as discussed further below.

As shown in FIG. 1, the lighting unit 100 also may include a processor 102 that is configured to output one or more control signals to drive the light sources 104A, 104B, 104C and 104D so as to generate various intensities of light from the light sources. For example, in one implementation, the processor 102 may be configured to output at least one control signal for each light source so as to independently control the intensity of light generated by each light source. Some examples of control signals that may be generated by the processor to control the light sources include, but are not limited to, pulse modulated signals, pulse width modulated signals (PWM), pulse amplitude modulated signals (PAM), pulse displacement modulated signals, analog control signals (e.g., current control signals, voltage control signals), combinations and/or modulations of the foregoing signals, or other control signals. In one aspect, the processor 102 may control other dedicated circuitry (not shown in FIG. 1), which in turn controls the light sources so as to vary their respective intensities.

Lighting systems in accordance with this specification can operate LEDs in an efficient manner. Typical LED performance characteristics depend on the amount of current drawn by the LED. The optimal efficacy may be obtained at a lower current than the level where maximum brightness occurs. LEDs are typically driven well above their most efficient operating current to increase the brightness delivered by the LED while maintaining a reasonable life expectancy. As a result, increased efficacy can be provided when the maximum current value of the PWM signal may be variable. For example, if the desired light output is less than the maximum required output the current maximum and/or the PWM signal width may be reduced. This may result in pulse amplitude modulation (PAM), for example; however, the width and amplitude of the current used to drive the LED may be varied to optimize the LED performance. In an embodiment, a lighting system may also be adapted to provide only amplitude control of the current through the LED. While many of the embodiments provided herein describe the use of PWM and PAM to drive the LEDs, one skilled in the art would appreciate that there are many techniques to accomplish the LED control described herein and, as such, the scope of the present invention is not limited by any one control technique. In embodiments, it is possible to use other techniques, such as pulse frequency modulation (PFM), or pulse displacement modulation (PDM), such as in combination with either or both of PWM and PAM.

Pulse width modulation (PWM) involves supplying a substantially constant current to the LEDs for particular periods of time. The shorter the time, or pulse-width, the less brightness an observer will observe in the resulting light. The human eye integrates the light it receives over a period of time and, even though the current through the LED may generate the same light level regardless of pulse duration, the eye will perceive short pulses as "dimmer" than longer pulses. The PWM technique is considered on of the preferred techniques for driving LEDs, although the present invention is not limited to such control techniques. When two or more colored LEDs are provided in a lighting system, the colors may be mixed and many variations of colors can be generated by changing the intensity, or perceived intensity, of the LEDs. In an embodiment, three colors of LEDs are presented (e.g., red, green and blue) and each of the colors is driven with PWM to vary its apparent intensity. This system allows for the generation of millions of colors (e.g., 16.7 million colors when 8-bit control is used on each of the PWM channels).

In an embodiment the LEDs are modulated with PWM as well as modulating the amplitude of the current driving the LEDs (Pulse Amplitude Modulation, or PAM). LED efficiency increases to a maximum followed by decreasing efficiency as a function of current. Typically, LEDs are driven at a current level beyond its maximum efficiency to attain greater brightness while maintaining acceptable life expectancy. The objective is typically to maximize the light output from the LED while maintaining an acceptable lifetime. In an embodiment, the LEDs may be driven with a lower current maximum when lower intensities are desired. PWM may still be used, but the maximum current intensity may also be varied depending on the desired light output. For example, to decrease the intensity of the light output from a maximum operational point, the amplitude of the current may be decreased until the maximum efficiency is achieved. If further reductions in the LED brightness are desired the PWM activation may be reduced to reduce the apparent brightness.

In one embodiment of the lighting unit 100, one or more of the light sources 104A, 104B, 104C and 104D shown in FIG. 1 may include a group of multiple LEDs or other types of light sources (e.g., various parallel and/or serial connections of LEDs or other types of light sources) that are controlled together by the processor 102. Additionally, it should be appreciated that one or more of the light sources 104A, 104B, 104C and 104D may include one or more LEDs that are adapted to generate radiation having any of a variety of spectra (i.e., wavelengths or wavelength bands), including, but not limited to, various visible colors (including essentially white light), various color temperatures of white light, ultraviolet, or infrared.

In another aspect of the lighting unit 100 shown in FIG. 1, the lighting unit 100 may be constructed and arranged to produce a wide range of variable color radiation. For example, the lighting unit 100 may be particularly arranged such that the processor-controlled variable intensity light generated by two or more of the light sources combines to produce a mixed colored light (including essentially white light having a variety of color temperatures). In particular, the color (or color temperature) of the mixed colored light may be varied by varying one or more of the respective intensities of the light sources (e.g., in response to one or more control signals output by the processor 102). Furthermore, the processor 102 may be particularly configured (e.g., programmed) to provide control signals to one or more of the light sources so as to generate a variety of static or time-varying (dynamic) multi-color (or multi-color temperature) lighting effects.

As shown in FIG. 1, the lighting unit 100 also may include a memory 114 to store various information. For example, the memory 114 may be employed to store one or more lighting programs for execution by the processor 102 (e.g., to generate one or more control signals for the light sources), as well as various types of data useful for generating variable color radiation (e.g., calibration information, discussed further below). The memory 114 also may store one or more particular identifiers (e.g., a serial number, an address, etc.) that may be used either locally or on a system level to identify the lighting unit 100. In various embodiments, such identifiers may be pre-programmed by a manufacturer, for example, and may be either alterable or non-alterable thereafter (e.g., via some type of user interface located on the lighting unit, via one or more data or control signals received by the lighting unit, etc.). Alternatively, such identifiers may be determined at the time of initial use of the lighting unit in the field, and again may be alterable or non-alterable thereafter.

One issue that may arise in connection with controlling multiple light sources in the lighting unit 100 of FIG. 1, and controlling multiple lighting unit 100 in a lighting system (e.g., as discussed below in connection with FIG. 2), relates to potentially perceptible differences in light output between substantially similar light sources. For example, given two virtually identical light sources being driven by respective identical control signals, the actual intensity of light output by each light source may be perceptibly different. Such a difference in light output may be attributed to various factors including, for example, slight manufacturing differences between the light sources, normal wear and tear over time of the light sources that may differently alter the respective spectrums of the generated radiation, etc. For purposes of the present discussion, light sources for which a particular relationship between a control signal and resulting intensity are not known are referred to as "uncalibrated" light sources.

The use of one or more uncalibrated light sources in the lighting unit 100 shown in FIG. 1 may result in generation of light having an unpredictable, or "uncalibrated," color or color temperature. For example, consider a first lighting unit including a first uncalibrated red light source and a first uncalibrated blue light source, each controlled by a corresponding control signal having an adjustable parameter in a range of from zero to 255 (0-255). For purposes of this example, if the red control signal is set to zero, blue light is generated, whereas if the blue control signal is set to zero, red light is generated. However, if both control signals are varied from non-zero values, a variety of perceptibly different colors may be produced (e.g., in this example, at very least, many different shades of purple are possible). In particular, perhaps a particular desired color (e.g., lavender) is given by a red control signal having a value of 125 and a blue control signal having a value of 200.

Now consider a second lighting unit including a second uncalibrated red light source substantially similar to the first uncalibrated red light source of the first lighting unit, and a second uncalibrated blue light source substantially similar to the first uncalibrated blue light source of the first lighting unit. As discussed above, even if both of the uncalibrated red light sources are driven by respective identical control signals, the actual intensity of light output by each red light source may be perceptibly different. Similarly, even if both of the uncalibrated blue light sources are driven by respective identical control signals, the actual intensity of light output by each blue light source may be perceptibly different.

With the foregoing in mind, it should be appreciated that if multiple uncalibrated light sources are used in combination in lighting units to produce a mixed colored light as discussed above, the observed color (or color temperature) of light produced by different lighting units under identical control conditions may be perceivably different. Specifically, consider again the "lavender" example above; the "first lavender" produced by the first lighting unit with a red control signal of 125 and a blue control signal of 200 indeed may be perceptibly different than a "second lavender" produced by the second lighting unit with a red control signal of 125 and a blue control signal of 200. More generally, the first and second lighting units generate uncalibrated colors by virtue of their uncalibrated light sources.

In view of the foregoing, in one embodiment of the present invention, the lighting unit 100 includes calibration means to facilitate the generation of light having a calibrated (e.g., predictable, reproducible) color at any given time. In one aspect, the calibration means is configured to adjust the light output of at least some light sources of the lighting unit so as to compensate for perceptible differences between similar light sources used in different lighting units.

For example, in one embodiment, the processor 102 of the lighting unit 100 is configured to control one or more of the light sources 104A, 104B, 104C and 104D so as to output radiation at a calibrated intensity that substantially corresponds in a predetermined manner to a control signal for the light source(s). As a result of mixing radiation having different spectra and respective calibrated intensities, a calibrated color is produced. In one aspect of this embodiment, at least one calibration value for each light source is stored in the memory 114, and the processor is programmed to apply the respective calibration values to the control signals for the corresponding light sources so as to generate the calibrated intensities.

In one aspect of this embodiment, one or more calibration values may be determined once (e.g., during a lighting unit manufacturing/testing phase) and stored in the memory 114 for use by the processor 102. In another aspect, the processor 102 may be configured to derive one or more calibration values dynamically (e.g. from time to time) with the aid of one or more photosensors, for example. In various embodiments, the photosensor(s) may be one or more external components coupled to the lighting unit, or alternatively may be integrated as part of the lighting unit itself. A photosensor is one example of a signal source that may be integrated or otherwise associated with the lighting unit 100, and monitored by the processor 102 in connection with the operation of the lighting unit. Other examples of such signal sources are discussed further below, in connection with the signal source 124 shown in FIG. 1.

One exemplary method that may be implemented by the processor 102 to derive one or more calibration values includes applying a reference control signal to a light source, and measuring (e.g., via one or more photosensors) an intensity of radiation thus generated by the light source. The processor may be programmed to then make a comparison of the measured intensity and at least one reference value (e.g., representing an intensity that nominally would be expected in response to the reference control signal). Based on such a comparison, the processor may determine one or more calibration values for the light source. In particular, the processor may derive a calibration value such that, when applied to the reference control signal, the light source outputs radiation having an intensity that corresponds to the reference value (i.e., the "expected" intensity).

In various aspects, one calibration value may be derived for an entire range of control signal/output intensities for a given light source. Alternatively, multiple calibration values may be derived for a given light source (i.e., a number of calibration value "samples" may be obtained) that are respectively applied over different control signal/output intensity ranges, to approximate a nonlinear calibration function in a piecewise linear manner.

In another aspect, as also shown in FIG. 1, the lighting unit 100 optionally may include one or more user interfaces 118 that are provided to facilitate any of a number of user-selectable settings or functions (e.g., generally controlling the light output of the lighting unit 100, changing and/or selecting various pre-programmed lighting effects to be generated by the lighting unit, changing and/or selecting various parameters of selected lighting effects, setting particular identifiers such as addresses or serial numbers for the lighting unit, etc.). In various embodiments, the communication between the user interface 118 and the lighting unit may be accomplished through wire or cable, or wireless transmission.

In one implementation, the processor 102 of the lighting unit monitors the user interface 118 and controls one or more of the light sources 104A, 104B, 104C and 104D based at least in part on a user's operation of the interface. For example, the processor 102 may be configured to respond to operation of the user interface by originating one or more control signals for controlling one or more of the light sources. Alternatively, the processor 102 may be configured to respond by selecting one or more pre-programmed control signals stored in memory, modifying control signals generated by executing a lighting program, selecting and executing a new lighting program from memory, or otherwise affecting the radiation generated by one or more of the light sources.

In particular, in one implementation, the user interface 118 may constitute one or more switches (e.g., a standard wall switch) that interrupt power to the processor 102. In one aspect of this implementation, the processor 102 is configured to monitor the power as controlled by the user interface, and in turn control one or more of the light sources 104A, 104B, 104C and 104D based at least in part on a duration of a power interruption caused by operation of the user interface. As discussed above, the processor may be particularly configured to respond to a predetermined duration of a power interruption by, for example, selecting one or more pre-programmed control signals stored in memory, modifying control signals generated by executing a lighting program, selecting and executing a new lighting program from memory, or otherwise affecting the radiation generated by one or more of the light sources.

LED based lighting systems may be preprogrammed with several lighting routines, such as for use in a non-networked mode or to executed stored programs when triggered by a signal in a networked mode. For example, the switches on the lighting device may be set such that the lighting device produces a solid color, a program that slowly changes the color of the illumination throughout the visible spectrum over a few minutes, or a program designed to change the illumination characteristics quickly or even strobe the light. Generally, the switches used to set the address of the lighting system may also be used to set the system into a preprogrammed non-networked lighting control mode. Each lighting control programs may also have adjustable parameters that are adjusted by switch settings. All of these functions can also be set using a programming device according to the principles of the invention. For example, a user interface may be provided in the programming device to allow the selection of a program in the lighting system, adjust a parameter of a program in the lighting system, set a new program in the lighting system, or make another setting in the lighting system. By communicating to the lighting system through a programming device according to the principles of the invention, a program could be selected and an adjustable parameter could be set. The lighting device can then execute the program without the need of setting switches. Another problem with setting switches for such a program selection is that the switches do not provide an intuitive user interface. The user may have to look to a table in a manual to find the particular switch setting for a particular program, whereas a programming device according to the principles of the invention may contain a user interface screen. The user interface may display information relating to a program, a program parameter or other information relating to the illumination device. The programmer may read information from the illumination apparatus and provide this information of the user interface screen. In embodiments, a non-networked device may detect a signal, such as a sync signal, or the presence of power "on" in a circuit, to initiate playing of an effect. Thus, multiple lighting units that are not formally networked can be synchronized by synchronizing lighting program initiation to such external factors.

FIG. 1 also illustrates that the lighting unit 100 may be configured to receive one or more signals 122 from one or more other signal sources 124. In one implementation, the processor 102 of the lighting unit may use the signal(s) 122, either alone or in combination with other control signals (e.g., signals generated by executing a lighting program, one or more outputs from a user interface, etc.), so as to control one or more of the light sources 104A, 104B, 104C and 104D in a manner similar to that discussed above in connection with the user interface.

By way of example, a lighting unit 100 may also include sensors and or transducers and or other signal generators (collectively referred to hereinafter as sensors) that serve as signal sources 124. The sensors may be associated with the processor 102 through wired or wireless transmission systems. Much like the user interface and network control systems, the sensor(s) may provide signals to the processor and the processor may respond by selecting new LED control signals from memory 114, modifying LED control signals, generating control signals, or otherwise change the output of the LED(s).

Examples of the signal(s) 122 that may be received and processed by the processor 102 include, but are not limited to, one or more audio signals, video signals, power signals, various types of data signals, signals from a hand-held remote control, signals representing information obtained from a network (e.g., the Internet), signals representing some detectable/sensed condition, signals from lighting units, signals consisting of modulated light, etc. In various implementations, the signal source(s) 124 may be located remotely from the lighting unit 100, or included as a component of the lighting unit. For example, in one embodiment, a signal from one lighting unit 100 could be sent over a network to another lighting unit 100.

Some examples of a signal source 124 that may be employed in, or used in connection with, the lighting unit 100 of FIG. 1 include any of a variety of sensors or transducers that generate one or more signals 122 in response to some stimulus. Examples of such sensors include, but are not limited to, various types of environmental condition sensors, such as thermally sensitive (e.g., temperature, infrared) sensors, humidity sensors, motion sensors, photosensors/light sensors (e.g., sensors that are sensitive to one or more particular spectra of electromagnetic radiation), sound or vibration sensors or other pressure/force transducers (e.g., microphones, piezoelectric devices), and the like.

Additional examples of a signal source 124 include various metering/detection devices that monitor electrical signals or characteristics (e.g., voltage, current, power, resistance, capacitance, inductance, etc.) or chemical/biological characteristics (e.g., acidity, a presence of one or more particular chemical or biological agents, bacteria, etc.) and provide one or more signals 122 based on measured values of the signals or characteristics. Yet other examples of a signal source 124 include various types of scanners, image recognition systems, voice or other sound recognition systems, artificial intelligence and robotics systems, and the like.

A signal source 124 could also be a lighting unit 100, a processor 102, or any one of many available signal generating devices, such as media players, MP3 players, computers, DVD players, CD players, television signal sources, camera signal sources, microphones, speakers, telephones, cellular phones, instant messenger devices, SMS devices, wireless devices, personal organizer devices, and many others.

In one embodiment, the lighting unit 100 shown in FIG. 1 also may include one or more optical facilities 130 to optically process the radiation generated by the light sources 104A, 104B, 104C and 104D. For example, one or more optical facilities may be configured so as to change one or both of a spatial distribution and a propagation direction of the generated radiation. In particular, one or more optical facilities may be configured to change a diffusion angle of the generated radiation. In one aspect of this embodiment, one or more optical facilities 130 may be particularly configured to variably change one or both of a spatial distribution and a propagation direction of the generated radiation (e.g., in response to some electrical and/or mechanical stimulus). Examples of optical facilities that may be included in the lighting unit 100 include, but are not limited to, reflective materials, refractive materials, translucent materials, filters, lenses, mirrors, and fiber optics. The optical facility 130 also may include a phosphorescent material, luminescent material, or other material capable of responding to or interacting with the generated radiation.

As also shown in FIG. 1, the lighting unit 100 may include one or more communication ports 120 to facilitate coupling of the lighting unit 100 to any of a variety of other devices. For example, one or more communication ports 120 may facilitate coupling multiple lighting units together as a networked lighting system, in which at least some of the lighting units are addressable (e.g., have particular identifiers or addresses) and are responsive to particular data transported across the network. The lighting unit 100 may also include a communication port 120 adapted to communicate with a programming device. The communication port may be adapted to receive data through wired or wireless transmission. In an embodiment of the invention, information received through the communication port 120 may relate to address information and the lighting unit 100 may be adapted to receive and then store the address information in the memory 114. The lighting system 100 may be adapted to use the stored address as its address for use when receiving data from network data. For example, the lighting unit 100 may be connected to a network where network data is communicated. The lighting unit 100 may monitor the data communicated on the network and respond to data it 'hears' that correspond to the address stored in the lighting systems 100 memory 114. The memory 114 may be any type of memory including, but not limited to, non-volatile memory. A person skilled in the art would appreciate that there are many systems and methods for communicating to addressable lighting fixtures through networks (e.g. U.S. Pat. No. 6,016,038) and the present invention is not limited to a particular system or method.

In an embodiment, the lighting system 100 may be adapted to select a given lighting program, modify a parameter of a lighting program, or otherwise make a selection or modification or generate certain lighting control signals based on the data received from a programming device.

In particular, in a networked lighting system environment, as discussed in greater detail further below (e.g., in connection with FIG. 2), as data is communicated via the network, the processor 102 of each lighting unit coupled to the network may be configured to be responsive to particular data (e.g., lighting control commands) that pertain to it (e.g., in some cases, as dictated by the respective identifiers of the networked lighting units). Once a given processor identifies particular data intended for it, it may read the data and, for example, change the lighting conditions produced by its light sources according to the received data (e.g., by generating appropriate control signals to the light sources). In one aspect, the memory 114 of each lighting unit coupled to the network may be loaded, for example, with a table of lighting control signals that correspond with data the processor 102 receives. Once the processor 102 receives data from the network, the processor may consult the table to select the control signals that correspond to the received data, and control the light sources of the lighting unit accordingly.

In one aspect of this embodiment, the processor 102 of a given lighting unit, whether or not coupled to a network, may be configured to interpret lighting instructions/data that are received in a DMX protocol (as discussed, for example, in U.S. Pat. Nos. 6,016,038 and 6,211,626), which is a lighting command protocol conventionally employed in the lighting industry for some programmable lighting applications. However, it should be appreciated that lighting units suitable for purposes of the present invention are not limited in this respect, as lighting units according to various embodiments may be configured to be responsive to other types of communication protocols so as to control their respective light sources.

In one embodiment, the lighting unit 100 of FIG. 1 may include and/or be coupled to one or more power sources 108. In various aspects, examples of power source(s) 108 include, but are not limited to, AC power sources, DC power sources, batteries, solar-based power sources, thermoelectric or mechanical-based power sources and the like. Additionally, in one aspect, the power source(s) 108 may include or be associated with one or more power conversion devices that convert power received by an external power source to a form suitable for operation of the lighting unit 100.

While not shown explicitly in FIG. 1, the lighting unit 100 may be implemented in any one of several different structural configurations according to various embodiments of the present invention. For example, a given lighting unit may have any one of a variety of mounting arrangements for the light source(s), enclosure/housing arrangements and shapes to partially or fully enclose the light sources, and/or electrical and mechanical connection configurations. In particular, a lighting unit may be configured as a replacement or "retrofit" to engage electrically and mechanically in a conventional socket or fixture arrangement (e.g., an Edison-type screw socket, a halogen fixture arrangement, a fluorescent fixture arrangement, etc.).

Additionally, one or more optical elements as discussed above may be partially or fully integrated with an enclosure/housing arrangement for the lighting unit. Furthermore, a given lighting unit optionally may be associated with (e.g., include, be coupled to and/or packaged together with) various other components (e.g., control circuitry such as the processor and/or memory, one or more sensors/transducers/signal sources, user interfaces, displays, power sources, power conversion devices, etc.) relating to the operation of the light source(s).

Figure 2:
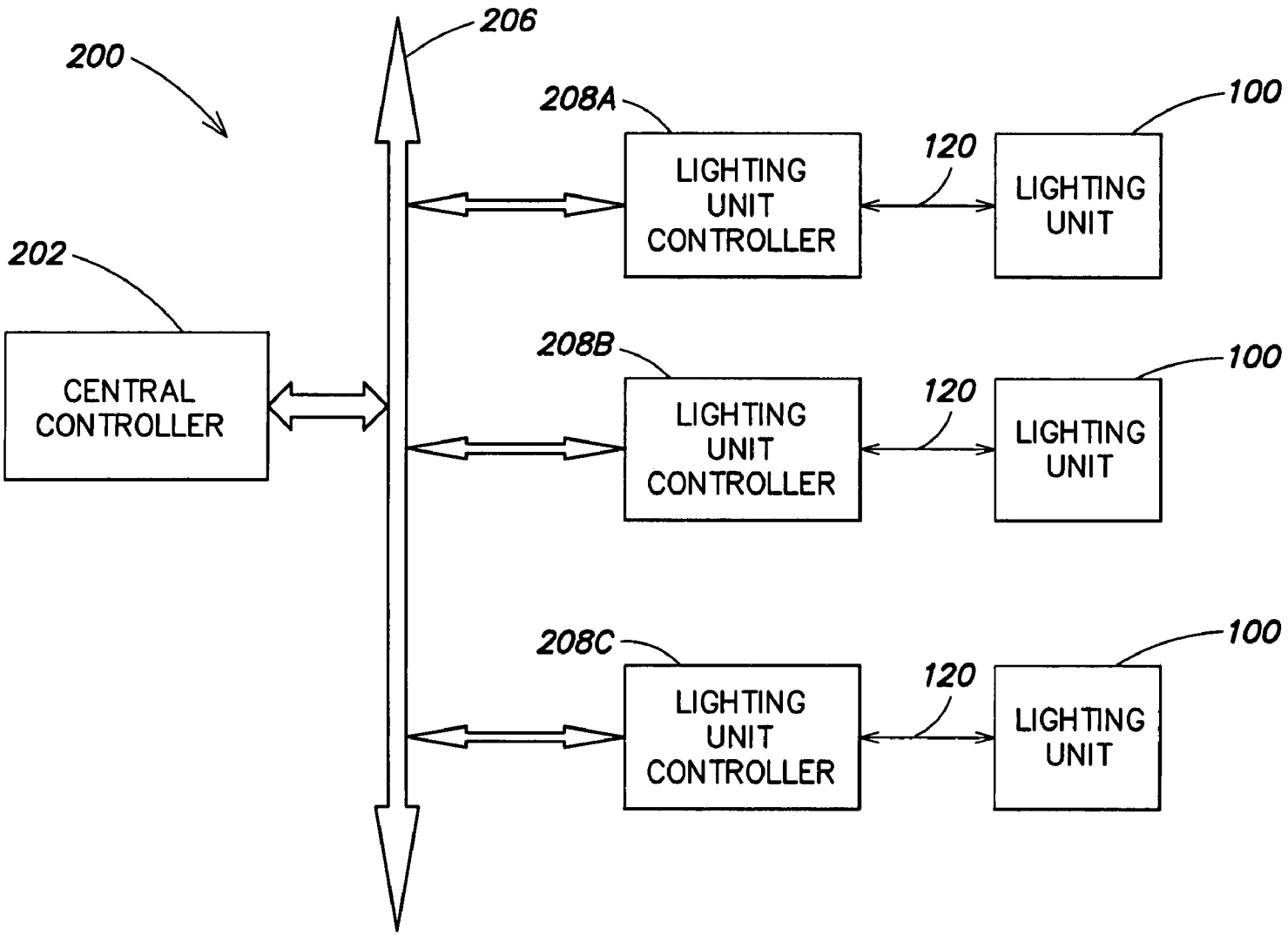
FIG. 2 depicts a lighting system with a plurality of lighting units and a central controller.

FIG. 2 illustrates an example of a networked lighting system 200 according to one embodiment of the present invention. In the embodiment of FIG. 2, a number of lighting units 100, similar to those discussed above in connection with FIG. 1, are coupled together to form the networked lighting system. It should be appreciated, however, that the particular configuration and arrangement of lighting units shown in FIG. 2 is for purposes of illustration only, and that the invention is not limited to the particular system topology shown in FIG. 2.

Thus, lighting units 100 may be associated with a network such that the lighting unit 100 responds to network data. For example, the processor 102 may be an addressable processor that is associated with a network. Network data may be communicated through a wired or wireless network and the addressable processor may be 'listening' to the data stream for commands that pertain to it. Once the processor 'hears' data addressed to it, it may read the data and change the lighting conditions according to the received data. For example, the memory 114 in the lighting unit 100 may be loaded with a table of lighting control signals that correspond with data the processor 102 receives. Once the processor 102 receives data from a network, user interface, or other source, the processor may select the control signals that correspond to the data and control the LED(s) accordingly. The received data may also initiate a lighting program to be executed by the processor 102 or modify a lighting program or control data or otherwise control the light output of the lighting unit 100.

Additionally, while not shown explicitly in FIG. 2, it should be appreciated that the networked lighting system 200 may be configured flexibly to include one or more user interfaces, as well as one or more signal sources such as sensors/transducers. For example, one or more user interfaces and/or one or more signal sources such as sensors/transducers (as discussed above in connection with FIG. 1) may be associated with any one or more of the lighting units of the networked lighting system 200. Alternatively (or in addition to the foregoing), one or more user interfaces and/or one or more signal sources may be implemented as "stand alone" components in the networked lighting system 200. Whether stand alone components or particularly associated with one or more lighting unit 100, these devices may be "shared" by the lighting units of the networked lighting system. Stated differently, one or more user interfaces and/or one or more signal sources such as sensors/transducers may constitute "shared resources" in the networked lighting system that may be used in connection with controlling any one or more of the lighting units of the system.

As shown in the embodiment of FIG. 2, the lighting system 200 may include one or more lighting unit controllers 208 (hereinafter "LUCs"), such as LUCs 208A, 208B, 208C and 208D, wherein each LUC is responsible for communicating with and generally controlling one or more lighting units 100 coupled to it. Although FIG. 2 illustrates three lighting units 100 coupled in a serial fashion to a given LUC, it should be appreciated that the invention is not limited in this respect, as different numbers of lighting units 100 may be coupled to a given LUC in a variety of different configurations using a variety of different communication media and protocols.

In the system of FIG. 2, each LUC in turn may be coupled to a central controller 202 that is configured to communicate with one or more LUCs. Although FIG. 2 shows three LUCs coupled to the central controller 202 via a switching or coupling device 206, it should be appreciated that according to various embodiments, different numbers of LUCs may be coupled to the central controller 202. Additionally, according to various embodiments of the present invention, the LUCs and the central controller may be coupled together in a variety of configurations using a variety of different communication media and protocols to form the networked lighting system 200. Moreover, it should be appreciated that the interconnection of LUCs and the central controller, and the interconnection of lighting units to respective LUCs, may be accomplished in different manners (e.g., using different configurations, communication media, and protocols).

For example, according to one embodiment of the present invention, the central controller 202 shown in FIG. 2 may by configured to implement Ethernet-based communications with the LUCs, and in turn the LUCs may be configured to implement DMX-based communications with the lighting unit 100. In particular, in one aspect of this embodiment, each LUC may be configured as an addressable Ethernet-based controller and accordingly may be identifiable to the central controller 202 via a particular unique address (or a unique group of addresses) using an Ethernet-based protocol. In this manner, the central controller 202 may be configured to support Ethernet communications throughout the network of coupled LUCs, and each LUC may respond to those communications intended for it. In turn, each LUC may communicate lighting control information to one or more lighting units coupled to it, for example, via a DMX protocol, based on the Ethernet communications with the central controller 202.

More specifically, according to one embodiment, the LUCs 208A, 208B, 208C and 208D shown in FIG. 2 may be configured to be "intelligent" in that the central controller 202 may be configured to communicate higher level commands to the LUCs that need to be interpreted by the LUCs before lighting control information can be forwarded to the lighting unit 100. For example, a lighting system operator may want to generate a color changing effect that varies colors from lighting unit to lighting unit in such a way as to generate the appearance of a propagating rainbow of colors ("rainbow chase"), given a particular placement of lighting units with respect to one another. In this example, the operator may provide a simple instruction to the central controller 202 to accomplish this, and in turn the central controller may communicate to one or more LUCs using an Ethernet-based protocol high-level command to generate a "rainbow chase." The command may contain timing, intensity, hue, saturation or other relevant information, for example. When a given LUC receives such a command, it may then interpret the command so as to generate the appropriate lighting control signals which it then communicates using a DMX protocol via any of a variety of signaling techniques (e.g., PWM) to one or more lighting units that it controls.

It should again be appreciated that the foregoing example of using multiple different communication implementations (e.g., Ethernet/DMX) in a lighting system according to one embodiment of the present invention is for purposes of illustration only, and that the invention is not limited to this particular example.

One aspect of the methods and systems described herein is how the colored LEDs (such as red, green, blue LEDs, or in the case of white light products, the different color temperatures of white or amber LEDs) are turned on and off to achieve color changing or color-temperature-changing effects. The balance of this section discusses controlling the red, green and blue LEDs, but the same approach is used to control different LEDs, such as white and amber LEDs, white light embodiments. In embodiments a processor 102 may have, for example, three output pins, such as one for a red LED, one for a green LED and one for a blue LED (of course other numbers of output pins and other types of LEDs are encompassed herein). In embodiments multiple LEDs of the same color are connected to an output channel, so that the output channel or pin controls a group of, for example, red, green or blue LEDs at the same time.

In embodiments, an interrupt service routine (ISR) can run on the processor 102 at a specific frequency. The ISR can convert a set of desired intensity values for each LED channel into a stream of digital "on" and "off" pulses on each channel's corresponding output pin. In embodiments the ISR processes the output channels sequentially. That is, the ISR can be implemented as a software or firmware routine running on a processor 102 that updates the "on" or "off" state of each output pin. In embodiments the first color is updated first, and the routine continues through to the point where the second color is updated. The routine progresses through the third color and begins again to update the first color, and so on. In embodiments the interrupt service routine converts a desired set of LED intensity values into a stream of on and off commands for each LED channel.

In embodiments networked lighting units 100 systems receive control instructions through the DMX protocol, a protocol widely used for many years in theatrical lighting systems. Lighting control signals in the DMX protocol format can be sent from a central controller over a network to individual lighting units 100, each of which has a processor 102 that controls groups of red, green and blue LEDs. In some cases an intermediate power/data supply (PDS) converts instructions that are initially sent in another protocol, such as Ethernet, into the DMX protocol format for delivery to individual lightings units 100. The DMX protocol instructions include a channel for red, a channel for blue and a channel for green. In embodiments each channel value has 8-bit resolution, producing 256 possible values for each channel. For networked lighting units 100, a DMX collection routine runs on the processor of the individual lighting unit. The collection routine cycles through incoming DMX-protocol instructions until it receives an instruction for red, an instruction for blue and an instruction for green. Next, the collection routine converts each 8-bit DMX channel value into a higher-resolution 14- (or 16-) bit desired intensity value by looking up the 8-bit DMX channel value in an internally stored table of 14-bit intensity values. The 14- (or 16-) bit intensity values allow these networked lighting units 100 to have 64 (or 128) times the dynamic resolution of 8-bit products, allowing for much finer-grained control over the generated color values.

For non-networked lighting units 100, pre-programmed instructions for lighting shows can be stored in memory of the individual lighting unit 100. A user interface, such as a button or power-interrupt device, allows the user to select among different shows or software/firmware programs that generate data to be used by an ISR similar to that described above. Values for the individual channels of red, green and blue for each pre-programmed show are stored in the table for access by the interrupt service routine.

In certain other embodiments that use a serial data protocol, control instructions for lighting units 100 are placed in a data stream that consists of a series of bytes, with each byte representing a control instruction for a channel of LEDs. In embodiments, the incoming stream of data for the first unmodified byte (as described further below) is clocked into three different 12-bit shift registers, one for the red channel, one for the green channel and one for the blue channel. In embodiments an oscillator clocks out the first shift register, then the second shift register, then the third shift register and delivers the signal 120 degrees out-of-phase to each of three transistor drivers that drive the red, green and blue LEDs respectively. Optionally driving the LEDs out of phase evens out the load on the system.

For networked products that use a serial addressing protocol, control instructions are sent in a series of bytes to a series of individual lighting units, each of which can be equipped with a custom application specific integrated circuit (ASIC) 3600 that is programmed to respond to the incoming stream of instructions. The stream of control data from the central controller includes control instructions for individual lighting units 100 in a series, where positions of the control instructions in the series correspond to positions of individual lighting units along a string of such lighting units. Each individual lighting unit 100 receives the stream of data and responds to the byte of data that is intended for it, as follows. Each lighting unit 100 receives the entire stream of bytes of data in order and begins to check bytes of data for a bit that indicates whether the byte has been modified, such as by determining whether a "1" is present in a predetermined position of that byte of data. If the byte of data has been modified, then the ASIC 3600 proceeds to check the next byte, and so on, until an unmodified byte is found. The lighting unit 100 then stores values corresponding to the control instructions indicated by that unmodified byte of data in the table that holds the input values for the interrupt service routine. Once the lighting unit 100 has found and used the first three unmodified bytes of data in the data stream, the lighting unit 100 modifies those bytes, such as by changing a zero in the predetermined position to a "1" or vice versa, or by stripping the byte of data from the stream entirely. The entire modified data stream is then sent to the next lighting unit 100 in the string, which will as a result respond to the next byte of data in the stream, which is now the first unmodified byte. The result is that the string of lighting units 100 responds to control instructions in series according to the order of the series of bytes in the data stream.

Figure 3:
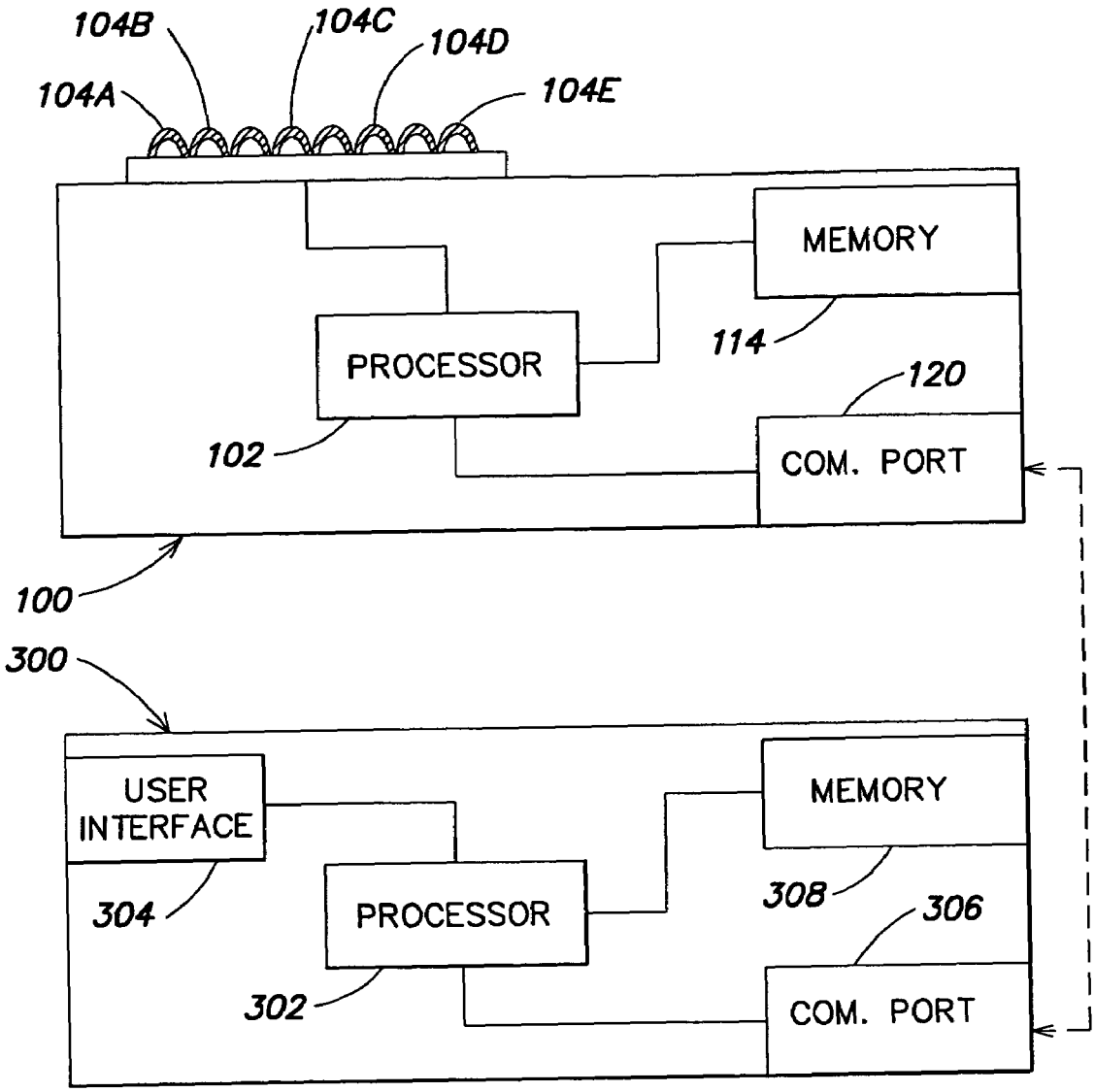
FIG. 3 is a schematic diagram for a programming device for programming a lighting unit in accordance with the principles of the invention.

FIG. 3 illustrates a programming device 300 in communicative association with a lighting system 100. The programming device 300 may include a processor 302, a user interface 304 associated with the processor 302, a communication port 306 in association with the processor 302, and memory 308 associated with the processor 302. The communication port 306 may be arranged to communicate a data signal to the lighting system 100 and the lighting system 100 may be adapted to receive the data signal. For example, the communication port 306 may be arranged to communicate data via wired transmission and the communication port 120 of the lighting system 100 may be arranged to receive the wired transmission. Likewise, the communication ports may be arranged to communicate through wireless transmission.

The programming device processor 302 may be associated with a user interface 304 such that the user interface 304 can be used to generate an address in the processor 302. The user interface 304 may be used to communicate a signal to the processor and the processor may, in turn, generate an address and or select an address from the memory 308. In an embodiment, the user interface may be used to generate or select a starting address and the programming device may then be arranged to automatically generate the next address. For example, a user may select a new address by making a selection on the user interface and then the address may be communicated to a lighting system 100. Following the transmission of the address a new address may be selected or generated so that it is transmitted to the next lighting system 100. Of course the actual timing of the selection and or generation of the new address is not critical and may actually be generated prior to the transmission of the previous address or at any other appropriate time. This method of generating addresses may be useful in situations where the user wants to address more than one lighting systems 100. For example, the user may have a row of one hundred lighting systems 100 and may desire the first such lighting system include the address number one thousand. The user may select the address one thousand on the programming device and cause the programming device to communicate the address to the lighting system. Then the programming device may automatically generate the next address in the desired progression (e.g. one thousand one). This newly generated address (e.g. one thousand one) may then be communicated to the next lighting system in the row. This eliminates the repeated selection of the new addresses and automates one more step for the user. The addresses may be selected/generated in any desired pattern (e.g. incrementing by two, three, etc.).

The programming device may be arranged to store a selected/generated address in its memory to be recalled later for transmission to a lighting system. For example, a user may have a number of lighting systems to program and he may want to preprogram the memory of the programming device with a set of addresses because he knows in advance the lighting systems he is going to program. He may have a layout planned and it may be desirable to select an address, store it in memory, and then select a new address to be place in memory. This system of selecting and storing addresses could place a long string of addresses in memory. Then he could begin to transmit the address information to the lighting systems in the order in which he loaded the addresses.

The programming device 300 may include a user interface 304 and the user interface may be associated with the processor 302. The user interface 304 may be an interface, button, switch, dial, slider, encoder, analog-to-digital converter, digital to analog converter, digital signal generator, or other user interface. The user interface 304 may be capable of accepting address information, program information, lighting show information, or other information or signals used to control an illumination device. The device may communicate with a lighting device upon receipt of user interface information. The user interface information may also be stored in memory and be communicated from the memory to an illumination device. The user interface 304 may also contain a screen for the displaying of information. The screen may be a screen, LCD, plasma screen, backlit display, edge-lit display, monochrome screen, color screen, screen, or any other type of display.

Many of the embodiments illustrated herein involve setting an address in a lighting system 100. However, a method or system according to the principles of the present invention may involve selecting a mode, setting, program or other setting in the lighting system 100. An embodiment may also involve the modification of a mode, setting, program or other setting in the lighting system 100. In an embodiment, a programming device may be used to select a preprogrammed mode in the lighting system 100. For example, a user may select a mode using a programming device and then communicate the selection to the lighting system 100 wherein the lighting system 100 would then select the corresponding mode. The programming device 300 may be preset with modes corresponding to the modes in the lighting system 100. For example, the lighting system 100 may have four preprogrammed modes: color wash, static red, static green, static blue, and random color generation. The programming device 300 may have the same four mode selections available such that the user can make the selection on the programming device 300 and then communicate the selection to the lighting system 100. Upon receipt of the selection, the lighting system 100 may select the corresponding mode from memory for execution by the processor 102. In an embodiment, the programming device may have a mode indicator stored in its memory such that the mode indicator indicates a particular mode or lighting program or the like. For example, the programming device may have a mode indicator stored in memory indicating the selection and communication of such a mode indicator would initiate or set a mode in the lighting system corresponding to the indicator. An embodiment of the present invention may involve using the programming device 300 to read the available selections from the lighting systems memory 114 and then present the available selections to the user. The user can then select the desired mode and communicate the selection back to the lighting system 100. In an embodiment, the lighting system may receive the selection and initiate execution of the corresponding mode.

In an embodiment, the programming device 300 may be used to download a lighting mode, program, setting or the like to a lighting system 100. The lighting system 100 may store the lighting mode in its memory 114. The lighting system 100 may be arranged to execute the mode upon download and or the mode may be available for selection at a later time. For example, the programming device 300 may have one or more lighting programs stored in its memory 308. A user may select one or more of the lighting programs on the programming device 300 and then cause the programming device 300 to download the selected program(s) to a lighting system 100. The lighting system 100 may then store the lighting program(s) in its memory 114. The lighting system 100 and or downloaded program(s) may be arranged such that the lighting system's processor 102 executes one of the downloaded programs automatically.

As used herein, the terms "wired" transmission and or communication should be understood to encompass wire, cable, optical, or any other type of communication where the devices are physically connected. As used herein, the terms "wireless" transmission and or communication should be understood to encompass acoustical, RF, microwave, IR, and all other communication and or transmission systems were the devices are not physically connected.

Having identified a variety of geometric configurations for a lighting unit 100 and certain optional methods for identifying lighting units 100, it can be recognized that providing illumination control signals to the configurations requires the operators to be able to relate the appropriate control signal to the appropriate lighting unit 100. A configuration of networked lighting unit 100 might be arranged arbitrarily, requiring the operator to develop a table or similar facility that relates a particular light to a particular geometric location in an environment. For large installations requiring many lighting unit 100, the requirement of identifying and keeping track of the relationship between a lighting unit's physical location and its network address can be quite challenging, particularly given that the lighting installer may not be the same operator who will use and maintain the lighting system over time. Accordingly, in some situations it may be advantageous to provide addressing schemes that enable easier relation between the physical location of a lighting unit 100 and its virtual location for purposes of providing it a control signal. Thus, one embodiment of the invention is directed to a method of providing address information to a lighting unit 100. The method includes acts of A) transmitting data to an independently addressable controller coupled to at least one LED lighting unit 100 and at least one other controllable device, the data including at least one of first control information for a first control signal output by the controller to the at least one LED lighting unit 100 and second control information for a second control signal output by the controller to the at least one other controllable device, and B) controlling at least one of the at least one LED light source and the at least one other controllable device based on the data.

Another embodiment of the invention is directed to a method, comprising acts of: A) receiving data for a plurality of independently addressable controllers, at least one independently addressable controller of the plurality of independently addressable controllers coupled to at least one LED light source and at least one other controllable device, B) selecting at least a portion of the data corresponding to at least one of first control information for a first control signal output by the at least one independently addressable controller to the at least one LED light source and second control information for a second control signal output by the at least one independently addressable controller to the at least one other controllable device, and C) controlling at least one of the at least one LED light source and the at least one other controllable device based on the selected portion of the data.

Another embodiment of the invention is directed to a lighting system, comprising a plurality of independently addressable controllers coupled together to form a network, at least one independently addressable controller of the plurality of independently addressable controllers coupled to at least one LED light source and at least one other controllable device, and at least one processor coupled to the network and programmed to transmit data to the plurality of independently addressable controllers, the data corresponding to at least one of first control information for a first control signal output by the at least one independently addressable controller to the at least one LED light source and second control information for a second control signal output by the at least one independently addressable controller to the at least one other controllable device. Another embodiment of the invention is directed to an apparatus for use in a lighting system including a plurality of independently addressable controllers coupled together to form a network, at least one independently addressable controller of the plurality of independently addressable controllers coupled to at least one LED light source and at least one other controllable device. The apparatus comprises at least one processor having an output to couple the at least one processor to the network, the at least one processor programmed to transmit data to the plurality of independently addressable controllers, the data corresponding to at least one of first control information for a first control signal output by the at least one independently addressable controller to the at least one LED light source and second control information for a second control signal output by the at least one independently addressable controller to the at least one other controllable device.

Another embodiment of the invention is directed to an apparatus for use in a lighting system including at least one LED light source and at least one other controllable device. The apparatus comprises at least one controller having at least first and second output ports to couple the at least one controller to at least the at least one LED light source and the at least one other controllable device, respectively, the at least one controller also having at least one data port to receive data including at least one of first control information for a first control signal output by the first output port to the at least one LED light source and second control information for a second control signal output by the second output port to the at least one other controllable device, the at least one controller constructed to control at least one of the at least one LED light source and the at least one other controllable device based on the data.

Another embodiment of the invention is directed to a method in a lighting system including at least first and second independently addressable devices coupled to form a series connection, at least one device of the independently addressable devices including at least one light source. The method comprises an act of: A) transmitting data to at least the first and second independently addressable devices, the data including control information for at least one of the first and second independently addressable devices, the data being arranged based on a relative position in the series connection of at least the first and second independently addressable devices.

Another embodiment of the invention is directed to a method in a lighting system including at least first and second independently addressable devices, at least one device of the independently addressable devices including at least one light source. The method comprises acts of: A) receiving at the first independently addressable device first data for at least the first and second independently addressable devices, B) removing at least a first data portion from the first data to form second data, the first data portion corresponding to first control information for the first independently addressable device. and C) transmitting from the first independently addressable device the second data. Another embodiment of the invention is directed to a lighting system, comprising at least first and second independently addressable devices coupled to form a series connection, at least one device of the independently addressable devices including at least one light source, and at least one processor coupled to the first and second independently addressable devices, the at least one processor programmed to transmit data to at least the first and second independently addressable devices, the data including control information for at least one of the first and second independently addressable devices, the data arranged based on a relative position in the series connection of at least the first and second independently addressable devices.

Another embodiment of the invention is directed to an apparatus for use in a lighting system including at least first and second independently addressable devices coupled to form a series connection, at least one device of the independently addressable devices including at least one light source. The apparatus comprises at least one processor having an output to couple the at least one processor to the first and second independently addressable devices, the at least one processor programmed to transmit data to at least the first and second independently addressable devices, the data including control information for at least one of the first and second independently addressable devices, the data arranged based on a relative position in the series connection of at least the first and second independently addressable devices.

Another embodiment of the invention is directed to an apparatus for use in a lighting system including at least first and second independently controllable devices, at least one device of the independently controllable devices including at least one light source. The apparatus comprises at least one controller having at least one output port to couple the at least one controller to at least the first independently controllable device and at least one data port to receive first data for at least the first and second independently controllable devices, the at least one controller constructed to remove at least a first data portion from the first data to form second data and to transmit the second data via the at least one data port, the first data portion corresponding to first control information for at least the first independently controllable device.

Another embodiment of the present invention is directed to lighting system. The lighting system comprises an LED lighting system adapted to receive a data stream through a first data port, generate an illumination condition based on a first portion of the data stream and communicate at least a second portion of the data stream through a second data port; a housing wherein the housing is adapted to retain the LED lighting system and adapted to electrically associate the first and second data ports with a data connection; wherein the data connection comprises an electrical conductor with at least one discontinuous section; wherein the first data port is associated with the data connection on a first side of the discontinuous section and the second data port is associated with a second side of the discontinuous section wherein the first and second sides are electrically isolated.

Another embodiment of the present invention is directed at an integrated circuit. The integrated circuit comprises a data recognition circuit wherein the data recognition circuit is adapted to read at least a first portion of a data stream received through a first data port; an illumination control circuit adapted to generate at least one illumination control signal in response to the first portion of data; and an output circuit adapted to transmit at least a second portion of the data stream through a second data port.

Another embodiment of the present invention is directed at a method for controlling lighting systems. The method comprises the steps of providing a plurality of lighting systems; communicating a data stream to a first lighting system of the plurality of lighting systems; causing the first lighting system to receive the data stream and to read a first portion of the data stream; causing the first lighting system to generate a lighting effect in response to the first portion of the data stream; and causing the first lighting system to communicate at least a second portion of the data stream to second lighting system of the plurality of lighting systems.

Figure 4:
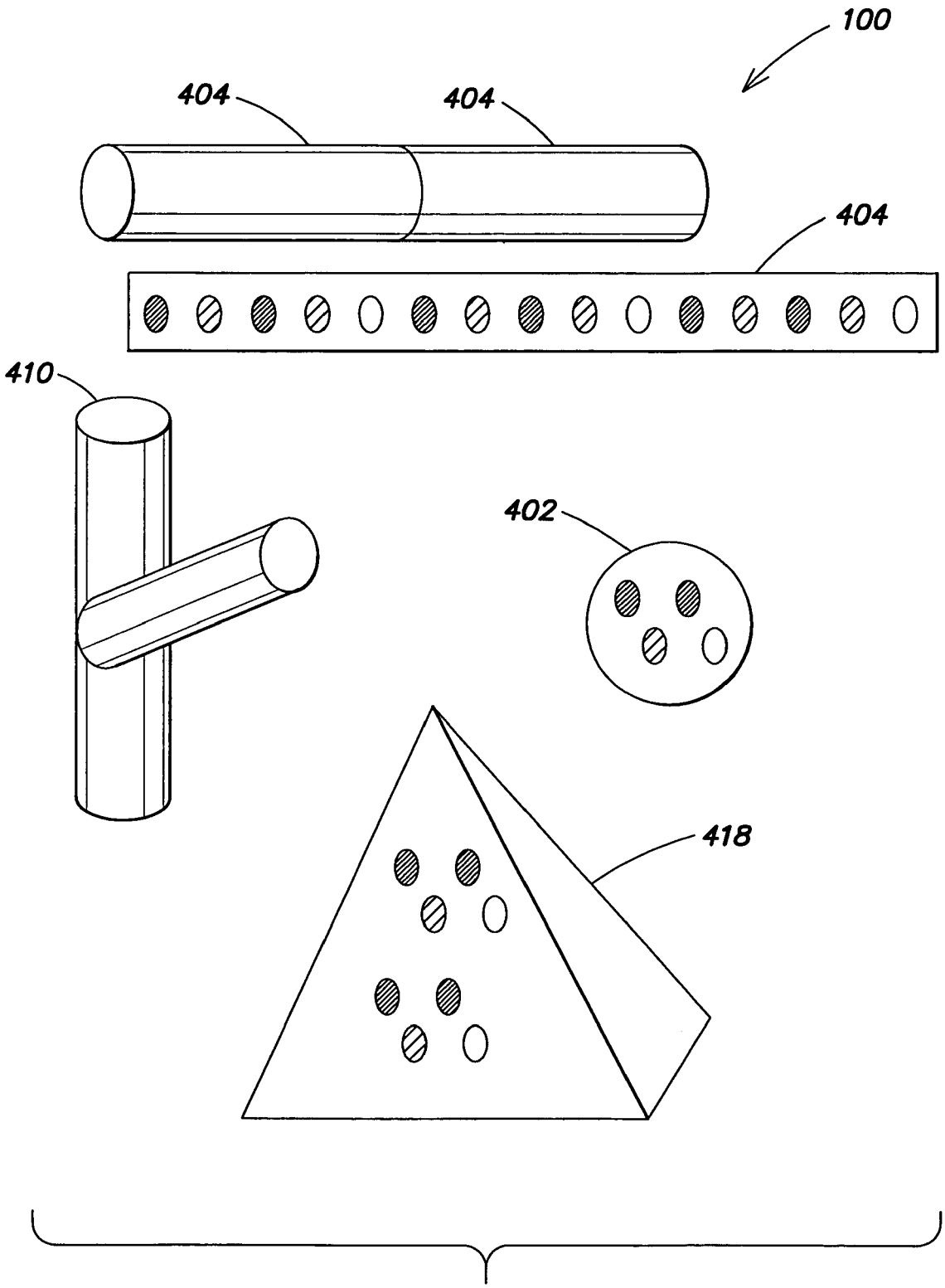
FIG. 4 depicts various configurations of lighting units in accordance with the invention.

Referring to FIG. 4, various configurations can be provided for lighting units 100, in each case with an optional communications facility 120. Configurations include a linear configuration 404 (which may be curvilinear in embodiments), a circular configuration 402, an oval configuration 414, a three-dimensional configuration 418, such as a pyramid, or a collection of various configurations 402, 404, etc. Lighting unit 100 can also include a wide variety of colors of LED, in various mixtures, including red, green, and blue LEDs to produce a color mix, as well as one or more other LEDs to create varying colors and color temperatures of white light. For example, red, green and blue can be mixed with amber, white, UV, orange, IR or other colors of LED. Amber and white LEDs can be mixed to offer varying colors and color temperatures of white. Any combination of LED colors can produce a gamut of colors, whether the LEDs are red, green, blue, amber, white, orange, UV, or other colors. The various embodiments described throughout this specification encompass all possible combinations of LEDs in lighting unit 100, so that light of varying color, intensity, saturation and color temperature can be produced on demand under control of a processor 102. Combinations of LEDs with other mechanisms, such as phosphors, are also encompassed herein.

Although mixtures of red, green and blue have been proposed for light due to their ability to create a wide gamut of additively mixed colors, the general color quality or color rendering capability of such systems are not ideal for all applications. This is primarily due to the narrow bandwidth of current red, green and blue emitters. However, wider band sources do make possible good color rendering, as measured, for example, by the standard CRI index. In some cases this may require LED spectral outputs that are not currently available. However, it is known that wider-band sources of light will become available, and such wider-band sources are encompassed as sources for lighting unit 100 described herein.

Additionally, the addition of white LEDs (typically produced through a blue or UV LED plus a phosphor mechanism) does give a 'better' white it is still limiting in the color temperature that is controllable or selectable from such sources.

The addition of white to a red, green and blue mixture may not increase the gamut of available colors, but it can add a broader-band source to the mixture. The addition of an amber source to this mixture can improve the color still further by 'filling in' the gamut as well.

This combinations of light sources as lighting unit 100 can help fill in the visible spectrum to faithfully reproduce desirable spectrums of lights. These include broad daylight equivalents or more discrete waveforms corresponding to other light sources or desirable light properties. Desirable properties include the ability to remove pieces of the spectrum for reasons that may include environments where certain wavelengths are absorbed or attenuated. Water, for example tends to absorb and attenuate most non-blue and non-green colors of light, so underwater applications may benefit from lights that combine blue and green sources for lighting unit 100.

Amber and white light sources can offer a color temperature selectable white source, wherein the color temperature of generated light can be selected along the black body curve by a line joining the chromaticity coordinates of the two sources. The color temperature selection is useful for specifying particular color temperature values for the lighting source.

Orange is another color whose spectral properties in combination with a white LED-based light source can be used to provide a controllable color temperature light from a lighting unit 100.

The combination of white light with light of other colors as light sources for lighting unit 100 can offer multi-purpose lights for many commercial and home applications, such as in pools, spas, automobiles, building interiors (commercial and residential), indirect lighting applications, such as alcove lighting, commercial point of purchase lighting, merchandising, toys, beauty, signage, aviation, marine, medical, submarine, space, military, consumer, under cabinet lighting, office furniture, landscape, residential including kitchen, home theater, bathroom, faucets, dining rooms, decks, garage, home office, household products, family rooms, tomb lighting, museums, photography, art applications, and many others.

Referring still to FIG. 4, lighting units 100 can be arranged in many different forms. Thus, one or more light sources 104A-104D can be disposed with a processor 102 in a housing. The housing can take various shapes, such as one that resembles a point source 402, such as a circle or oval. Such a point source 402 can be located in a conventional lighting fixture, such as lamp or a cylindrical fixture. Lighting units 100 can be configured in substantially linear arrangements, either by positioning point sources 402 in a line, or by disposing light sources 104A-104D substantially in a line on a board located in a substantially linear housing, such as a cylindrical housing. A linear lighting unit 404 can be placed end-to-end with other linear elements 404 or elements of other shapes to produce longer linear lighting systems comprised of multiple lighting units 100 in various shapes. A housing can be curved to form a curvilinear lighting unit. Similarly, junctions can be created with branches, "Ts," or "Ys" to created a branched lighting unit 410. A bent lighting unit can include one or more "V" elements. Combinations of various configurations of point source 402, linear 404, curvilinear, branched 410 and bent lighting units 100 can be used to create any shape of lighting system, such as one shaped to resemble a letter, number, symbol, logo, object, structure, or the like. An embodiment of a lighting unit 100 suitable for being joined to other lighting units 100 in different configurations is disclosed below.

In one embodiment, the present invention relates to controlled, networked or non-networked, lighting units 100 configured into panels or tiles. A lighting unit 100 with one or more LEDs can be mounted or embedded into such a lighting unit 100 to provide patterns of color and color changing capability at a variety of scales. Such lighting units, 100, in one embodiment, can be mounted or integrated into walls, ceilings, doors, windows or floors.

Figure 5:
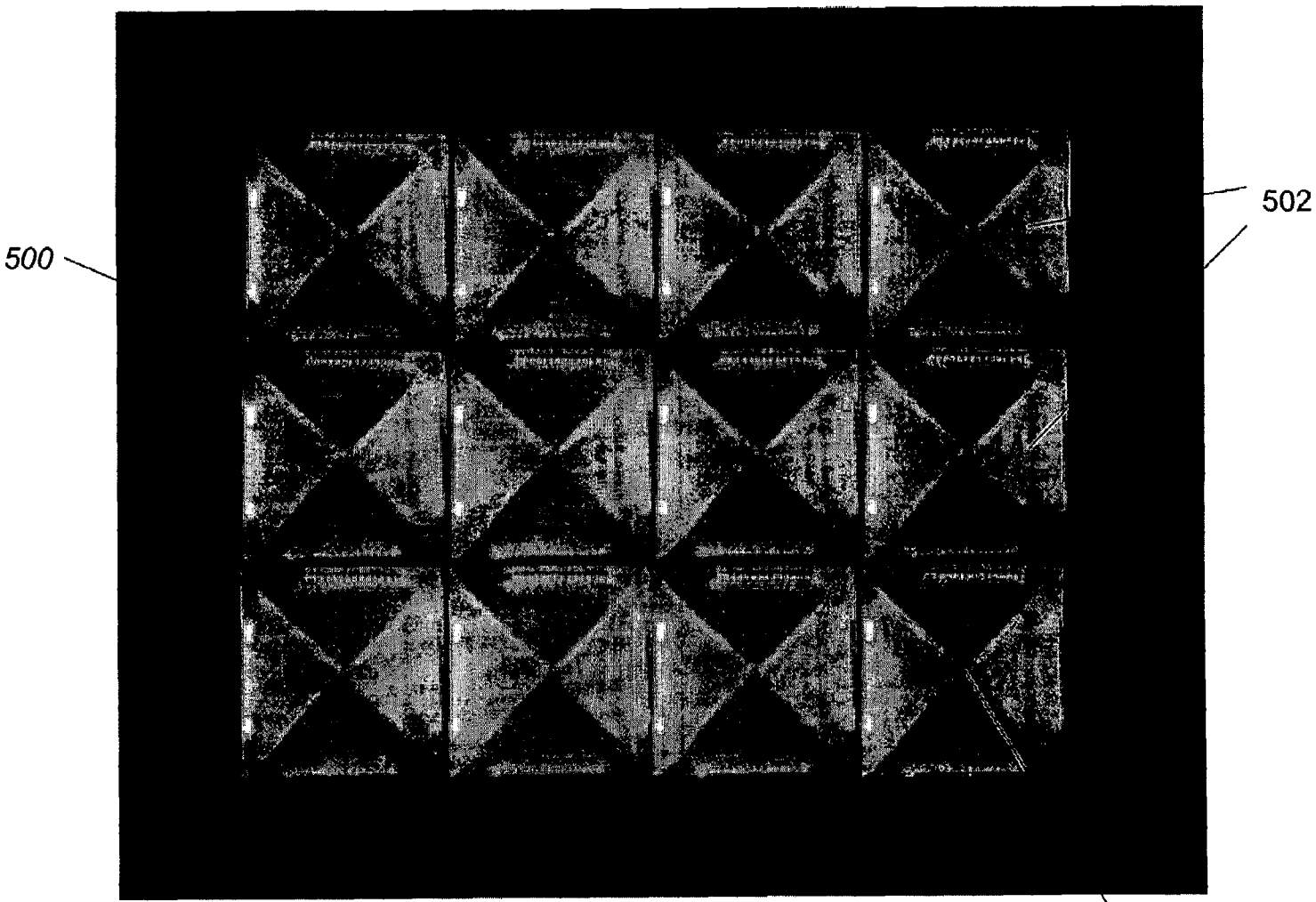
FIG. 5 depicts a tile lighting fixture in accordance with the invention.

Referring to FIG. 5, a lighting unit 100 is disposed in a tile 500 that includes a plurality of triangular regions 502, each of whose color can be selected and controlled for a wide variety of pleasing effects. Light and color patterns can be created and manipulated, faded and moved. The tiles 500 can be networked for coordinated effects or run in stand-alone modes. In various embodiments, the particulars of the illuminated surfaces include geometries to maximize light output, homogenize and diffuse light output, and to shape light output. The viewed surfaces incorporate textures and 2D or 3D forms to guide and direct light towards the viewer.

The embodiment of FIG. 5 is a tile 500 that is designed for a panel wall installation comprising a 12-element panel with four controllable areas per element 504. This is just one of many combinations of tiles 500 that are possible. Tiles 500 of all shapes can be combined to cover any surface, just as conventional floor, wall or ceiling tiles or other construction materials are fitted together to cover structures or parts of structures. Tiles 500 can be fitted together to form furniture and fixtures as well, in each case with the lighting system capabilities described throughout this disclosure and in the patent and patent applications incorporated herein by reference.

Referring to FIG. 6, there are a variety of mounting provisions for mounting of the tiles 500 or panels to surfaces or for interconnecting elements. In one embodiment, as shown in FIGS. 6A and 6B, wall mounting 602 is used. Wall mounting uses mounting clips 604 and bracket 605 to provide desired spacing, to secure units to the wall, and to provide spacing from the wall. Attachment to a wall can be through a bracket such as a Z-bracket or two-piece assemblies such as Z-clips or French- cleats. In one embodiment, as assembled unit 500A of multiple tiles 500 may be pre-assembled on the ground and mounted on a Z-track 605, as shown in FIG. 6B. Tiles 500 can also be hung like a picture from a hook by a wire across the back. These cleat designs also can incorporate features such as channels or recessed surfaces to allow the running of wires for communication of data and positioning of power supplies between adjacent units or to better route such cabling for the purposes of termination and passage through wall cavities and junction boxes. FIGS. 6C and 6D and the subsequent figures show more details on how the tiles 500 can be used and mounted.

Figure 6C:
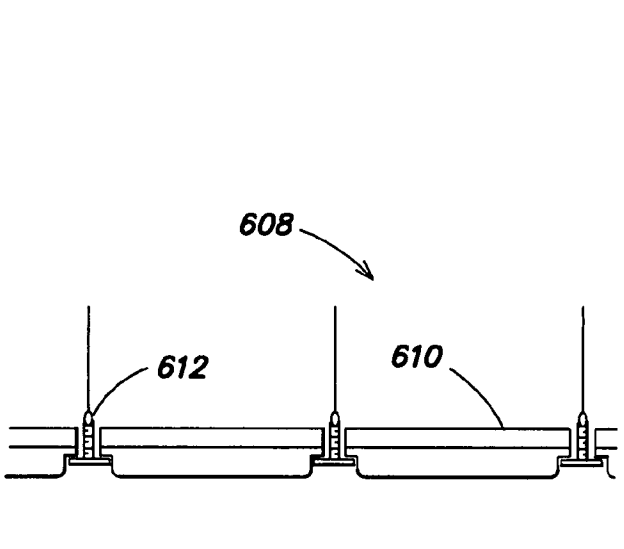
FIGS. 6C and 6D depict ceiling mounting methods and systems for a tile light embodiment of the invention.
Figure 6B:
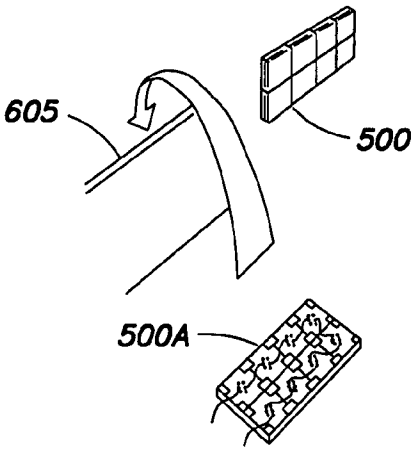
FIGS. 6A and 6B depicts wall mounting methods and systems for a tile light embodiment of the invention.
Figure 6D:
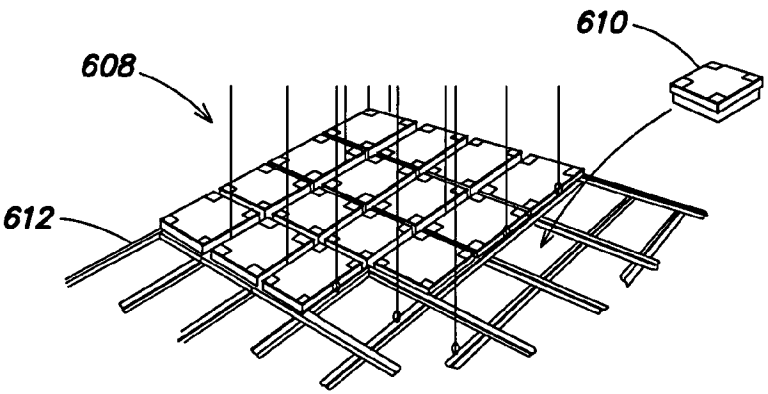
Figure 6A:
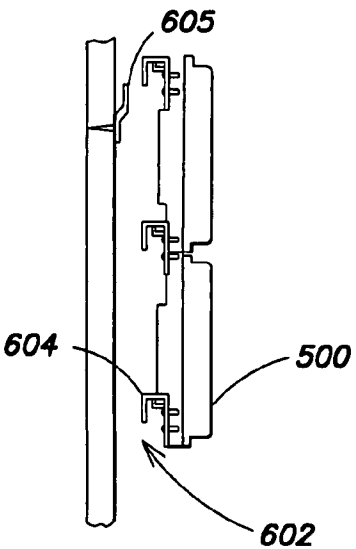

FIGS. 6C and 6D also shows ceiling mounting 608. While the devices can be secured to a ceiling via brackets and other attachments as described in the wall mounting embodiment, ceilings are often covered with a suspended grid infrastructure that allows for a variety of ceiling tiles as well as lights and HVAC-related elements. Ceiling tile elements 610 can be sized to fit into standard suspended ceiling grids. For example a 2-foot by 2-foot element 610 could fit directly into a standard ceiling grid 612. Additional wiring options for ceiling mounting can include jumper cables from unit to unit to give flexibility in installation.

In other embodiments, the tiles 500 can be incorporated as flooring elements. The housing design can be of sufficient structural strength to form a flooring element much like that of raised flooring used in computer centers or even structural tiles used as a direct application flooring material. Alternatively, the tiles 500 can be mounted beneath transparent or translucent flooring elements to provide illumination through such elements. For example, the combination of many of these panel elements can then be used as dance floors or for studios and stage sets for a variety of dramatic and pleasing effects.

For ceiling mounted embodiments all materials and construction are preferably plenum rated, since air spaces above suspended ceilings are typically used for air handling as well. Selected materials including panels and wiring insulation should meet all required fire ratings and should not emit volatile gases.

Additionally, for high power LED devices or where large concentrations of LEDs are used, heat dissipation facilities can be directly incorporated into the panel structure. There are many embodiments of heat dissipation facilities. These can take the form of traditional cast or extruded metal heat sinks, as well as fans and appropriate venting and air flow channels. Other facilities include liquid-cooled systems that allow for convection currents to transfer heat and provide a flow of heat away from the source. Additional means for thermal dissipation include thermoelectric cooling devices, such as those using the Peltier-effect, which uses electricity to create a cold side and dissipate heat to a 'hot' side.

Figure 7B:
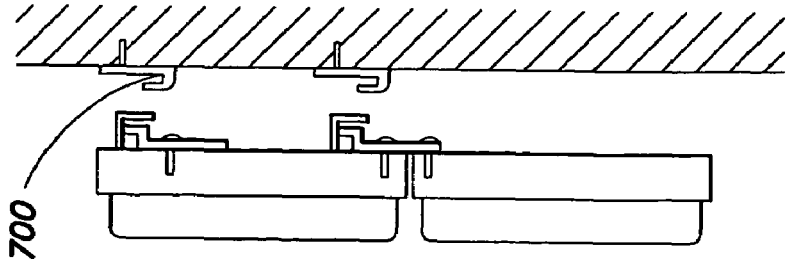
FIGS. 7A and 7B depicts a wall mounting rail system for a tile lighting system.
Figure 7A:
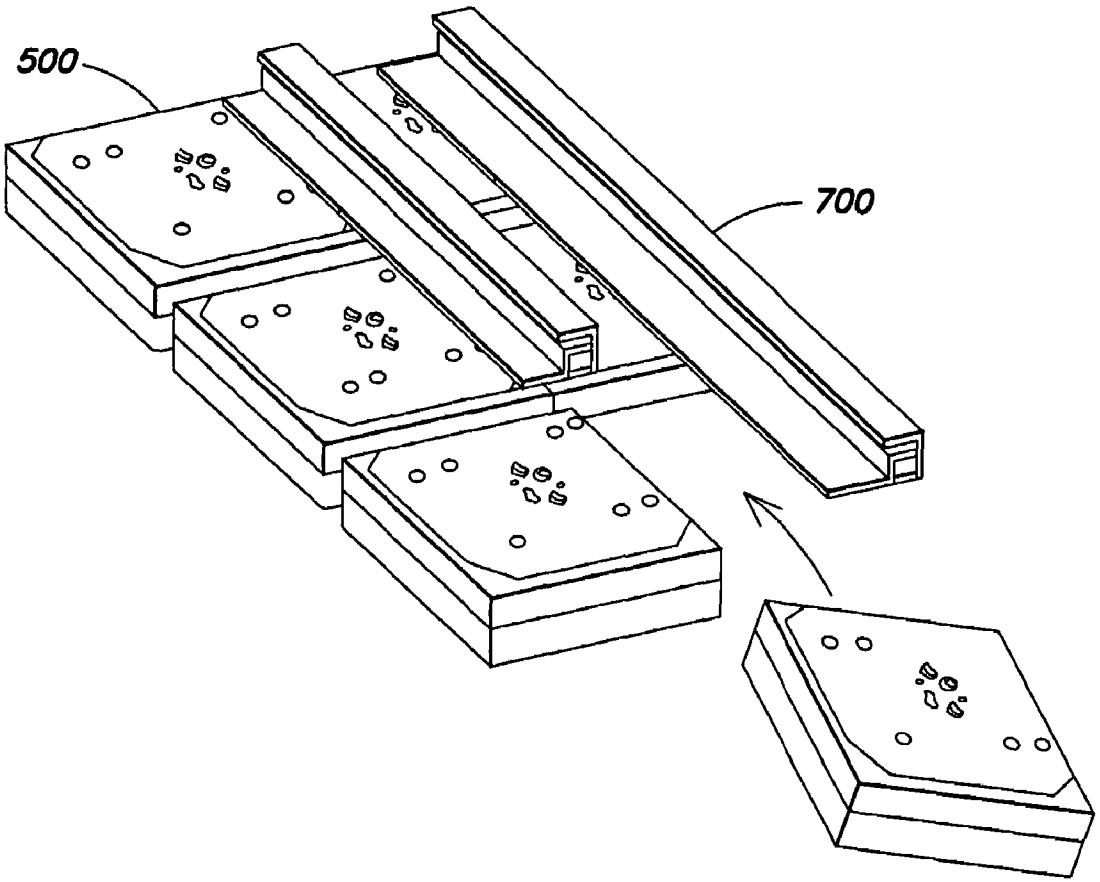

FIG. 7 shows a rail mounting facility 700 for a tile 500. This embodiment is a mounting system that includes rails to connect a larger number of the tiles 500 or panel elements together. The same rails 700 can be used as a hanging or mounting system as shown in FIG. 7.

Figure 8:
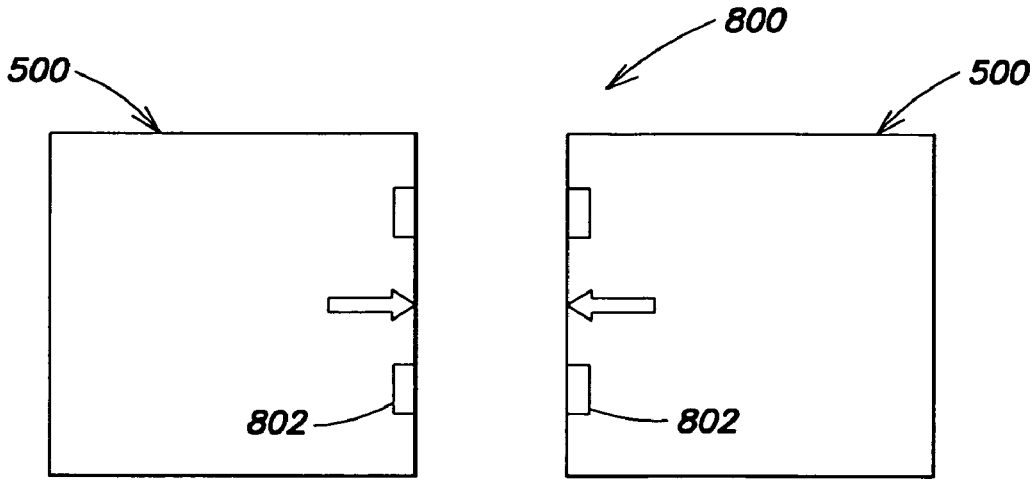
FIG. 8 is a schematic diagram of an electrical and mechanical connection between units of a tile lighting system.

Referring to FIG. 8, another aspect of this invention 800 is that wiring of the devices can be done through a direct connector 802 between tiles 500 similar in principle to building blocks. That is, the modular tiles 500 or panel elements can be directly connected to each other with both mechanical and electrical attachments 802.

Figure 9:
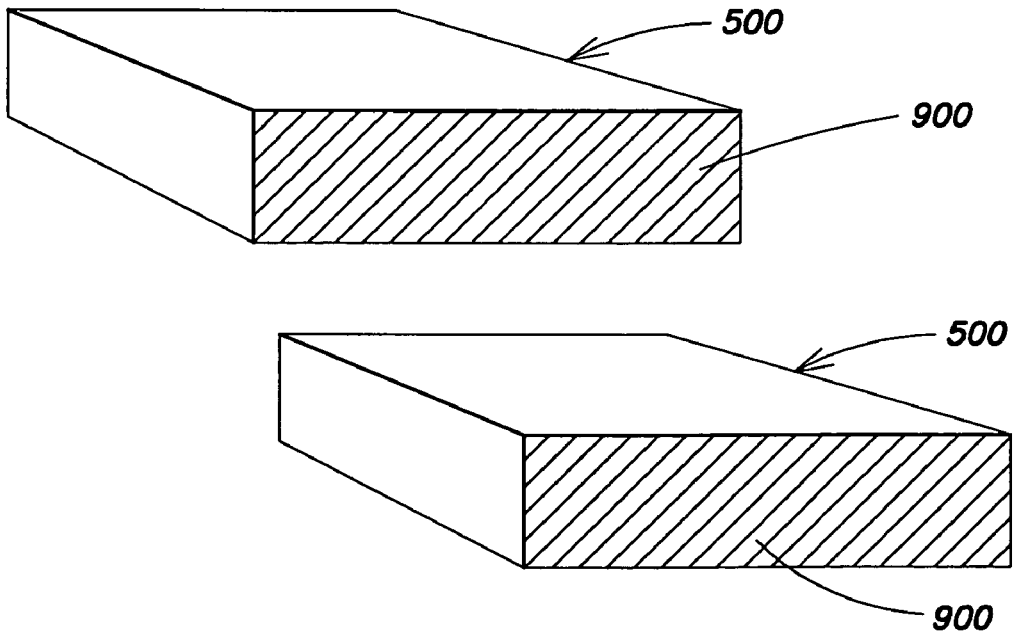
FIG. 9 illustrates a magnetic connection among two tile light units.

Referring to FIG. 9, the tiles 500 can be equipped with a magnetic facility 900, so that the tiles 500 are held together by the attraction of magnets 900. The panels can be light enough and incorporate either ferrous materials or magnets whose fields are properly aligned so as to allow coupling between adjacent elements.

Figure 10B:
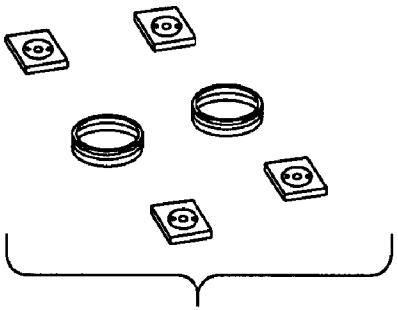
FIGS. 10A and 10B illustrates a bracket system for connecting tile lighting units.
Figure 10A:
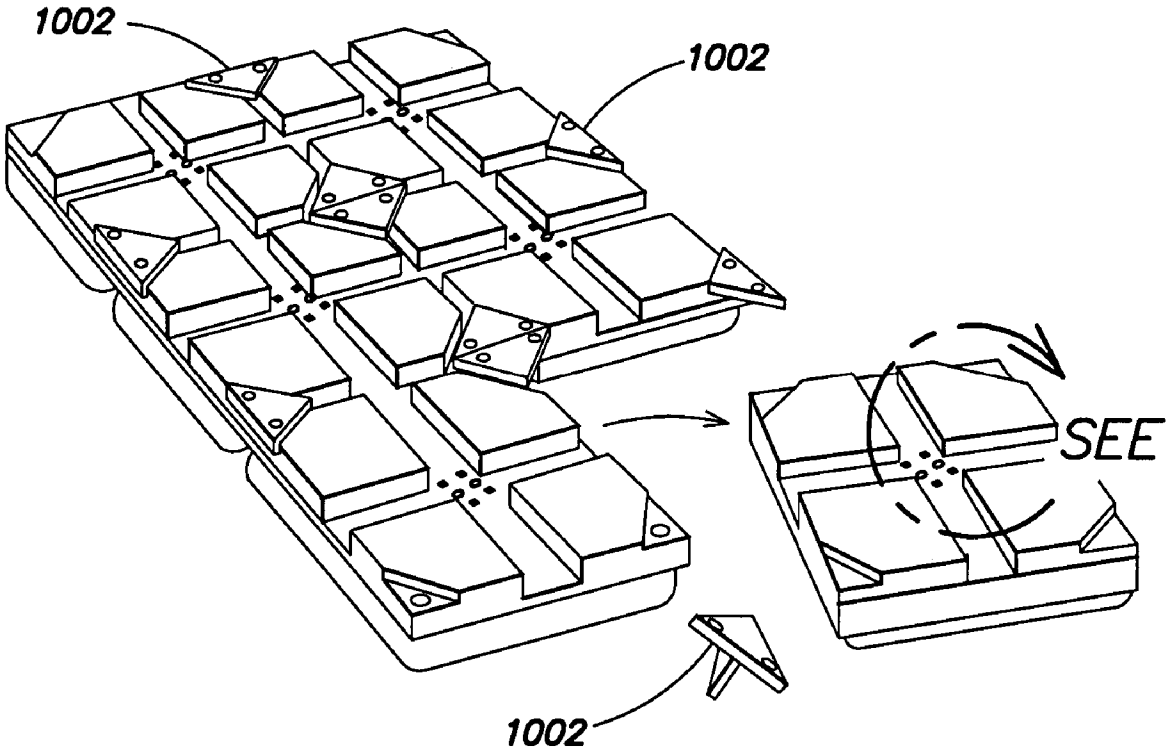

Referring to FIG. 10, a facility for connecting and attaching tiles 500 or panels with dual-purpose connections is disclosed. In FIG. 10, the diamond and triangular-shaped elements 1002 are brackets to interconnect the tiles 500. The zoom-in feature shows the electrical and data connections between the tiles 500.

Figure 11:
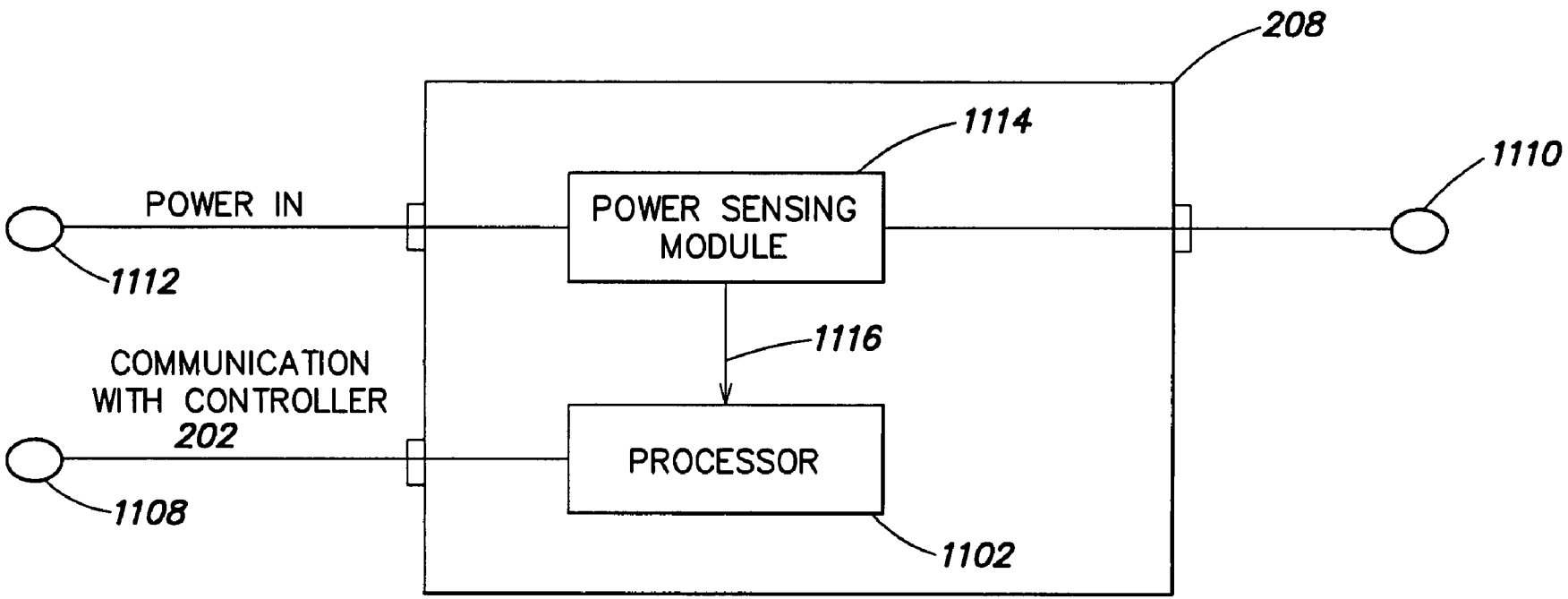
FIG. 11 illustrates a portion of a lighting unit controller including a power-sensing module according to one embodiment of the present invention.

FIG. 11 shows a block diagram of a portion of a generic LUC 208 that includes a LUC processor 1102 and a power-sensing module 1114. As indicated in FIG. 11, the power sensing module 1114 may be coupled to a power supply input connection 1112 and may in turn provide power to one or more lighting units coupled to the LUC via a power output connection 1110. The power-sensing module 1114 also may provide one or more output signals 1116 to the processor 1102, and the processor in turn may communicate to the central controller 202 information relating to power sensing, via the connection 1108.

In one aspect of the LUC shown in FIG. 11, the power sensing module 1114, together with the processor 1102, may be adapted to determine merely when any power is being consumed by any of the lighting units coupled to the LUC, without necessarily determining the actual power being drawn or the actual number of units drawing power. Such a "binary" determination of power either being consumed or not consumed by the collection of lighting units coupled to the LUC facilitates an identifier determination/learning algorithm (e.g., that may be performed by the LUC processor 1102 or the central controller 202) according to one embodiment of the invention. In other aspects, the power sensing module 1114 and the processor 1102 may be adapted to determine, at least approximately, and actual power drawn by the lighting units at any given time. If the average power consumed by a single lighting unit is known a priori, the number of units consuming power at any given time can then be derived from such an actual power measurement. Such a determination is useful in other embodiments of the invention, as discussed further below.

Figure 12:
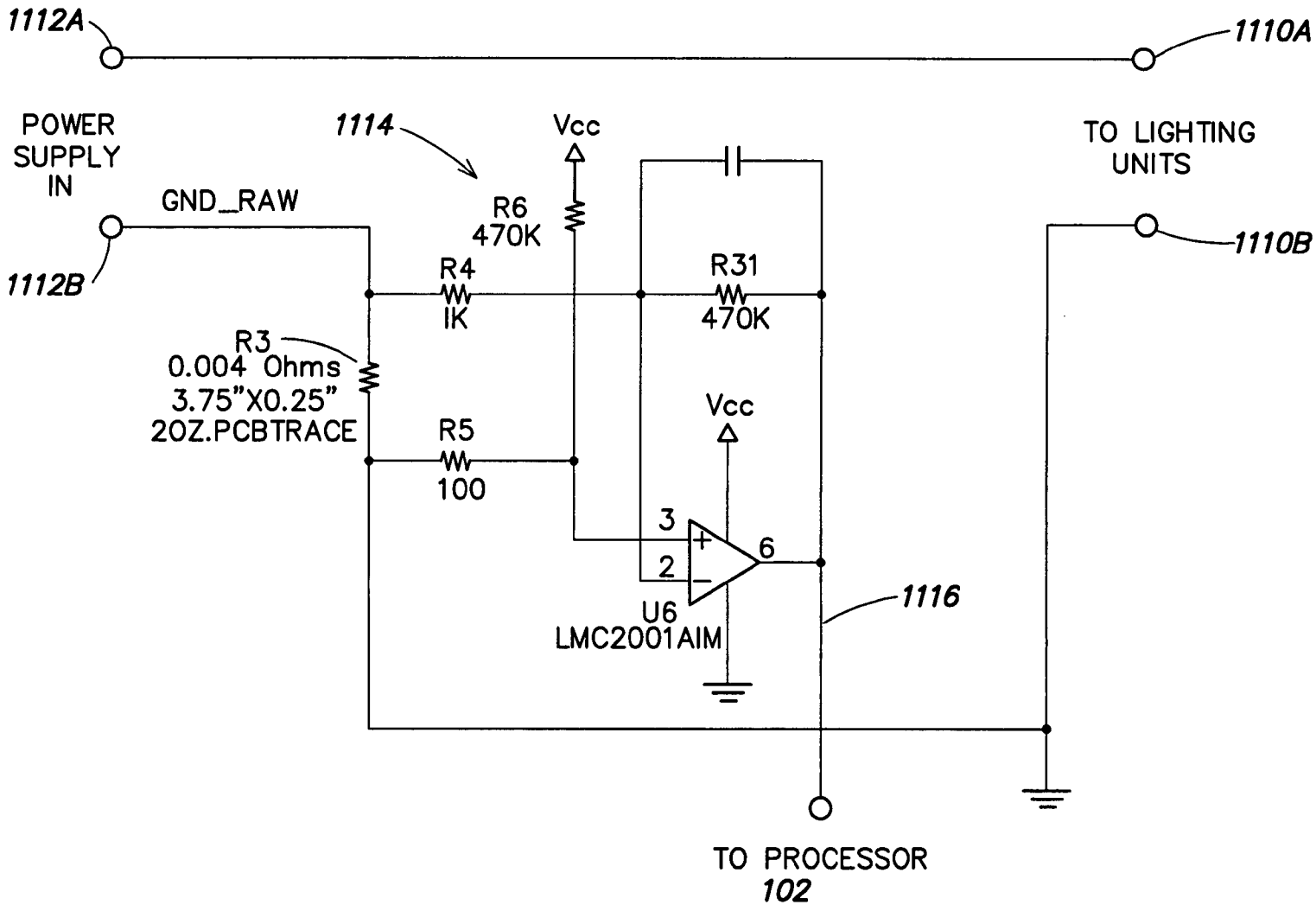
FIG. 12 shows an example of a circuit implementation of a lighting unit controller including a power-sensing module according to one embodiment of the invention.

FIG. 12 shows an example of a portion of a circuit implementation of a LUC including a power-sensing module 1114 according to one embodiment of the invention. In FIG. 12, the power supply input connection is shown as a positive terminal 1112A and a ground terminal 1112B. Similarly, the power output connection to the lighting units is shown as a positive terminal 1110A and a ground terminal 1110B. In FIG. 12, the power sensing module 1114 is implemented essentially as a current sensor interposed between the ground terminal 1112B of the power supply input connection and the ground terminal 1110B of the power output connection. The current sensor includes a sampling resistor R3 to develop a sampled voltage based on power drawn from the power output connection. The sampled voltage is then amplified by operational amplifier U6 to provide an output signal 1116 to the processor 102 indicating that power is being drawn.

In one aspect of the embodiment shown in FIG. 12, the power input supply connection 1112A and 1112B may provide a supply voltage of approximately 20 volts, and the power sensing module 1114 may be designed to generate an output signal 1116 of approximately 2 volts per amp of load current (i.e., a gain of 2 V/A) drawn by the group of lighting units coupled to the LUC. In other aspects, the processor 102 may include an A/D converter having a detection resolution on the order of approximately 0.02 volts, and the lighting units may be designed such that each lighting unit may draw approximately 0.1 amps of current when energized, resulting in a minimum of approximately a 0.2 volt output signal 1116 (based on the 2 V/A gain discussed above) when any unit of the group is energized (i.e., easily resolved by the processor's A/D converter). In another aspect, the minimum quiescent current (off-state current, no light sources energized) drawn by the group of lighting units may be measured from time to time, and an appropriate threshold may be set for the power sensing module 1114, so that the output signal 1116 accurately reflects when power is being drawn by the group of lighting units due to actually energizing one or more light sources.

As discussed above, according to one embodiment of the invention, the LUC processor 102 may monitor the output signal 1116 from the power sensing module 1114 to determine if any power is being drawn by the group of lighting units, and use this indication in an identifier determination/learning algorithm to determine the collection of identifiers of the group of lighting units coupled to the LUC.

Figure 13:
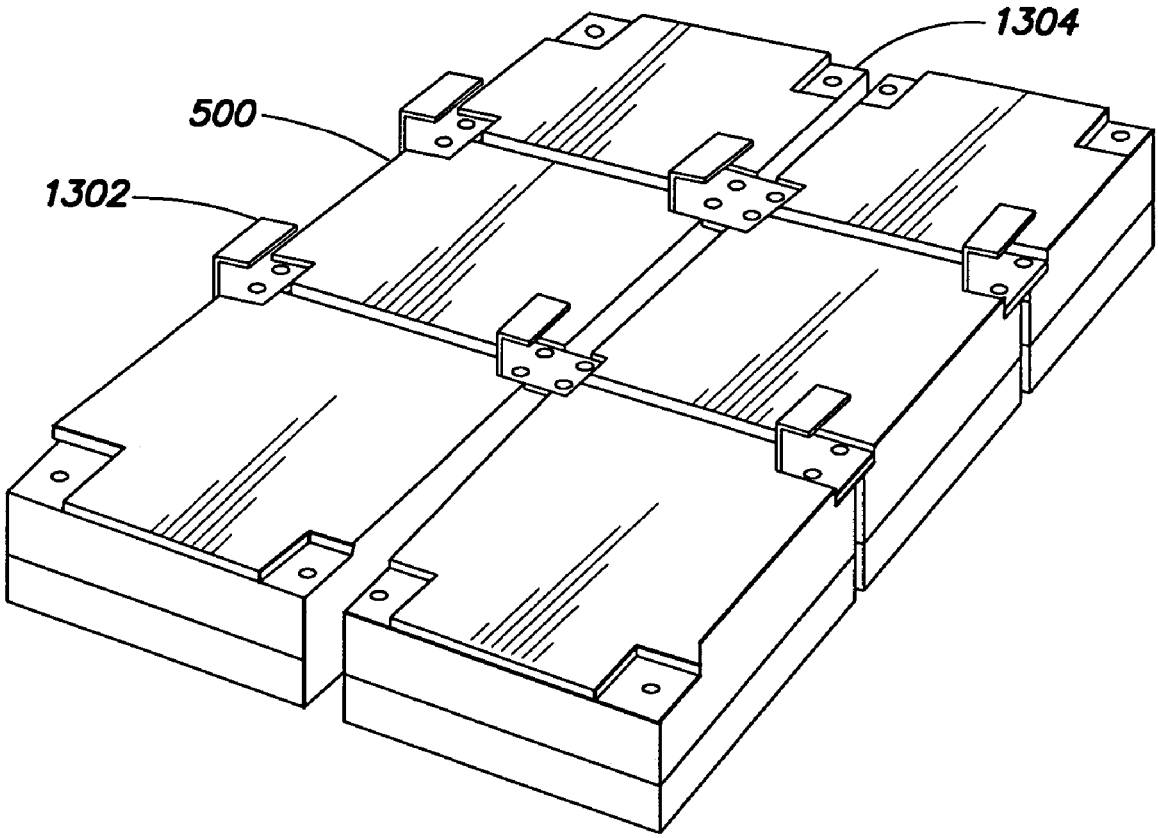
FIG. 13 illustrates a bracket system for connecting tile lighting units and for attaching the tile lighting units to a wall or other surface.

Referring to FIG. 13, tiles 500 can be joined on the back by bracket elements 1302 that fit into a recessed area 1304 to join and interconnect tiles 500. The recessed areas 1304 can serve as a channel to facilitate wiring or cabling of a lighting system with lighting units 100. The zoomed-in area shows an embodiment of bracket elements 1302. The brackets also form an element that provides spacing, wall hanging and connection between adjacent tiles 500. Brackets 1302 provide spacing, attachment and hanging capability as well as an integral wire channel. A bracket 1302 can use one or more of these features.

In the case of spacing of a tile 500 from a wall, floor, ceiling or other surface, optical elements can provide a path for light on the backside edge of the tile to frame the lighting panels and to give a "halo effect" to the tiles 500. This halo light can also be provided with separate light emitting elements to provide separate control of both forward and backside lightings. The halo effect can also use a shadow mask or shaped silhouettes to give different lighting shapes such as crenellated, wavy, lines, diffusing materials with varying fade over the surface or even a simple sharp edge frame.

Figure 14:
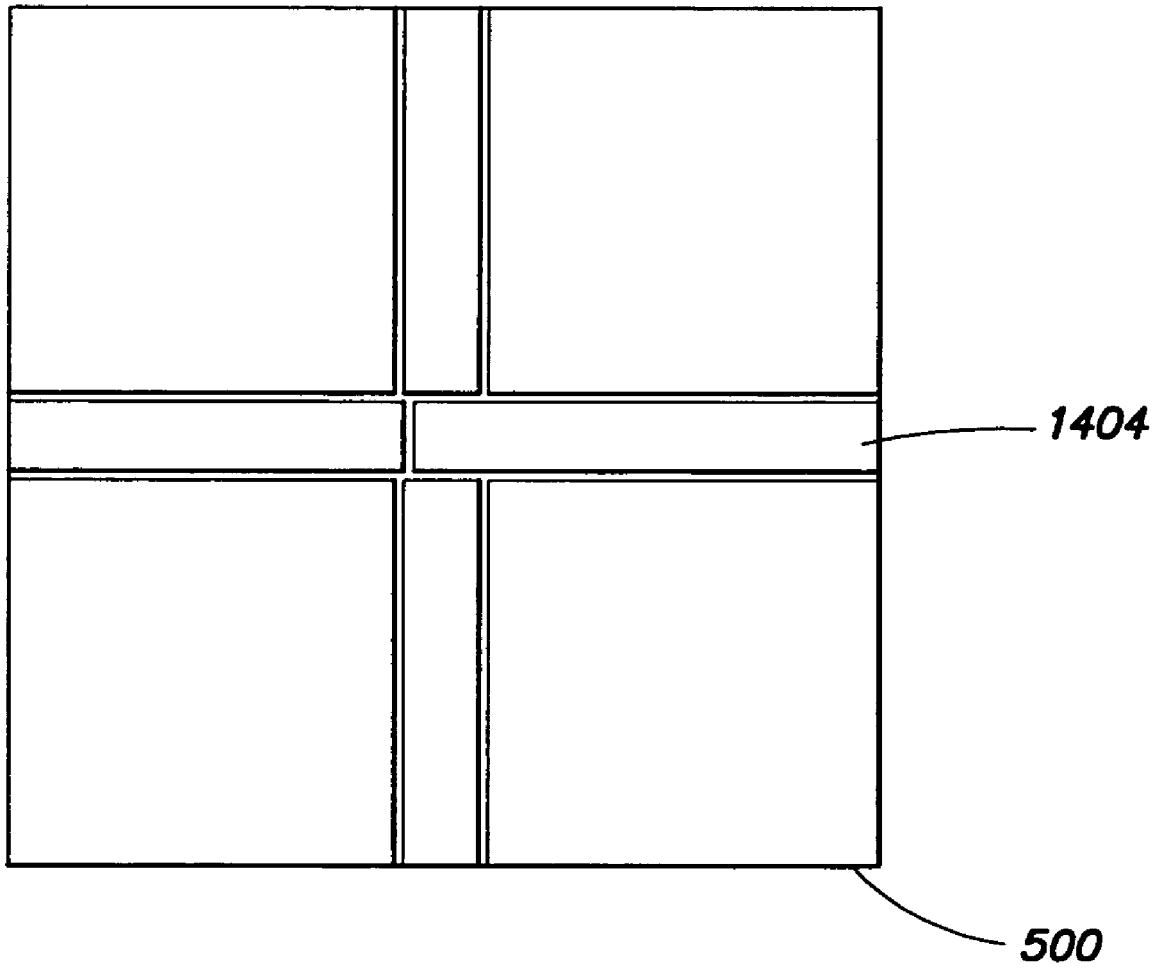
FIG. 14 illustrates a system for creating a halo effect about a tile lighting unit.

The halo or frame effect can also be instantiated through distinct and separately controlled lighting units 100. The lines or adjoining surfaces can be strips of light that are incorporated as accent pieces within a grid or pattern of tiles or panels. FIG. 14 shows square tiles 500 separated by separately controlled rectangular lighting elements 1404. The lighting elements 1404 are modular and can be made in any shape so that any pattern or sets of patterns can be created.

In various embodiments, each tile 500 can be partitioned into a variety of individual shapes. With the underlying grid of controllable nodes, there would be sufficient illumination to light each node down to the resolution of the grid itself. Arbitrary shapes including polygons, circles and any other set of interlocking patterns can be isolated and individually controlled within a tile 500.

Figure 15:
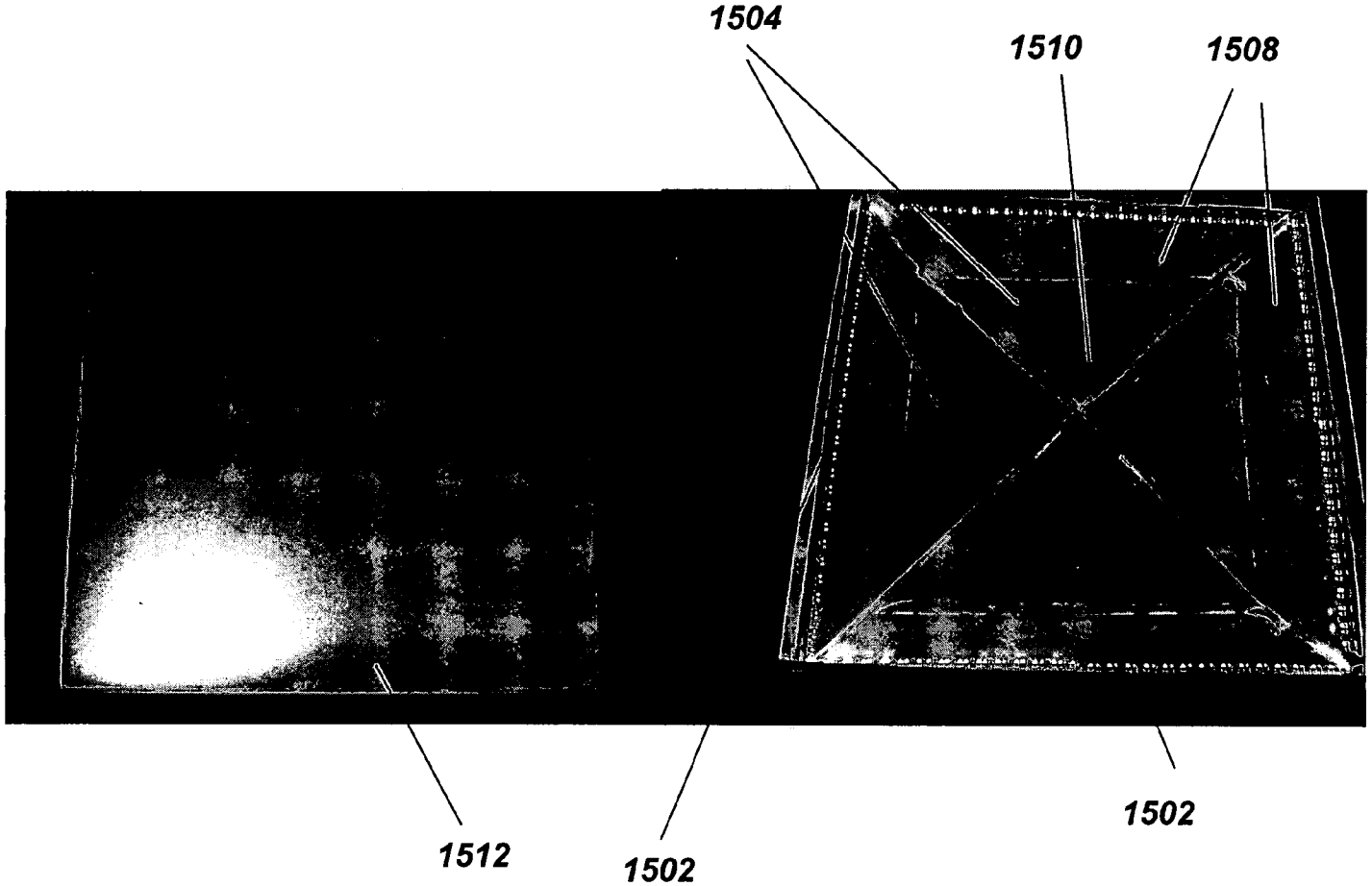
FIG. 15 illustrates an edge-lit embodiment of the interior of a tile light as well as the lit exterior cover of the tile light.

To reduce the number of light emitting elements required for a tile 500, boards with LEDs can be mounted as a lighting unit 100 or light source 1502 on the edges facing in towards the center of the shape as shown in the right hand side of FIG. 15. Light radiating away from the light source 1502 will fade in intensity as a function of distance away from the light source 1502. In order to provide more uniform illumination, the shape of the interior of the tile 500 can be configured in such a way as to capture and reflect the illumination to provide a more uniformly illuminated surface for a cover 1512 that is placed over the region in which the light sources 1502 are placed. In FIG. 15, a pyramid 1510 is shown in relief, coming towards the viewer and providing an increase in light towards the viewer. The faces of the pyramid 1504 near the base of the pyramid 1510 are brighter than the flat area 1508 that is nearer to the light source 1502, because the angle of incidence of light from the light source 1502 is such that more light is reflected upward (toward the eye of a viewer who is looking on the tile 500 from a direction substantially toward the top of the pyramid 1508) from the angled faces 1504 than from the flat areas 1508. With the diffusing cover 1512, this effect provides nearly uniform intensity of illumination from the whole tile 500, as shown in the left hand side of FIG. 15. Thus, FIG. 15 shows a tile 500 with an edge lit interior, with, and without, the diffusing cover 1512. Note the use of the pyramidal element 1510 to guide, diffuse and homogenize light output. Diagonals provide separation between adjacent areas and can be provided at a variety of heights to eliminate or allow overlap of colors from adjacent sections.

While the pyramid 1510 is a simple shape to implement a favorable light effect, other shapes may be provided and may be more effective over different differences and different configurations of tiles 500. Curved shapes, specifically those tailored to the mathematical model of light distribution, can provide even better uniformity over the distance. A shape described by a $2^{nd}$ order equation, such as a parabola, may be better suited to giving the correct properties of uniformity of reflected light toward the eye of a viewer of the tile 500.

In embodiments, the surface material for the interior of the tile 500 may be a matte white surface, namely, a Lambertian surface. A Lambertian surface is a surface of perfectly matte properties and thus adheres to Lambert's cosine law which states that the reflected light in any direction from a perfectly diffusing surface varies as the cosine of the angle between that direction and the perpendicular to the surface. The result is that the luminance of that surface is the same regardless of the viewing angle. This in combination with the shape as described above gives a pleasing uniform lit surface with little perceptible variation.

Of course, in embodiments, it may be desired to use a variety of shapes and materials to give an effect other than uniform illumination. Various shapes may provide variance, shadows and textures to give sculptural effects from the light. For example, a symbol, letter, number, logo, character, picture or other element can be formed by designing the interior configuration of the tile 500, the reflective nature of the interior, or the light-transmitting capacity of the cover 1512, to vary light intensity in particular regions of the tile 500.

Note that the use of a surface in the interior of the tile 500, such as the pyramid 1510, can create a void beneath which space can be used to hide power supplies and controllers, connectors and other related pieces of the system of tiles 500.

While the embodiment of FIG. 15 shows an edge-lit system, other configurations of lighting units 100 can be used to light the interior of the tile 500. These include regular or irregular grids, columnar arrays, circles, or other shapes of lighting units 100 serving as light emitting elements. These elements can also provide fixed color or have independently controlled nodes within the interior of the tile 500.

In embodiments, a circuit board can use a white solder mask to maximize reflectance and light output from the tile 500.

The cover 1512 of FIG. 15 is an example of a diffusing panel for a tile 500. Such diffusing panels can be shaped and sculpted into a variety of pleasing forms for aesthetic and decorative purposes. These can be modular units that can be substituted for one another to change the overall appearance or to represent different themes. In combinations of colors and shapes, each installation can be unique. The use of colorful translucent or opaque coverings such as silk-screens can provide still more effects. This can be used for advertising or information purposes, the front of dispensing or vending machines, signs, accessible services, such as phones or kiosks, and any other application where artwork, signs or displays are used. With translucent colors a flare effect can be made using changing colors behind colored graphics. Using modular diffusing panels then allows a larger variety of color changing effects based on the colors of the materials.

Figure 16:
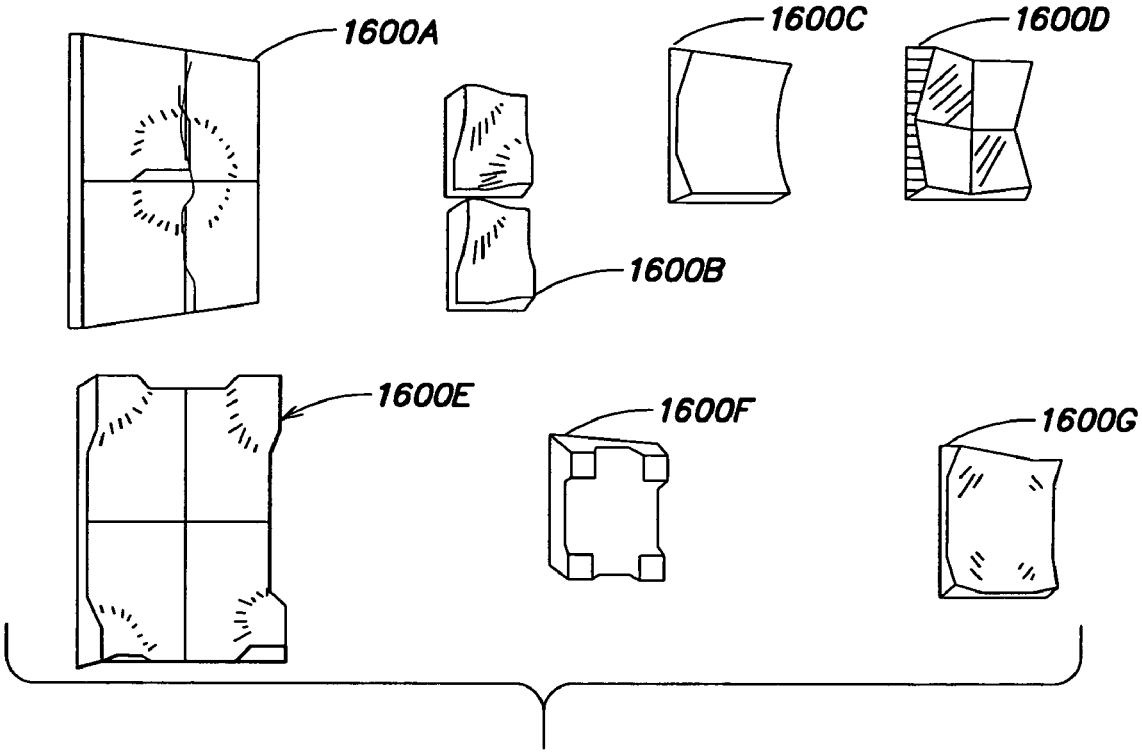
FIG. 16 illustrates embodiments of a diffusing panel exterior for a tile lighting unit.
Figure 17:
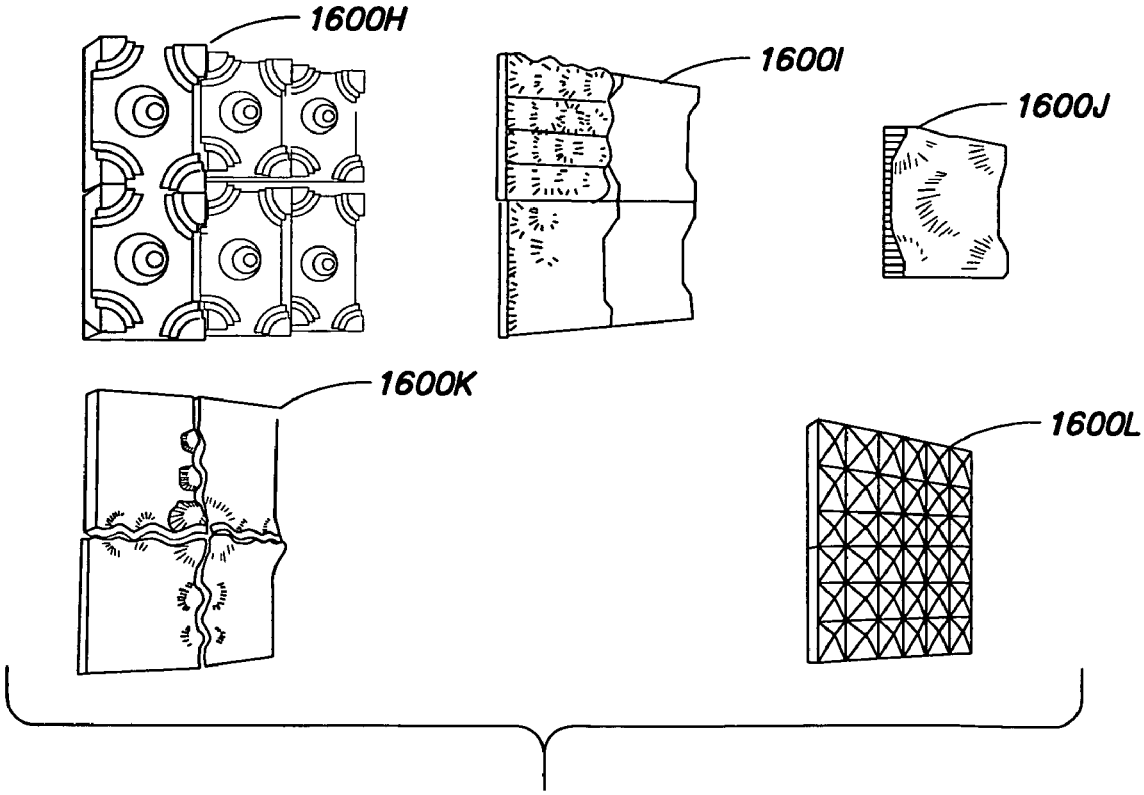
FIG. 17 illustrates additional embodiments of a diffusing panel exterior of a tile lighting unit.

FIGS. 16 and 17 show a variety of textures and shapes that can be used to diffuse and diffract light among the wide variety that are encompassed by this disclosure. The covers 1600A-1600C can incorporate graphics and other elements such as characters and artwork. Tessellations can be provided in Escher-like or Penrose-type patterns that are either periodic or aperiodic. Tiles incorporating covers in these many textures and shapes can be disposed in many environments, such as to cover parts of building interiors and exteriors, including walls, doors, windows, ceilings, floors, furniture, tables, shelves, and other surfaces.

Figure 18A:
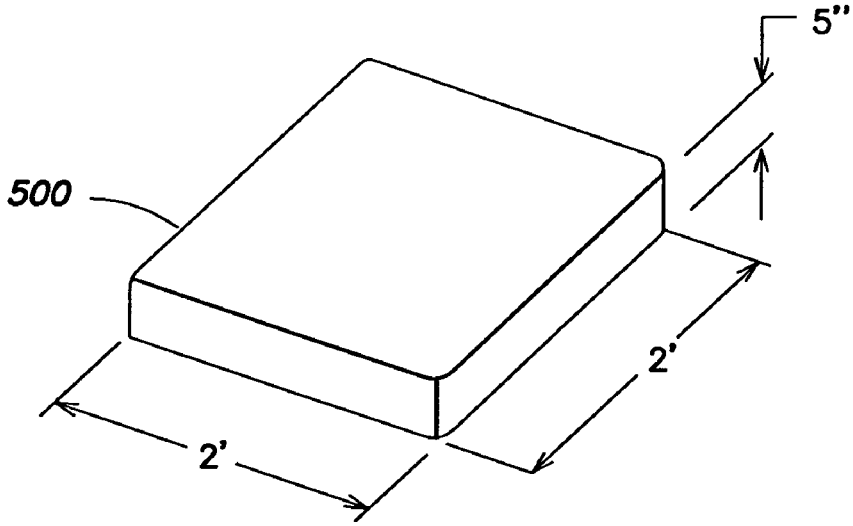
FIGS. 18A and 18B illustrates a tile lighting unit designed to be placed flush to a flat surface.
Figure 18B:
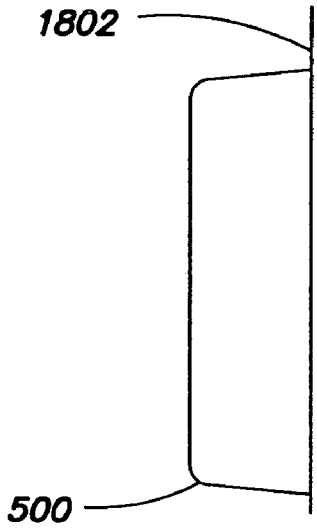
Figure 19:
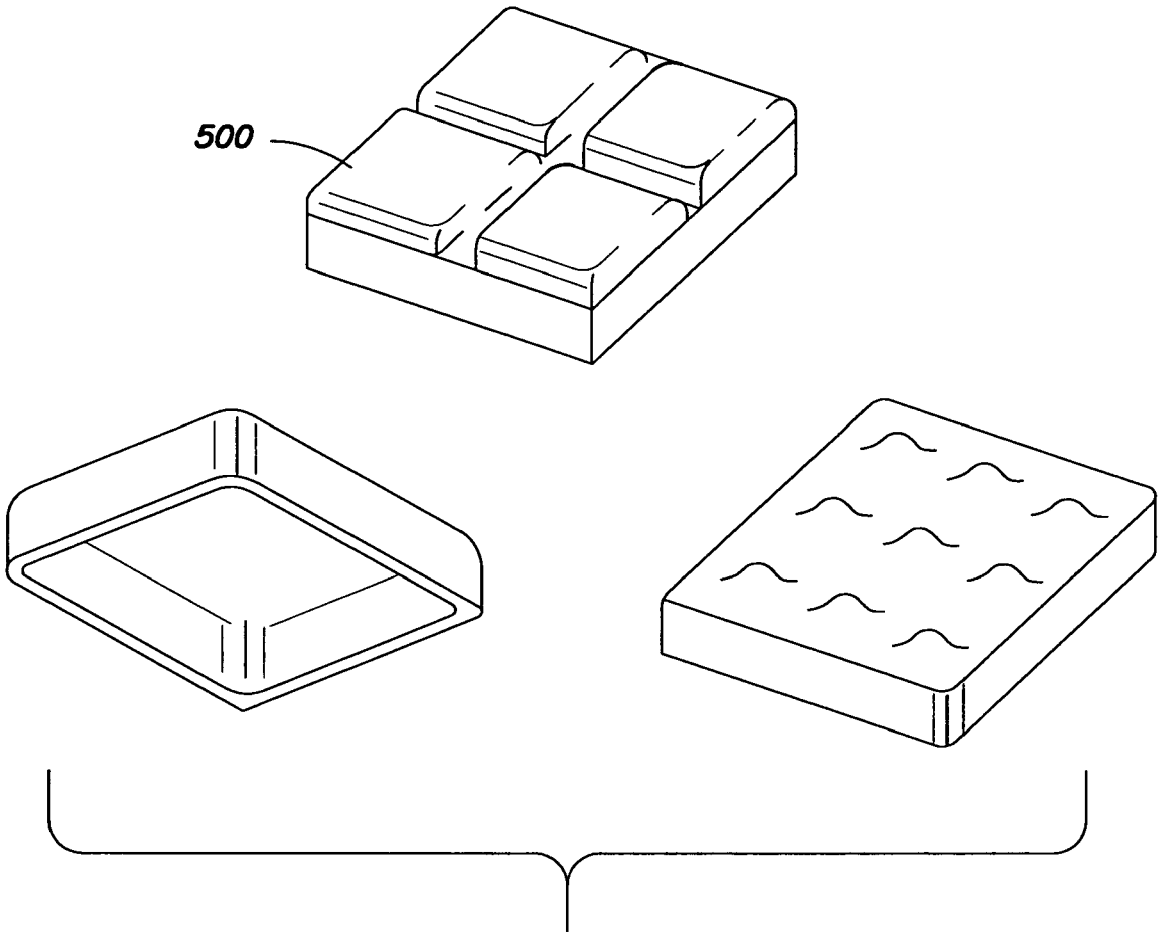
FIG. 19 illustrates additional form factors for a tile lighting unit that is designed to be placed flush on a flat surface.

FIGS. 18 and 19 show diffuse surfaces that form the panels that are designed to be easily formed and molded with conventional manufacturing techniques. Here the tile 500 can be designed to fit flush with a surface 1802, so that it requires no framing on the outside of a multiple unit configuration by going all the way back to the wall with no gaps, exposing wiring and other mechanical aspects of the tile. FIG. 19 shows several embodiments of such tiles 500, with different designs for the diffusing panels.

Figure 20:
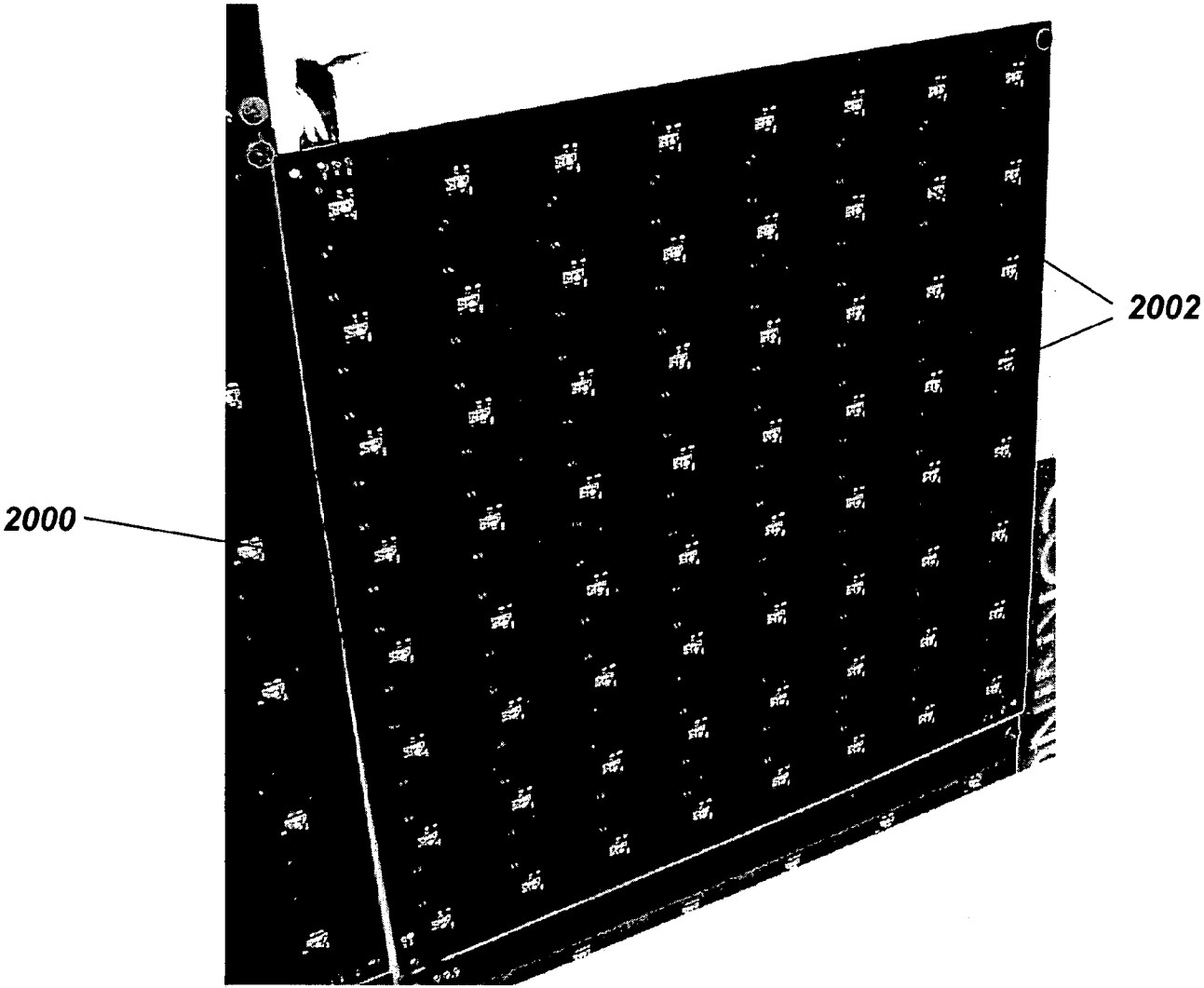
FIG. 20 depicts an array or grid of addressable lighting units that can form the interior of a tile lighting unit.
Figure 21:
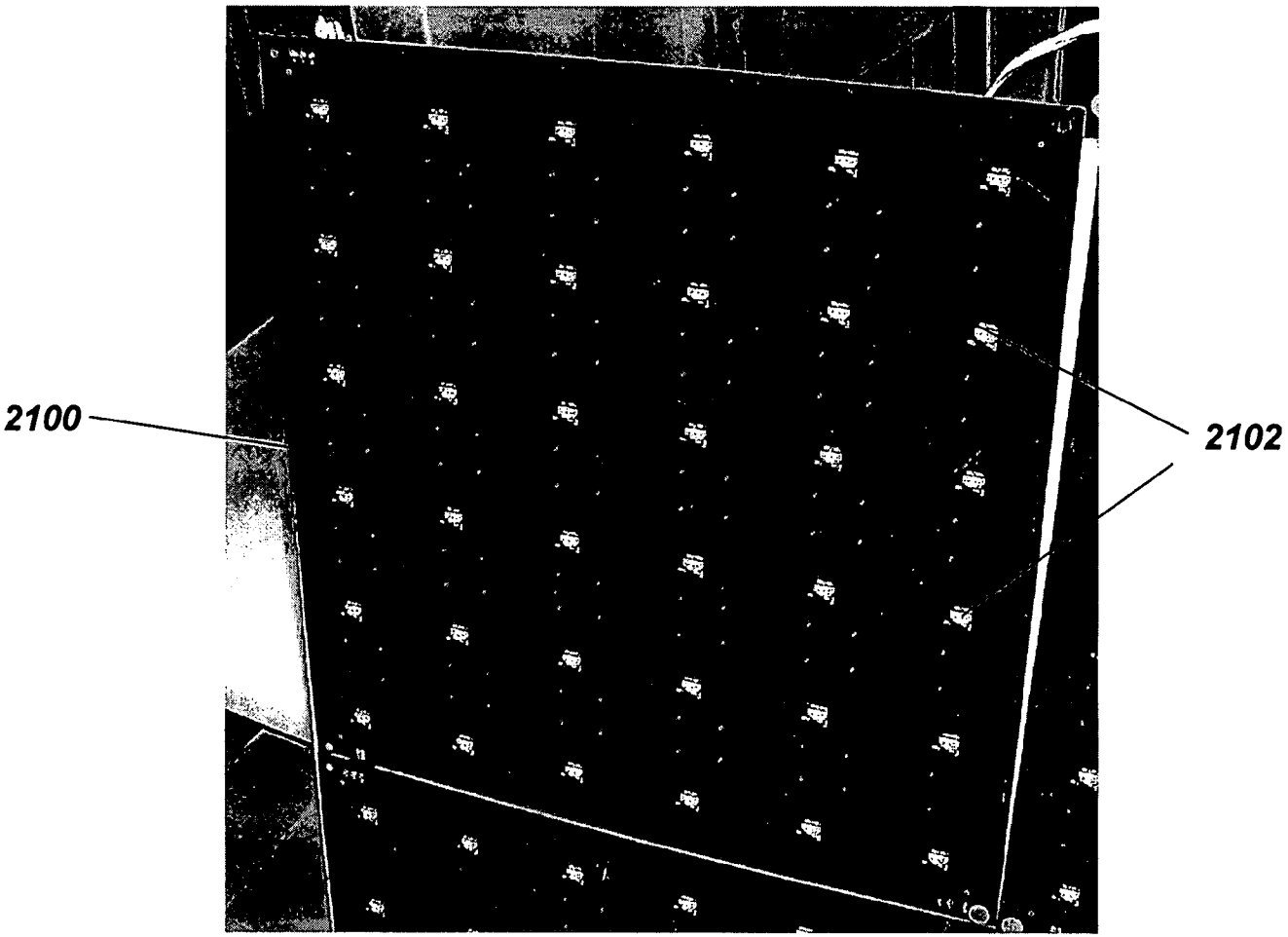
FIG. 21 depicts another embodiment of an array or grid of addressable lighting units for the interior of a tile lighting units.

FIG. 20 shows a configuration 2000 with regular grids of color changing elements 2002, each using an LED package that incorporates a red, a green and a blue LED. Of course other LED colors can be used. The light emitting elements are coupled with an integrated control, power and communications chip or ASIC on the back of the board, which makes the development of arbitrarily shaped configurations a very straightforward process. FIGS. 20 and 21 show two different printed circuit boards 2000, 2100, with different spacing between the lighting elements 2002, 2102. Configuration 2000 is a 6 by 6 array, or 36 units per square foot. Configuration 2100 is an 8 by 8 array, or 64 elements 2102 per square foot. This number can be varying in accordance with particular applications, and there are no limits until the entire space is completely filled with light-emitting elements 2002, 2102. These controlled light boards can be made in any shape. Each node can be made individually controllable, whether by an addressing scheme such as DMX, or more preferably in some embodiments, a string light protocol described elsewhere herein, in which each node receives data in a series and responds to the first unmodified data element in the stream. In this particular embodiment, and RGB cluster is co-located in a single package. When the lighting elements are placed in such a grid configuration, a diffusing panel can be placed directly over the elements, and any shape, symbol, character or the like can be created by authoring signals to each grid element, varying the intensity and color of the grid element. One embodiment is a plurality of boards 204 arranged in a square pattern and covered by a diffuser to form a tile light 500. In embodiments, the control can be object-oriented control, such as in conjunction with a software authoring system as described elsewhere herein. In embodiments the authoring can be a geometric authoring method, such as described elsewhere herein. Thus, effects authored in software, such as Flash animations, can be replicated in the configurations 2000, 2100, then diffused in a diffusing panel, resulting in very pleasing effects, such as explosions of color, chasing rainbows, tie-dye-like effects, and the like. Effects can include scrolling text, graphics, animations, and the like. In embodiments effects can be authored to respond to an input signal 122, such as an incoming video signal, where the individual lighting units 100 that form a grid or array respond to elements of the video signal, such as to represent pixels, or portions of pixels, of the incoming video signal.

Another method of providing a tile 500 uses edge lighting, with one embodiment using a reflective underside or extruded reflector shape.

Figure 22:
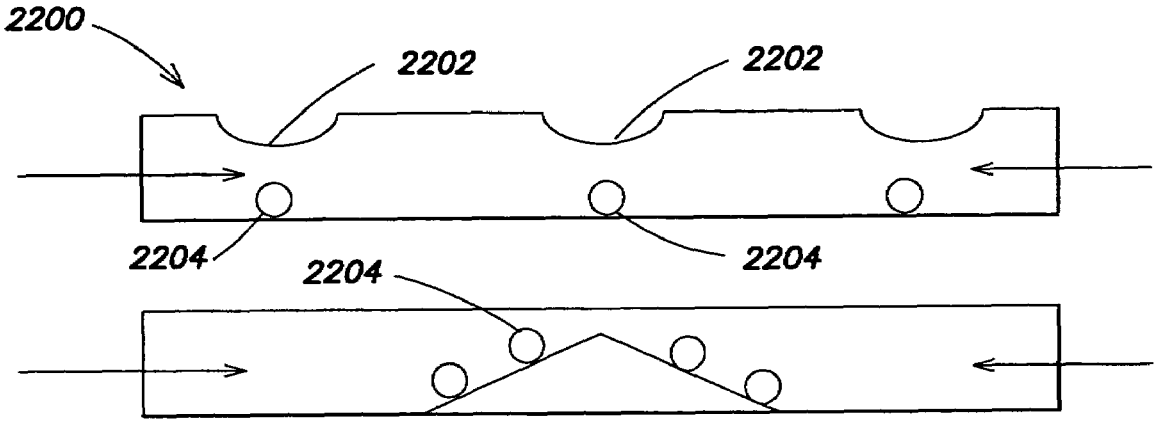
FIG. 22 depicts an embodiment of a diffusing element disposed proximally to an LED lighting unit for diffusing light in a tile lighting unit.

Referring to FIG. 22, another embodiment 2200 uses different physical layers for an effect. The method uses integral LED nodes 2204 with diffusers 2202. Using polygonal PCBs with white solder mask; each node 2204 sits under a bump on the diffuser material 2202. The effect is a number of separately addressable controllable nodes floating in a uniform color field. Light emitting nodes 2204, shown as small circles, emit light upwards into the diffusers 2202, which can have a variety of shapes and textures. This can be in addition to edge lighting units whose light is shown by the horizontal arrows in FIG. 22.

Figure 23:
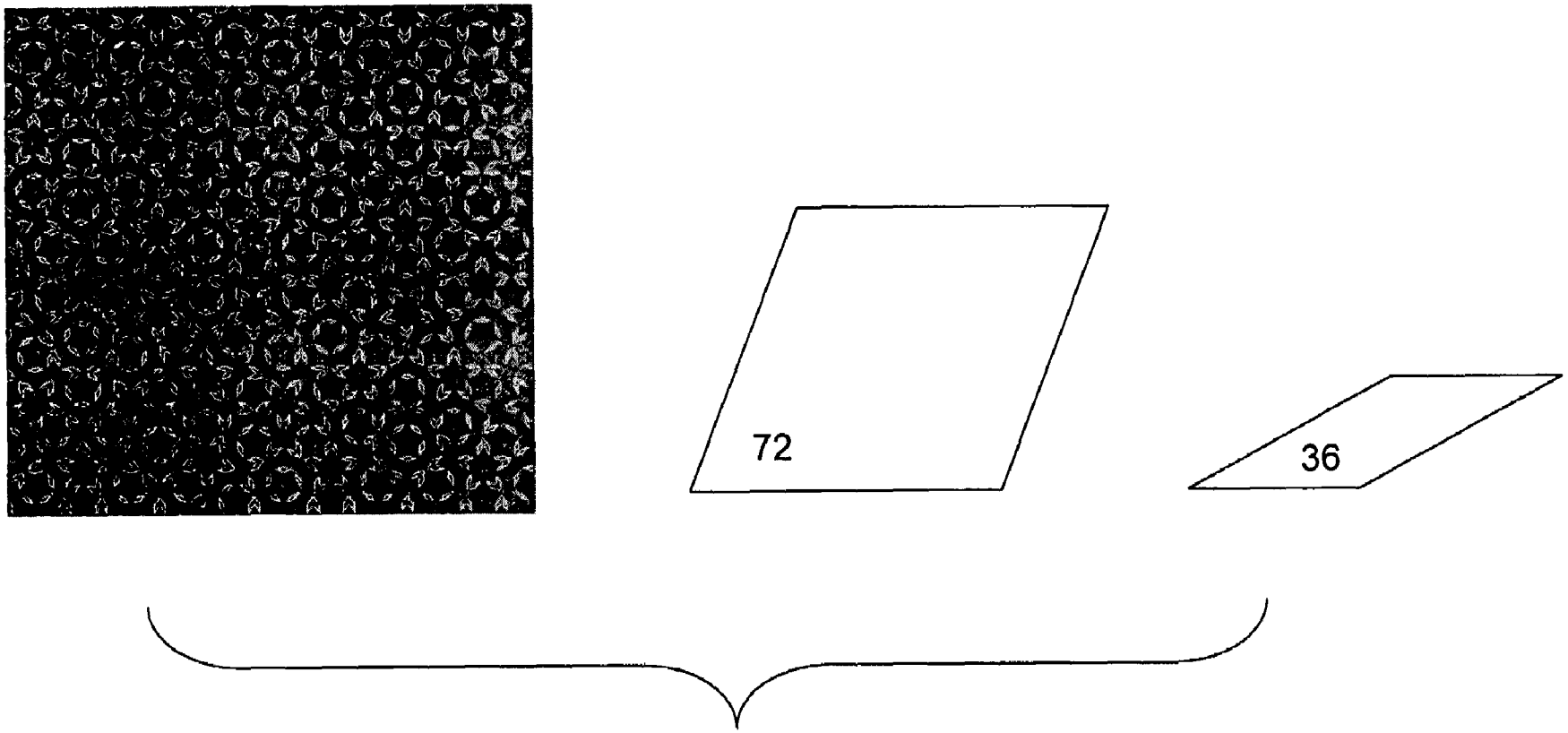
FIG. 23 depicts a Penrose tile configuration for a lighting unit.

Referring to FIG. 23, Penrose tiles are a set of tiles that form no regular pattern no matter how many are used. The patterns are termed aperiodic. The simplest set of two tiles that have this property are the two rhomboids shown in FIG. 23, with all edges of unit length. Tiled surfaces produced with these shapes will, through color control, have some very interesting patterns. These are arrangements of tiles that fill the plane in such a way that there are no regularly recurring patterns. The same-looking cluster of tiles can recur infinitely often, but not evenly spaced apart. Such shapes are discussed in U.S. Pat. No. 4,133,152, which is incorporated by reference, entitled Set of Tiles for Covering a Surface. Other tiles can include versatile tiles that can form both periodic and aperiodic tilings of the plane. These effects can be geometry-based and coupled to other systems such as media (music, video, video and computer games, movies etc).

Having developed a variety of embodiments for relating a lighting unit 100 that has a physical location to an address for the lighting unit 100, whether it be a network address, a unique identifier, or a position within a series or string of lighting unit 100 that pass control signals along to each other, as well as a variety of configurations for lighting units 100, including arrangements of tiles in various geometries, it is further desirable to have facilities for authoring control signals for the lighting units. An example of such an authoring system is a software-based authoring system, such as COLORPLAY™ offered by Color Kinetics Incorporated of Boston, Mass.

An embodiment of this invention relates to systems and methods for generating control signals. While the control signals are disclosed herein in connection with authoring lighting shows and displays for lighting unit 100 in various configurations, it should be understood that the control signals may be used to control any system that is capable of responding to a control signal, whether it be a lighting system, lighting network, light, LED, LED lighting system, audio system, surround sound system, fog machine, rain machine, electromechanical system or other systems. Lighting systems like those described in U.S. Pat. Nos. 6,016,038, 6,150,774, and 6,166,496 illustrate some different types of lighting systems where control signals may be used.

In certain computer applications, there is typically a display screen (which could be a personal computer screen, television screen, laptop screen, handheld, gameboy screen, computer monitor, flat screen display, LCD display, PDA screen, or other display) that represents a virtual environment of some type. There is also typically a user in a real world environment that surrounds the display screen. The present invention relates, among other things, to using a computer application in a virtual environment to generate control signals for systems, such as lighting systems, that are located in real world environments, such as lighting unit 100 positioned in various configurations described above, including linear configurations, arrays, curvilinear configurations, 3D configurations, and other configurations, and in particular including configurations that can be formed by arranging tiles 500 in various two- and three-dimensional configurations.

Figure 24:
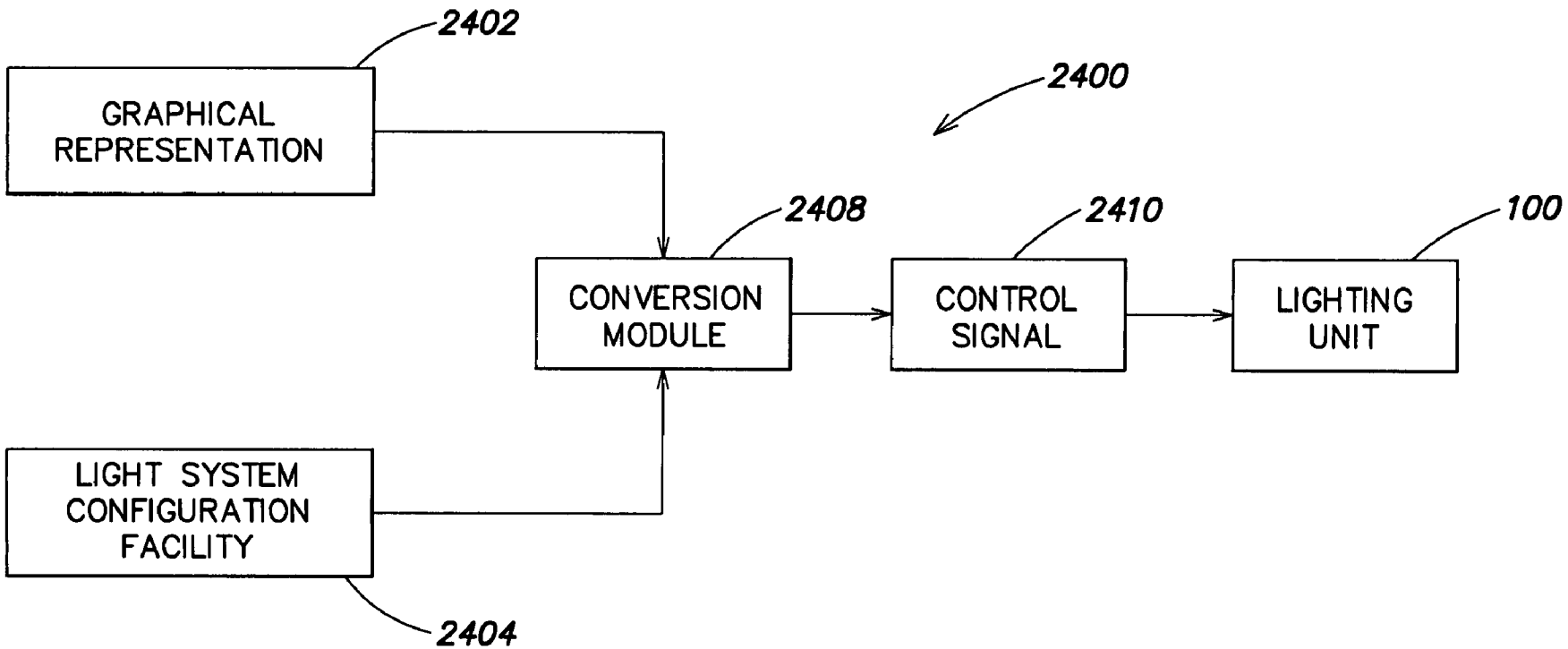
FIG. 24 is a schematic diagram showing elements for authoring a lighting control signal.

An embodiment of the present invention describes a method 2400 for generating control signals as illustrated in the block diagram in FIG. 24. The method may involve providing or generating an image or representation of an image, i.e., a graphical representation 2402. The graphical representation may be a static image such as a drawing, photograph, generated image, or image that is or appears to be static. The static image may include images displayed on a computer screen or other screen even though the image is continually being refreshed on the screen. The static image may also be a hard copy of an image.

Providing a graphical representation 2402 may also involve generating an image or representation of an image. For example, a processor may be used to execute software to generate the graphical representation 2402. Again, the image that is generated may be or appear to be static or the image may be dynamic. An example of software used to generate a dynamic image is Flash 5 computer software offered by Macromedia, Incorporated. Flash 5 is a widely used computer program to generate graphics, images and animations. Other useful products used to generate images include, for example, Adobe Illustrator, Adobe Photoshop, and Adobe LiveMotion. There are many other programs that can be used to generate both static and dynamic images. For example, Microsoft Corporation makes a computer program Paint. This software is used to generate images on a screen in a bit map format. Other software programs may be used to generate images in bitmaps, vector coordinates, or other techniques. There are also many programs that render graphics in three dimensions or more. Direct X libraries, from Microsoft Corporation, for example generate images in three-dimensional space. The output of any of the foregoing software programs or similar programs can serve as the graphical representation 2402. In embodiments the graphical representation may correspond to an incoming video signal, where individual video frames are represented as graphical representations.

In embodiments the graphical representation 2402 may be generated using software executed on a processor, but the graphical representation 2402 may never be displayed on a screen. In an embodiment, an algorithm may generate an image or representation thereof, such as an explosion in a space for example. The explosion function may generate an image and this image may be used to generate control signals as described herein with or without actually displaying the image on a screen. The image may be displayed through a lighting network for example without ever being displayed on a screen.

In an embodiment, generating or representing an image may be accomplished through a program that is executed on a processor. In an embodiment, the purpose of generating the image or representation of the image may be to provide information defined in a space. For example, the generation of an image may define how a lighting effect travels through a space. The lighting effect may represent an explosion, for example. The representation may initiate bright white light in the corner of a grid of tiles 500 and the light may travel away from this corner a velocity (with speed and direction) and the color of the light may change as the propagation of the effect continues. In an embodiment, an image generator may generate a function or algorithm. The function or algorithm may represent an event such as an explosion, lighting strike, headlights, train passing through a space or grid, bullet shot through a space or grid, light moving through a space or grid, sunrise across a space or grid, spinning pinwheel moving around a space or grid, color-chasing rainbow, or other event. The function or algorithm may represent an image such as lights swirling in a space or grid, balls of light bouncing in a space or grid, sounds bouncing in a space, or other images. The function or algorithm may also represent randomly generated effects or other effects. The term "grid" is intended to encompass any two-dimensional arrangement, such as a grid, array, lattice, or similar surface, including such an arrangement that is bent or curved, such as a wall going around a corner. The term "space" is intended to encompass any three-dimensional arrangement.

Referring again to FIG. 24, a light system configuration facility 2404 may accomplish further steps for the methods and systems described herein. The light system configuration facility may generate a system configuration file, configuration data or other configuration information for a lighting system, such as the one depicted in connection with FIG. 1.

The light system configuration facility can represent or correlate a system, such as a lighting unit 100, sound system or other system as described herein with a position or positions in an environment 100. For example, an LED lighting unit 100 may be correlated with a position within a space. In an embodiment, the location of a lighted surface may also be determined for inclusion into the configuration file. The position of the lighted surface may also be associated with a lighting unit 100. In embodiments, the lighted surface 107 may be the desired parameter while the lighting unit 100 that generates the light to illuminate the surface is also important. Lighting control signals may be communicated to a lighting unit 100 when a surface is scheduled to be lit by the lighting unit 100. For example, control signals may be communicated to a lighting system when a generated image calls for a particular section of a space to change in hue, saturation or brightness. In this situation, the control signals may be used to control the lighting system such that the lighted surface 107 is illuminated at the proper time. The lighted surface 107 may be located on a wall but the lighting unit 100 designed to project light onto the surface 107 may be located on the ceiling. The configuration information could be arranged to initiate the lighting unit 100 to activate or change when the surface 107 is to be lit.

Referring still to FIG. 24, the graphical representation 2402 and the configuration information from the light system configuration facility 2404 can be delivered to a conversion module 2408, which associates position information from the configuration facility with information from the graphical representation and converts the information into a control signal 2410, such as a control signal for a lighting unit 100. Then the conversion module can communicate the control signal, such as to the lighting unit 100. In embodiments the conversion module maps positions in the graphical representation to positions of lighting units 100 in the environment, as stored in a configuration file for the environment (as described below). The mapping might be a one-to-one mapping of pixels or groups of pixels in the graphical representation to lighting units 100 or groups of lighting units 100 in the environment 100. It could be a mapping of pixels in the graphical representation to surfaces 107, polygons, or objects in the environment that are lit by lighting units 100. A mapping relation could also map vector coordinate information, a wave function, or an algorithm to positions of lighting units 100. Many different mapping relations can be envisioned and are encompassed herein.

Figure 25:
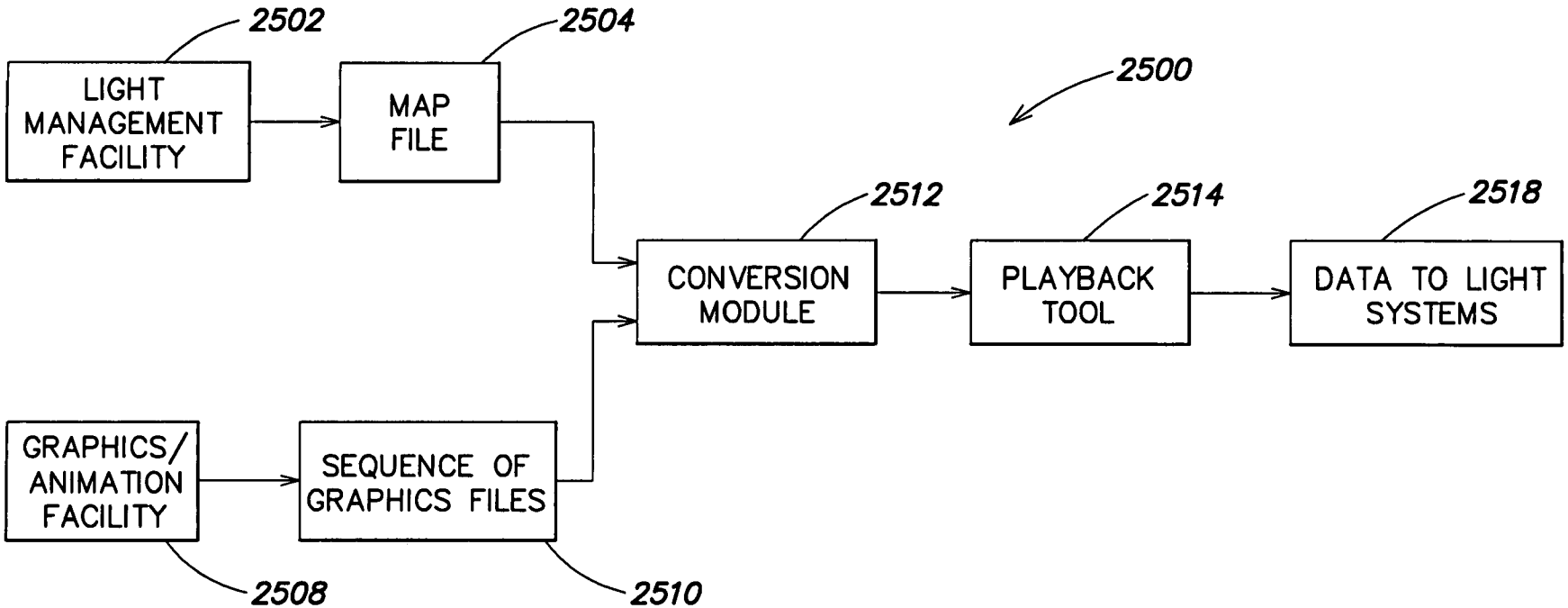
FIG. 25 is a schematic diagram showing elements for generating a lighting control signal from an animation facility and light management facility.

Referring to FIG. 25, another embodiment of a block diagram for a method and system for generating a control signal 2500 is depicted. A light management facility 2502 is used to generate a map file 2504 that maps lighting units 100 to positions in an environment, to surfaces that are lit by the light systems, and the like. An animation facility 2508 generates a sequence of graphics files 2510 for an animation effect. A conversion module 2512 relates the information in the map file 2504 for the lighting units 100 to the graphical information in the graphics files. For example, color information in the graphics file may be used to convert to a color control signal for a lighting unit 100 to generate a similar color. Pixel information for the graphics file may be converted to address information for lighting units 100, which will correspond to the pixels in question. In embodiments, the conversion module 2512 includes a lookup table for converting particular graphics file information into particular lighting control signals, based on the content of a configuration file for the lighting system and conversion algorithms appropriate for the animation facility in question. The converted information can be sent to a playback tool 2514, which may in turn play the animation and deliver control signals 2518 to lighting units 100 in an environment.

Referring to FIG. 26, an embodiment of a configuration file 2600 is depicted, showing certain elements of configuration information that can be stored for a lighting unit 100 or other system. Thus, the configuration file 2600 can store an identifier 2602 for each lighting unit 100, as well as the position 2608 of that light system in a desired coordinate or mapping system for the environment 100 (which may be (x,y,z) coordinates, polar coordinates, (x,y) coordinates, or the like). The position 2608 and other information may be time-dependent, so the configuration file 2600 can include an element of time 2604. The configuration file 2600 can also store information about the position 2610 that is lit by the lighting unit 100. That information can consist of a set of coordinates, or it may be an identified surface, polygon, object, or other item in the environment. The configuration file 2600 can also store information about the available degrees of freedom for use of the lighting unit 100, such as available colors in a color range 2612, available intensities in an intensity range 2614, or the like. The configuration file 2600 can also include information about other systems in the environment that are controlled by the control systems 2618 disclosed herein, information about the characteristics of surfaces 107 in the environment, and the like. Thus, the configuration file 2600 can map a set of lighting units 100 to the conditions that they are capable of generating in an environment 100.

Figure 27:
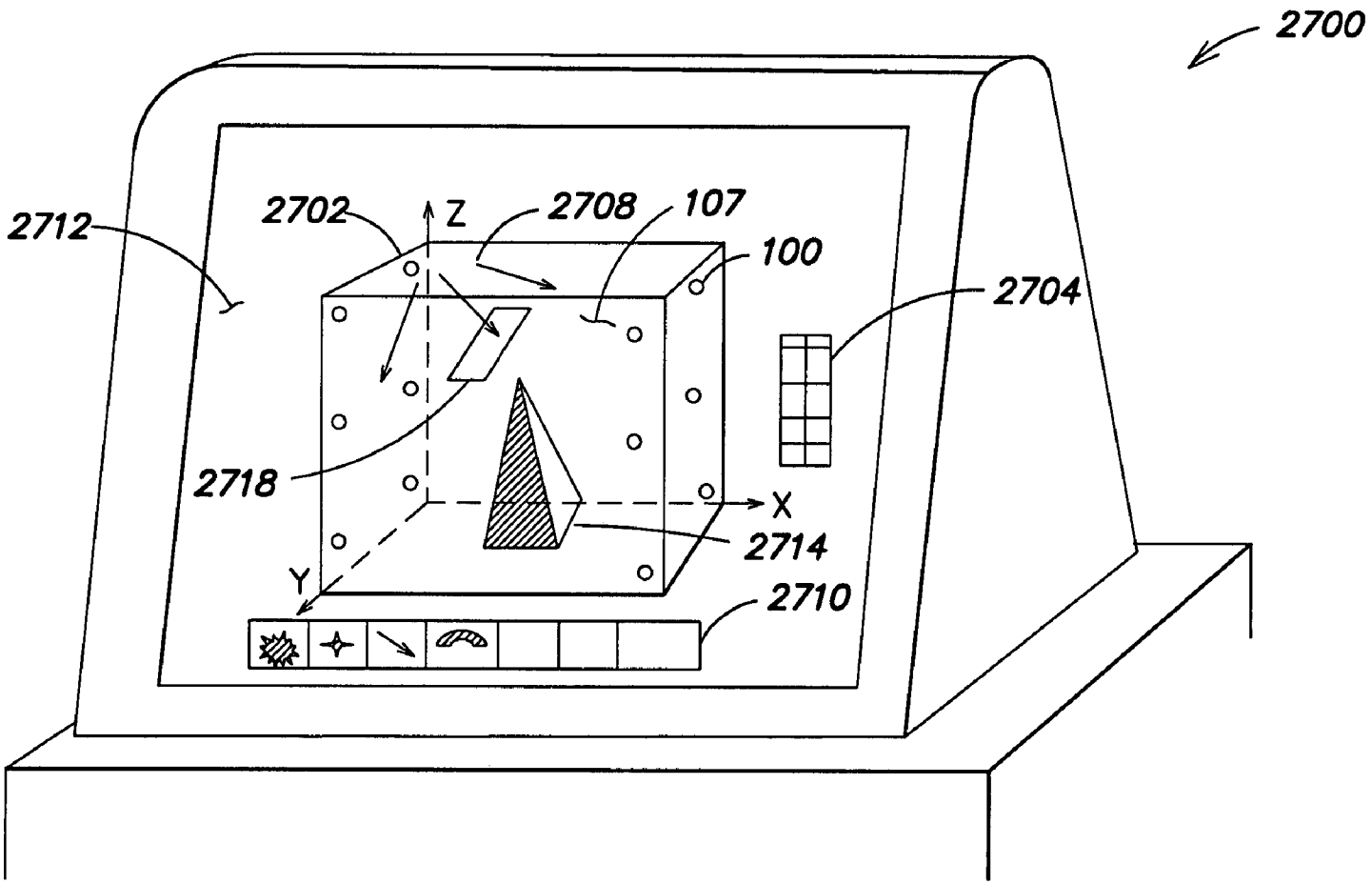
FIG. 27 illustrates a virtual representation of an environment using a computer screen.
Figure 28:
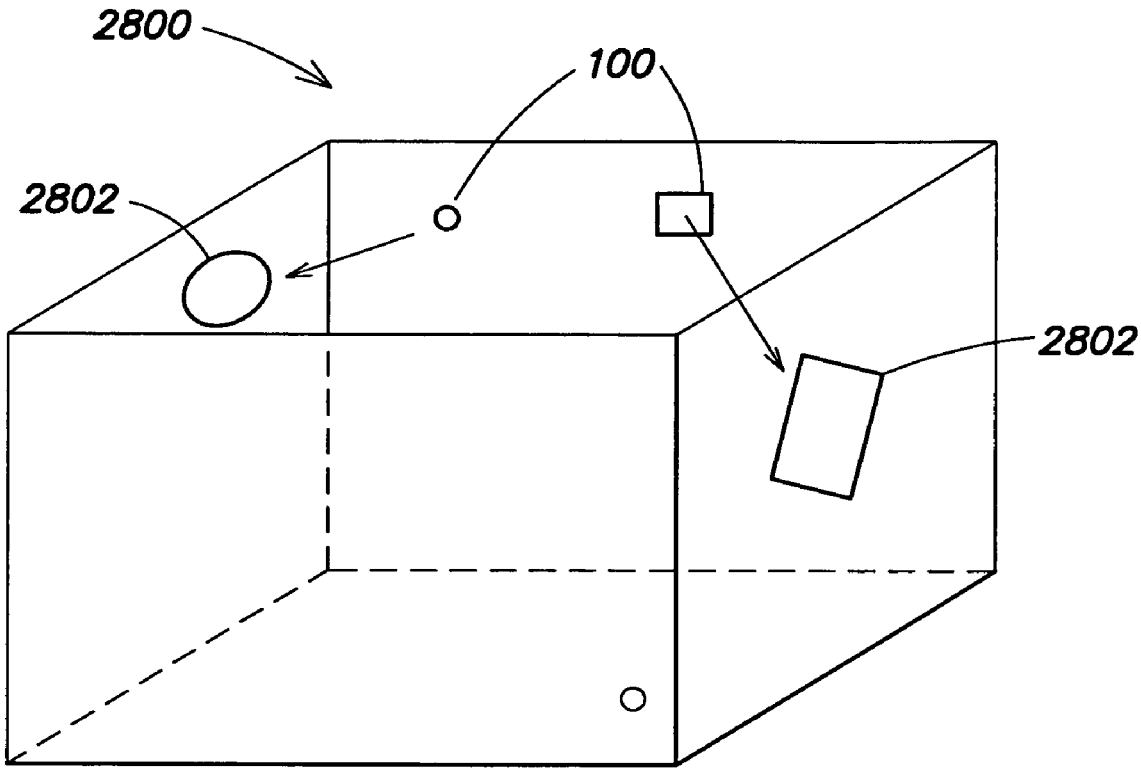
FIG. 28 is a representation of an environment with light systems that project light onto portions of the environment.

In an embodiment, configuration information such as the configuration file 2600 may be generated using a program executed on a processor. Referring to FIG. 27, the program may run on a computer 2700 with a graphical user interface 2712 where a representation of an environment 2702 can be displayed, showing lighting units 100, lit surfaces 107 or other elements in a graphical format. The interface may include a representation 2702 of a space for example. Representations of lights, lighted surfaces or other systems may then be presented in the interface 2712 and locations can be assigned to the system. In an embodiment, position coordinates or a position map may represent a system, such as a light system. A position map may also be generated for the representation of a lighted surface for example. FIG. 27 illustrates a space with lighting units 100. In other embodiments, the lighting units 100 could be positioned on the exterior of a building, in windows of a building, or the like.

The representation 2702 can also be used to simplify generation of effects. For example, a set of stored effects can be represented by icons 2710 on the screen 2712. An explosion icon can be selected with a cursor or mouse, which may prompt the user to click on a starting and ending point for the explosion in the coordinate system. By locating a vector in the representation, the user can cause an explosion to be initiated in the upper corner of the space 2702 and a wave of light and or sound may propagate through the environment. With all of the lighting units 100 in predetermined positions, as identified in the configuration file 2600, the representation of the explosion can be played in the space by the light system and or another system such as a sound system.

In use, a control system such as used herein can be used to provide information to a user or programmer from the lighting units 100 in response to or in coordination with the information being provided to the user of the computer 2700. One example of how this can be provided is in conjunction with the user generating a computer animation on the computer 2700. The lighting unit 100 may be used to create one or more light effects in response to displays 2712 on the computer 2700. The lighting effects, or illumination effects, can produce a vast variety of effects including color-changing effects; stroboscopic effects; flashing effects; coordinated lighting effects; lighting effects coordinated with other media such as video or audio; color wash where the color changes in hue, saturation or intensity over a period of time; creating an ambient color; color fading; effects that simulate movement such as a color chasing rainbow, a flare streaking across a space, a sun rising, a plume from an explosion, other moving effects; and many other effects. The effects that can be generated are nearly limitless. Light and color continually surround the user, and controlling or changing the illumination or color in a space can change emotions, create atmosphere, provide enhancement of a material or object, or create other pleasing and or useful effects. The user of the computer 2700 can observe the effects while modifying them on the display 2712, thus enabling a feedback loop that allows the user to conveniently modify effects.

In an embodiment, the information generated to form the image or representation may be communicated to a lighting unit 100 or plurality of lighting units 100. The information may be sent to lighting systems as generated in a configuration file. For example, the image may represent an explosion that begins in the upper right hand corner of a space and the explosion may propagate through the space. As the image propagates through its calculated space, control signals can be communicated to lighting systems in the corresponding space. The communication signal may cause the lighting system to generate light of a given hue, saturation and intensity when the image is passing through the lighted space the lighting systems projects onto. An embodiment of the invention projects the image through a lighting system. The image may also be projected through a computer screen or other screen or projection device. In an embodiment, a screen may be used to visualize the image prior or during the playback of the image on a lighting system. In an embodiment, sound or other effects may be correlated with the lighting effects. For example, the peak intensity of a light wave propagating through a space may be just ahead of a sound wave. As a result, the light wave may pass through a space followed by a sound wave. The light wave may be played back on a lighting system and the sound wave may be played back on a sound system. This coordination can create effects that appear to be passing through a space or they can create various other effects.

Referring to FIG. 27, an effect can propagate through a virtual environment that is represented in 3D on the display screen 2712 of the computer 2700. In embodiments, the effect can be modeled as a vector or plane moving through space over time. Thus, all lighting units 100 that are located on the plane of the effect in the real world environment can be controlled to generate a certain type of illumination when the effect plane propagates through the light system plane. This can be modeled in the virtual environment of the display screen, so that a developer can drag a plane through a series of positions that vary over time. For example, an effect plane 2718 can move with the vector 2708 through the virtual environment. When the effect plan 2718 reaches a polygon 2714, the polygon can be highlighted in a color selected from the color palette 2704. A lighting unit 100 positioned on a real world object that corresponds to the polygon can then illuminate in the same color in the real world environment. Of course, the polygon could be any configuration of light systems on any object, plane, surface, wall, or the like, so the range of 3D effects that can be created is unlimited.

In an embodiment, the image information may be communicated from a central controller. The information may be altered before a lighting system responds to the information. For example, the image information may be directed to a position within a position map. All of the information directed at a position map may be collected prior to sending the information to a lighting system. This may be accomplished every time the image is refreshed or every time this section of the image is refreshed or at other times. In an embodiment, an algorithm may be performed on information that is collected. The algorithm may average the information, calculate and select the maximum information, calculate and select the minimum information, calculate and select the first quartile of the information, calculate and select the third quartile of the information, calculate and select the most used information calculate and select the integral of the information or perform another calculation on the information. This step may be completed to level the effect of the lighting system in response to information received. For example, the information in one refresh cycle may change the information in the map several times and the effect may be viewed best when the projected light takes on one value in a given refresh cycle.

In an embodiment, the information communicated to a lighting system may be altered before a lighting system responds to the information. The information format may change prior to the communication for example. The information may be communicated from a computer through a USB port or other communication port and the format of the information may be changed to a lighting protocol such as DMX when the information is communicated to the lighting system. In an embodiment, the information or control signals may be communicated to a lighting system or other system through a communications port of a computer, portable computer, notebook computer, personal digital assistant or other system. The information or control signals may also be stored in memory, electronic or otherwise, to be retrieved at a later time. Systems such the iPlayer and SmartJack systems manufactured and sold by Color Kinetics Incorporated can be used to communicate and or store lighting control signals.

In an embodiment, several systems may be associated with position maps and the several systems may a share position map or the systems may reside in independent position areas. For example, the position of a lighted surface from a first lighting system may intersect with a lighted surface from a second lighting system. The two systems may still respond to information communicated to the either of the lighting systems. In an embodiment, the interaction of two lighting systems may also be controlled. An algorithm, function or other technique may be used to change the lighting effects of one or more of the lighting systems in a interactive space. For example, if the interactive space is greater than half of the non-interactive space from a lighting system, the lighting system's hue, saturation or brightness may be modified to compensate the interactive area. This may be used to adjust the overall appearance of the interactive area or an adjacent area for example.

In an embodiment, the lighting effects could also be coupled to sound that will add to and reinforce the lighting effects. An example is a 'red alert' sequence where a 'whoop whoop' siren-like effect is coupled with the lighting unit 100 pulsing red in concert with the sound. One stimulus reinforces the other. Sounds and movement of an earthquake using low frequency sound and flickering lights is another example of coordinating these effects. Movement of light and sound can be used to indicate direction.

In an embodiment the lights are represented in a two-dimensional or plan view. This allows representation of the lights in a plane where the lights can be associated with various pixels. Standard computer graphics techniques can then be used for effects. Animation tweening and even standard tools may be used to create lighting effects. Macromedia Flash works with relatively low-resolution graphics for creating animations on the web. Flash uses simple vector graphics to easily create animations. The vector representation is efficient for streaming applications such as on the World Wide Web for sending animations over the net. The same technology can be used to create animations that can be used to derive lighting commands by mapping the pixel information or vector information to vectors or pixels that correspond to positions of lighting units 100 within a coordinate system for an environment 100.

For example, an animation window of a computer 2700 can represent a space or other environment of the lights. Pixels in that window can correspond to lights within the space or a low-resolution averaged image can be created from the higher resolution image. In this way lights in the space can be activated when a corresponding pixel or neighborhood of pixels turn on. Because LED-based lighting technology can create any color on demand using digital control information, see U.S. Pat. Nos. 6,016,038, 6,150,774, and 6,166,496, the lights can faithfully recreate the colors in the original image.

Some examples of effects that could be generated using systems and methods according to the principles of the invention include, but are not limited to, explosions, colors, underwater effects, turbulence, color variation, fire, missiles, chases, rotation of a space, shape motion, Tinkerbell-like shapes, lights moving in a space, and many others. Any of the effects can be specified with parameters, such as frequencies, wavelengths, wave widths, peak-to-peak measurements, velocities, inertia, friction, speed, width, spin, vectors, and the like. Any of these can be coupled with other effects, such as sound.

In computer graphics, anti-aliasing is a technique for removing staircase effects in imagery where edges are drawn and resolution is limited. This effect can be seen on television when a narrow striped pattern is shown. The edges appear to crawl like ants as the lines approach the horizontal. In a similar fashion, the lighting can be controlled in such a way as to provide a smoother transition during effect motion. The effect parameters such as wave width, amplitude, phase or frequency can be modified to provide better effects.

Figure 29:
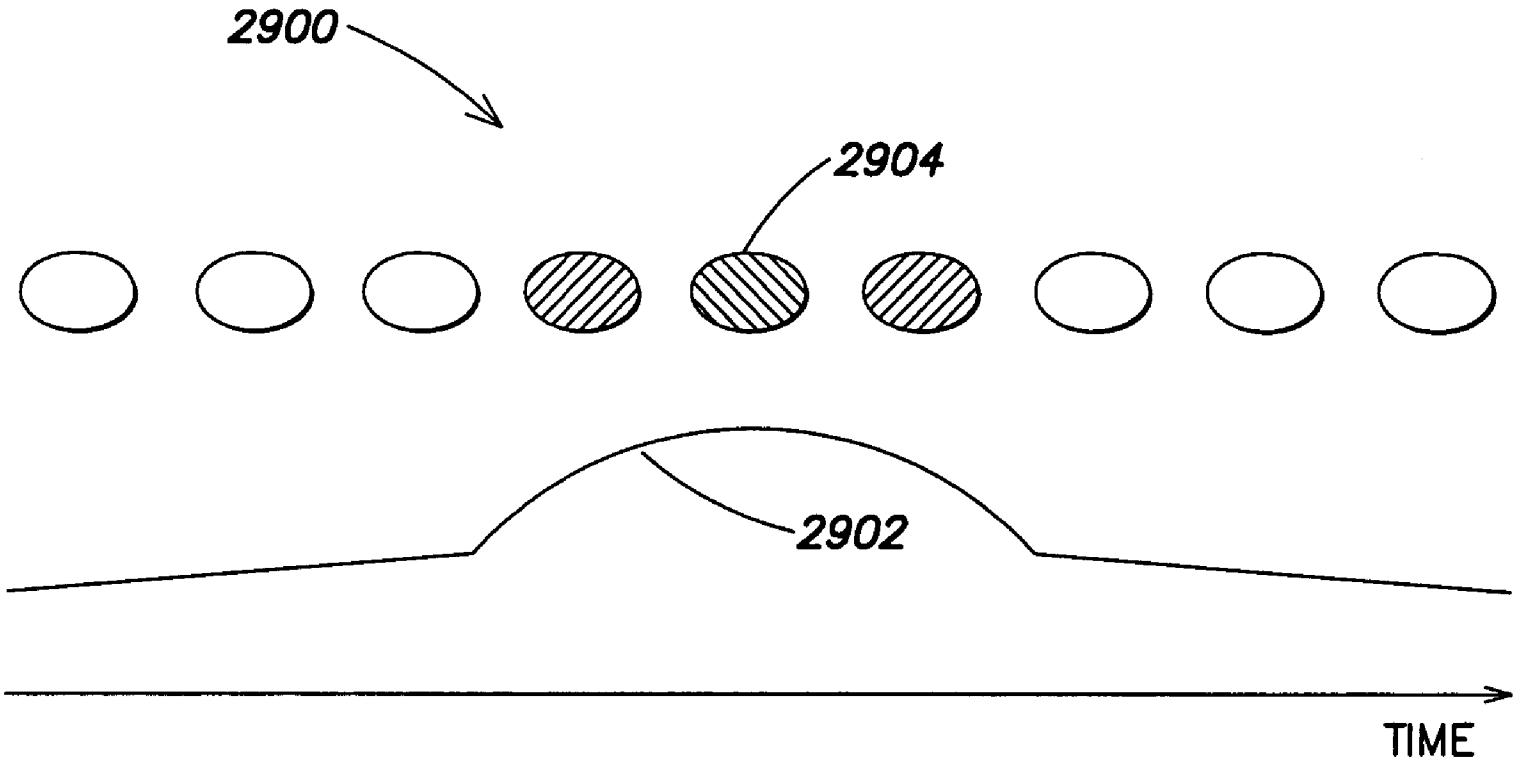
FIG. 29 is a schematic diagram showing the propagation of an effect through a light system.

For example, referring to FIG. 29, a schematic diagram 2900 has circles that represent a single light 2904 over time. For an effect to 'traverse' this light, it might simply have a step function that causes the light to pulse as the wave passes through the light. However, without the notion of width, the effect might be indiscernible. The effect preferably has width. If however, the effect on the light was simply a step function that turned on for a period of time, then might appear to be a harsh transition, which may be desirable in some cases but for effects that move over time (i.e. have some velocity associated with them) then this would not normally be the case.

The wave 2902 shown in FIG. 29 has a shape that corresponds to the change. In essence it is a visual convolution of the wave 2902 as it propagates through a space. So as a wave, such as from an explosion, moves past points in space, those points rise in intensity from zero, and can even have associated changes in hue or saturation, which gives a much more realistic effect of the motion of the effect. At some point, as the number and density of lights increases, the space then becomes an extension of the screen and provides large sparse pixels. Even with a relatively small number of lighting units 100 the effect eventually can serve as a display similar to a large screen display.

Effects can have associated motion and direction, i.e. a velocity. Even other physical parameters can be described to give physical parameters such as friction, inertia, and momentum. Even more than that, the effect can have a specific trajectory. In an embodiment, each light may have a representation that gives attributes of the light. This can take the form of 2D position, for example. A lighting unit 100 can have all various degrees of freedom assigned (e.g., xyz-rpy), or any combination.

The techniques listed here are not limited to lighting. Control signals can be propogated through other devices based on their positions, such as special effects devices such as pyrotechnics, smell-generating devices, fog machines, bubble machines, moving mechanisms, acoustic devices, acoustic effects that move in space, or other systems.

Figure 30:
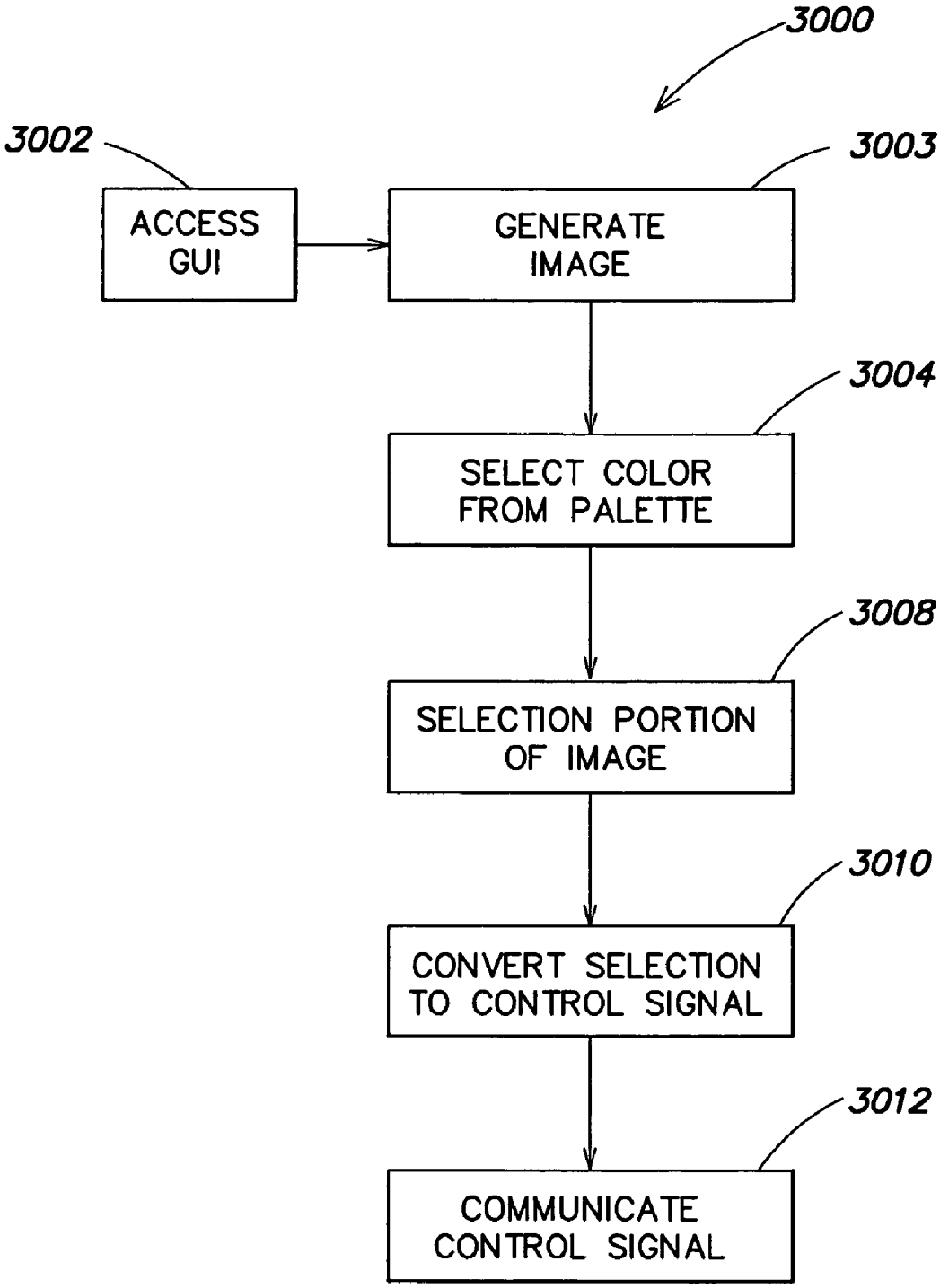
FIG. 30 is a flow diagram showing steps for using an image capture device to determine the positions of a plurality of light systems in an environment.

Another embodiment of the invention is depicted in FIG. 30, which contains a flow diagram 3000 with steps for generating a control signal. First, at a step 3002 a user can access a graphical user interface, such as the display 2712 depicted in FIG. 27. Next, at a step 3003, the user can generate an image on the display, such as using a graphics program or similar facility. The image can be a representation of an environment, such as a room, space, wall, building, surface, object, or the like, in which lighting units 100 are disposed. It is assumed in connection with FIG. 30 that the configuration of the lighting units 100 in the environment is known and stored, such as in a table or configuration file 2600. Of course similar information could be stored simply by knowing the ordinal position of a lighting unit 100, such as its position along a string of lights in a string light protocol (which in turn could be used to form a grid by stringing the grid in a particular order). Next, at a step 3004, a user can select an effect, such as from a menu of effects. In an embodiment, the effect may be a color selected from a color palette. The color might be a color temperature of white. The effect might be another effect, such as described herein. In an embodiment, generating the image 3003 may be accomplished through a program executed on a processor. The image may then be displayed on a computer screen. Once a color is selected from the palette at the step 3004, a user may select a portion of the image at a step 3008. This may be accomplished by using a cursor on the screen in a graphical user interface where the cursor is positioned over the desired portion of the image and then the portion is selected with a mouse. Following the selection of a portion of the image, the information from that portion can be converted to lighting control signals at a step 3010. This may involve changing the format of the bit stream or converting the information into other information. The information that made the image may be segmented into several colors such as red, green, and blue. The information may also be communicated to a lighting system in, for example, segmented red, green, and blue signals. The signal may also be communicated to the lighting system as a composite signal at a step 3012. This technique can be useful for changing the color of a lighting system. For example, a color palette may be presented in a graphical user interface and the palette may represent millions of different colors. A user may want to change the lighting in a space or other area to a deep blue. To accomplish her task, the user can select the color from the screen using a mouse and the lighting in the space changes to match the color of the portion of the screen she selected. Generally, the information on a computer screen is presented in small pixels of red, green and blue. LED systems, such as those found in U.S. Pat. Nos. 6,016,038, 6,150,774 and 6,166,496, may include red, green and blue lighting elements as well. The conversion process from the information on the screen to control signals may be a format change such that the lighting system understands the commands. However, in an embodiment, the information or the level of the separate lighting elements may be the same as the information used to generate the pixel information. This provides for an accurate duplication of the pixel information in the lighting system.

Using the techniques described herein, including techniques for determining positions of light systems in environments, techniques for modeling effects in environments (including time- and geometry-based effects), and techniques for mapping light system environments to virtual environments, it is possible to model an unlimited range of effects in an unlimited range of environments. Effects need not be limited to those that can be created on a square or rectangular display, such as the tile 500. Instead, light systems can be disposed in a wide range of lines, strings, curves, polygons, cones, cylinders, cubes, spheres, hemispheres, non-linear configurations, clouds, and arbitrary shapes and configurations, then modeled in a virtual environment that captures their positions in selected coordinate dimensions. Thus, light systems can be disposed in or on the interior or exterior of any environment, such as a room, space, building, home, wall, object, product, retail store, vehicle, ship, airplane, pool, spa, hospital, operating space, or other location.

In embodiments, the light system may be associated with code for the computer application, so that the computer application code is modified or created to control the light system. For example, object-oriented programming techniques can be used to attach attributes to objects in the computer code, and the attributes can be used to govern behavior of the light system. Object oriented techniques are known in the field, and can be found in texts such as "Introduction to Object-Oriented Programming" by Timothy Budd, the entire disclosure of which is herein incorporated by reference. It should be understood that other programming techniques may also be used to direct lighting systems to illuminate in coordination with computer applications, object oriented programming being one of a variety of programming techniques that would be understood by one of ordinary skill in the art to facilitate the methods and systems described herein.

In an embodiment, a developer can attach the light system inputs to objects in the computer application. For example, the developer may have an abstraction of a lighting unit 100 that is added to the code construction, or object, of an application object. An object may consist of various attributes, such as position, velocity, color, intensity, or other values. A developer can add light as an instance in the object in the code of a computer application. For example, the object could be vector in an object-oriented computer animation program or solid modeling program, with attributes, such as direction and velocity. A lighting unit 100 can be added as an instance of the object of the computer application, and the light system can have attributes, such as intensity, color, and various effects. Thus, when events occur in the computer application that call on the object of the vector, a thread running through the program can draw code to serve as an input to the processor of the light system. The light can accurately represent geometry, placement, spatial location, represent a value of the attribute or trait, or provide indication of other elements or objects.

Figure 31:
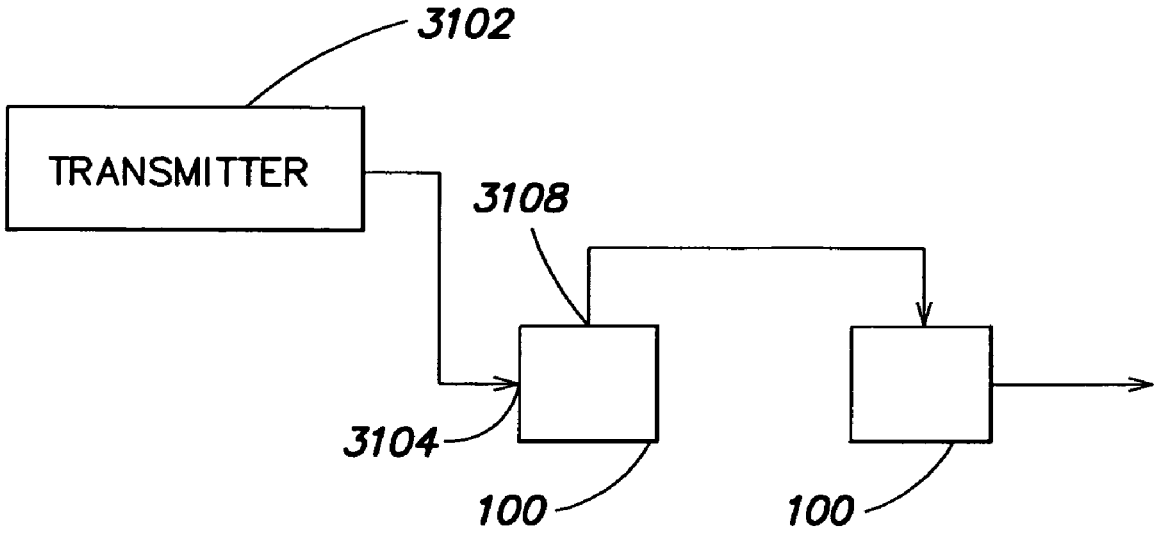
FIG. 31 is a flow diagram showing steps for interacting with a graphical user interface to generate a lighting effect in an environment.

Referring to FIG. 31, in one embodiment of a networked lighting system according to the principles of the invention, a network transmitter 3102 communicates network information to the lighting units 100. In such an embodiment, the lighting units 100 can include an input port 3104 and an export port 3108. The network information may be communicated to the first lighting unit 100 and the first lighting unit 100 may read the information that is addressed to it and pass the remaining portion of the information on to the next lighting unit 100. A person with ordinary skill in the art would appreciate that there are other network topologies that are encompassed by a system according to the principles of the present invention.

Figure 32:
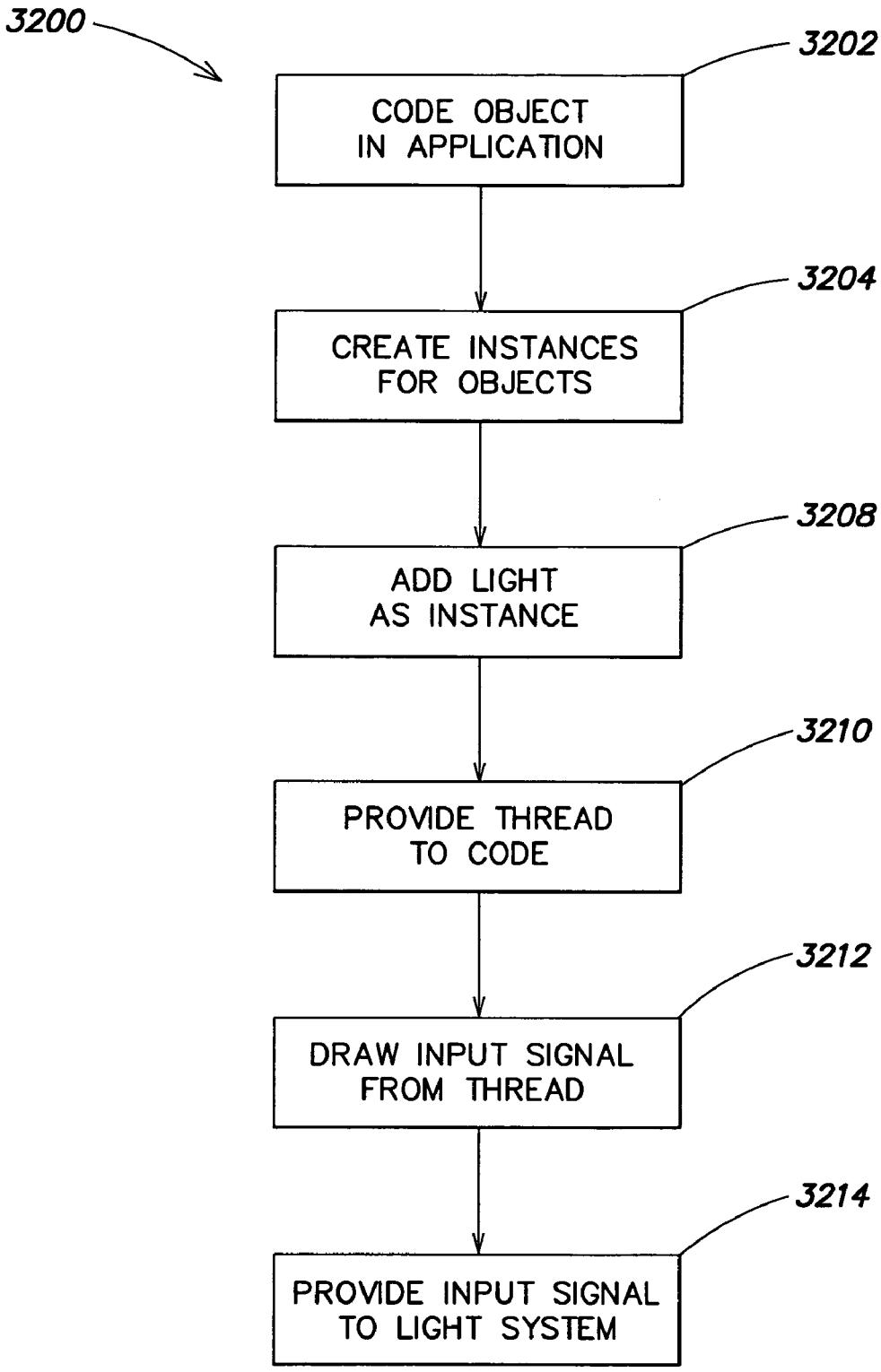
FIG. 32 is a schematic diagram depicting light systems that transmit data that is generated by a network transmitter.

Referring to FIG. 32, a flow chart 3200 provides steps for a method of providing for coordinated illumination. At the step 3202, the programmer codes an object for a computer application, using, for example, object-oriented programming techniques. At a step 3204, the programming creates instances for each of the objects in the application. At a step 3208, the programmer adds light as an instance to one or more objects of the application. At a step 3210, the programmer provides for a thread, running through the application code. At a step 3212, the programmer provides for the thread to draw lighting system input code from the objects that have light as an instance. At a step 3214, the input signal drawn from the thread at the step 3212 is provided to the light system, so that the lighting system responds to code drawn from the computer application.

Using such object-oriented light input to the lighting unit 100 from code for a computer application, various lighting effects can be associated in the real world environment with the virtual world objects of a computer application. For example, in animation of an effect such as explosion of a polygon, a light effect can be attached with the explosion of the polygon, such as sound, flashing, motion, vibration and other temporal effects. Further, the lighting unit 100 could include other effects devices including sound producing devices, motion producing devices, fog machines, rain machines or other devices which could also produce indications related to that object.

Figure 33:
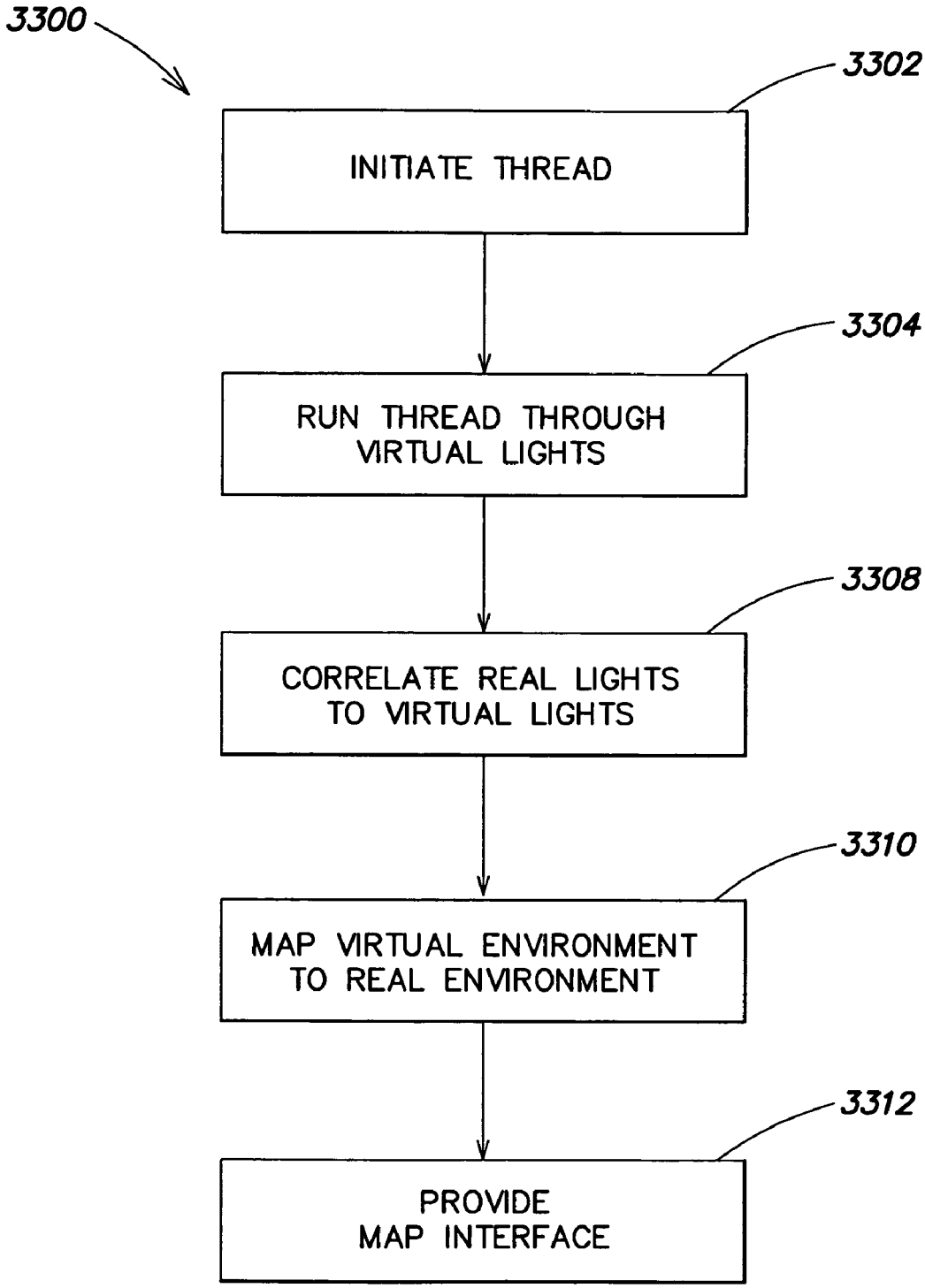
FIG. 33 is a flow diagram showing steps for generating a control signal for a light system using an object-oriented programming technique.

Referring to FIG. 33, a flow diagram 3300 depicts steps for coordinated illumination between a representation on virtual environment of a computer screen and a lighting unit 100 or set of lighting units 100 in a real environment. In embodiments, program code for control of the lighting unit 100 has a separate thread running on the machine that provides its control signals. At a step 3302 the program initiates the thread. At a step 3304 the thread as often as possible runs through a list of virtual lights, namely, objects in the program code that represent lights in the virtual environment. At a step 3308 the thread does three-dimensional math to determine which real-world lighting units 100 in the environment are in proximity to a reference point in the real world (e.g., is a selected surface 107) that is projected as the reference point of the coordinate system of objects in the virtual environment of the computer representation. Thus, the (0,0,0) position can be a location in a real environment and a point on the screen in the display of the computer application (for instance the center of the display. At a step 3310, the code maps the virtual environment to the real world environment, including the lighting units 100, so that events happening outside the computer screen are similar in relation to the reference point as are virtual objects and events to a reference point on the computer screen. In embodiments the virtual world is two-dimensional, so that a two-dimensional real world grid, such as formed of tiles 500, is represented by two-dimensional object in the virtual environment. In other cases the virtual world represents three-dimensional objects, such as spaces or polygons, in the real world. Such three-dimensional objects include those formed of two-dimensional objects, such as tiles 500.

At a step 3312, the host of the method may provide an interface for mapping. The mapping function may be done with a function, e.g., "project-all-lights," as described in the Directlight API described herein below, that maps real world lights using a simple user interface, such as drag and drop interface. In some embodiments, the placement of the lights may not be as important as the surface the lights are directed towards. It may be this surface that reflects the illumination or lights back to the environment and as a result it may be this surface that is the most important for the mapping program. The mapping program may map these surfaces rather than the light system locations or it may also map both the locations of the light systems and the light on the surface.

A system for providing the code for coordinated illumination may be any suitable computer capable of allowing programming, including a processor, an operating system, and memory, such as a database, for storing files for execution.

Each real lighting unit 100 may have attributes that are stored in a configuration file. An example of a structure for a configuration file is depicted in FIG. 26. In embodiments, the configuration file may include various data, such as a light number, a position of each light, the position or direction of light output, the gamma (brightness) of the light, an indicator number for one or more attributes, and various other attributes. By changing the coordinates in the configuration file, the real world lights can be mapped to the virtual world represented on the screen in a way that allows them to reflect what is happening in the virtual environment. The developer can thus create time-based effects, such as an explosion. There can then be a library of effects in the code that can be attached to various application attributes. Examples include explosions, rainbows, color chases, fades in and out, etc. The developer attaches the effects to virtual objects in the application. For example, when an explosion is done, the light goes off in the display, reflecting the destruction of the object that is associated with the light in the configuration file.

To simplify the configuration file, various techniques can be used. In embodiments, hemispherical cameras, sequenced in turn, can be used as a baseline with scaling factors to triangulate the lights and automatically generate a configuration file without ever having to measure where the lights are. In embodiments, the configuration file can be typed in, or can be put into a graphical user interface that can be used to drag and drop light sources onto a representation of an environment. The developer can create a configuration file that matches the fixtures with true placement in a real environment. For example, once the lighting elements are dragged and dropped in the environment, the program can associate the virtual lights in the program with the real lights in the environment. An example of a light authoring program to aid in the configuration of lighting is included in U.S. patent application Ser. No. 09/616,214 "Systems and Methods for Authoring Lighting Sequences." Color Kinetics Inc. also offers a suitable authoring and configuration program called "ColorPlay."

Further details as to one implementation of authoring code can be found in the Directlight API described below.

Directlight API is an example of a programmer's interface that allows a programmer to incorporate lighting effects into a program. Object oriented programming is just one example of a programming technique used to incorporate lighting effects. Lighting effects could be incorporated into any programming language or method of programming. In object oriented programming, the programmer is often simulating a 2D or 3D space.

In the above examples, lights were used to indicate the position of objects which produce the expected light or have light attached to them. There are many other ways in which light can be used. The lights in the light system can be used for a variety of purposes, such as to indicate events in a computer application (such as a game), or to indicate levels or attributes of objects.

Having appreciated that a computer screen or similar facility can be used to represent a configuration of lighting units 100 in an environment, and having appreciated that the representation of the lighting units 100 can be linked to objects in an objected-oriented program that generates control signals for the lighting units 100 that correspond to events and attributes of the representation in the virtual world, one can understand that the control signals for lighting units 100 can be linked not only to a graphical representation for purposes of authoring lighting shows, but to graphical representations that are created for other purposes, such as entertainment purposes, as well as to other signals and data sources that can be represented graphically, and thus in turn represented by lighting units 100 in an environment. For example, music can be represented graphically, such as by a graphic equalizer that appears on a display, such as a consumer electronics display or a computer display screen. The graphical representation of the music can in turn be converted into an authoring signal for lighting units 100, in the same way that a scripted show can be authored in a software authoring tool. Thus, any kind of signal or information that can be presented graphically can be translated into a representation on a lighting unit 100, using signal generating facilities similar to those described above, coupled with addressing and configuration facilities described above that translate real world locations of lighting units 100 into coordinates in a virtual environment. For example, anything that can be sensed by a signal source 124 can be represented graphically as data, and in turn represented in color, such as on an array of tiles 500 in a room. For example, tiles 500 can glow red if the outside temperature is warm, blue if the stock market is up, or the like.

One example of a representation that can be translated to a control signal for a lighting unit 100 is a computer game representation. In computer games, there is typically a display screen (which could be a personal computer screen, television screen, laptop screen, handheld, gameboy screen, computer monitor, flat screen display, LCD display, PDA screen, or other display) that represents a virtual world of some type. The display screen may contain a graphical representation, which typically embodies objects, events and attributes coded into the program code for the game. The code for the game can attach a lighting control signal for a lighting unit 100, so that events in the game are represented graphically on the screen, and in turn the graphics on the screen are translated into corresponding lighting control signals, such as signals that represent events or attributes of the game in the real world, such as flashing lights for an explosion. In some games the objects in the game can be represented directly on an array of lights, such as an array of tiles 500; for example, the game "pong" could be played on a wall or the side of a building, with tiles 500 representing game elements, such as paddles and the "ball."

Figure 34:
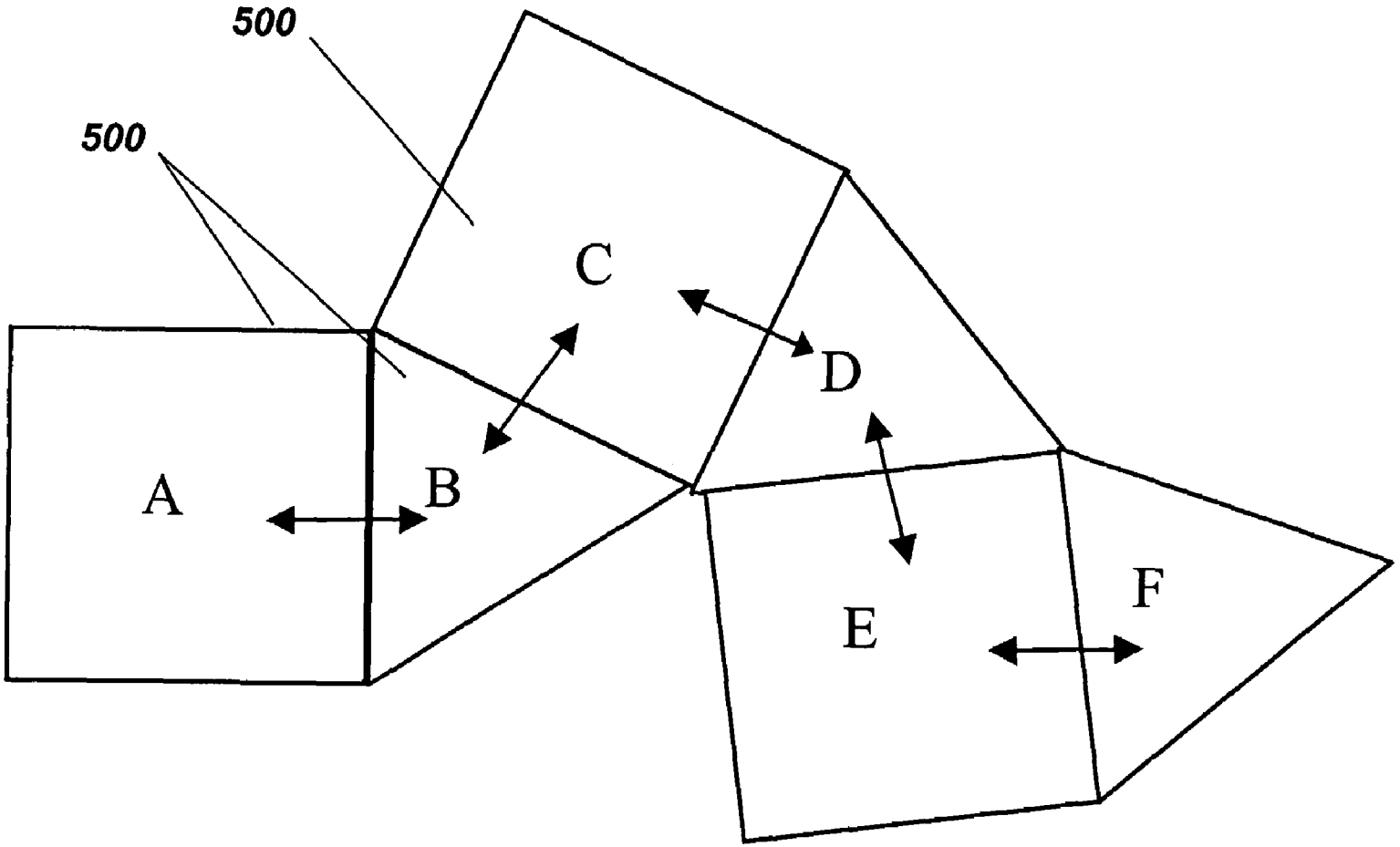
FIG. 34 shows a configuration of multiple tile lighting units in a self-configuring network.

For configurations whereby electrical connections are facilitated between adjacent units, as described in connection with FIG. 8, these connections can be used to establish proximity and geometry. This can be used, in turn, to generate a general map of the system, which can then be used to author effects across a number of tiles 500. Referring to FIG. 34, if Tile A is linked or connected to Tile B, and Tile B, in turn, is connected to Tile C, then we now have three tiles whose general topology or relationship to each other is established. This can be done automatically through a system that identifies specific tiles either by type or by unit. This information can be stored or represented through memory elements, or electrical jumpers or resistors that represent an identifier. Thus, each tile 500 or panel element knowing who its neighbor is and knowing what tiles 500 are in the network of light emitting elements and knowing exactly what is in each tile, allows the system to know where each and every controllable light-emitting element is located. This, in turn allows effects or imagery to treat the whole system as one integral unit.

In such an implementation, each tile 500 can either have a unique ID or an ID that represents the type of tile 500. It might be one of several varieties. When adjacent tiles are connected edge-to-edge electrically through edge connections, there can be a handshaking routine to communicate between those tiles and provide information to each other. This is very similar to the protocol followed when devices are connected to a computer network. To determine the overall topology then requires a sequence of communications from one tile or panel to the next to a central controller. There are two types of tiles 500 depicted in FIG. 34, a triangle and square. The adjacent tiles 500 have an electrical connection that allows the transmission of information from one unit to the next using serial protocols and low overhead communication. The connections between tiles allow a path of communication to determine the configuration of the complete installation. Knowledge of neighbors and tile types gives an unambiguous layout in this two-neighbor configuration. It is also possible to have more than two neighbors as long as the connecting geometry is known. Self-configuration of networks for the purpose of creating physical pixels is described, for example, in the works of Kelly Heaton of Massachusetts Institute of Technology, such as "Physical Pixels" submitted to the program in Media Arts and Sciences, School of Architecture and Planning, in partial fulfillment of the requirements for the degree of Master of Science in Media Arts and Sciences at the Massachusetts Institute of Technology, June 2000.

Another application of the use of tiles 500 is the use of these devices, as described above, under the ice at a skating rink or other ice-centric venue including ice sculptures. The tiles can be laid under the ice. To protect the tiles an encapsulant or transparent protective coating is used to prevent water damage and damage from the weight of people or vehicles to the units. As the layers of water are added to the rink and built-up atop the units, the ice will diffuse the light from the tiles 500.

Once the ice is ready, additional sensing devices on skaters and props on the ice can be tied to position systems to determine absolute position of skaters or other artifacts on the ice, such as pucks and then track that position over time with light. A skater can thus trace out shapes as they skate and particular effects such as persistence of the light or color change and shift can be emplaced to give a 'tail' to movement. For Ice Capades and the like, the light can be used as a display for a wide variety of themes including patriotic or related to characters in the ice event—i.e. Cinderella, Winnie-the-Pooh and more.

Additional sensing can be used to detect the presence of a person or a person hand or arm or instrument and respond to 'unveil' an image by sensing the proximity of said arm or instrument. For example, as an arm moves across a surface, the lighting pattern is revealed as though you simply wiped away a surface covering. No touching is required, although it would be possible to have that as well as the use of a pad or pad that would move across. For example, a squeegee-like instrument whose presence and proximity would be detected and turn on lighting elements in close proximity. The movement and velocity of the motion could be detected to adjust the timing of the 'unveiling' of the light pattern beneath. This could be used for movement tracking and indication during dancing, movement, etc. The surface could be treated as a canvas and color could be selected by other actuation or signaling means. Persistance effects could also be added so the movement has a 'tail' to it.

In general, any of the display modes described for the tiles 500 can be coupled to sensing means (electromagnetic, IR, wireless, capacitive, visible light, hall effect, acoustic and more) to trigger effects or to tie an effect to the amplitude or position of a sensed signal. A person moving by a wall, floor or ceiling can trigger effects. Proximity detectors operating on many principles can be used to couple sensed information to lighting. Music can provide and couple to lighting effects based on frequency and amplitude of a musical signal (a responsive system) or a pre-scripted effect can be triggered that is then synchronized to music.

Acoustic effects are typically done through a microphone coupled directly to control and changing an illumination pattern or sequence as a function of amplitude. More sophisticated effects are possible based on temporal and spatial effects that propagate effects or have a show sequence coordinated with the music or audio.

Additional sensing can adjust the light output as a function of ambient light by coupling a light sensors such as the TAOS sensor or even simpler photoelectric sensors that provide a measure of ambient light. This information is then used by the controller to dim the overall light accordingly or change the color or color temperature. Even the passage of time or the image of the sky can be used and the panels can be used to match that color.

A virtual skylight can be created even on floor and in spaces where the ceiling is not the roof. The tile lights lend themselves well to the concept of a Virtual Skylight™ or a Virtual Window™ where you can have a very inexpensive camera pointing outside of a building (even a cheap webcam will suffice) and use that imagery in slow-time or real-time to give a virtual window that doesn't necessarily give a high resolution window but gives a sense of what it is doing outside—even the passage of a cloud or the shadow of something moving by. The VS or VW could also be a non-sensing based system with a simple dimmer-style interface, or an interface like that of the ColorDial from Color Kinetics Incorporated of Boston, Mass.

Other control related aspects to the invention include the incorporation of scaling factors for dimming and calibration which can be set and programmed at the factory into controller memory or set by the user via dip-switches or PC-interface or other similar means into the tile light.

Tiles 500 can take any shapes, including arbitrary shapes, polygons, squares, rectangles, triangles, circles, ovals, rhombuses, pentagons, hexagons, septagons, octagons, nonagons, decagons and any other shape.

While much of the above discussion has surrounded the concept of two-dimensional shapes for the panels or tiles 500, these elements can be in 3D as well and form any three-dimensional shape. Many polygonal solids including pyramids, tetrahedrons, dodecahedronss, parallelpipeds and the like can be formed, as well as arbitrary three-dimensional shapes.

The present invention encompasses the combination of the physical shape of a luminaire and the ability to individually address and control sections of that luminaire, to achieve specific illumination effects throughout a room or space. It also relates to a way of construction for a luminaire or display that utilizes interlocking, substantially similar, repeated subassemblies whose interlocking mechanism can provide both mechanical strength and electrical connectivity. It also relates to the exploitation of the geometry of interlocking repeated subassemblies for the purpose of enabling accurate and precise positioning of light sources. It further relates to the combination of the physical shape of a display and the ability to individually address and control sections of that display, to achieve a general illumination effect.

Figure 35:
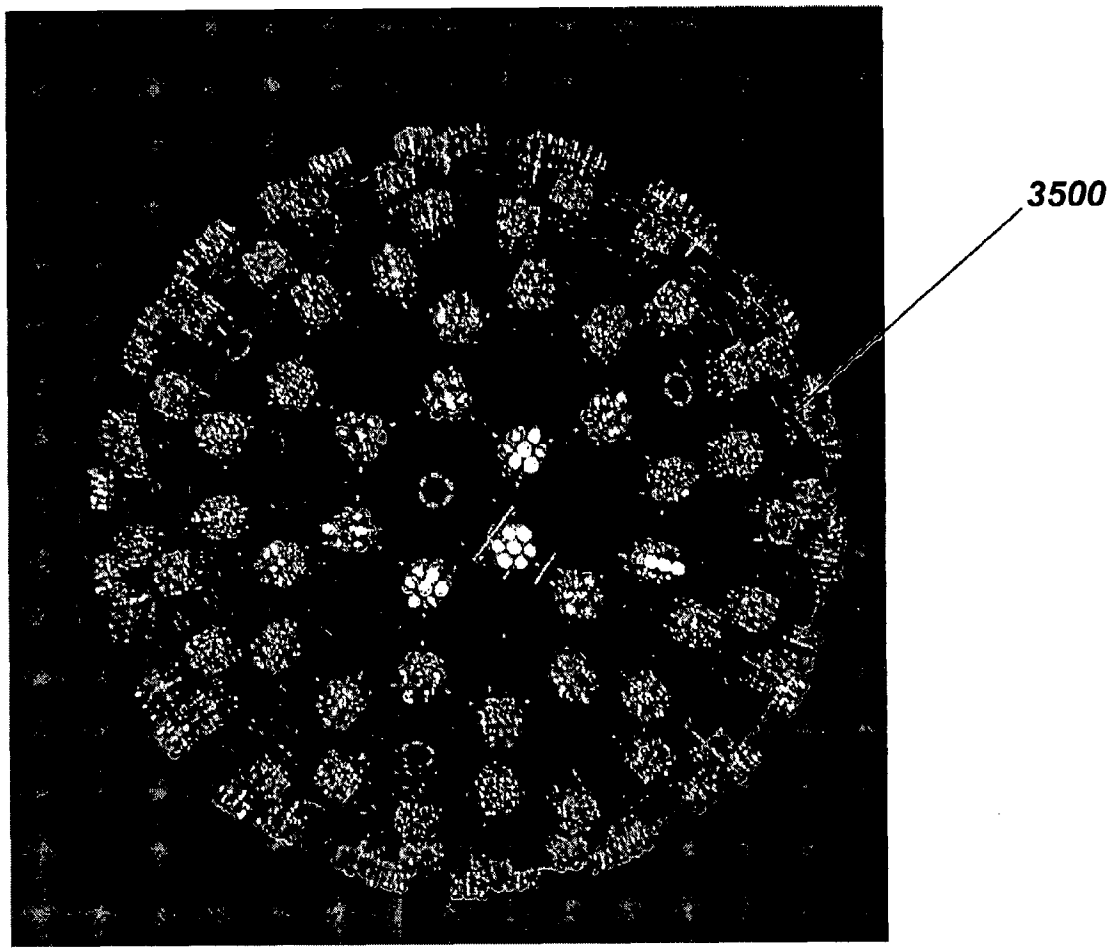
FIG. 35 shows a substantially spherical lighting unit formed of a plurality of flat circuit board lighting units.
Figure 36:
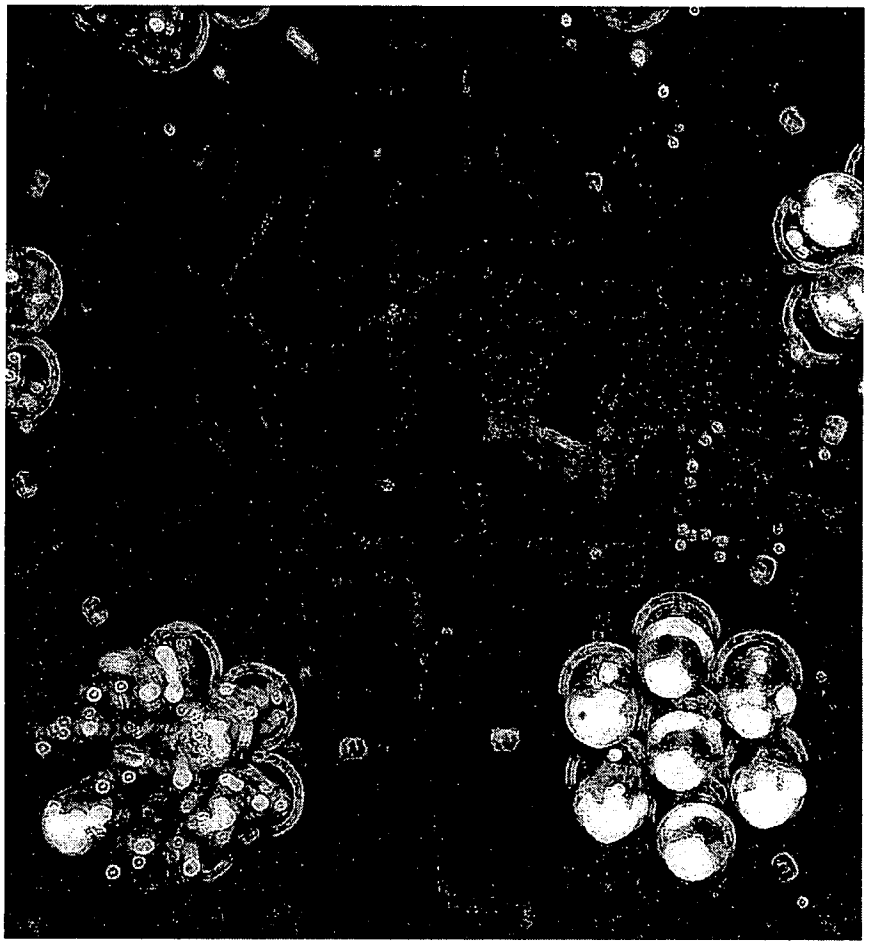
FIG. 36 shows a close view of elements of the embodiment of FIG. 35.
Figure 37:
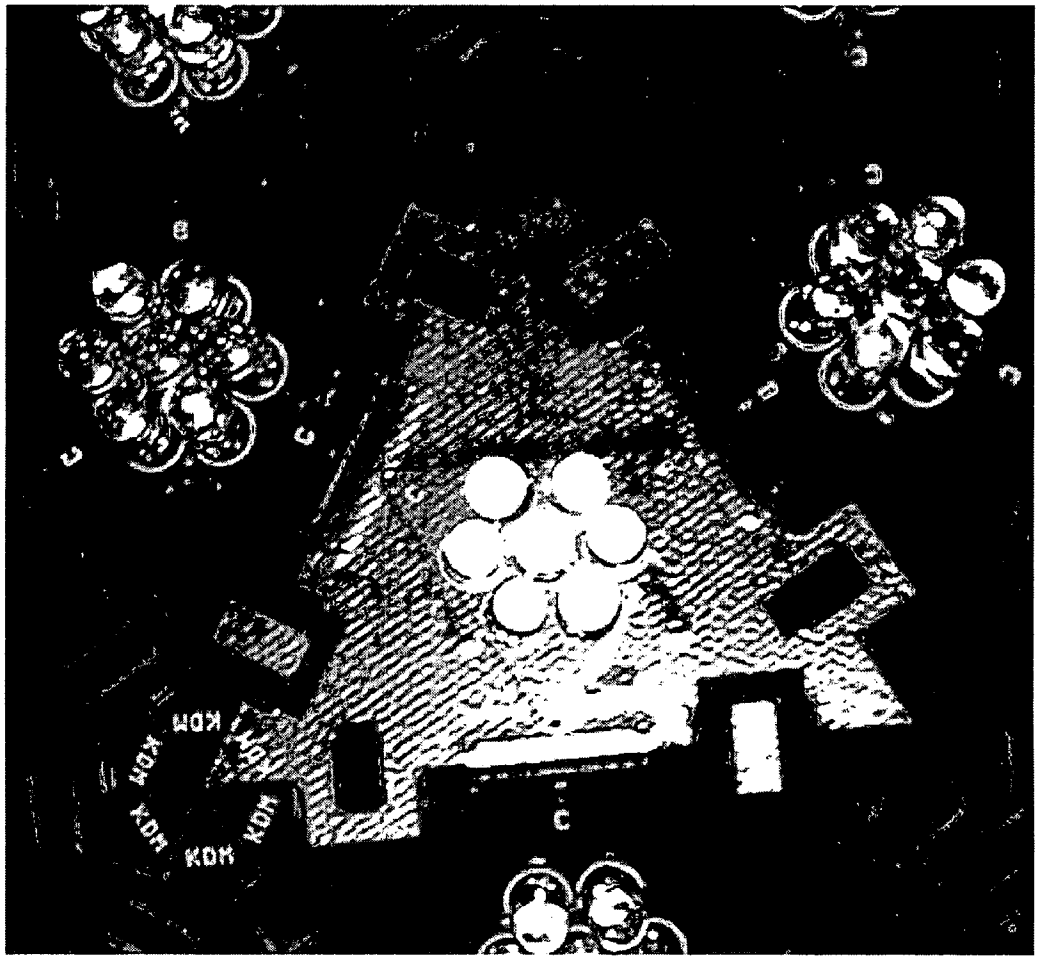
FIG. 37 shows a substantially triangular circuit board element designed to interlock with other circuit board elements to form the substantially spherical lighting unit of FIG. 35.

As shown in FIGS. 35, 36 and 37, for a particular and representative shape, a sphere 3500, an interlocking design in the form of a 2D triangle was created that, when connected and interlocked with other boards of the same design can form a sphere 3500. Although not a platonic solid (see below) the principle can be used to create scaled forms and many shapes based on interlocking elements.

While mechanical connections using rigid supports and fasteners can be used to hold the shaped board elements together, the electrical connection can also be used or soldering of the adjacent boards can provide sufficient connections for many smaller shapes as well. Each board in this case, is an individually controllable and networked lighting element. This can be accomplished through individual controllers on each board, which can use off-the-shelf microprocessors or an integrated control chip such as the Chromasic chip using a string light protocol by Color Kinetics.

Figure 38:
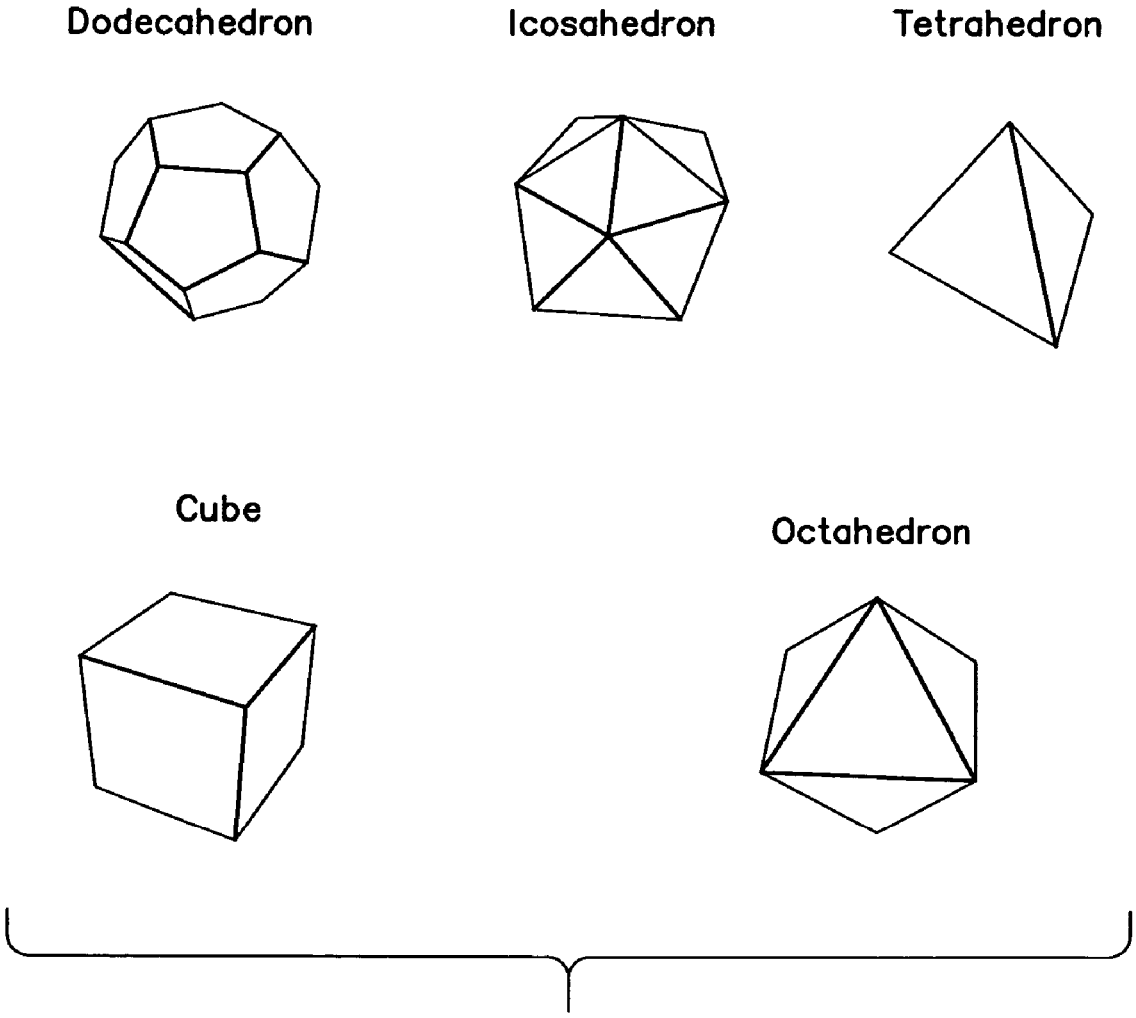
FIG. 38 shows platonic solids that can be formed from polygons and that can comprise lighting unit configurations according to the principles of the invention.

Other shapes include, a cube, an octahedron, a rhombic dodecahedron, the pyritohedron, the deltoidal dodecahedron, the tetartoid, the tetrahedron, the diploid, the gyroid, the tetartoid, the trapezohedron, the hexoctahedron, the tetrahexahedron, the tristetrahedron, the trisoctahedron and the hextetrahedron. Each of these shapes has the advantage of being formed of simple geometric elements that can be designed as circuit board elements for lighting control and illumination. Also disclosed are the platonic solids, which are those polyhedra whose faces are all regular polygons, which means they have congruent legs and angles. There are only five such polyhedra, shown in FIG. 38.

In various embodiments, interconnection and modularity can be further improved through the use of inductive elements that co-align through proximity to one another. Inductive coupling uses an AC signal, akin to a transforner, which can be used to provide power, for example 12 VAC, from one element to another. Simultaneously, data can be superimposed upon the power signal to create a multiplexed data and power connection. The multiplexing can also happen through a direct electrical connection and using a multiplexed data and DC power between elements. This concept is similar to the Color Kinetics iColor MR product, but in a very different physical form factor, a tile 500, rather than a lamp.

Even simpler, communication between elements can occur through optical (such as visible or IR) means whereby adjacent panels are aligned and optical coupling elements allows data to stream from one element to the next. In this way a wide variety of coordinated and synchronized patterns can occur across a variety of panels. Another way is the use of RF techniques to allow many panels to interconnect without wires and the like.

Figure 39:
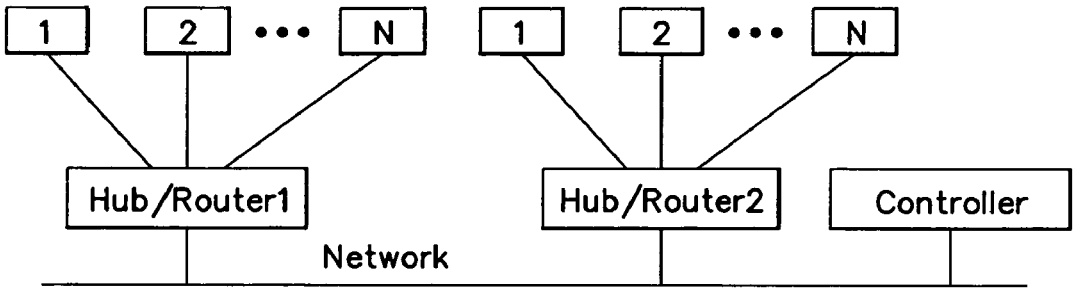
FIG. 39 shows a network configuration for a plurality of lighting units.

This disclosure includes many ways information can be transferred between modules. The underlying architecture is also relevant. In FIG. 39, each of the numbered blocks (1,2, . . . N) represents a tile 500 with a plurality of controllable nodes (e.g. RGB or RGBW and control chip). A network, for example Ethernet, can be used to connect a series of hubs or routers each of which is, in turn, connected to many tiles 500. In this way a hierarchy of elements from the processor, computer or controller provides a control data stream to the hubs that, in turn, take their information and distribute it to the lighting units 100 and the nodes within the tiles 500. This is in contrast, for example, to video screens that listen to an entire video signal and pick off a particular section of that signal to display.

Figure 40:
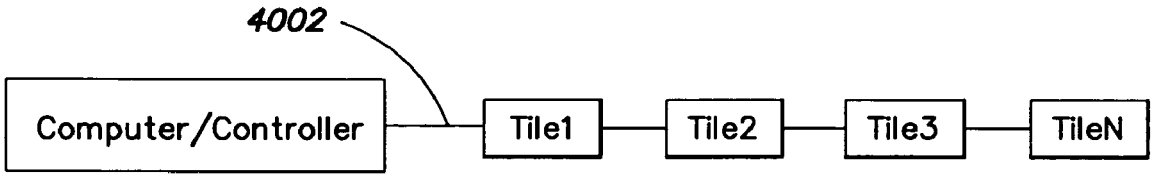
FIG. 40 shows a plurality of tile lights connected by a very high speed serial bus.

Referring to FIG. 40, an additional invention uses a conceptually simpler but higher speed approach using a very high-speed serial bus 4002. The bus 4002 could be a higher speed version of FireWire. The interconnection between tiles 500 could be wireless, such as Bluetooth or any other known wireless connection protocol.

Figure 41:
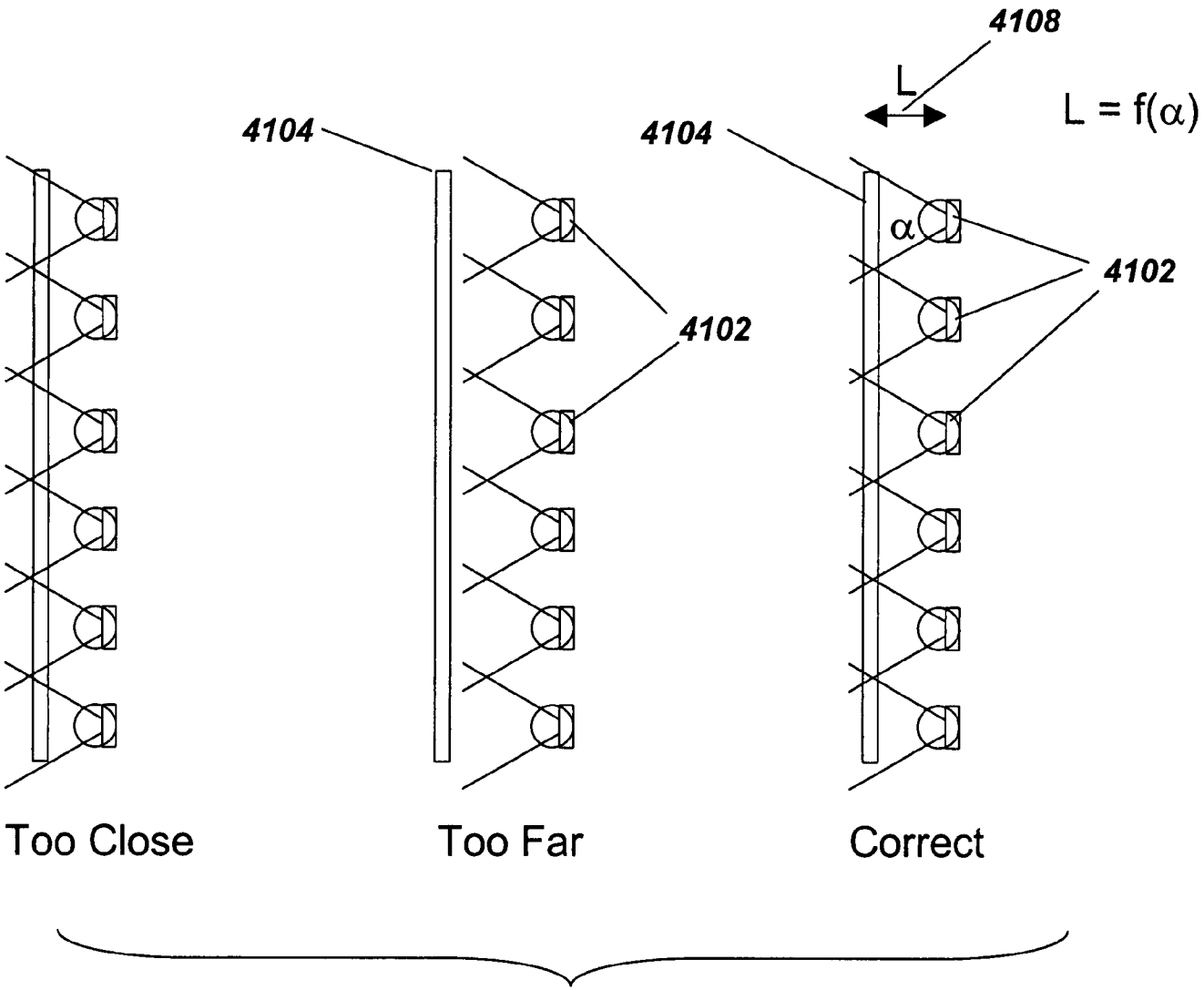
FIG. 41 shows a set of LEDs placed in varying proximity to a diffuser.

Referring to FIG. 41, in embodiments of the invention various mounting configurations can be used. In the embodiment of FIG. 41, the distance L 4108 of the light sources 4102 to a surface 4104 can be chosen to minimize overlap between light from the light sources 4102 and to maximize coverage. As seen in FIG. 41, the distance is a function of the beam angle of the LEDs 4102. It is desirable to choose a distance 4108 that, within a practical percentage, is chosen to eliminate much overlap or to provide frames or boxes between adjacent light elements. As can be seen in FIG. 41, the function relating beam angle and distance is a trigonometric value. If the half-angle spread is alpha and the distance between adjacent LEDs is L then the distance at which the beams from adjacent LEDs meet is L/(2 tan (alpha)). This is the desired distance. However, due to absorption, reflectance and other optical characteristics it may prove desirable to adjust this distance slightly to one side of the other of this distance to obtain the most pleasing effect.

Referring still to FIG. 41, the proximity of the LEDs to the surface defines the resulting pattern. FIG. 41 shows a line of light emitting diodes 4102 and the effect of distance of a diffusing surface 4104. If the LEDs 4102 are too close to the surface then, depending of diffusive qualities of the surface 4104, a series of points will result. If too far, then overlap causes mixing of adjacent light sources. Finally in the rightmost figure is shown a diffuser position corresponding to the point at which the beams from adjacent light sources meet.

In typical embodiments the light sources 4102 do not have a perfect beam, such as with full light at one angle and then none at the next increment. However, a rapid fall-off of light is typical, and beam patterns and angles are often defined by the angle at which the light falls to one-half of center intensity.

Another mechanical means to prevent overlap and potentially increase light output is for each light source 4102 to be mechanically isolated from its neighbors such as that used in egg-crate lighting diffusers. Thin materials can be used and a small offset distance to prevent lines of the mechanical piece from showing through the diffuser.

Figure 42A:
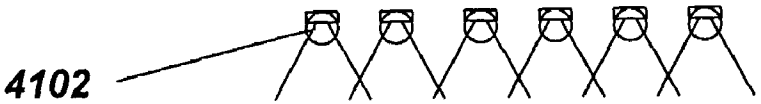
FIGS. 42A and 42B show views of an LED board with a plurality of lighting elements disposed on it.
Figure 42B:
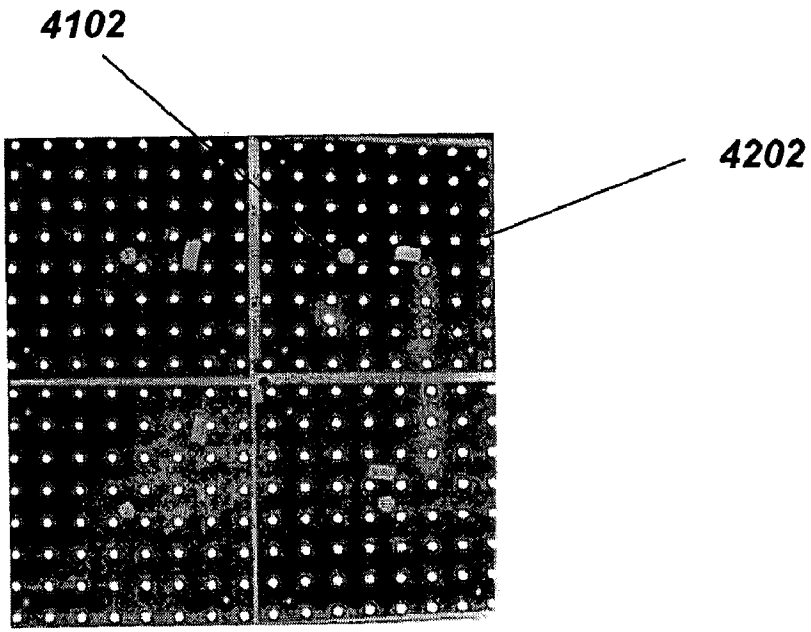

Referring to FIG. 42, the light sources 4102 are now viewed directly, without intervening diffusing materials. FIG. 42 is a direct view image of the LEDs 4102 mounted in a regular array on a board 4102. No diffuser is used. As can be seen in this image, the light sources 4202 appear as bright points of light. Each can be individually controlled or they can be synchronized to do the same thing over time. On top of FIG. 42 are shown a row of LEDs that are facing outwards; no materials interrupt the light path to the view. In the bottom image, the boards show four 1' square boards each within 8×8 (64) grid of RGB LED light sources.

Figure 43A:
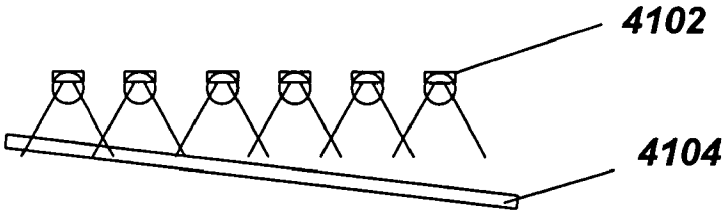
FIGS. 43A and 43B shows an LED board with a diffuser disposed in proximity to it at an angle relative to the surface of the board.
Figure 43B:
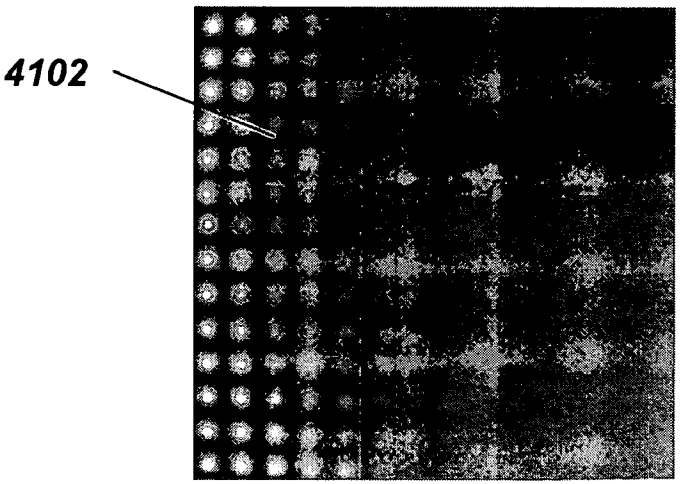
Figure 44D:
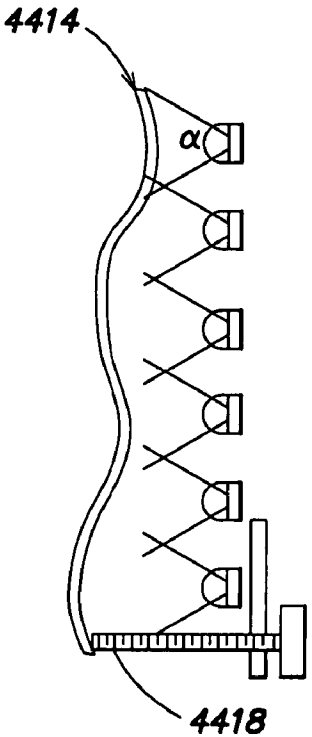
FIGS. 44A-44D shows embodiments of different shapes and types of materials that can be used as diffusers.
Figure 44C:
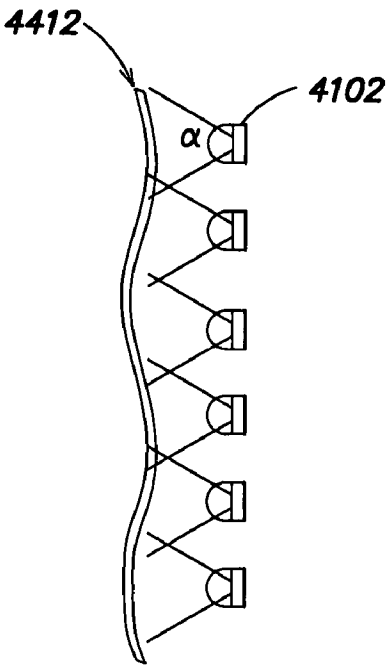
Figure 44B:
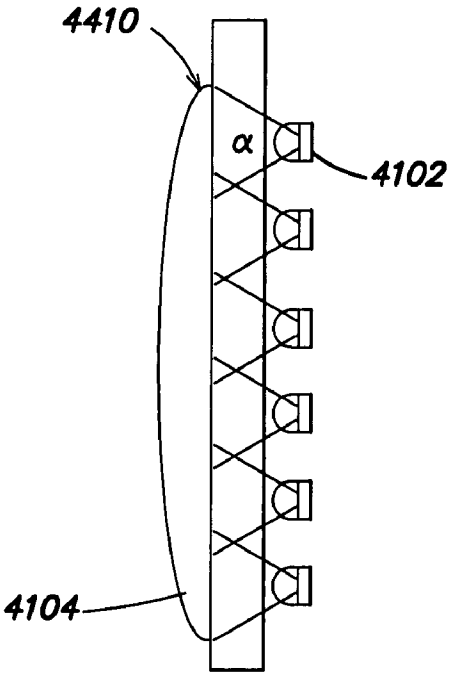
Figure 44A:
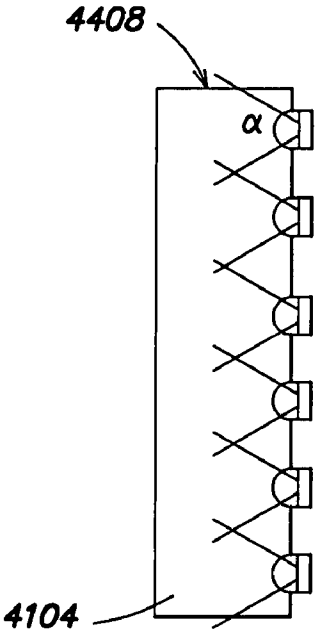

Referring to FIG. 43, in embodiments the diffusing surface 4104 can be slanted with respect to the light sources 4102. In FIG. 43, a diffusing surface is illustrated in the front of the 4104 LEDs 4102 between the light sources and the viewer. The diffusing surface is at an angle with respect to the LEDs. As can be seen from FIG. 43, as the distance is varied the points of light are visible and merge together with adjacent points of light. If merged too closely, then the colors from adjacent light sources overlap and it becomes difficult to differentiate sources and color mixing occurs. In the case of differing colors then, there is a resultant loss of resolution—similar to an out of focus images where blur occurs. This example can be used in applications where a transition is desired between distinct points of light and blurred areas where resolution is reduced for effect.

Referring to FIG. 44, a variety of configurations and surfaces can be used with light sources 4102. In FIG. 44, LED elements 4102 are shown, from left to right, in contact with a surface 4104. Embedded features within the diffusing material form a mating shape to the LED. This is true whether the LED is in a standard 5 mm (T 1¾) package, SMT, or other power package. This tight coupling reduces reflection losses and optical gel materials can be used in conjunction to minimize or eliminate optical losses.

In embodiments of FIG. 44, a material is used to form a shape that has general optical properties for shaping the output from a series of individual light sources 4102. In the embodiment 4408, the material is shaped as a flat surface. In the embodiment 4410, the material 4104 is an optical lens. In the embodiment 4412, an undulating surface forms a variety of patterns and shapes resulting from the light interaction with the changing distance. In the embodiment 4414, such a shape or any other, can be adjusted in distance from the LED sources. This adjustment can be one of many mechanical means for adjusting or setting the distance. A simple screw 4418 is shown, such that when the screw 4418 is turned, the material moves further away or closer to the LED board. Such adjustments could also be latches and serrated patterns that catch a mechanical pawl or indent mechanism or any other mechanism for adjusting distance and height.

Figure 45:
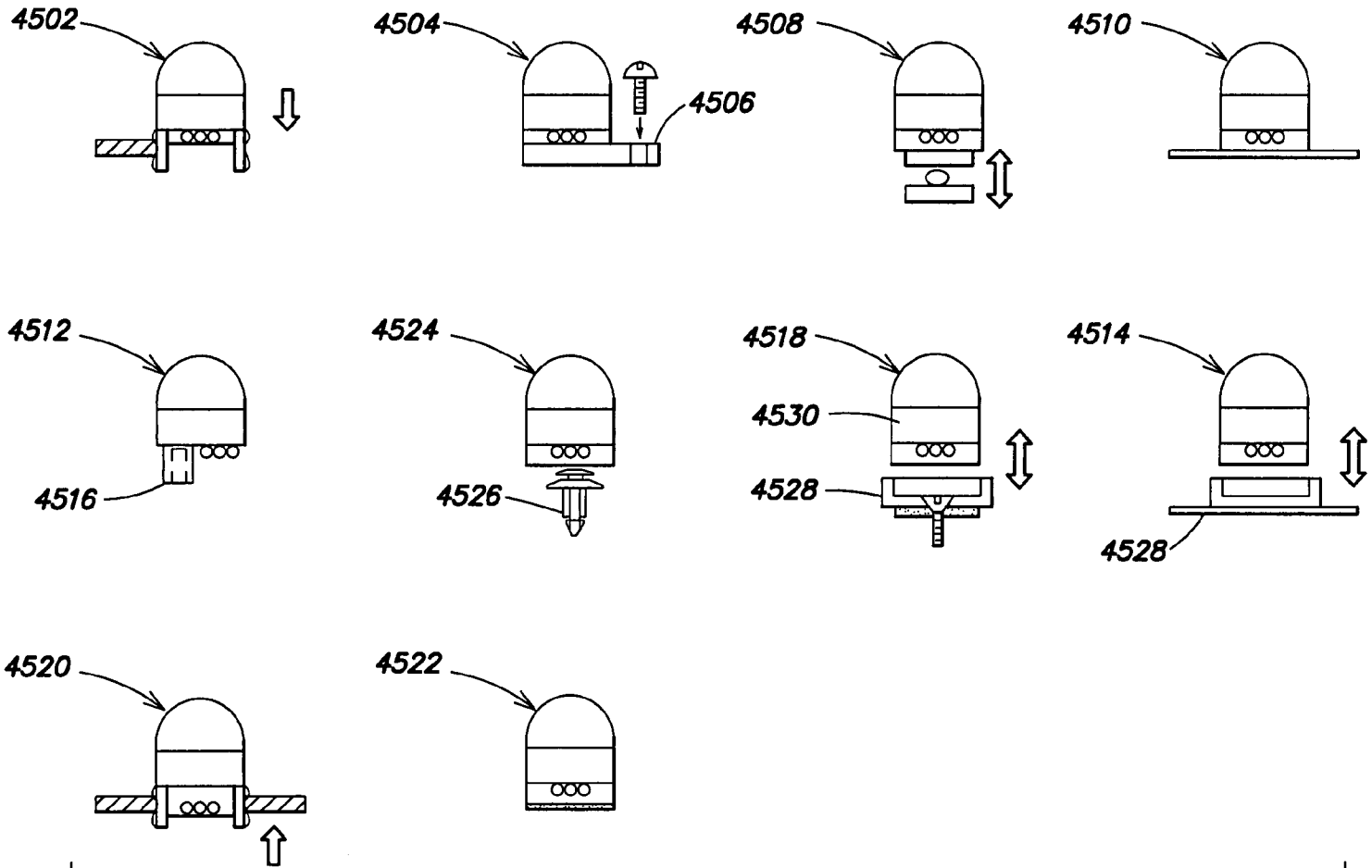
FIG. 45 shows examples of fastening facilities for light nodes of the methods and systems described herein.
Figure 46B:
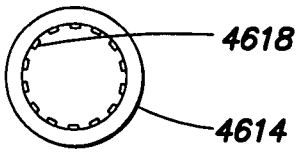
FIGS. 46A-46D shows a push-through fastening mechanism for a light node.
Figure 46D:
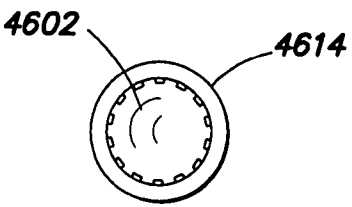
Figure 46A:
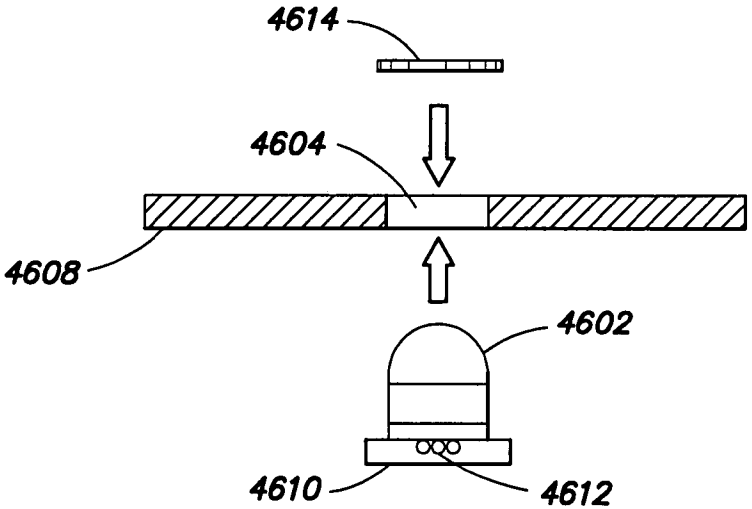
Figure 46C:
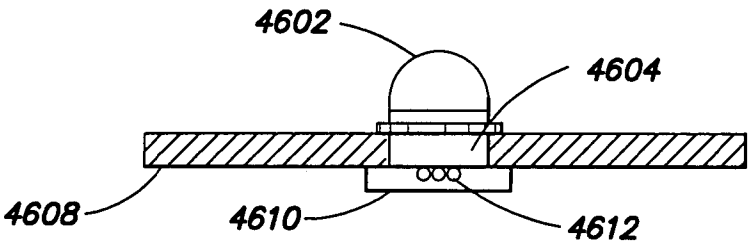

Referring to FIG. 45, there are many embodiments of fastening and mounting facilities for light sources of the present invention to hold LED modules to a surface. The embodiments of FIG. 45 are meant to be illustrative of general fastening facilities, and not limiting. This example set in no way limits the means by which one material or surface may be attached to another. IN the embodiment 4502, small features on the side lock into a circular hole in a panel as it pressed into the hole from the top of the panel. The cable connecting the modules is shown in cross-section and passes from one module to the next in a continuous fashion and is tied into the module via insulation displacement means (IDC-style). The module 4504 has a small flat tab 4506 to the side that is integral to the package and is used as a hold down area via a screw, nail, staple or other fastener.

In the embodiment 4508, a small separate flat piece with a mating feature is fastened to a surface and the module is snapped atop the separate piece. In the embodiment 4510, the embodiment is similar to the embodiment 4504, but the area of the tab is either circular or extends through the bottom of the module. In the embodiment 4512, a smaller hole is created in the panel and the screw feature shown in 4516 can be threaded or used with a self-tapping screw from the other side of the mounting surface. In the embodiment 4524, a panel fastener 4526 is attached or integrated into the module design and is pushed through an appropriately sized hole and thus held directly in place. In the embodiment 4518, a two piece arrangement is provided in which the first bottom piece 4528 is attached to a mounting surface via one of many possible means including but not limited to screws, nails, adhesives etc. The second piece 4530 with the cabling preattached, is snapped into the bottom piece via mating features that provide a locking action when the module is pressed in from above. Additional features, not shown, fore and aft prevent the unit from sliding or moving in the bottom mounting piece 4528. In the embodiment 4514, a tab extending from the bottom piece 4528 can then be attached to the surface. The module attaches to the bottom piece 4528 in a similar manner as described in connection with the embodiment 4518. In the embodiment 4520, the module pokes through from the bottom of the panel. Similar features provide a snap-in capability and the cabling remains on the bottom of the panel. In the embodiment 4522, adhesive, in the form of a double-sided piece, can be attached to the bottom of the module and to the module itself. For installation, protective material is peeled away from the adhesive revealing the sticky surface and then pressed onto the mounting surface. In the event of direct or other materials, the adhesive can be scraped or removed and a new piece of DST applied.

Referring to FIG. 46, details are provided for a push-through assembly mechanism. In FIG. 46, the light node 4602 is pressed through a hole 4604 in the Is mounting surface 4608 from the bottom. A rim 4610 on the bottom of the light node 4602 that is larger than the diameter of the hole 4604 prevents the light node 4602 from pushing all the way through. The cable 4612 joining a plurality of light nodes 4602 is thus protected from engagement on the shearing edge of the mounting hole 4604. From the other side, a retaining ring 4614 is pressed onto the outside of the light node 4602 and internal teeth 4618 or other similar features engage the light node 4602 and prevent it from backing into the hole 4604. Once engaged and pressed flush with the mounting surface 4608 this positive engagement holds the unit securely in place. By prying up the retaining ring 4614 with a suitably thin edged tool, it is also possible to remove the retaining ring 4614.

Figure 47:
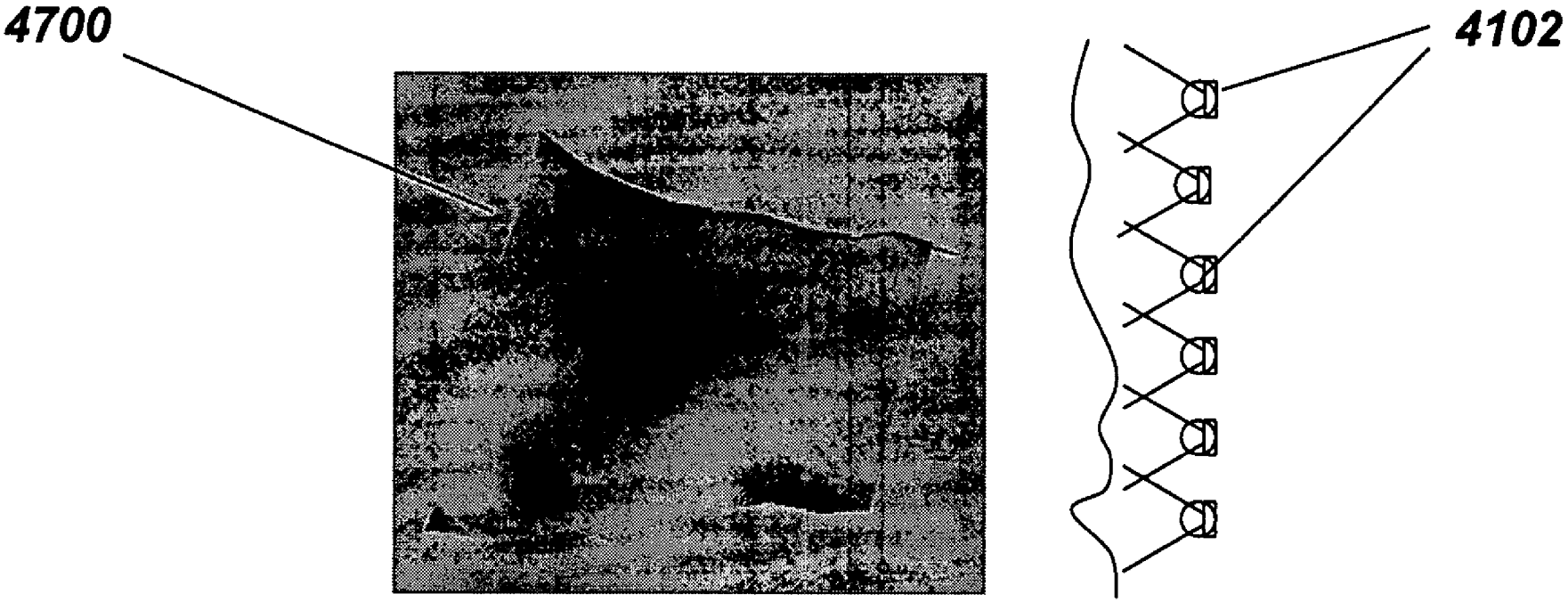
FIG. 47 shows a three-dimensional, complex surface of a diffuser.

Referring to FIG. 47, a surface lit by a light node 4102 as described herein need not be a two-dimensional surface. For example, it can be a complex topology, such as the surface 4700 of FIG. 47. In this example, a heavily sculptured or textured 3D surface can also be used in conjunction with an array of light elements or light nodes 4102. Various pleasing effects due to the varying distances to the surface can be achieved with such a surface 4700. The 3D surface 4700 can be of any suitably translucent or transparent material. Varying depths and thicknesses may actually become opaque, providing a rich set of variation in color and translucency. The surface itself may be colorless or have intrinsic color and depth of color.

Figure 48B:
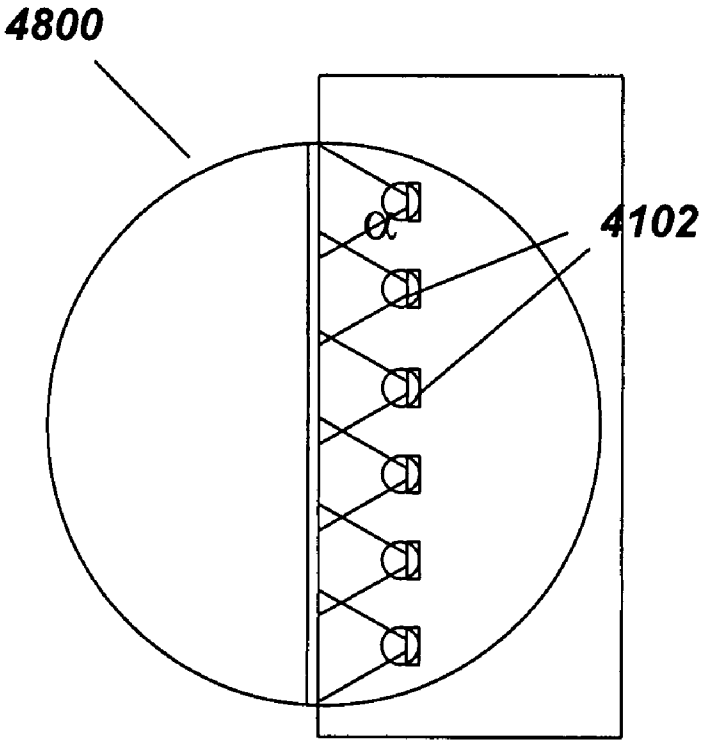
FIGS. 48A and 48B shows a hemispherical diffuser with a graphical element included on it.
Figure 48A:
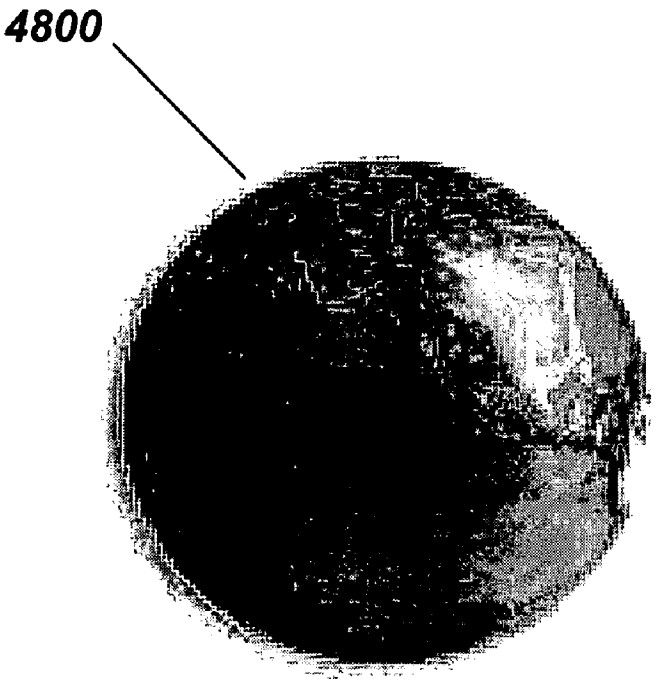

Referring to FIG. 48, it is also possible to have three dimensional illuminated shapes 4800 that have features and color that are augmented and enhanced by the set of controllable light nodes 4102 behind the shapes. For example, a hemispherical shape 4800 can include a map of part of the globe on it, and the light nodes 4102 can be lit to enhance the colors, such as by shining blue light to enhance the oceans, or yellow light to enhance yellow surface features.

Figure 49:
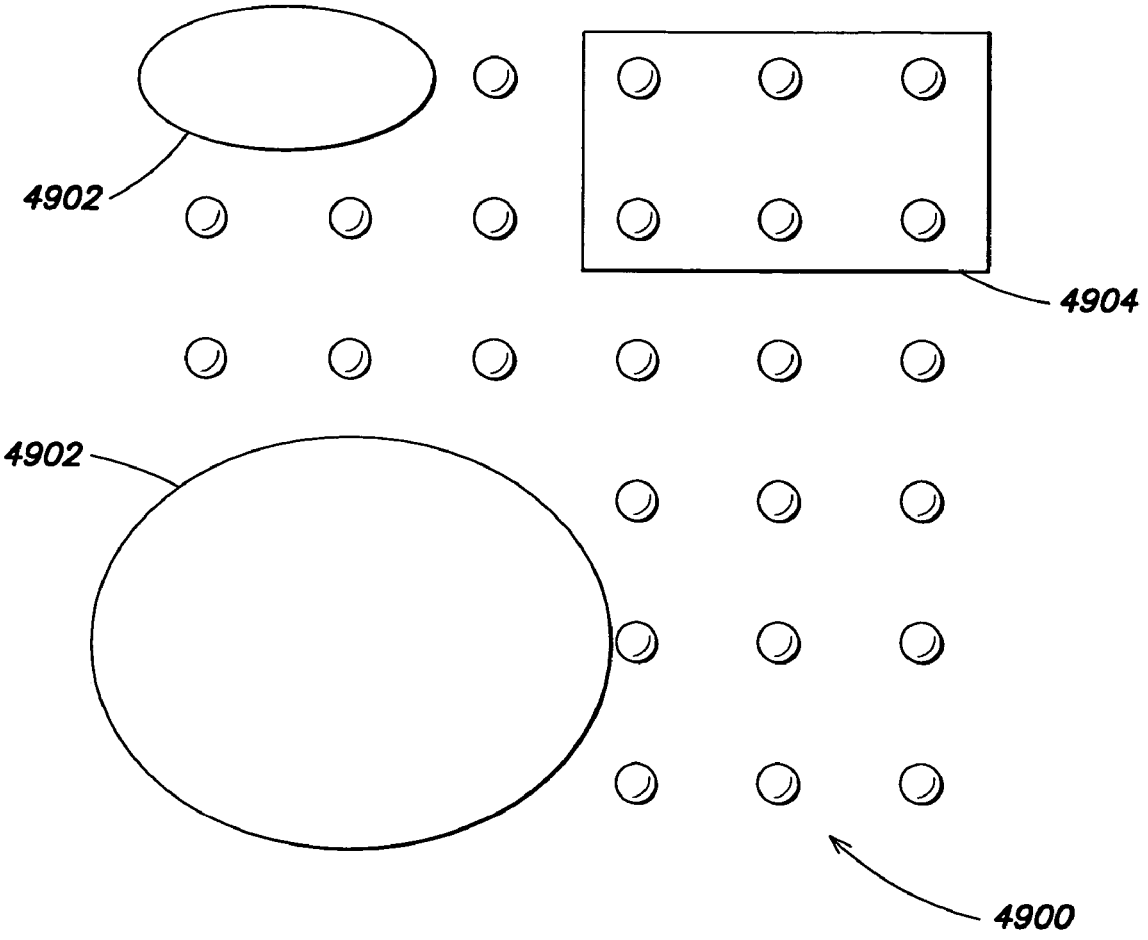
FIG. 49 shows the superposition of materials on top of an array of light nodes, including transparent and translucent materials.
Figure 50:
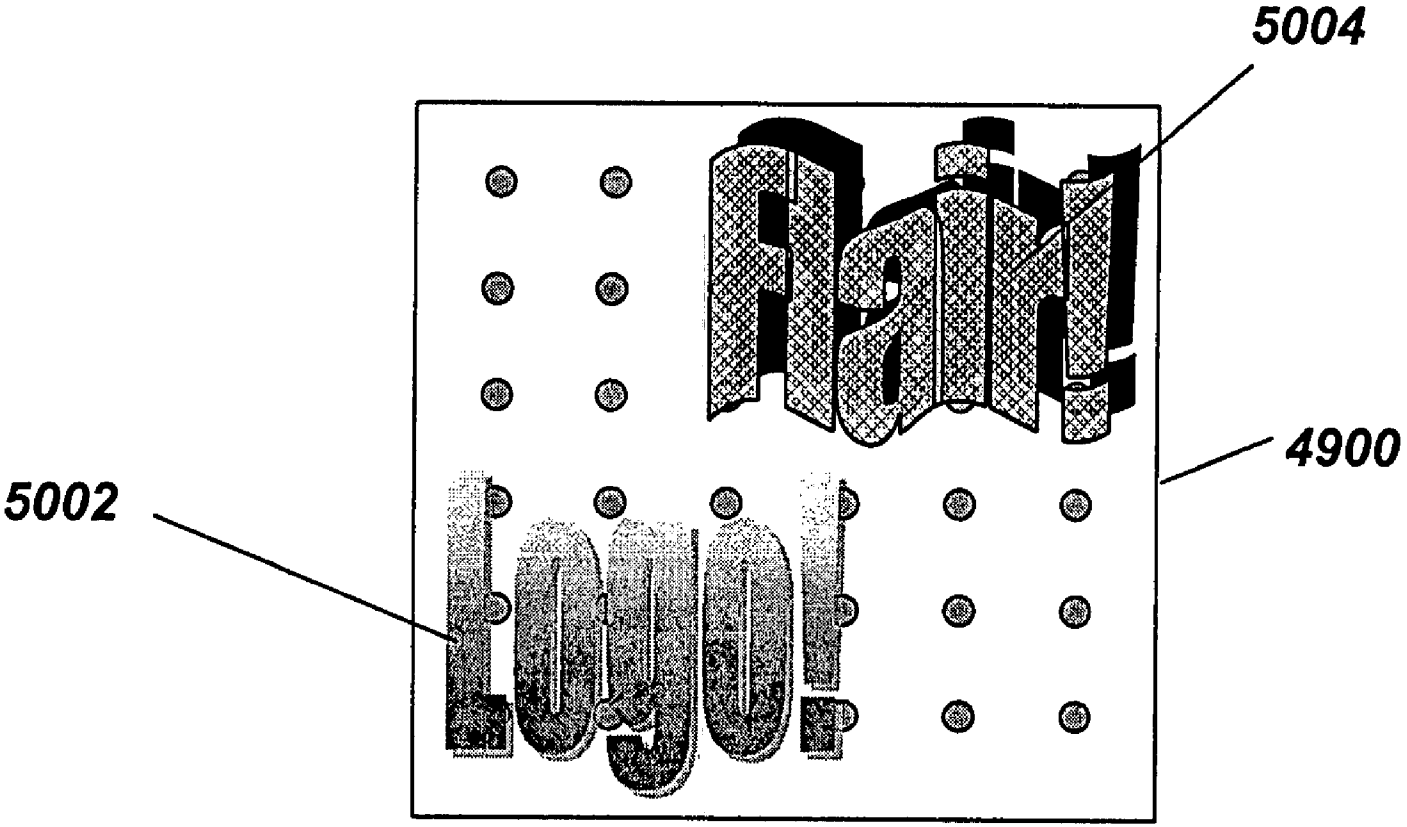
FIG. 50 shows superposition of a logo or other graphical element on an array of light nodes.

Referring to FIG. 49 and FIG. 50, it is also possible to establish arrays of lighting elements with superimposed graphical elements, such as translucent graphics and materials. For example, an array 4900 of lighting elements can be covered with superimposed translucent elements 4902 or a transparent element 4904 to enhance the effects of lighting from the array 4900. Referring to FIG. 50, the superimposed element might be a logo 5002, or similar element of a brand, trademark, trade name, business name, personal name, or the like. The superimposed element might also be a graphic 5004, such as a graphic designed to produce a changing, or "flair" effect when lighting elements illuminate the graphic 5004 with different colors of light. As shown in the above figures, these lighting arrays 4900 can be used to emphasize and delineate graphical elements for use in display or advertising applications as well as novel elements in consumer products and more. Graphics, printed on a variety of materials with varying light transmission qualities, can be overlaid onto the arrays to provide flexible and controllable backlit illumination for said graphical materials. These graphics can be any printed materials.

Figure 51:
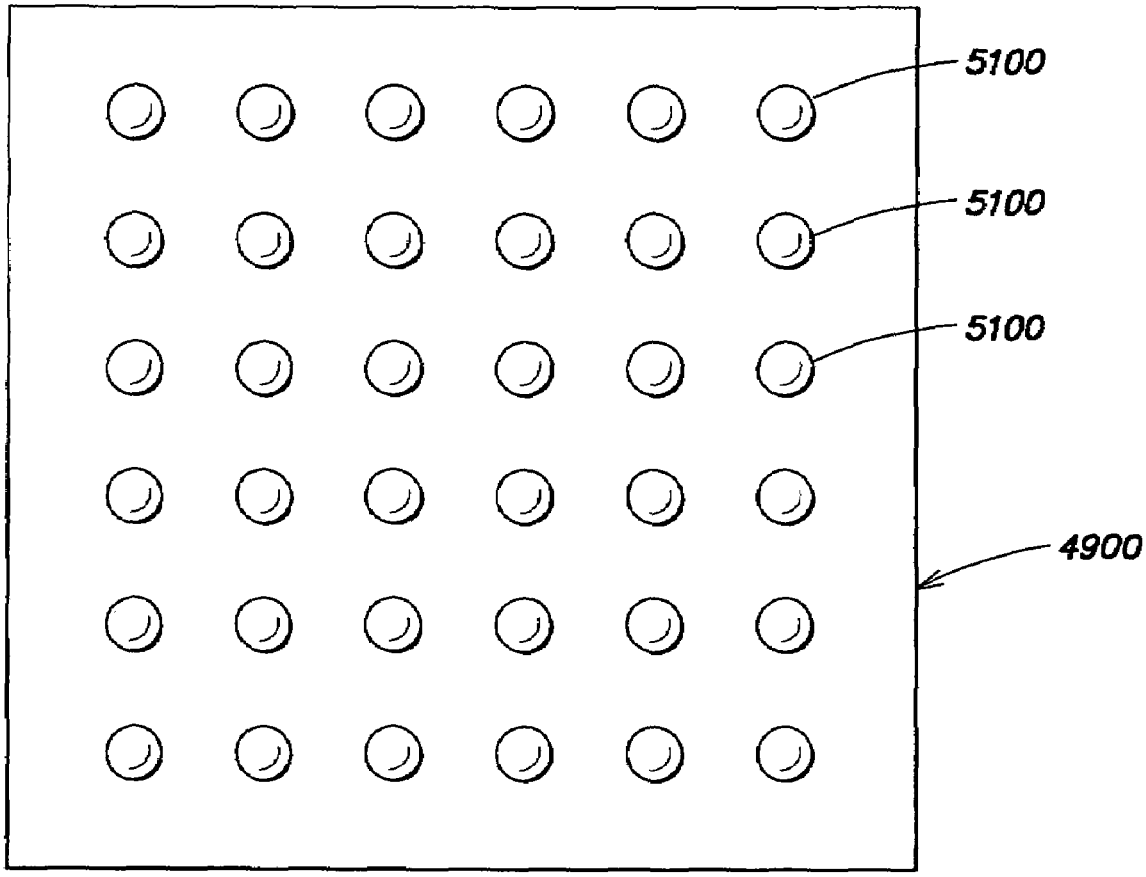
FIG. 51 shows a regular, planar array of LEDs on a board.
Figure 52:
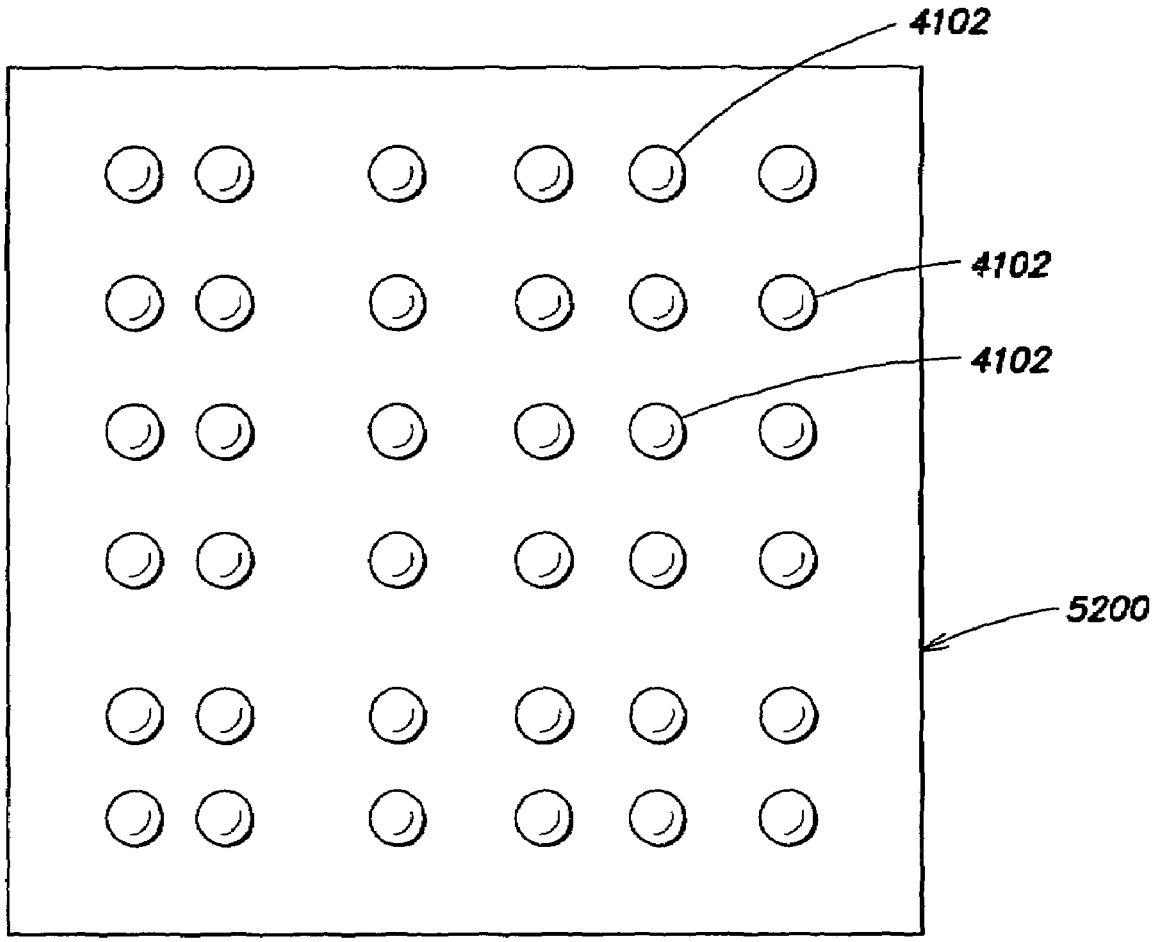
FIG. 52 shows an irregular pattern of LEDs in an array.

Referring to FIG. 51, arrays 4900 can be provided with various spacing. In one embodiment, an array 4900 is a regularly spaced, linear, planar array 5100. In other embodiments, the arrays can be spaced irregularly. FIG. 52 depicts an irregularly spaced, planar array 5200 of lighting elements 4102. FIGS. 51 and 52 illustrate variations in spacing of the lighting elements. The spacing can be regular or freeform. The spacing can vary linearly or non-linearly across the units and even in three dimensions, such as with the substantially spherical embodiment described above.

Figure 53:
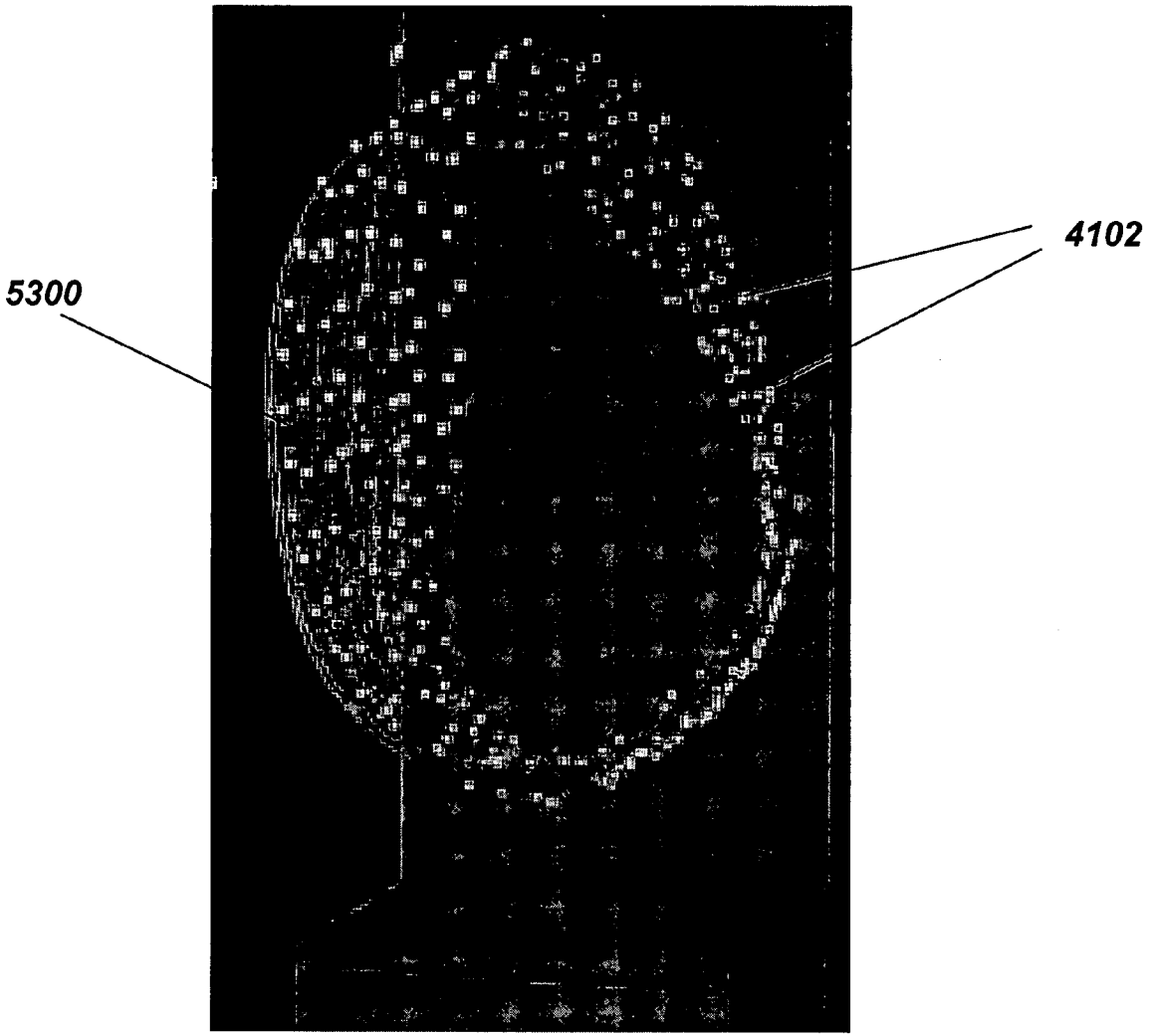
FIG. 53 shows a three-dimensional, Mobius strip configuration of an array of LEDs.

FIG. 53 depicts a three dimensional loop 5300 in the form of a Mobius strip. As shown in FIG. 53, a mesh of lighting elements 4102 can be created at varying densities and spacing as well as an infinite variety of overall shapes in 3D. The Mobius strip is a topological surface with only one edge and one side. The lighting elements can be easily incorporated into these types of complex surfaces (toruses, klein bottles, hypercube representations in 3-space, etc.).

Methods and systems described herein also include use of thermoset materials as the grid or mounting surface material to which light nodes are mounted. A thermoset plastic can be shaped under heat in a mold or even by hand and then cooled to assume the desired shape. In this way a custom surface can be molded, twisted or otherwise formed into the desired shape under heat or pressure and be made to maintain that form. Some examples of thermoset materials include ABS, Acrylics, Fluoropolymers, Nylons, Polyarylates, Polyesters, Polyphenylene Sulfide, Polystyrenes, Acetals, Acrylonitrile, Methacrylates, Phthalates, Polybutylenes, Polyethers, Polyphenylenes, Polysulfones, Styrenes, Acrylates, Cellulosics, Molding Resins, Polyamides, Polycarbonates, Polyethylenes, Polypropylenes, Polytethylene Terephthalate, and Vinyls & Polyvinyls. This list is not meant to be limiting in any way of the types and varieties of thermoset materials. Another method of shape creation is the use of bendable and formable materials such as metals, which, in one form of wire grids, can be twisted and shaped into many forms. Wire mesh, screen and cloth can be made from metal, coated metals (like Gumby® figures) or even plastic materials and then pushed and pulled into a wide variety of shapes. As shown below in FIG. 54, a grid arrangements of such materials provide for wide flexibility in the placement of said modules.

Figure 54A:
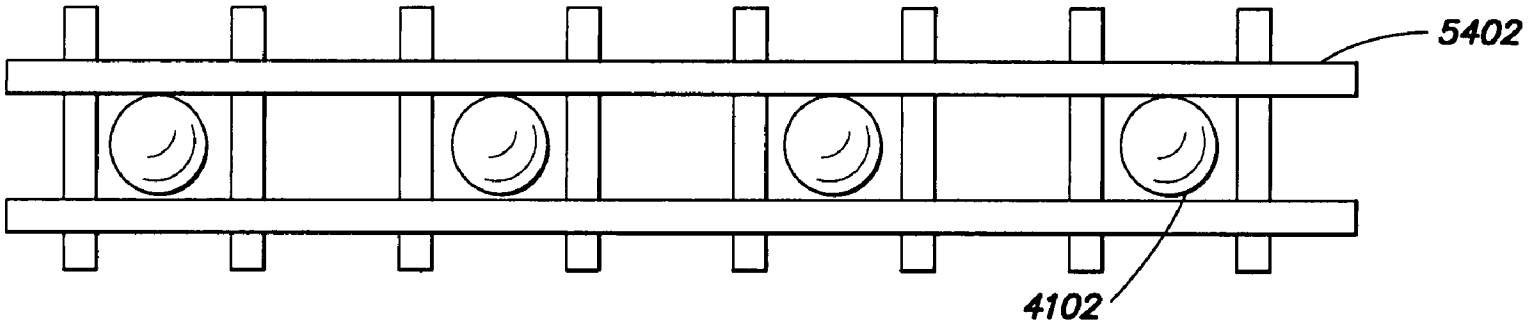
FIGS. 54A and 54B shows a grid for holding light nodes.
Figure 54B:
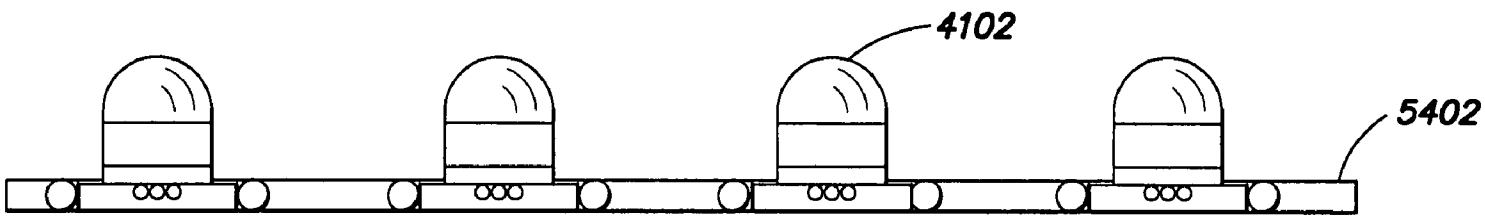

Referring to FIG. 54, light nodes 4102 can be arranged in the spacing within a wire grid 5402 with complete flexibility in the mounting subject only to the constraints of the grid 5402 itself. In this disclosure, the mounting surfaces themselves can also be shaped and 3-dimensional. There are no limitations on the shape of the mounting surface so long as provision is made for the mounting or attachment of the lighting elements.

Figure 55:
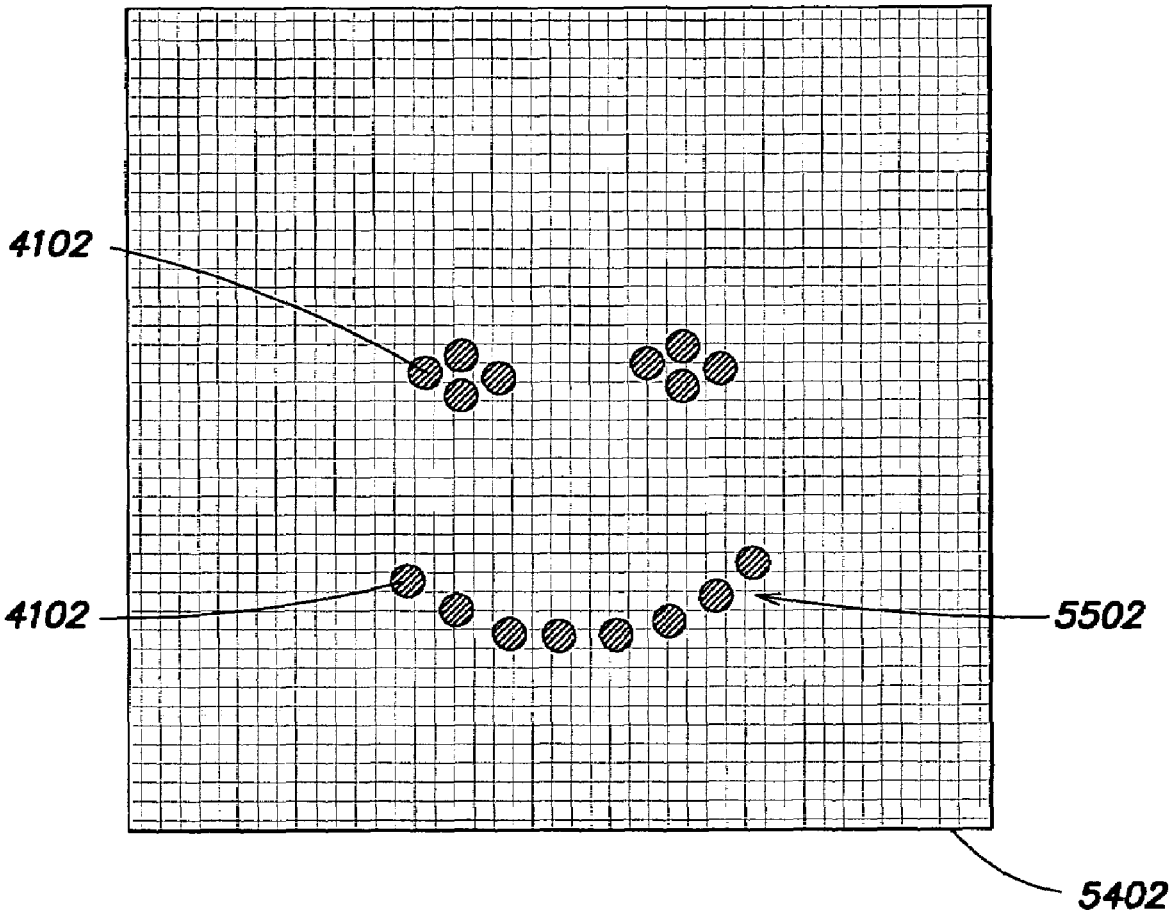
FIG. 55 shows an embodiment of a grid holding light nodes configured to represent a picture.

Referring to FIG. 55, complex arrangements of light nodes 4102 disposed in grids. 5402 can themselves form graphical elements, icons, and other representations of subject matter or artistic freedom, such as in the display 5502. As shown in FIG. 55, the location of the light nodes can form specific patterns and shapes that conform to a particular design. Although a dense array of such modules can be used to form any colored pattern, it may prove to be more economical to use specific patterns if the application only requires a subset of the dense array. This may be more economical and practical for many installations. Again, the grid 5402 shown in the figure is meant only to be illustrative of the potential for mounting and routing of light nodes 4102.

Figure 56:
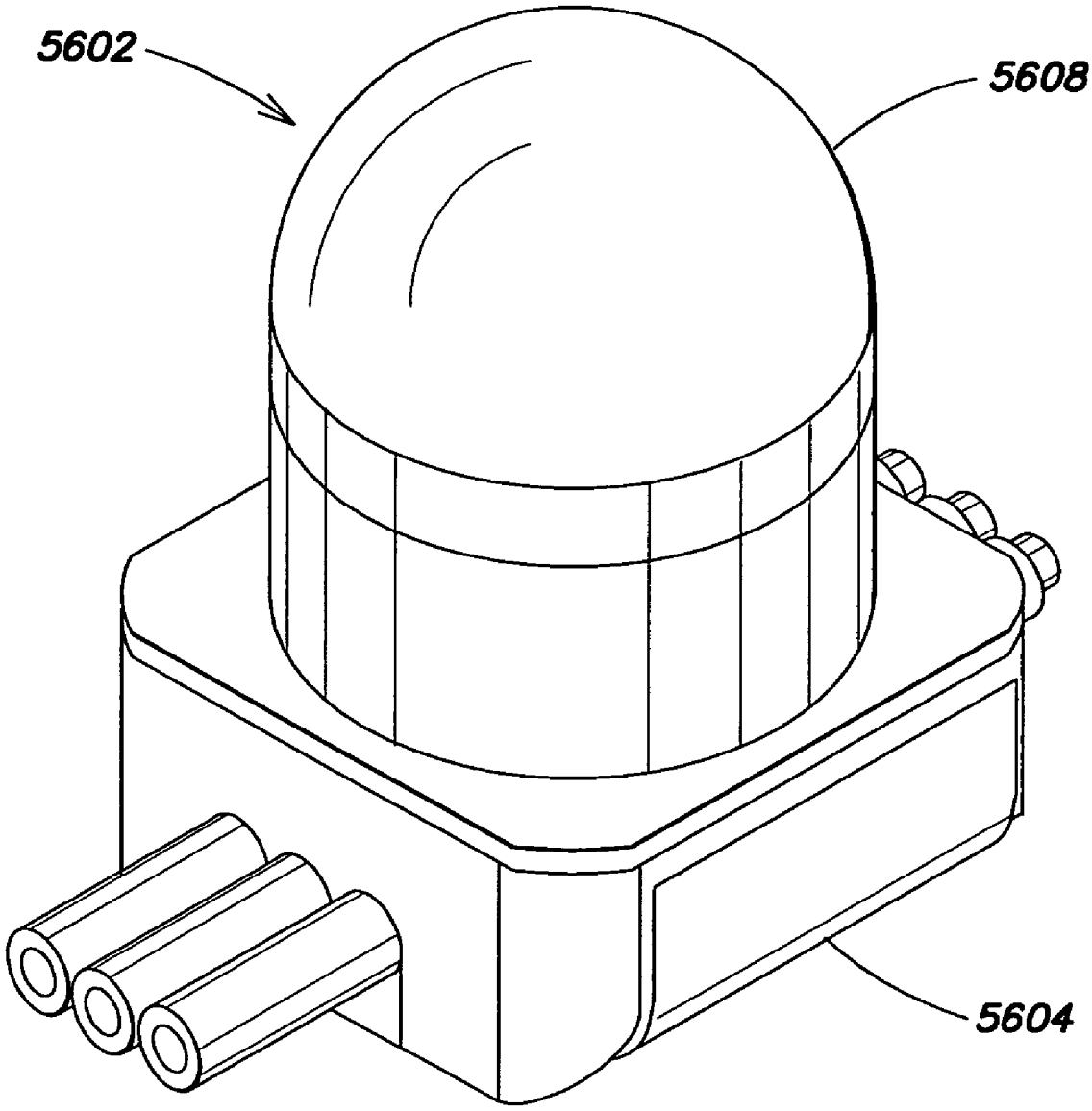
FIG. 56 shows a string light node with a short lens cap.

Methods and systems described herein also provide for various cap and lens options for light nodes or elements described herein. FIG. 56 depicts a light node 5602 with a snap module 5604 with a short lens option 5608. The design of FIG. 56 is one of many module designs. In this illustration the unit incorporates a hemispherical lens 5608. Such a lens 5608 is designed with a particular mating format to engage the base module 5604 and, as a result, the lens 5608 is modular and can take on many shapes depending on desired function such as optical characteristics or purely form-based based aesthetic appearance or application usage. Such lens designs may be in for form of licensed characters or jewel shaped or icons or corporate logos or any one of many custom shapes.

Figure 57:
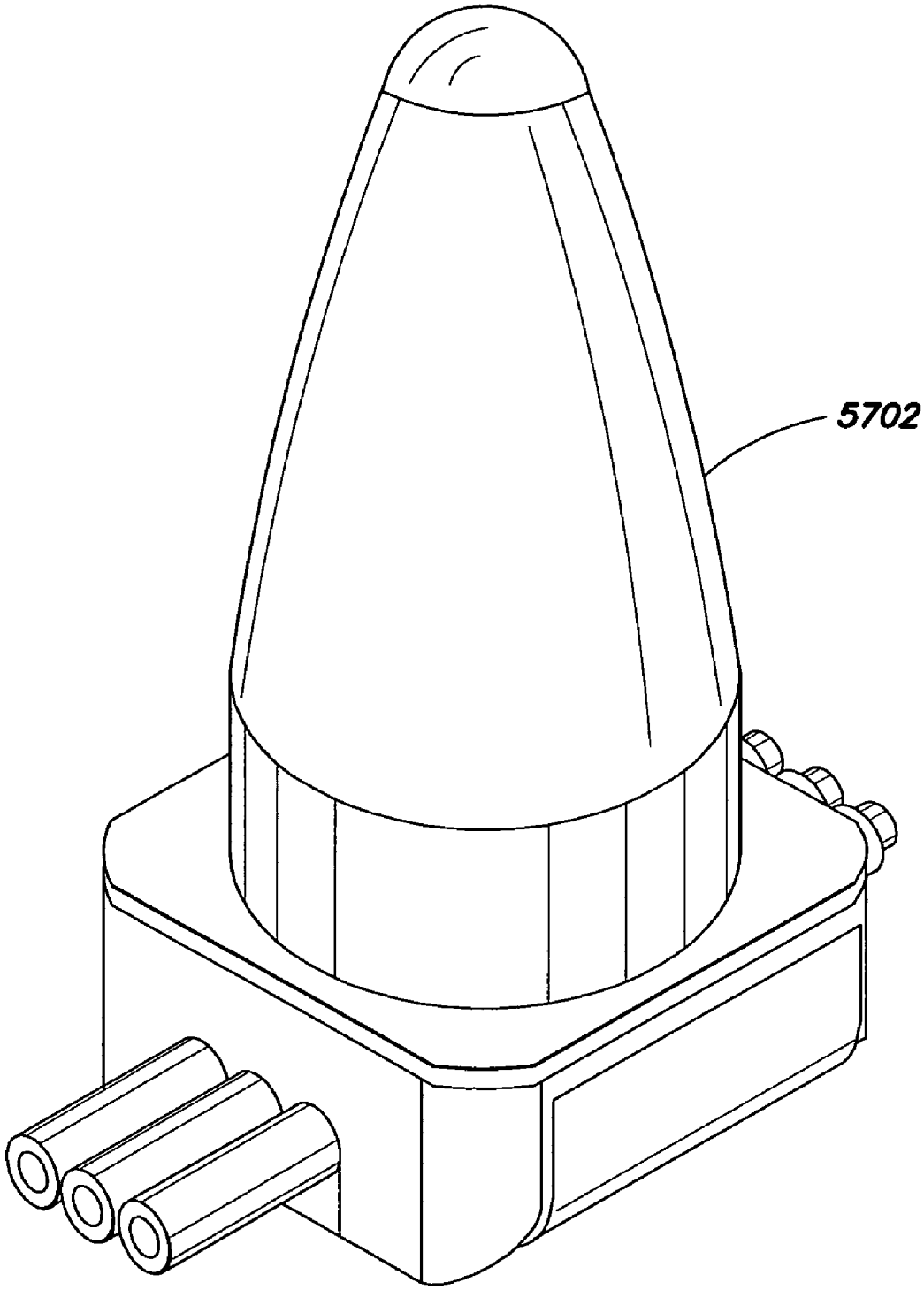
FIG. 57 shows a string light node with an elongated lens cap.

FIG. 57 shows a long lens 5702 wherein the exterior appearance may be a uniform light color along the entire lens assembly.

Figure 58:
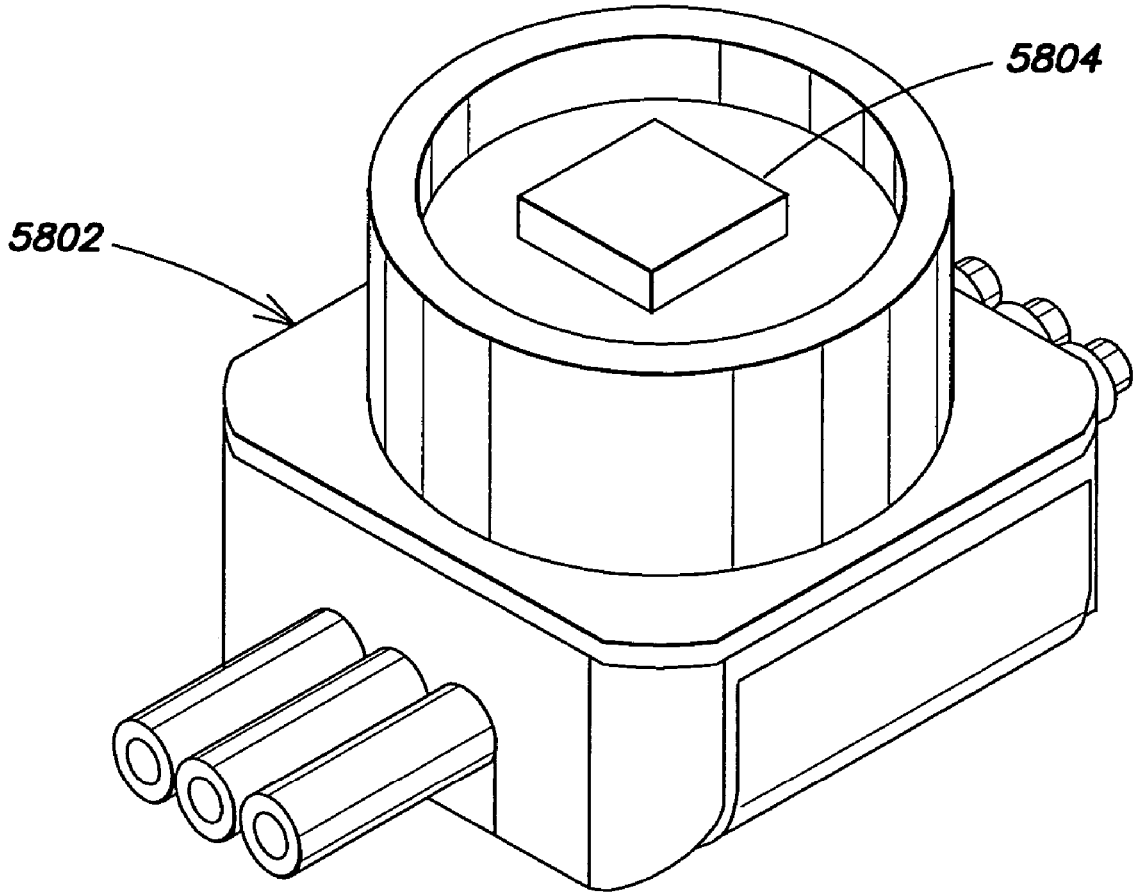
FIG. 58 shows a string light node with no lens cap.

FIG. 58 shows a light node 5802 without a lens. A module with no lens can accept a variety of lens configurations or no lens at all. In FIG. 58, the well 5804 surrounding the lighting emitter and electronics can be adapted to via a variety of cap or lens modules. The term 'lens' is not intended to be limiting in any way. The material and form of the 'lens' design can be optical facility to refract, reflect and diffuse the light but may be transparent, opaque in areas or translucent. It can be of any shape, part of which can conform to the module design. There is also no limitation on the scale of the unit—dimensions are meant to be illustrative of a particular design but the unit can be scaled up or down in size to provide functionality for many applications.

Figure 59:
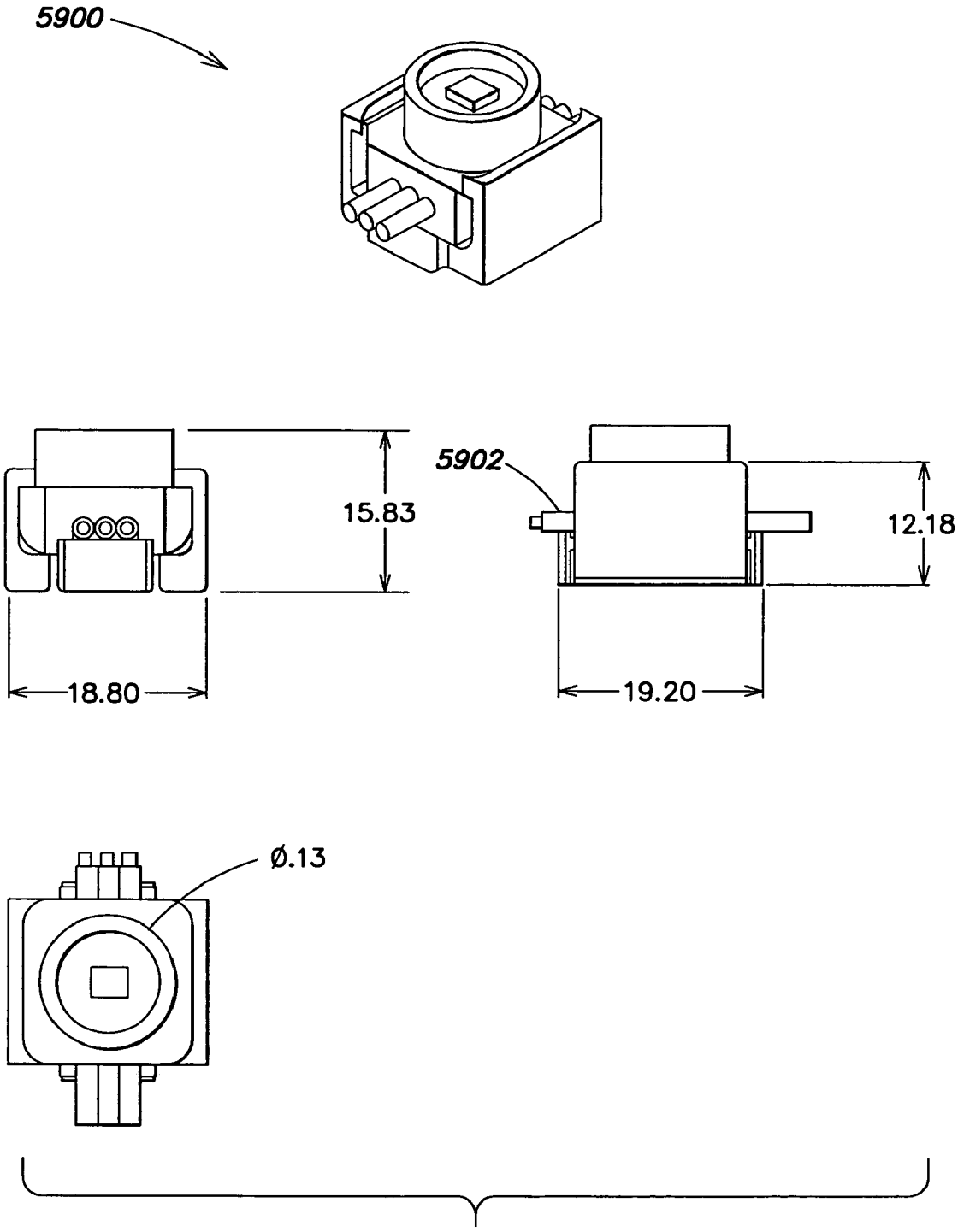
FIG. 59 shows a CAD drawing of a string light node.
Figure 60:
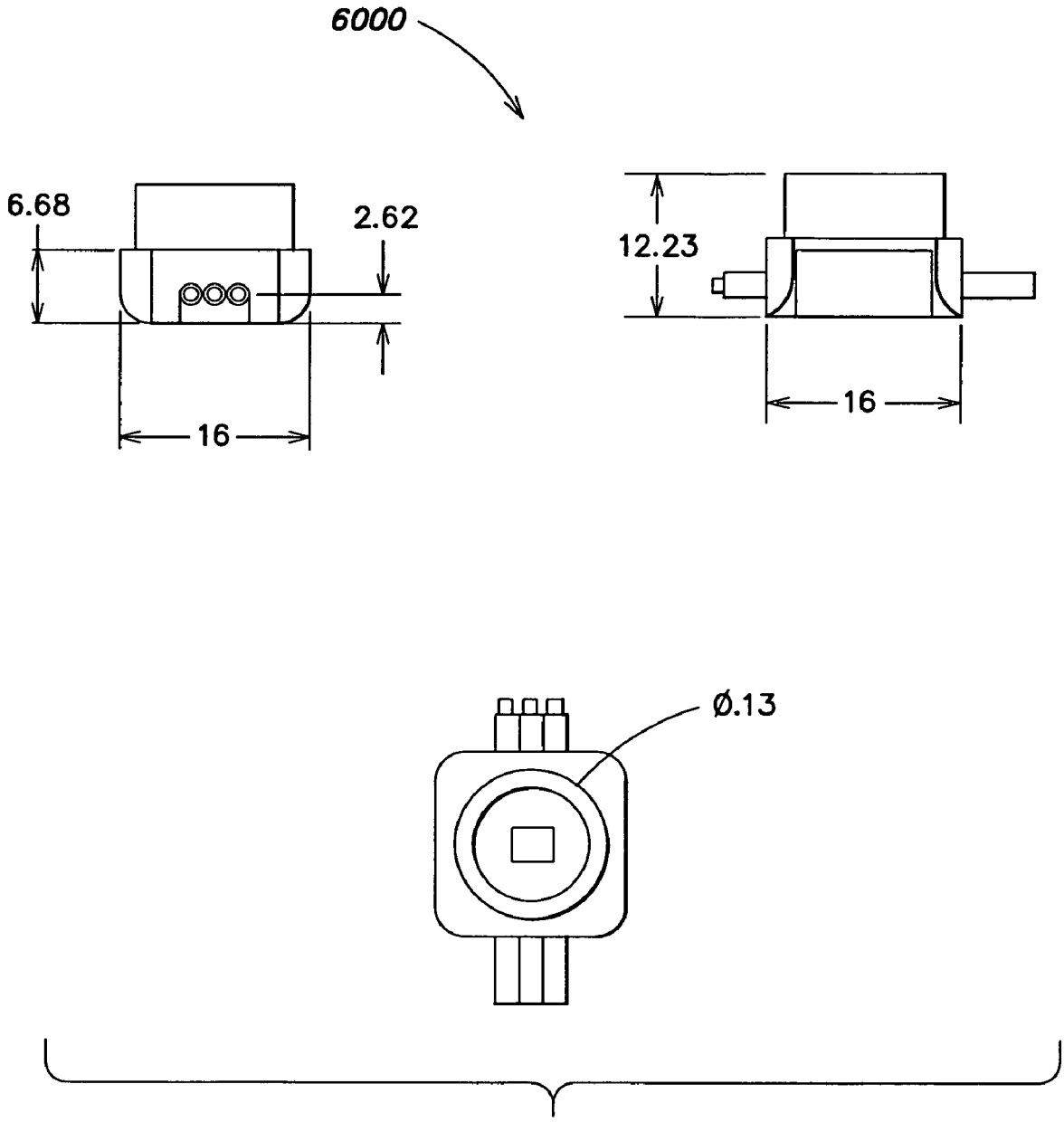
FIG. 60 shows a CAD drawing of a string light node in a no-lens embodiment.

FIG. 59 shows a computer aided design (CAD) drawing 5900 of a single node holder embodiment of a light node. FIG. 60 shows a CAD drawing 6000 of a no-lens embodiment of a light node. The modules showed in FIGS. 59 and 60 are representative modules with dimensions on the order of 10 mm or so. A light node can be easily scaled to much smaller sizes (1 mm scales for example) or even much larger sizes (100 or 1000 mm), wherein the modules are comprised of a plurality of light emitting elements within the module. FIG. 59 also shows a track mounting system 5902 for lighting elements or modules. In FIG. 59 the modules are shown being snapped or attached to a track shape providing for linear forms of module arrangement for many applications. A complete lighting unit can be provided for a variety of applications. In addition a bendable radius can be provided that gives, literally, flexibility in the lateral direction as well as the vertical direction for mounting to other surfaces.

Figure 61:
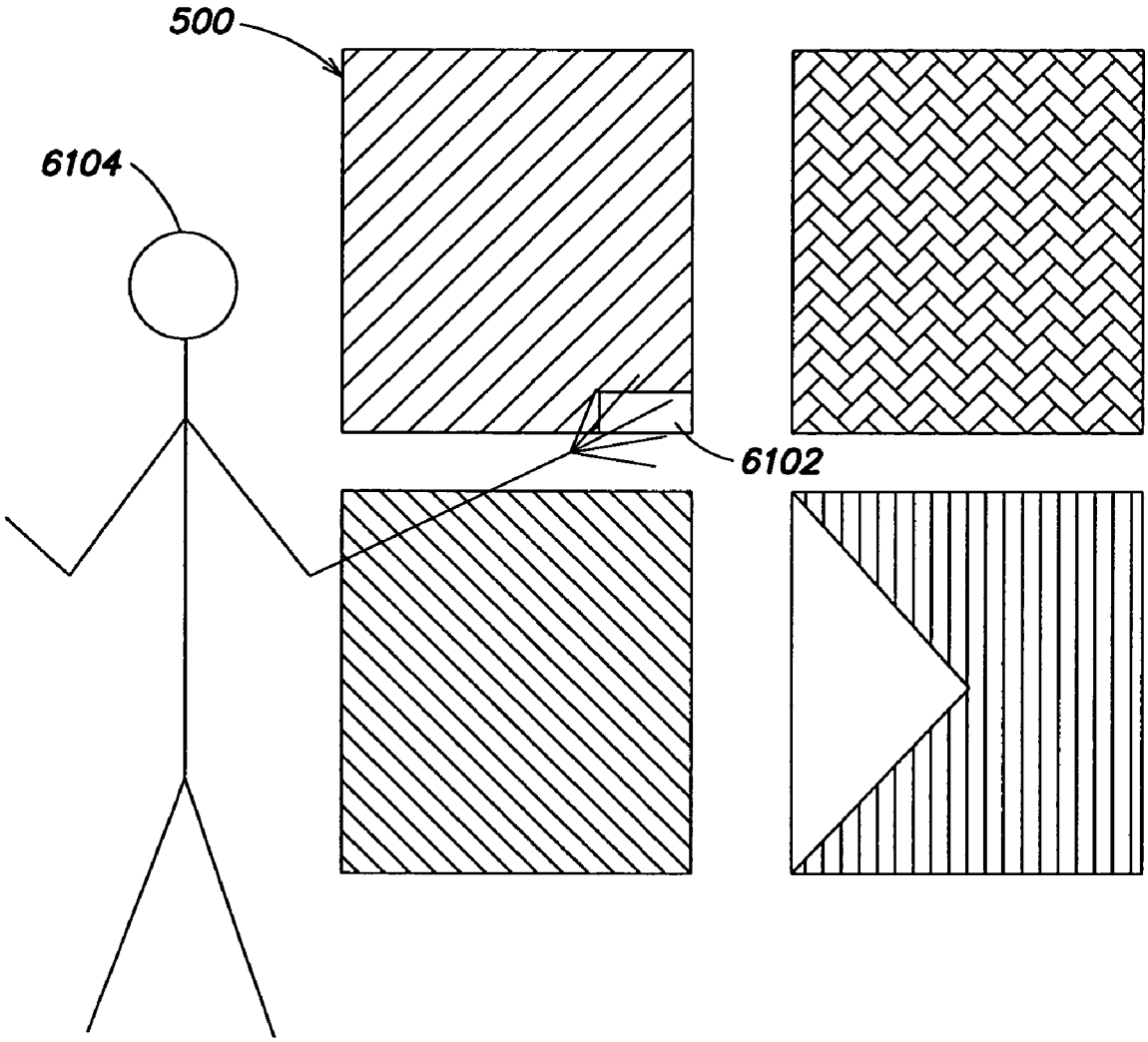
FIG. 61 shows a tile light with a sensing user interface.

Referring to FIG. 61, other embodiments of the invention may include embodiments that take advantage of various signal sources 124, such as sensors, as a basis for authoring a control signal for the tile 500. For example, a proximity sensor 6102 could be placed on or near a tile 500, in communication with the control system for the tile 500, so that when a user 6104 is in proximity to the tile 500, the tile changes color in a predetermined way. Thus, the proximity sensor 6102 serves as a user interface for the tile 500. An array of such tiles 500 with sensors 6102 can then be disposed, for example on a wall, so that the user 6104 can author various effects, such as by waving near various tiles in various sequences. For example, swiping a hand across the tiles 500 could produce a color-chasing rainbow or similar effect on the array of tiles 500.

Figure 62:
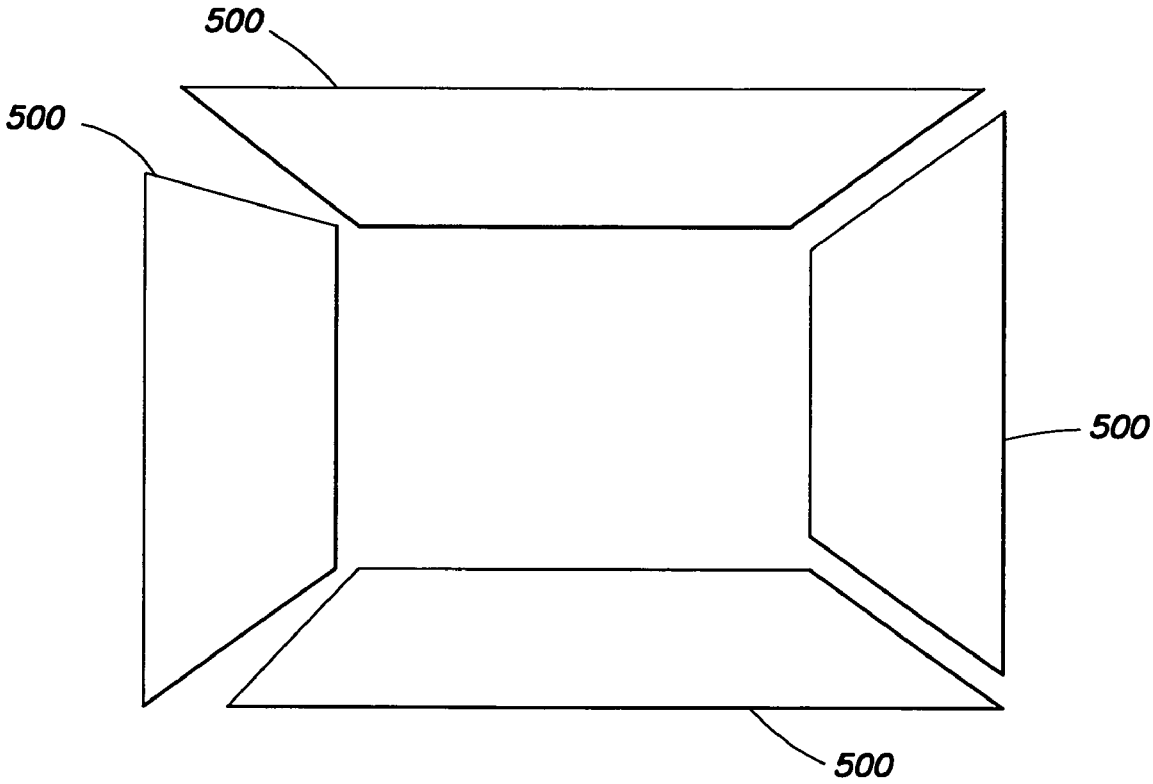
FIG. 62 shows surfaces on which a tile lighting unit may be disposed or in which it may be integrated.

Tiles 500 could be of any size, ranging from very small tiles on the order of the size of a group of LEDs to very large tiles. Referring to FIG. 62, tiles 500 are sized to cover an entire ceiling, floor, or wall, such as for a room or elevator. Thus, for example, a metal board could be made the size of a wall panel, with LEDs disposed on it and controlled, for example, with a string light or serial protocol as described above. The metal board could be shaped into any shape to fit a space, such as a rectangle, circle, regular polygon, or irregular shape. In embodiments, the metal board with LEDs could then be covered with a diffusing material, such as a translucent, elastic plastic or polymer that could be stretched over the board for installation as a unit. Such a unit could serve as a wall, a door, a ceiling, a floor, an elevator wall, or other construction units.

Figure 63:
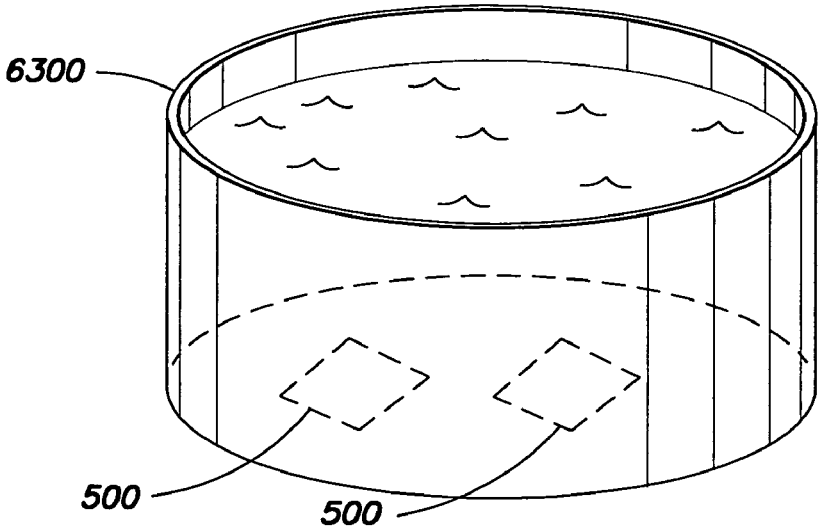
FIG. 63 shows an embodiment of a tile light for lighting a water environment.

In embodiments, the tiles 500 may be made water resistant for outdoor use or waterproof for underwater use. Thus, the tiles 500 can be covered with waterproof polymers, rubber, plastic, or other waterproof materials, and constructed with watertight construction, such as sealed connections for power and control cables. Such embodiments may include materials for thermally conducting heat away from the LEDs to increase the length of their use, such as metal or other conductive materials, which may be in thermal connection to water or other materials outside the tile 500. Water proof underwater tiles 500 can be used to illuminate the bottom or sides of an in ground or above ground swimming pool, a portable or in ground spa, the bottom or sides of a fountain, a pond or water display, a garden water display, an aquarium, or any other underwater environment. Thus, referring to FIG. 63, a tile 500 may be displayed, for example, in the bottom of a swimming pool 6300, spa, fountain, pond or aquarium, to provide digitally controlled illumination shows of various colors or color temperatures in the pool 6300.

Figure 64:
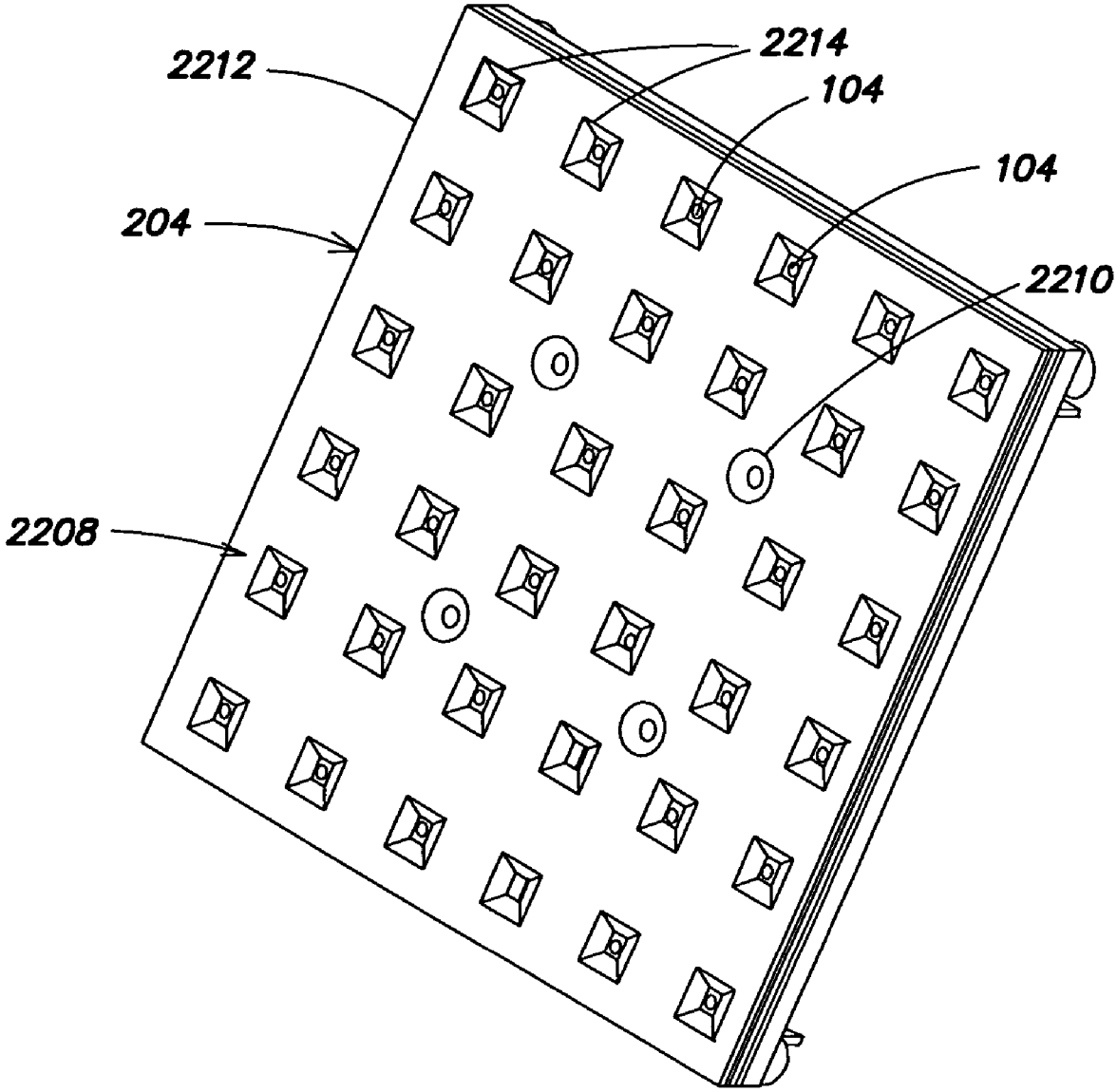
FIG. 64 shows a circuit board with an array of light sources.

In embodiments, the light sources 104 may be disposed on a support structure, such as a board 204. The board 204 may be a circuit board or similar facility suitable for holding light sources 104 as well as electrical components, such as components used in the electrical facility 202. Referring to FIG. 64, in embodiments the board 204 may consist of a rectangular board 204, with an array or grid 2208 of light sources 104. In the embodiment depicted in FIG. 64, the array is a six-by-six array on a square board 204 with six-inch sides. The array 2208 can have any number of light sources 104 and take on any other dimensions. The light sources may consist of miniature groups of LEDs, such as red, green, blue, white or other colors of LEDs. In embodiments each light source 104 is comprised of a triad of red, green and blue surface mount LEDs. The square array makes it very convenient for the array 2208 to be placed side by side with other boards 204 containing similar arrays 2208, so that effects can be generated across multiple arrays 2208, such as an extended system covering a wall or the outside of a building. That is, the arrays 2208 can serve as modular components of larger lighting systems. To facilitate rapid installation, the board 204 may have a plurality of prefabricated screw holes 2210 that make it very convenient to attach the board 204 to a wall or other mounting area. In embodiments the board 204 is provided with a protective cover 2212, such as a plastic cover to protect the board from damage and to prevent a user from touching electrical connections on the board 204. The cover 2212 may include spaces 2214, so that a viewer can see the light sources 104 directly without having light diffused through the cover 2212. In other embodiments the cover 2212 may be a light transmitting cover or a light diffusing cover.

Figure 65:
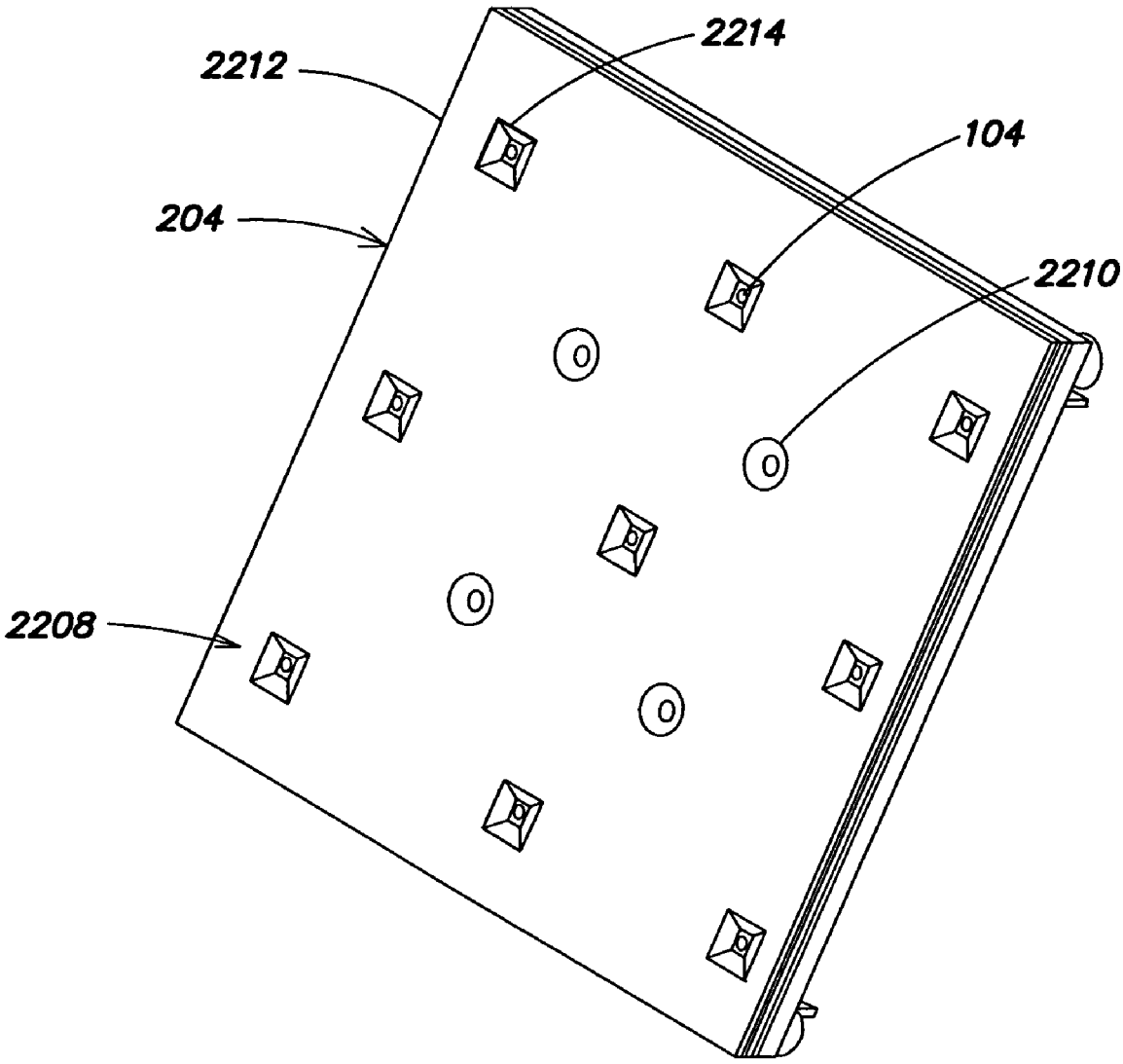
FIG. 65 shows another embodiment of a circuit board with an array of light sources.

Referring to FIG. 65, in another embodiment the array 2208 of light sources 104 may be a three-by-three array, less dense than the six-by-six array of FIG. 65, but including similar elements, such as the board 204 (again a six-inch by six-inch board 204), the cover 2212, the screw holes 2210 and the spaces 2214 through which the viewer can directly see the light sources 104. Again the light sources 104 may consist of various colors of LED, such as a trio of red, green and blue surface mount LEDs.

Figure 66:
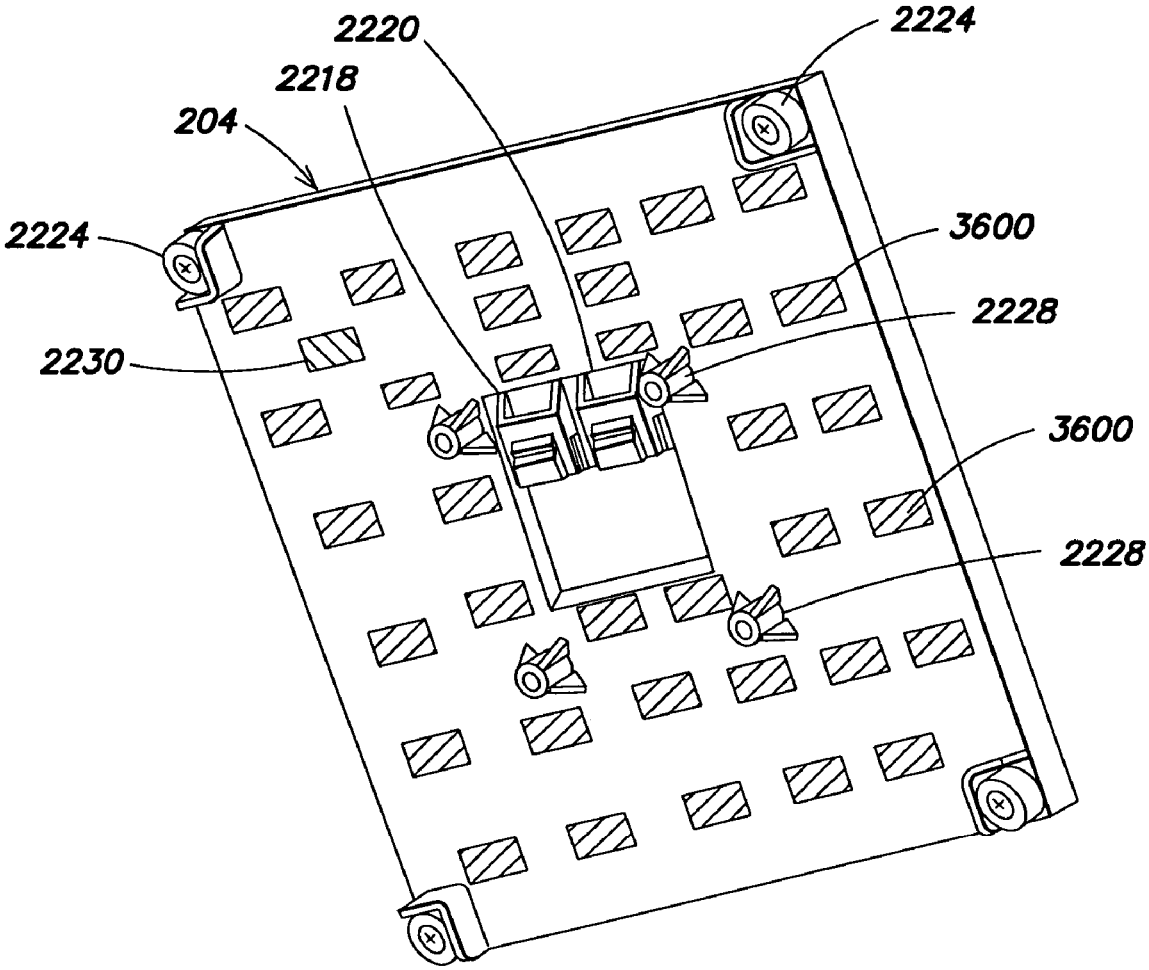
FIG. 66 shows a back view of the printed circuit board of FIGS. 64 and 65.

FIG. 66 shows the back of a board 204 such as the rectangular array 2208 boards 204 described in connection with FIGS. 64 and 65. The board 204 includes a jack 2218 for taking in power and data from a source and a jack 2220 for sending power and data out. In embodiments the jacks 2218, 2220 allow the board 204 to be aligned in series with other boards 204, where data from a central controller is passed from board-to-board by the jacks 2218, 2220. In embodiments each group of light sources 104 in the array 2208 may be provided with a processor, such as an ASIC 3600, for handling lighting control signals for the light sources 104. In embodiments the ASICs 3600 are disposed in series and are controlled by a serial control facility such as described herein, where each ASIC takes a data stream, responds to the first unmodified byte, modifies the byte to which it responds, and sends the modified data stream to the next ASIC. The ASICs 3600 on the back of the board 204 may be strung in an array, such as the six-by-six array 2208 or the three-by-three array 2208. In embodiments each of the ASICs 3600 is disposed along with a resistor and a capacitor on the back of the board 204. The board 204 may also contain an additional ASIC 2230, such as to allow a central controller to identify the particular type of board 204 on which the ASICs are disposed, such as to identify the board 204 as a six-by-six or three-by-three array. The board 204 may also include extrusions 2228 from the screw holes 2210 of the board. The extrusions 2228 guide the screws that attached the board 204 to a surface, and they also provide an offset between the back of the board 204 and the surface, so that the ASICs 3600 or other components are not crushed when the board 204 is attached to the surface. Corner extrusions 2224 provide an offset at the corners of the board 204 as well.

In embodiments the cover 2212 may be fitted with lenses, diffusers or other optical facilities 400 that shape the light coming from the light sources 104 that make up the arrays 2208, such as to increase the viewing angle of light sources 104.

In embodiments the lighting units 100 may include a dipline style mounting panel that allows units to be placed anywhere on a surface. The boards 204 may include integrated hash marks for aligning units 100 during installation. In embodiments boards 204 may have an integrated laser level to facilitate accurate installation. In this embodiment a layered surface of conductors such as Dipline-style (Dipline is a trademarked layered conductive mounting material) surface material is used to allow units to be placed anywhere on surface by inserting of modular attached pin connectors to be pushed through the surface of the materials to make contact with selected conductive layers within the surface.

Figure 67B:
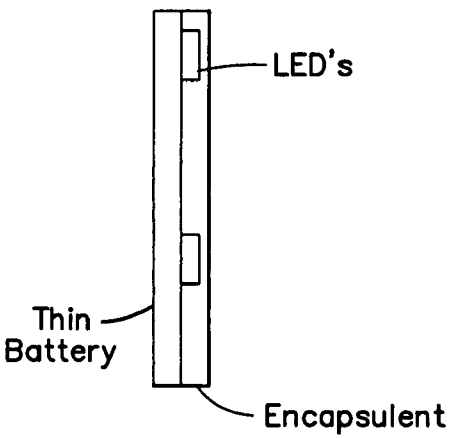
FIGS. 67A, 67B, and 67C shows additional configurations for lighting units.
Figure 67A:
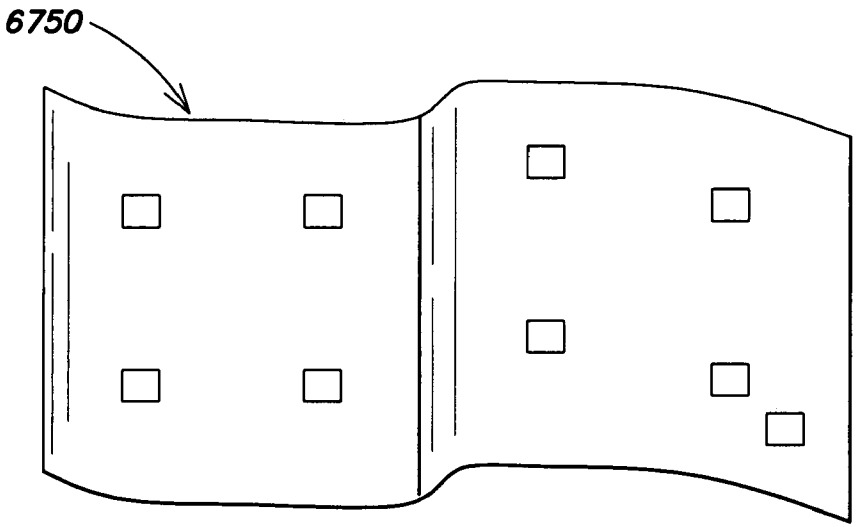
Figure 67C:
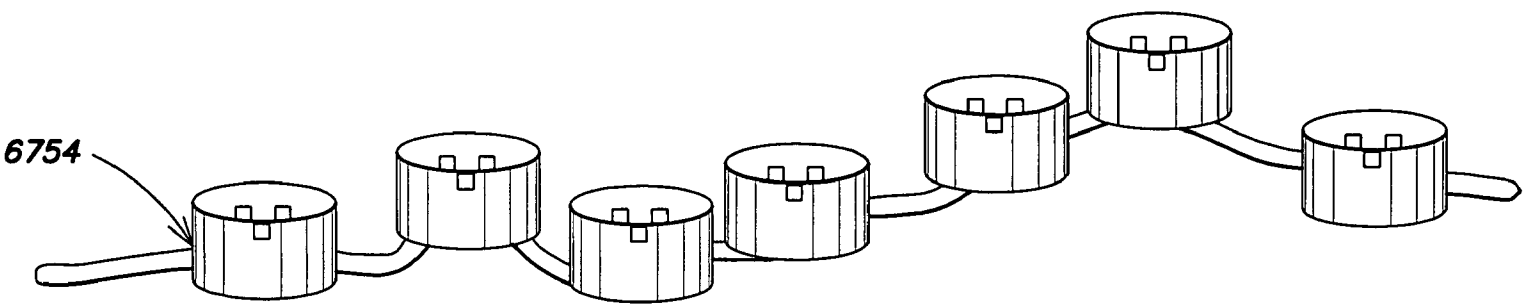

Referring to FIG. 67, housings may also take the form of a flexible band 6750, tape or ribbon to allow the user to conform the housing to particular shapes or cavities. Thus, the various embodiments of tiles 500 described herein can be flexible tiles. Similarly, housings can take the form of a flexible string 6754. Such a band 6750 or string 6754 can be made in various lengths, widths and thicknesses to suit specific demands of applications that benefit from flexible housings, such as for shaping to fit body parts or cavities for surgical lighting applications, shaping to fit objects, shaping to fit unusual spaces, or the like. In flexible embodiments it may be advantageous to use thin-form batteries, such as polymer or "paper" batteries for small bands 6750 or strings 6754.

Figure 68:
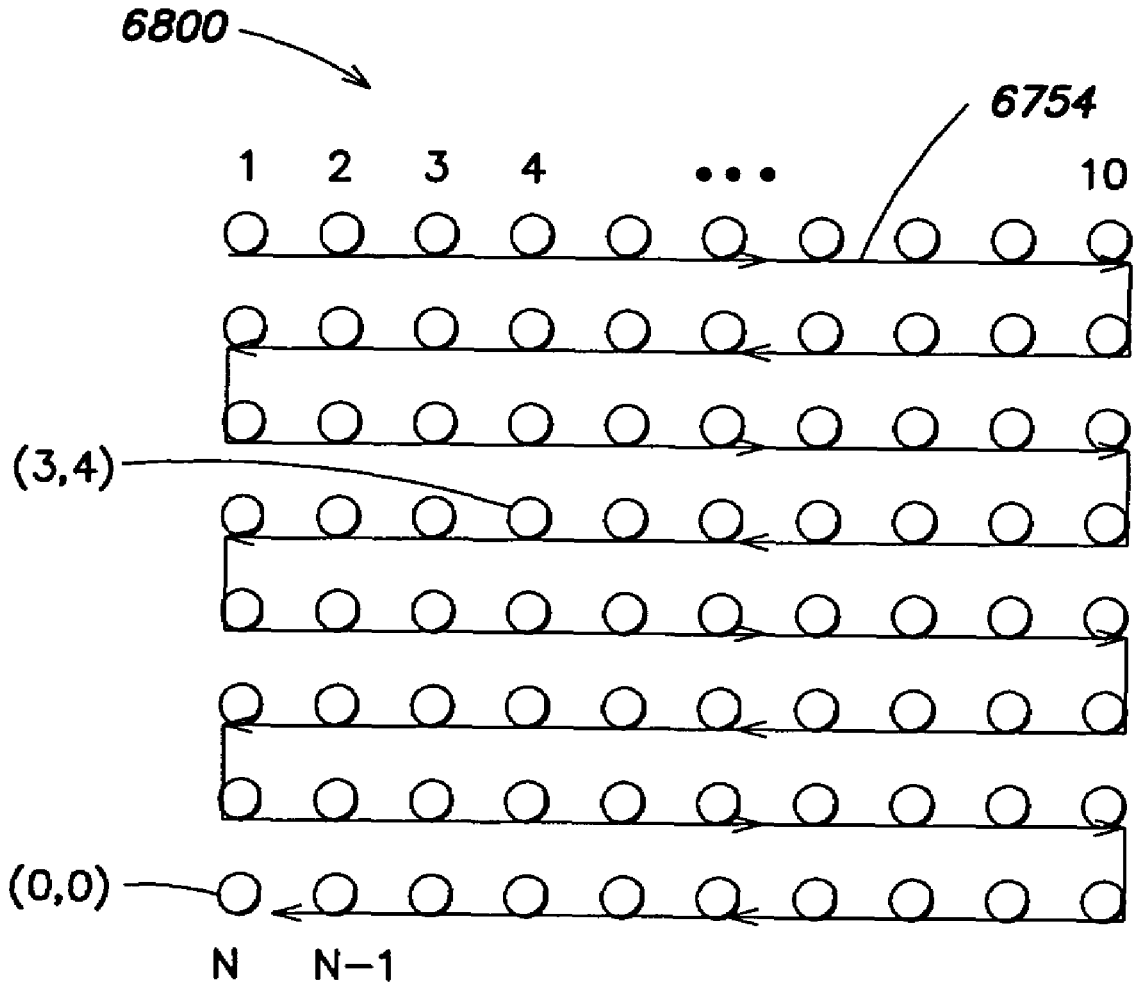
FIG. 68 shows an array created from a plurality of nodes.

Referring to FIG. 68, an array 6800 can be formed from a flexible string 6754, such as a string of string light nodes as described in connection with FIGS. 56 through 59 and in documents incorporated herein by reference. While such an array 6800 can be flexible, once positioned, the array can be used to display similar effects to a rigid grid, such as one disposed on a circuit board as described in connection with FIGS. 64 through 66. For example, an array 6800 can be strung on the outside of the building, such as by clipping flexible strings of nodes in rows and/or columns, or by stringing nodes in channels to create a linear arrangement. Such an array can be used, for example, to display effects that are designed to run on large arrays, including color-changing shows, graphical effects, animation effects, video-type effects, scrolling text effects, and others.

Figure 69A:
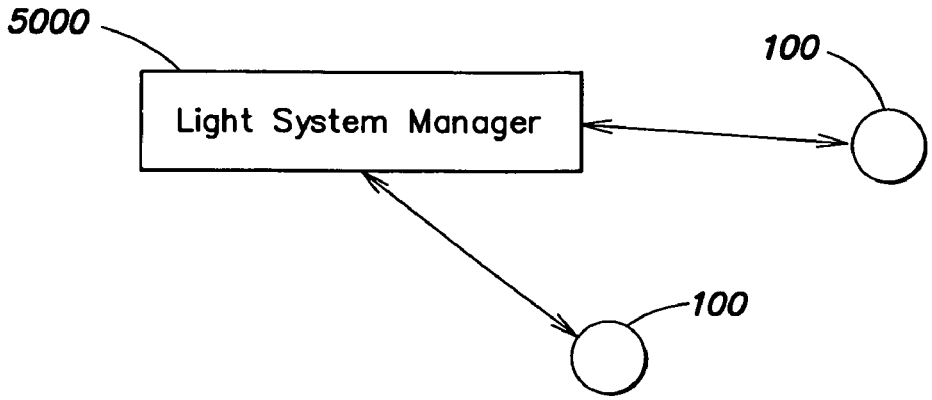
FIGS. 69A and 69B shows a light system manager facility.
Figure 69B:
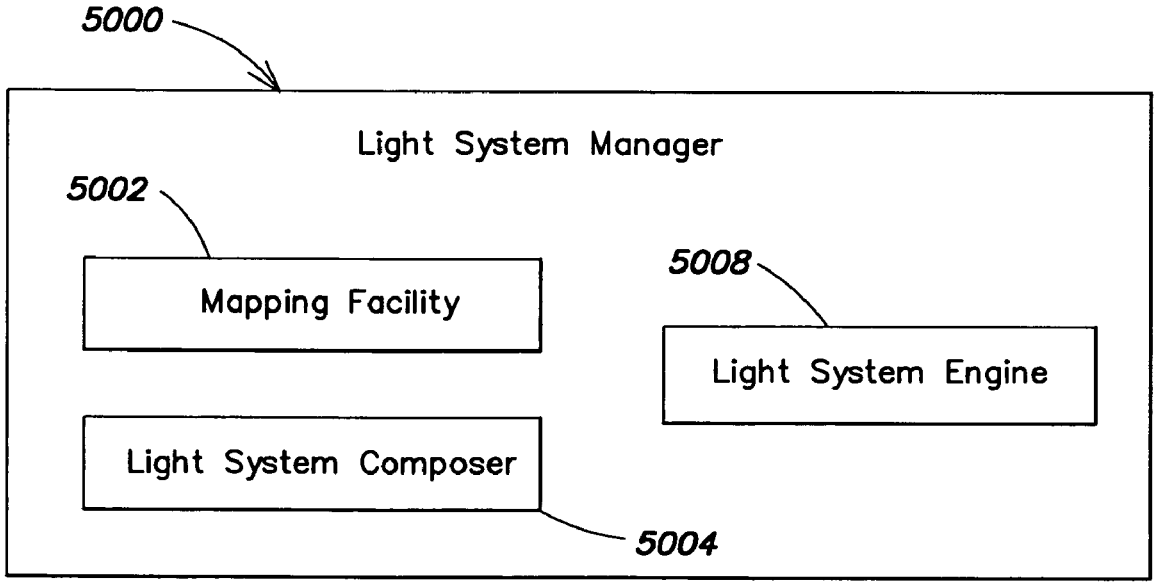

Referring to FIG. 69*a*, it is desirable to provide a light system manager 5000 to manage control of a plurality of lighting units 100 or light systems. Referring to FIG. 69*b*, the light system manager 5000 is provided, which may consist of a combination of hardware and software components. Included is a mapping facility 5002 for mapping the locations of a plurality of light systems. The mapping facility may use various techniques for discovering and mapping the locations of lights, such as described herein or as known to those of skill in the art. Locations may be physical locations in the world or may be relative locations, such as the relative position of a lighting unit 100 in a string or array of lighting units 100. Also provided is a light system composer 5004 for composing one or more lighting shows that can be displayed on a light system. The authoring of the shows may be based on geometry and an object-oriented programming approach, such as the geometry of the light systems that are discovered and mapped using the mapping facility, according to various methods and systems disclosed herein and in the documents incorporated herein by reference or known in the art. Also provided is a light system engine 5008, for playing lighting shows by executing code for lighting shows and delivering lighting control signals, such as to one or more lighting systems, or to related systems, such as power/data systems, that govern lighting systems. Further details of the light system manager 5000, mapping facility 5002, light system composer 5004 and light system engine 5008 are provided herein.

The light system manager 5000, mapping facility 5002, light system composer 5004 and light system engine 5008 may be provided through a combination of computer hardware, telecommunications hardware and computer software components. The different components may be provided on a single computer system or distributed among separate computer systems.

Figure 70:
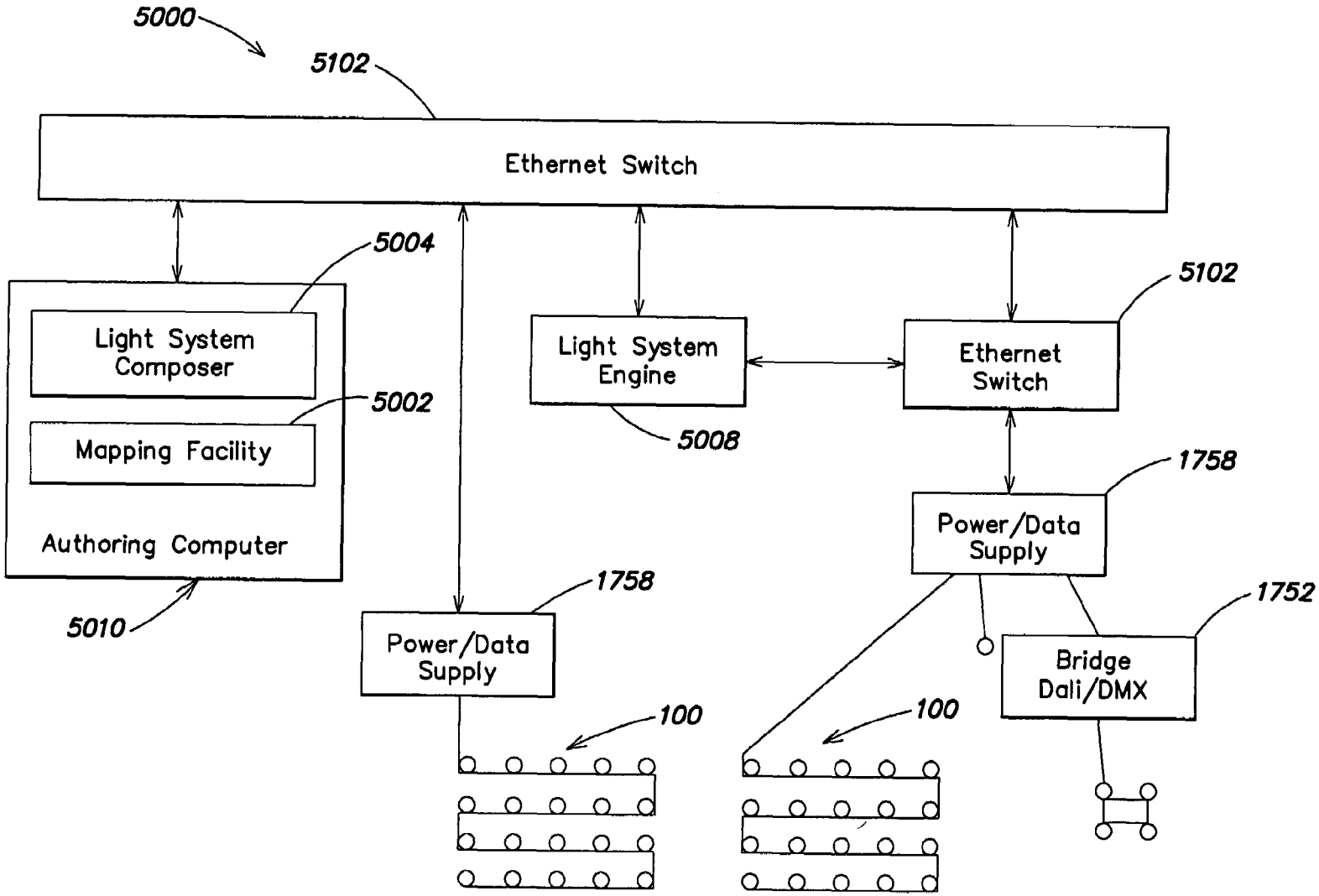
FIG. 70 shows an embodiment of a networked light system manager facility.

Referring to FIG. 70, in an embodiment, the mapping facility 5002 and the light system composer 5004 are provided on an authoring computer 5010. The authoring computer 5010 may be a conventional computer, such as a personal computer. In embodiments the authoring computer 5010 includes conventional personal computer components, such as a graphical user interface, keyboard, operating system, memory, and communications capability. In embodiments the authoring computer 5010 operates with a development environment with a graphical user interface, such as a Windows environment. The authoring computer 5010 may be connected to a network, such as by any conventional communications connection, such as a wire, data connection, wireless connection, network card, bus, Ethernet connection, Firewire, 802.11 facility, Bluetooth, or other connection. In embodiments, such as in FIG. 70, the authoring computer 5010 is provided with an Ethernet connection, such as via an Ethernet switch 5102, so that it can communicate with other Ethernet-based devices, optionally including the light system engine 5008, a light system itself (enabled for receiving instructions from the authoring computer 5010), or a power/data supply (PDS) 1758 that supplies power and/or data to a light system comprised of one or more lighting units 100. For example the light system might be a tile light 500 or board 204 with an array 2208, with a plurality of lighting units 100 arranged in a grid pattern. The mapping facility 5002 and the light system composer 5004 may comprise software applications running on the authoring computer 5010.

Referring still to FIG. 70, in an architecture for delivering control systems for complex shows to one or more light systems, shows that are composed using the authoring computer 5010 are delivered via an Ethernet connection through one or more Ethernet switches to the light system engine 5008. The light system engine 5008 downloads the shows composed by the light system composer 5004 and plays them, generating lighting control signals for light systems. In embodiments, the lighting control signals are relayed by an Ethernet switch to one or more power/data supplies and are in turn relayed to light systems that are equipped to execute the instructions, such as by turning LEDs on or off, controlling their color or color temperature, changing their hue, intensity, or saturation, or the like. In embodiments the power/data supply may be programmed to receive lighting shows directly from the light system composer 5004. In embodiments a bridge 1752 may be programmed to convert signals from the format of the light system engine 5008 to a conventional format, such as DMX or DALI signals used for entertainment lighting.

The light system composer 5004 can employ the graphical representation and object-oriented authoring techniques described in connection with FIGS. 24 through 33 above. Thus, graphical representations, including those that represent video signals, can thus be converted to control instructions, where the lighting control signals map locations of lighting units 100 to corresponding locations in the graphical representation. In the case of a graphical representation of an incoming video signal, the row/column format of a conventional video signal can be mapped to the format of a group of lighting units 100, such as units disposed in a tile light 500 or array 2208 on a board 204. Thus, a tile light 500 or array 2208 can be used to display video effects in various resolutions, as well as other animated effects, graphics, scrolling text effects, and a wide variety of color-changing effects.

Figure 71:
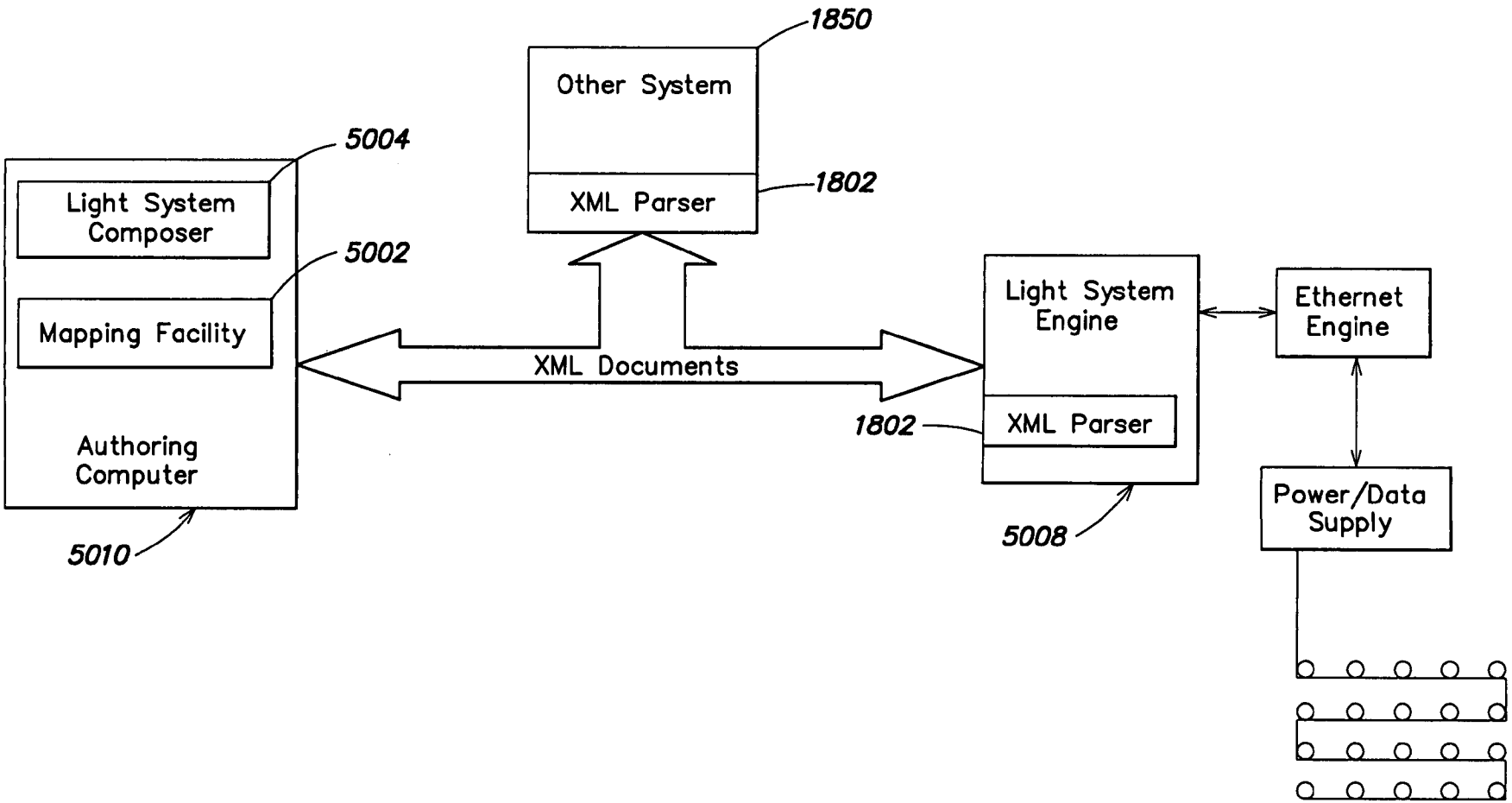
FIG. 71 shows an embodiment of a light system manager where control instructions are relayed as XML scripts.

Referring to FIG. 71, in embodiments the lighting shows composed using the light system composer 5004 are compiled into simple scripts that are embodied as XML documents. The XML documents can be transmitted rapidly over Ethernet connections. In embodiments, the XML documents are read by an XML parser 1802 of the light system engine 5008. Using XML documents to transmit lighting shows allows the combination of lighting shows with other types of programming instructions. For example, an XML document type definition may include not only XML instructions for a lighting show to be executed through the light system engine 5008, but also XML with instructions for another computer system 1850, such as a sound system, and entertainment system, a multimedia system, a video system, an audio system, a sound-effect system, a smoke effect system, a vapor effect system, a dry-ice effect system, another lighting system, a security system, an information system, a sensor-feedback system, a sensor system, a browser, a network, a server, a wireless computer system, a building information technology system, or a communication system.

Thus, methods and systems provided herein include providing a light system engine for relaying control signals to a plurality of light systems, wherein the light system engine plays back shows. The light system engine 5008 may include a processor, a data facility, an operating system and a communication facility. The light system engine 5008 may be configured to communicate with a DALI or DMX lighting control facility. In embodiments, the light system engine communicates with a lighting control facility that operates with a serial communication protocol. In embodiments the lighting control facility is a power/data supply for a lighting unit 100.

In embodiments, the light system engine 5008 executes lighting shows downloaded from the light system composer 5004. In embodiments the shows are delivered as XML files from the light system composer 5004 to the light system engine 5008. In embodiment the shows are delivered to the light system engine over a network. In embodiments the shows are delivered over an Ethernet facility. In embodiments the shows are delivered over a wireless facility. In embodiments the shows are delivered over a Firewire facility. In embodiments shows are delivered over the Internet.

In embodiments lighting shows composed by the light system composer 5004 can be combined with other files from another computer system, such as one that includes an XML parser that parses an XML document output by the light system composer 5004 along with XML elements relevant to the other computer. In embodiments lighting shows are combined by adding additional elements to an XML file that contains a lighting show. In embodiments the other computer system comprises a browser and the user of the browser can edit the XML file using the browser to edit the lighting show generated by the lighting show composer. In embodiments the light system engine 5008 includes a server, wherein the server is capable of receiving data over the Internet. In embodiments the light system engine 5008 is capable of handling multiple zones of light systems, wherein each zone of light systems has a distinct mapping. In embodiments the multiple zones are synchronized using the internal clock of the light system engine 5008.

The methods and systems included herein include methods and systems for providing a mapping facility 5002 of the light system manager 5000 for mapping locations of a plurality of light systems. In embodiments, the mapping system discovers lighting systems in an environment, using techniques described above. In embodiments, the mapping facility then maps light systems in a two-dimensional space, such as using a graphical user interface.

In embodiments of the invention, the light system engine 5008 comprises a personal computer with a Linux operating system. In embodiments the light system engine is associated with a bridge to a DMX or DALI system.

An embodiment of the DirectLight API described above follows on the subsequent pages.

A Programming Interface for Controlling Lighting

Important Items You Should Read First.

1) The sample program and Real Light Setup won't run until you register the DirectLight.dll COM object with Windows on your computer. Two small programs cleverly named "Register DirectLight.exe" and "Unregister DirectLight.exe" have been included with this install.

2) DirectLight assumes that you have a SmartJack hooked up to COM1. You can change this assumption by editing the DMX_INTERFACE_NUM value in the file "my_lights.h."

About DirectLight

Organization

An application (for example, a 3D rendered game) can create virtual lights within its 3D world. DirectLight can map these lights onto real-world digital lights with color and brightness settings corresponding to the location and color of the virtual lights within the game.

In DirectLights three general types of virtual lights exist:

Dynamic light. The most common form of virtual light has a position and a color value. This light can be moved and it's color changed as often as necessary. Dynamic lights could represent glowing space nebulae, rocket flares, a yellow spotlight flying past a corporate logo, or the bright red eyes of a ravenous mutant ice-weasel.

Ambient light is stationary and has only color value. The sun, an overhead room light, or a general color wash are examples of ambient. Although you can have as many dynamic and indicator lights as you want, you can only have one ambient light source (which amounts to an ambient color value).

Indicator lights can only be assigned to specific real-world lights. While dynamic lights can change position and henceforth will affect different real-world lights, and ambient lights are a constant color which can effect any or all real-world lights, indicator lights will always only effect a single real-world light. Indicators are intended to give feedback to the user separate from lighting, e.g. shield status, threat location, etc.

All these lights allow their color to be changed as often as necessary.

In general, the user will set up the real-world lights. The "my_lights.h" configuration file is created in, and can be edited by, the "DirectLight GUI Setup" program. The API loads the settings from the "my_lights.h" file, which contains all information on where the real-world lights are, what type they are, and which sort of virtual lights (dynamic, ambient, indicator, or some combination) are going to affect them.

Virtual lights can be created and static, or created at run time dynamically. DirectLights runs in it's own thread; constantly poking new values into the lights to make sure they don't fall asleep. After updating your virtual lights you send them to the real-world lights with a single function call. DirectLights handles all the mapping from virtual world to real world.

If your application already uses 3D light sources, implementing DirectLight can be very easy, as your light sources can be mapped 1:1 onto the Virtual_Light class.

A typical setup for action games has one overhead light set to primarily ambient, lights to the back, side and around the monitor set primarily to dynamic, and perhaps some small lights near the screen set to indicators.

The ambient light creates a mood and atmosphere. The dynamic lights around the player give feedback on things happening around him: weapons, environment objects, explosions, etc. The indicator lights give instant feedback on game parameters: shield level, danger, detection, etc.

Effects (LightingFX) can be attached to lights which override or enhance the dynamic lighting. In Star Trek: Armada, for example, hitting Red Alert causes every light in the space to pulse red, replacing temporarily any other color information the lights have.

Other effects can augment. Explosion effects, for example, can be attached to a single virtual light and will play out over time, so rather than have to continuously tweak values to make the fireball fade, virtual lights can be created, an effect attached and started, and the light can be left alone until the effect is done.

Real lights have a coordinate system based on the space they are installed in. Using a person sitting at a computer monitor as a reference, their head should be considered the origin. X increases to their right. Y increases towards the ceiling. Z increases towards the monitor.

Virtual lights are free to use any coordinate system at all. There are several different modes to map virtual lights onto real lights. Having the virtual light coordinate system axis-aligned with the real light coordinate system can make your life much easier.

Light positions can take on any real values. The DirectLight GUI setup program restricts the lights to within 1 meter of the center of the space, but you can change the values by hand to your heart's content if you like. Read about the Projection Types first, though. Some modes require that the real world and virtual world coordinate systems have the same scale.

Getting Started

Installing DirectLight SDK

Running the Setup.exe file will install:

In /Windows/System/ three dll files, one for DirectLight, two for low-level communications with the real-world lights via DMX.

DirectLight.dll
DMXIO.dll
DLPORTIO.dll

In the folder you installed DirectLight in: Visual C++ project files, source code and header files:

DirectLight.dsp
DirectLight.dsw
etc.
DirectLight.h
DirectLight.cpp
Real_Light.h

Real_Light.cpp

Virtual_Light.h

Virtual_Light.cpp etc.

compile time libraries:

FX_Library.lib

DirectLight.lib

DMXIO.lib and configuration files:

my_lights.h light_definitions.h

GUI_config_file.h

Dynamic_Localized_Strings.h

The "my_lights.h" file is referenced both by DirectLight and DirectLight GUI Setup.exe. "my_lights.h" in turn references "light_definitions.h" The other files are referenced only by DirectLight GUI Setup. Both the DLL and the Setup program use a registry entry to find these files:

HKEY_LOCAL_MACHINE\Software\ColorKinetics\DirectLight\1.00.000\location

Also included in this directory is this documentation, and subfolders:

FX_Libraries contain lighting effects which can be accessed by DirectLights.

Real Light Setup contains a graphical editor for changing info about the real lights.

Sample Program contains a copiously commented program demonstrating how to use DirectLight.

DirectLight COM

The DirectLight DLL implements a COM object which encapsulates the DirectLight functionality. The DirectLight object possesses the DirectLight interface, which is used by the client program.

In order to use the DirectLight COM object, the machine on which you will use the object must have the DirectLight COM server registered (see above: Important Stuff You Should Read First). If you have not done this, the Microsoft COM runtime library will not know where to find your COM server (essentially, it needs the path of DirectLight.dll).

To access the DirectLight COM object from a program (we'll call it a client), you must first include "directlight.h", which contains the definition of the DirectLight COM interface (among other things) and "directlight_i.c", which contains the definitions of the various UIDs of the objects and interfaces (more on this later).

Before you can use any COM services, you must first initialize the COM runtime. To do this, call the CoInitialize function with a NULL parameter:

```
CoInitialize(NULL);
```

For our purposes, you don't need to concern yourself with the return value.

Next, you must instantiate a DirectLight object. To do this, you need to call the CoCreateInstance function. This will create an instance of a DirectLight object, and will provide a pointer to the DirectLight interface:

```
HRESULT hCOMError =
    CoCreateInstance(   CLSID_CDirectLight,
                        NULL,
                        CLSCTX_ALL ,
                        IID_IDirectLight,
                        (void **)&pDirectLight);
```

CLSID_CDirectLight is the identifier (declared in directlight_i.c) of the DirectLight object, IID_IDirectLight is the identifier of the DirectLight interface, and pDirectLight is a pointer to the implementation of the DirectLight interface on the object we just instantiated. The pDirectLight pointer will be used by the rest of the client to access the DirectLights functionality.

Any error returned by CoCreateInstance will most likely be REGDB_E_CLASSNOTREG, which indicates that the class isn't registered on your machine. If that's the case, ensure that you ran the Register DirectLight program, and try again.

When you're cleaning up your app, you should include the following three lines:

```
    // kill the COM object
    pDirectLight->Release( );
// We ask COM to unload any unused COM Servers.
CoFreeUnusedLibraries( );
    // We're exiting this app so shut down the COM Library.
    CoUninitialize( );
```

You should release the COM interface when you are done using it. Failure to do so will result in the object remaining in memory after the termination of your application.

CoFreeUnusedLibraries( ) will ask COM to remove our DirectLight factory (a server that created the COM object when we called CoCreateInstance( )) from memory, and CoUninitialize( ) will shut down the COM library.

DirectLight Class

The DirectLight class contains the core functionality of the API. It contains functionality for setting ambient light values, global brightness of all the lights (gamma), and adding and removing virtual lights.

Types:

```
enum Projection_Type{
    SCALE_BY_VIRTUAL_DISTANCE_TO_
    CAMERA_ONLY = 0,
    SCALE_BY_DISTANCE_AND_ANGLE = 1,
    SCALE_BY_DISTANCE_VIRTUAL_TO_REAL = 2 };
```

For an explanation of these values, see "Projection Types" in Direct Light Class

```
enum Light_Type{
    C_75 = 0,
    COVE_6 = 1 };
```

For an explanation of these values, see "Light Types" in Direct Light Class, or look at the online help for "DirectLight GUI Setup."

```
enum Curve_Type{
    DIRECTLIGHT_LINEAR = 0,
    DIRECTLIGHT_EXPONENTIAL = 1,
    DIRECTLIGHT_LOGARITHMIC = 2 };
```

These values represent different curves for lighting effects when fading from one color to another.

Public Member Functions:

```
void Set_Ambient_Light(  int R,
                         int G,
                         int B );
```

The Set_Ambient_Light function sets the red, green and blue values of the ambient light to the values passed into the function. These values are in the range 0-MAX_LIGHT_BRIGHTNESS. The Ambient light is designed to represent constant or "Room Lights" in the application. Ambient Light can be sent to any or all real of the real-world lights. Each real world light can include any percentage of the ambient light.

```
void Stir_Lights( void *user_data );
```

Stir_Lights sends light information to the real world lights based on the light buffer created within DirectLights. The DirectLight DLL handles stirring the lights for you. This function is normally not called by the application

```
Virtual_Light * Submit_Virtual_Light(  float xpos,
                                       float ypos,
                                       float zpos,
                                       int red,
                                       int green,
                                       int blue );
```

Submit_Virtual_Light creates a Virtual_Light instance. Its virtual position is specified by the first three values passed in, it's color by the second three. The position should use application space coordinates. The values for the color are in the range 0-MAX_LIGHT_BRIGHTNESS. This function returns a pointer to the light created.

```
void Remove_Virtual_Light( Virtual_Light * bad_light );
```

Given a pointer to a Virtual_Light instance, Remove_Virtual_Light will delete the virtual light.

```
void Set_Gamma( float gamma );
```

The Set_Gamma function sets the gamma value of the Direct Light data structure. This value can be used to control the overall value of all the lights, as every virtual light is multiplied by the gamma value before it is projected onto the real lights.

```
void Set_Cutoff_Range( float cutoff_range );
```

Set_Cutoff_Range sets the cutoff distance from the camera. Beyond this distance virtual lights will have no effect on real-world lights. Set the value high to allow virtual lights to affect real world lights from a long way away. If the value is small virtual lights must be close to the camera to have any effect. The value should be in application space coordinates.

```
void Clear_All_Real_Lights( void );
```

Clear_All_Lights destroys all real lights.

```
void Project_All_Lights( void );
```

Project_All_Lights calculates the effect of every virtual on every real-world light, taking into account gamma, ambient and dynamic contributions, position and projection mode, cutoff angle and cutoff range, and sends the values to every real-world light.

```
void Set Indicator Color(  int which indicator,
                           int red,
                           int green,
                           int blue );
```

Indicators can be assigned to any of the real world lights via the configuration file(my_lights.h). Each indicator must have a unique non-negative integer ID. Set_Indicator_Color changes the color of the indicator designated by which_indicator to the red, green, and blue values specified. If Set_Indicator_Color is called with an indicator id which does not exist, nothing will happen. The user specifies which lights should be indicators, but note that lights that are indicators can still be effected by the ambient and dynamic lights.

```
Indicator Get Indicator( int which indicator );
```

Returns a pointer to the indicator with the specified value.

```
int Get_Real_Light_Count( void );
```

Returns the number of real lights.

```
void Get_My_Lights_Location( char buffer[MAX_PATH] );
```

Looks in the directory and finds the path to the "my_lights.h" file.

```
void Load_Real_Light_Configuration( char * fullpath = NULL );
```

Loads the "my_lights.h" file from the default location determined by the registry. DirectLight will create a list of real lights based on the information in the file.

```
void Submit_Real_Light( char * indentifier,
    int DMX_port,
    Projection_Type projection_type,
    int indicator_number,
    float add_ambient,
    float add_dynamic,
    float gamma,
    float cutoff_angle,
    float x,
    float y,
    float z );
```

Creates a new real light in the real world. Typically DirectLight will load the real light information from the "my_lights.h" file at startup.

```
void Remove_Real_Light( Real_Light * dead_light );
```

Safely deletes an instance of a real light.

```
Light GetAmbientLight ( void );
```

Returns a pointer to the ambient light.

```
bool RealLightListEmpty ( void );
```

Returns true if the list of real lights is empty, false otherwise.

Light Class

Ambient lights are defined as lights. Light class is the parent class for Virtual Lights and Real Lights. Member variables:

```
static const int MAX_LIGHT_BRIGHTNESS. Defined as 255
```

LightingFX_List*m_FX_currently_attached. A list of the effects currently attached to this light.

ColorRGB m_color. Every light must have a color! ColorRGB is defined in ColorRGB.h

```
void Attach_FX( LightingFX * new_FX )
```

Attach a new lighting effect to this virtual light.

```
void Detach_FX( LightingFX * old_FX )
```

Detach an old lighting effect from this virtual light.

Real Lights

Real Light inherits from the Light class. Real lights represent lights in the real world. Member variables:

```
static const int NOT_AN_INDICATOR_LIGHT defined as -1.
```

char m_identifier[100] is the name of the light (like "overhead" or "covelight1"). Unused by DirectLight except as a debugging tool.

int DMX_port is a unique non-negative integer representing the channel the given light will receive information on. DMX information is sent out in a buffer with 3 bytes (red, green and blue) for each light. (DMX_port*3) is actually the index of the red value for the specified light. DirectLight DMX buffers are 512 bytes, so DirectLight can support approximately 170 lights. Large buffers can cause performance problems, so if possible avoid using large DMX_port numbers.

Light_Type m_type describes the different models of Color Kinetics lights. Currently unused except by DirectLight GUI Setup to display icons.

float m_add_ambient the amount of ambient light contribution to this lights color. Range 0-1 float m_add_dynamic the amount of dynamic light contribution to this lights color. Range 0-1 float m_gamma is the overall brightness of this light. Range 0-1.

float m_cutoff_angle determines how sensitive the light is to the contribtions of the virtual lights around it. Large values cause it to receive information from most vitual lights. Smaller values cause it to receive contributions only from virtual lights in the same arc as the real light.

Projection_Type m_projection_type defines how the virtual lights map onto the real lights.

SCALE_BY_VIRTUAL_DISTANCE_TO_CAMERA_ONLY this real light will receive contributions from virtual lights based soley on the distance from the origin of the virtual coordinate system to the position of the virtual light. The virtual light contribution fades linearly as the distance from the origin approaches the cutoff range.

SCALE_BY_DISTANCE_AND_ANGLE this real light will receive contributions from virtual lights based on the distance as computed above AND the difference in angle between the real light and the virtual light. The virtual light contribution fades linearly as the distance from the origin approaches the cutoff range and the angle approaches the cutoff angle.

SCALE_BY_DISTANCE_VIRTUAL_TO_REAL this real light will receive contributions from virtual lights based on the distance in 3-space from real light to virtual light. This mode assumes that the real and virtual coordinate systems are identical. The virtual light contribution fades linearly as the distance from real to virtual approaches the cutoff range.

float m_xpos x,y,z position in virtual space.

float m_ypos float m_zpos int m_indicator_number. if indicator is negative the light is not an indicator. If it is non-negative it will only receive colors sent to that indicator number.

Virtual Lights

Virtual Lights represent light sources within a game or other real time application that are mapped onto real-world Color Kinetics lights. Virtual Lights may be created, moved, destroyed, and have their color changed as often as is feasible within the application.

```
static const int MAX_LIGHT_BRIGHTNESS;
```

MAX_LIGHT_BRIGHTNESS is a constant representing the largest value a light can have. In the case of most Color Kinetics lights this value is 255. Lights are assumed to have a range that starts at 0

```
void Set_Color(   int R,
                  int G,
                  int B );
```

The Set_Color function sets the red, green and blue color values of the virtual light to the values passed into the function.

```
void Set_Position(   float x_pos,
                     float y_pos,
                     float z_pos );
```

The Set_Position function sets the position values of the virtual light to the values passed into the function. The position should use application space coordinates.

```
void Get_Position(   float *x_pos,
                     float *y_pos,
                     float *z_pos );
```

Gets the position of the light.

Lighting FX

Lighting FX are time-based effects which can be attached to real or virtual lights, or indicators, or even the ambient light. Lighting effects can have other effects as children, in which case the children are played sequentially.

```
static const int FX_OFF;        Defined as -1.
static const int START_TIME;    Times to start and stop the effect.
This is a virtual value. The
static const int STOP_TIME;     individual effects will scale their
time of play based on the total.
```

```
void Set_Real_Time( bool Real_Time );
```

If TRUE is passed in, this effect will use real world time and update itself as often as Stir_Lights is called. If FALSE is passed in the effect will use application time, and update every time Apply-FX is called.

```
void Set_Time_Extrapolation ( bool extrapolate );
```

If TRUE is passed in, this effect will extrapolate it's value when Stir_Lights is called.

```
void Attach_FX_To_Light ( Light * the_light );
```

Attach this effect to the light passed in.

```
void Detach_FX_From_Light ( Light * the_light,
    bool remove_FX_from_light = true );
```

Remove this effect's contribution to the light. If remove_FX_from_light is true, the effect is also detached from the light.

The above functions also exist as versions to effect Virtual lights, Indicator lights (referenced either by a pointer to the indicator or it's number), Ambient light, and all Real Lights.

```
void Start ( float FX_play_time,
    bool looping = false );
```

Start the effect. If looping is true the effect will start again after it ends.

```
void Stop ( void );
```

Stop the effect without destroying it.

```
void Time_Is_Up ( void );
```

Either loop or stop playing the effect, since time it up for it.

```
void Update_Time ( float time_passed );
```

Change how much game time has gone by for this effect.

```
void Update_Real_Time ( void );
```

Find out how much real time has passed for this effect.

```
void Update_Extrapolated_Time ( void );
```

Change the FX time based on extrapolating how much application time per real time we have had so far.

```
virtual void Apply_FX (   ColorRGB &base_color );
```

This is the principle lighting function. When Lighting_FX is inherited, this function does all the important work of actually changing the light's color values over time. Note that you can choose to add your value to the existing light value, replace the existing value with your value, or any combination of the two. This way Lighting effects can override the existing lights or simply supplant them.

```
static void Update_All_FX_Time ( float time_passed );
```

Update the time of all the effects.

```
void Apply_FX_To_All_Virtual_Lights ( void );
```

Apply this effect to all virtual, ambient and indicator lights that are appropriate.

```
void Apply_All_FX_To_All_Virtual_Lights ( void );
```

Apply each effect to all virtual, ambient and indicator lights that are appropriate.

```
void Apply_All_FX_To _Real_Light ( Real_Light * the_real_light
);
```

Apply this effect to a single real light.

```
void Start_Next_ChildFX ( void );
```

If this effect has child effect, start the next one.

```
void Add_ChildFX ( LightingFX * the_child,
    float timeshare );
```

Add a new child effect onto the end of the list of child effects that this effect has. Timeshare is this child's share of the total time the effect will play. The timeshares don't have to add up to one, as the total shares are scaled to match the total real play time of the effect

```
void Become_Child_Of ( Lighting_FX * the_parent );
```

Become a parent of the specified effect.

```
void Inherit_Light_List ( Affected_Lights * our_lights );
```

Have this effect and all it's children inherit the list of lights to affect.

Configuration File

The file "my_lights.h" contains information about real-world lights, and is loaded into the DirectLight system at startup. The files "my_lights.h" and "light_definitions.h" must be included in the same directory as the application using DirectLights.

"my_lights.h" is created and edited by the DirectLight GUI Setup program. For more information on how to use the program check the online help within the program.

Here is an example of a "my_lights.h" file:

```
//////////////////////////////////////////////////////////////////////////////
//
// my_lights.h
//
// Configuration file for Color Kinetics lights
//      used by DirectLights
//
// This file created with DirectLights GUI Setup v1.0
//
//////////////////////////////////////////////////////////////////////////////
// Load up the basic structures
#include "Light_Definitions.h"
// overall gamma
```

-continued

```
float OVERALL_GAMMA = 1.0;
// which DMX interface do we use?
int DMX_INTERFACE_NUM = 0;
////////////////////////////////////////////////////////////////////////////////
//
// This is a list of all the real lights in the world
//
Real_Light my_lights[MAX_LIGHTS] =
{
//NAME          PORT  TYPE  PRJ  IND  AMB    DYN    GAMMA  CUTOFF  X       Y       Z
"Overhead",     0,    1,    0,   -1,  1.000, 0.400, 1.000, 3.142,  0.000,  -1.000, 0.000,
"Left",         1,    0,    1,   -1,  0.000, 1.000, 1.000, 1.680,  -1.000,  0.000,  0.000,
"Right",        2,    0,    1,   -1,  0.000, 1.000, 0.800, 1.680,  1.000,   0.000,  0.000,
"Back",         3,    0,    1,   -1,  0.000, 1.000, 1.000, 1.680,  0.000,   0.000,  -1.000,
"LeftCove0",    4,    0,    1,    0,  0.000, 0.000, 1.000, 0.840,  -0.500,  -0.300, 0.500,
"LeftCove1",    5,    0,    1,    1,  0.000, 0.000, 1.000, 0.840,  -0.500,  0.100,  0.500,
"LeftCove2",    6,    0,    1,   -1,  0.000, 0.000, 1.000, 0.840,  -0.500,  0.500,  0.500,
"CenterCove0",  7,    0,    1,   -1,  0.000, 0.000, 1.000, 0.840,  -0.400,  0.700,  0.500,
"CenterCove1",  8,    0,    1,   -1,  0.000, 0.000, 1.000, 0.840,  -0.200,  0.700,  0.500,
"CenterCove2",  9,    0,    1,   -1,  0.000, 0.000, 1.000, 0.840,  0.200,   0.700,  0.500,
"CenterCove3",  10,   0,    1,   -1,  0.000, 0.000, 1.000, 0.840,  0.400,   0.700,  0.500,
"RightCove0",   11,   0,    1,    2,  0.000, 0.000, 1.000, 0.840,  0.500,   0.500,  0.500,
"RightCove1",   12,   0,    1,   -1,  0.000, 0.000, 1.000, 0.840,  0.500,   0.100,  0.500,
"RightCove2",   13,   0,    1,   -1,  0.000, 0.000, 1.000, 0.840,  0.500,   -0.300, 0.500,
};
```

This example file is taken from our offices, where we had lights setup around a computer, with the following lights (referenced from someone sitting at the monitor): One overhead (mostly ambient); one on each side of our head (Left and Right); one behind our head; Three each along the top, left and right side of the monitor in front of us.

Each line in the "my_lights" file represents one Real_Light. Each Real_Light instance represents, surprise surprise, one real-world light.

The lower lights on the left and right side of the monitor are indicators 0 and 2, the middle light on the left side of the monitor is indicator 1.

The positional values are in meters. Z is into/out of the plane of the monitor. X is vertical in the plane of the monitor, Y is horizontal in the plane of the monitor.

MAX_LIGHTS can be as high as 170 for each DMX universe. Each DMX universe is usually a single physical connection to the computer (COM1, for example). The larger MAX_LIGHTS is, the slower the lights will respond, as MAX_LIGHTS determines the size of the buffer sent to DMX (MAX_LIGHTS*3) Obviously, larger buffers will take longer to send.

OVERALL_GAMMA can have a value of 0-1. This value is read into DirectLights and can be changed during runtime. This represents the end of the DirectLight API.

While the invention has been disclosed in connection with the embodiments shown and described above, various equivalents, modifications and improvements will be apparent to one of ordinary skill in the art and are encompassed herein.

The invention claimed is:

1. A tile lighting system, comprising:

a plurality of addressable lighting units configured in a flexible string and arranged in a grid;

a controller for controlling illumination generated by the addressable lighting units; and at least one substantially translucent cover disposed over the grid for receiving and diffusing the illumination from the addressable lighting units.

2. The tile lighting system of claim 1, wherein the at least one substantially translucent cover comprises a phosphorescent material.

3. The tile lighting system of claim 1, wherein the illumination generated by the addressable lighting units, when controlled by the controller, includes a plurality of lighting effects.

4. A tile lighting arrangement, comprising two or more systems of claim 3, wherein the plurality of lighting effects includes at least one lighting effect that is coordinated between the two or more systems.

5. The tile lighting system of claim 1, wherein the at least one substantially translucent cover has a geometric shape.

6. The tile lighting system of claim 1, wherein the at least one substantially translucent cover has an irregular shape.

7. A tile lighting arrangement, comprising at least two systems of claim 1 comprising complementary-shaped substantially translucent covers and disposed in close proximity to each other.

8. The tile lighting system of claim 1, wherein the lighting units are controlled using a string light protocol.

9. A tile lighting system, comprising:

a plurality of addressable LED lighting units disposed on a circuit board in an array, wherein the addressable LED lighting units respond to control signals provided using a serial addressing protocol to produce mixed light of varying colors, wherein at least one of the addressable lighting units receives data intended for at least two lighting units of the plurality of addressable lighting units and selectively responds to data addressed to it; and a diffuser for receiving light from the plurality of addressable lighting units.

10. The tile lighting system of claim 9, wherein the diffuser includes a phosphorescent material.

11. The tile lighting system of claim 9, wherein the diffuser is substantially translucent.

12. The tile lighting system of claim 9, wherein the diffuser has a geometric shape.

13. The tile lighting system of claim 9, wherein the diffuser has an irregular shape.

14. The tile lighting system of claim 9, wherein the mixed light of varying colors produced by the addressable LED lighting units in response to the control signals comprises a plurality of lighting effects, the system further comprising an authoring system for creating a graphical representation of at least one lighting effect of the plurality of lighting effects and converting the graphical representation of the at least one lighting effect into the control signals for the addressable LED lighting units.

15. The tile lighting system of claim 14, wherein the at least one lighting effect produced by the addressable LED lighting units corresponds to a video signal received at the authoring system.

16. The tile lighting system of claim 14, wherein the authoring system is an object-oriented authoring facility.

17. A tile light, comprising:

a plurality of LED lighting units disposed only about a perimeter of a substantially rectangular housing; and a substantially translucent diffuser disposed over the housing for receiving and diffusing light from the lighting units.

18. The tile light of claim 17, wherein the diffuser includes a phosphorescent material.

19. A tile light comprising:

a plurality of LED lighting units disposed about a perimeter of a substantially rectangular housing;

a diffuser for diffusing light from the lighting units; and a reflector interior to the housing for providing a consistent level of light output to different portions of the diffuser.

20. The tile light of claim 17, wherein the housing is divided into a plurality of cells.

21. The tile light of claim 20, wherein the cells are substantially rectangular.

22. A tile light comprising:

a plurality of LED lighting units disposed about a perimeter of a substantially rectangular housing;

a diffuser for diffusing light from the lighting units; and wherein the housing is divided into a plurality of cells, and wherein the cells are triangular.

23. The tile light of claim 17, wherein the tile light is disposed in an architectural environment.

24. The tile light of claim 17, wherein the tile light is disposed on a building exterior.

25. A lighting system, comprising:

a series of LED-based addressable lighting units for producing mixed light of varying colors, wherein each lighting unit is configured to respond to data addressed to it in a serial addressing protocol, wherein the series of lighting units is configured in a flexible string; and a fastening facility for holding the flexible string in a predetermined configuration.

26. The lighting system of claim 25, wherein the fastening facility comprises at least one substantially linear channel for holding at least a portion of the flexible string.

27. A lighting system comprising:

a series of LED-based lighting units configured in a flexible string, wherein each lighting unit is configured to respond to data addressed to it in a serial addressing protocol; and a fastening facility for holding the flexible string in a predetermined configuration, wherein the fastening facility holds the flexible string in an array.

28. The lighting system of claim 25, wherein the mixed light of varying colors produced by the addressable LED lighting units comprises a plurality of lighting effects, the system further comprising an authoring system for creating graphical representations of the lighting effects and converting the graphical representations of the lighting effects into the data addressed to the addressable LED lighting units.

29. The lighting system of claim 28, wherein the authoring system is an object-oriented authoring facility.

30. The lighting system of claim 28, wherein a lighting effect produced by the addressable LED lighting units corresponds to a video signal received at the authoring system.

31. The lighting system of claim 27, wherein the array is disposed in an architectural environment.

32. The lighting system of claim 27, wherein the array is disposed on a building exterior.

33. The lighting system of claim 25, wherein the fastening facility comprises a push-though assembly mechanism.

34. A modular component for a lighting system, comprising:

a plurality of addressable LED-based lighting units disposed in an array on a circuit board, wherein each addressable lighting unit of the plurality of addressable lighting units is configured to respond to data addressed to it in a serial addressing protocol, by receiving data intended for at least two lighting units of the plurality of addressable lighting units and selectively responding to data addressed to it.

35. The component of claim 34, wherein the circuit board is flexible.

36. The component of claim 34, wherein the circuit board is a printed circuit board.

37. A lighting system, comprising:

a plurality of modular components, wherein each modular component includes a plurality of addressable LED-based lighting units disposed in an array on a circuit board, wherein each addressable lighting unit is configured to respond to data addressed to it in a serial addressing protocol, by receiving data intended for at least two lighting units of the plurality of addressable lighting units and selectively responding to data addressed to it.

38. The system of claim 37, comprising at least two modular components of the plurality of modular components disposed adjacent to each other.

39. The system of claim 37, wherein the addressable LED-based lighting units are configured to produce mixed light of varying colors comprising a plurality of lighting effects, the system further comprising an authoring system for creating a graphical representation of at least one lighting effect of the plurality of lighting effects and converting the graphical representation of the at least one lighting effect into the data addressed to the addressable LED lighting units.

40. The system of claim 39, wherein the addressable LED lighting units of at least two modular components of the plurality of modular components are configured to generate at least one lighting effect of the plurality of lighting effects that is coordinated between the at least two modular components.

41. The system of claim 39, wherein the authoring system is an object-oriented authoring facility.

42. The system of claim 39, wherein the at least one lighting effect produced by the addressable LED lighting units corresponds to a video signal received at the authoring system.

43. The system of claim 39, wherein the array is disposed in an architectural environment.

44. The system of claim 39, wherein the array is disposed on a building exterior.

45. A method of providing illumination, comprising:

arranging a flexible string of addressable LED lighting units in a grid;

controlling illumination generated by the addressable lighting units; and covering the grid with a light diffusing cover.

46. The method of claim 45, wherein the light diffusing cover comprises a phosphorescent material.

47. The method of claim 45, wherein the light diffusing cover is substantially translucent.

48. The method of claim 45, wherein the light diffusing cover has a geometric shape.

49. The method of claim 45, wherein the light diffusing cover has an irregular shape.

50. The method of claim 45, wherein the lighting units are controlled using a string light protocol.

51. The method of claim 45, wherein the addressable LED-based lighting units are configured to produce mixed light of varying colors comprising a plurality of lighting effects, the method further comprising:

creating a graphical representation of at least one lighting effect; and converting the graphical representation of the at least one lighting effect into control signals for controlling the addressable LED lighting units.

52. A method of providing a tile lighting system, comprising:

providing a plurality of addressable LED lighting units disposed on a circuit board in an array, wherein the addressable LED lighting units respond to control signals provided using a serial addressing protocol to produce mixed light of varying colors, wherein at least one of the addressable lighting units receives data intended for at least two lighting units of the plurality of addressable lighting units and selectively responds to data addressed to it; and providing a diffuser for receiving light from the plurality of addressable lighting units.

53. The method of claim 52, wherein the diffuser comprises a phosphorescent material.

54. The method of claim 52, wherein the diffuser is substantially translucent.

55. The method of claim 52, wherein the diffuser has a geometric shape.

56. The method of claim 52, wherein the diffuser has an irregular shape.

57. The method of claim 52, wherein the addressable LED-based lighting units are configured to produce mixed light of varying colors comprising a plurality of lighting effects, the method further comprising:

creating a graphical representation of at least one lighting effect; and converting the graphical representation of the at least one lighting effect into the control signals for controlling the addressable LED lighting units.

58. The method of claim 57, wherein the at least one lighting effect produced by the addressable LED lighting units corresponds to a video signal.

59. A method of providing a tile light, comprising:

providing a plurality of LED lighting units disposed only about a perimeter of a substantially rectangular housing; and providing a substantially translucent diffuser for diffusing light from the lighting units.

60. The method of claim 59, wherein the diffuser comprises a phosphorescent material.

61. The method of claim 59, wherein the diffuser has a geometric shape.

62. The method of claim 59, wherein the diffuser has an irregular shape.

63. A method of providing a tile light, comprising:

providing a plurality of LED lighting units disposed about a perimeter of a substantially rectangular housing;

providing a diffuser for diffusing light from the lighting units; and providing a reflector interior to the housing for providing a consistent level of light output to different portions of the diffuser.

64. The method of claim 59, wherein the housing is divided into a plurality of cells.

65. The method of claim 64, wherein the cells are rectangular.

66. A method of providing a tile light comprising:

providing a plurality of LED lighting units disposed about a perimeter of a substantially rectangular housing;

providing a diffuser for diffusing light from the lighting units; and wherein the housing is divided into a plurality of cells, and wherein the cells are triangular.

67. A method of providing lighting, comprising:

arranging a series of LED-based lighting units in a flexible string, wherein each lighting unit is configured to respond to data addressed to it in a serial addressing protocol; and fastening the flexible string in a predetermined configuration.

68. The method of claim 67, wherein the flexible string is held in a channel shaped in the predetermined configuration.

69. A method of providing lighting, comprising:

providing a series of LED-based lighting units, wherein each lighting unit is configured to respond to data addressed to it in a serial addressing protocol, wherein the series of lighting units is configured in a flexible string;

providing a fastening facility for holding the flexible string in a predetermined configuration; and wherein the fastening facility holds the flexible string in an array.

70. A method of providing a modular component for a lighting system, comprising:

disposing a plurality of addressable LED-based lighting units in an array on a circuit board, wherein each addressable lighting unit of the plurality of addressable lighting units is configured to respond to data addressed to it in a serial addressing protocol, by receiving data intended for at least two lighting units of the plurality of addressable lighting units and selectively responding to data addressed to it.

71. The method of claim 70, wherein the circuit board is flexible.

72. The method of claim 70, wherein the circuit board is a printed circuit board.

73. A method of providing a lighting system, comprising:

providing a plurality of modular components, wherein each modular component includes a plurality of addressable LED-based lighting units disposed in an array on a circuit board, wherein each addressable lighting unit is configured to respond to data addressed to it in a serial addressing protocol, by receiving data intended for at least two lighting units of the plurality of addressable lighting units and selectively responding to data addressed to it.

74. The method of claim 73, wherein the modular components are disposed adjacent to each other to form a large array of modular components.

75. The method of claim 73, further comprising an authoring system for authoring effects for the lighting system.

76. The method of claim 73, wherein the array is disposed on a building exterior.

77. The method of claim 75, wherein the authoring system is an object-oriented authoring facility.

78. The method of claim 75, wherein an effect displayed on the large array corresponds to a graphical representation of the authoring facility.

79. The method of claim 75, wherein an effect displayed on the array corresponds to an incoming video signal.

80. The method of claim 75, wherein the array is disposed in an architectural environment.

81. A method for providing illumination, comprising:

arranging a first flexible string of addressable lighting units in a first grid;

covering the first grid with a first light diffusing cover;

arranging a second flexible string of addressable lighting units in a second grid;

covering the second grid with a second light diffusing cover, wherein the first and second light diffusing covers are complementary shaped;

disposing the first grid in close proximity to the second grid such that the first light diffusing cover is adjacent to the second light diffusing cover; and controlling the illumination from the first and second strings of addressable lighting units.

* * * * *

UNITED STATES PATENT AND TRADEMARK OFFICE

CERTIFICATE OF CORRECTION

PATENT NO. : 7,358,929 B2
APPLICATION NO. : 10/828933
DATED : April 15, 2008
INVENTOR(S) : George G. Mueller et al.

It is certified that error appears in the above-identified patent and that said Letters Patent is hereby corrected as shown below:

Col. 52, line 56, "transforner" should read -- transformer --

Col. 55, line 38, "in the Is mounting" should read -- in the mounting --

In the Claims:

Col. 78, line 15, claim 33, "push-though" should read -- push-through --

Signed and Sealed this

Eighth Day of July, 2008

JON W. DUDAS
*Director of the United States Patent and Trademark Office*